US007665654B2

(12) United States Patent
McLeod

(10) Patent No.: US 7,665,654 B2
(45) Date of Patent: Feb. 23, 2010

(54) SHIPPING CONTAINERS WITH STACKING SUPPORT STRUCTURES

(75) Inventor: Michael B. McLeod, Romeoville, IL (US)

(73) Assignee: Smurfit-Stone Container Enterprises, Inc., Chicago, IL (US)

( * ) Notice: Subject to any disclaimer, the term of this patent is extended or adjusted under 35 U.S.C. 154(b) by 655 days.

(21) Appl. No.: 11/148,729

(22) Filed: Jun. 9, 2005

(65) Prior Publication Data

US 2006/0231603 A1 Oct. 19, 2006

Related U.S. Application Data

(63) Continuation-in-part of application No. 10/831,987, filed on Apr. 26, 2004, now Pat. No. 7,484,655.

(51) Int. Cl.
*B65D 5/28* (2006.01)

(52) U.S. Cl. ..... 229/143; 229/147; 229/170; 229/174; 229/918

(58) Field of Classification Search ..... None
See application file for complete search history.

(56) References Cited

U.S. PATENT DOCUMENTS 2,568,204 A * 9/1951 Recser ..... 229/161
2,603,404 A * 7/1952 Eldredge ..... 229/103.2
RE25,050 E * 10/1961 Hamilton ..... 206/510
3,019,959 A * 2/1962 Skowronski ..... 229/224
4,056,223 A * 11/1977 Williams ..... 229/160
4,214,695 A * 7/1980 Cooper ..... 229/143
4,676,428 A * 6/1987 McClure ..... 229/100
4,860,948 A * 8/1989 Hofstede ..... 229/143
4,883,221 A * 11/1989 Brundage ..... 229/143
5,052,221 A * 10/1991 Glockner et al. ..... 73/159
5,979,746 A * 11/1999 McLeod et al. ..... 229/120.09
6,481,619 B1 * 11/2002 Jackson ..... 229/169
6,935,504 B2 * 8/2005 Ritter et al. ..... 206/511
7,314,159 B2 * 1/2008 Rochefort et al. ..... 229/147

* cited by examiner

*Primary Examiner*—Gary E Elkins
(74) *Attorney, Agent, or Firm*—Armstrong Teasdale LLP

(57) ABSTRACT

Shipping containers having stacking support structures are provided. The shipping containers or cartons, are provided with three-panel inner support structures, in which the three panels form either triangular- (delta-) shaped cross-sections or L shaped cross-sections. In addition, the shipping containers or cartons, are provided with first outer support panels, and one or two second outer support panels. The shipping containers or cartons may be provided with no lid, one lid panel with closure panels for affixation to the end panels, or two lid panels, each with closure panels for affixation to the end panels.

37 Claims, 128 Drawing Sheets

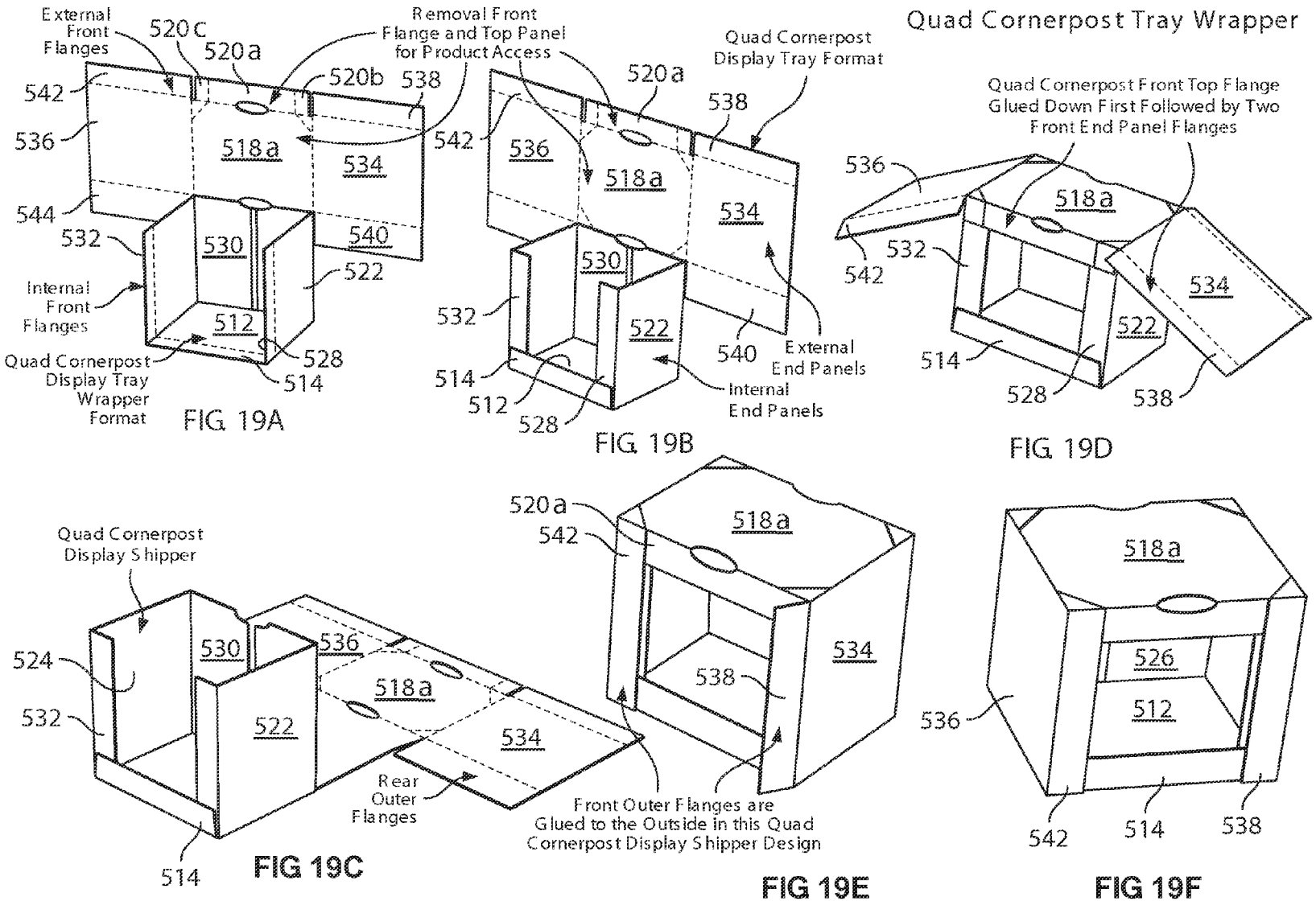
Quad Cornerpost Tray Wrapper
Quad Cornerpost Front Top Flange Glued Down First Followed by Two Front End Panel Flanges
Quad Cornerpost Display Tray Format
External End Panels
Internal End Panels
Removal Front Flange and Top Panel for Product Access
External Front Flanges
Internal Front Flanges
Quad Cornerpost Display Tray Wrapper Format
Front Outer Flanges are Glued to the Outside in this Quad Cornerpost Display Shipper Design
Rear Outer Flanges
Quad Cornerpost Display Shipper
FIG 19A
FIG 19B
FIG 19C
FIG 19D
FIG 19E
FIG 19F

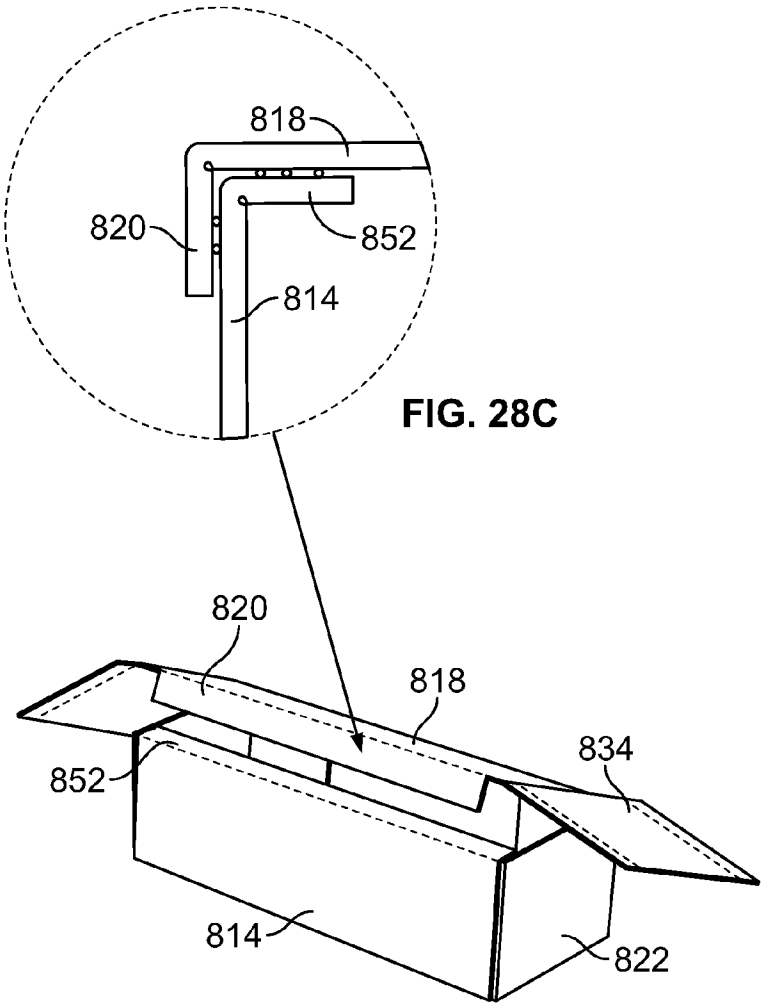
FIG. 28C
FIG. 28B
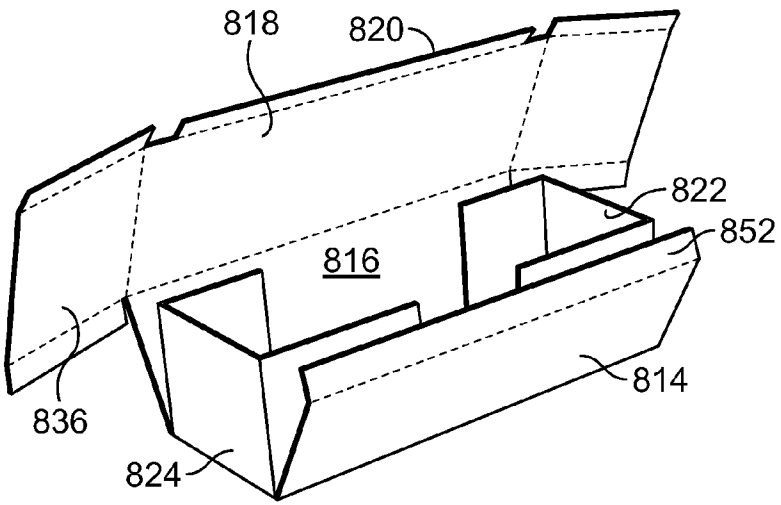
FIG. 28A

SHIPPING CONTAINERS WITH STACKING SUPPORT STRUCTURES

CROSS REFERENCE TO RELATED APPLICATIONS

This application is a continuation-in-part of, and claims the benefit of the filing date of U.S. patent application Ser. No. 10/831,987, filed Apr. 26, 2004 now U.S. Pat. No. 7,484,655. The contents of which is hereby incorporated by reference in its entirety.

BACKGROUND OF THE INVENTION

The present invention relates to shipping containers, in particular shipping containers that are fabricated at least in part from paper, paperboard and/or corrugated paperboard material.

Shipping container designs are known which are tray/wrap structures, having an inside minor flap which is divided, and shared with an outside full depth flap, to provide four additional corners in the same amount of material as other shipping containers.

However, issues arise when the depth of the shipping container is greater than its width, as it may cause the internal and external flaps to interfere with each other when machine erected unless material is removed from those flaps.

In extreme instances, the size of the slot of removed material can be severe, creating potential weakness in the flat blank in unit load building and handling prior to erecting, not to mention the removal of material which could benefit the customer by further contributing stacking support.

In addition, as paperboard structures derive their supportive stacking strength from vertical support structures, increasing the number of corners can help to increase the overall stacking strength without increasing the material consumption.

BRIEF DESCRIPTION OF THE INVENTION

The present invention comprises, in part, a carton, fabricated from a blank formed from at least one of paper, paperboard and corrugated paperboard, comprising a bottom panel; two side panels emanating from opposing side edges of the bottom panel; and two end panels emanating from opposing end edges of the bottom panel, the opposing end edges of the bottom panel extending substantially perpendicular to the opposing side edges of the bottom panel. At least one connection panel emanates from a top edge region of at least one of the two side panels, with a foldable line of weakness disposed between each side panel and its respective at least one connection panel. At least one outer support panel emanates from an end edge of at least one connection panel, with a foldable line of weakness disposed between each connection panel and its corresponding at least one outer support panel, the outer support panel being affixed to an outer surface of an adjacent one of the end panels. At least one first inner support panel emanates from an end edge of at least one of the two end panels, with a line of foldable weakness disposed between the first inner support panel, and its respective end panel. At least one second inner support panel emanates from an edge of the at least one first inner support panel, with a line of foldable weakness disposed between each second inner support panel and its corresponding first inner support panel. At least one third inner support panel emanates from an edge of the at least one second inner support panel, with a line of foldable weakness disposed between each third inner support panel and its corresponding second inner support panel. The at least one third inner support panel is affixed to an inner surface of its respective associated end panel, to form, with the first and second inner support panels, at least one vertically extending stacking support structure, upon articulation of the blank into the carton.

In a preferred embodiment of the invention, the at least one vertically extending stacking support structure is L-shaped in cross-section. In this alternative preferred embodiment of the invention, the at least one second inner support panel has a width that is less than a width of the respective at least one first inner support panel. In an alternative embodiment, the at least one vertically extending stacking support structure is triangular in cross-section. In this embodiment, the at least one second inner support panels has a width that is greater than a width of its respective first inner support panel.

The carton may further comprise at least one second outer support panel, emanating from each at least one first outer support panel, along a foldable line of weakness disposed therebetween, the at least one second outer support panel being affixed to an outside surface of the respective side panel with which the at least one second outer support panel is associated.

The carton may further comprise at least one lid panel, emanating from a top edge of one of the side panels. The at least one lid panel may comprises two lid panels, emanating from top edges of the two side panels. The carton may further comprise at least one closure flap, emanating from an end edge of the at least one lid panel, and affixable to an outside surface of an adjacent end panel. The at least one closure flap may comprise two closure flaps, emanating from opposing end edges of the at least one lid panel, and affixable to outside surfaces of adjacent end panels.

The carton may further comprise at least one closure flap, emanating from an end edge of each of the two lid panels, and affixable to an outside surface of an adjacent end panel. The at least one closure flap may comprise two closure flaps, emanating from opposing end edges of each of the lid panels, and affixable to outside surfaces of adjacent end panels.

The carton may further comprise at least one closure flap, emanating from an end edge of each of the two lid panels, and affixable to an outside surface of an adjacent end panel. The at least one closure flap may comprise two closure flaps, emanating from opposing end edges of each of the lid panels, and affixable to outside surfaces of adjacent end panels.

The at least one outer support panel may have a width which is substantially the same as the end panel adjacent to which it is positioned, in which case the carton may further comprise two second outer support panels, emanating from opposing end edges of the at least one outer support panel, and affixed to outer surfaces of each of the side panels.

The present invention also comprises in part, a blank for a carton, formed from at least one of paper, paperboard and corrugated paperboard. The blank may comprise a bottom panel; two side panels emanating from opposing side edges of the bottom panel; and two end panels emanating from opposing end edges of the bottom panel, the opposing end edges of the bottom panel extending substantially perpendicular to the opposing side edges of the bottom panel. At least one connection panel emanates from a top edge region of at least one of the two side panels, with a foldable line of weakness disposed between each side panel and its respective at least one connection panel. At least one outer support panel emanates from an end edge of at least one connection panel, with a foldable line of weakness disposed between each connection panel and its corresponding at least one outer support panel. At least one first inner support panel emanates from an end edge of at least one of the two end panels, with a line of foldable weakness disposed between the first inner support panel, and its respective end panel. At least one second inner support panel emanates from an edge of the at least one first inner support panel, with a line of foldable weakness disposed between each second inner support panel and its corresponding first inner support panel. At least one third inner support panel emanates from an edge of the at least one second inner support panel, with a line of foldable weakness disposed between each third inner support panel and its corresponding second inner support panel.

In a preferred embodiment of the invention, the at least one second inner support panel has a width that is less than a width of the respective at least one first inner support panel. In an alternative embodiment, the at least one second inner support panel has a width that is greater than a width of its respective first inner support panel.

The blank may further comprise at least one second outer support panel, emanating from each at least one first outer support panel, along a foldable line of weakness disposed therebetween.

The blank may further comprise at least one lid panel, emanating from a top edge of one of the side panels. The at least one lid panel may comprise two lid panels, emanating from top edges of the two side panels.

The blank may further comprise at least one closure flap, emanating from an end edge of the at least one lid panel. The at least one closure flap may comprise two closure flaps, emanating from opposing end edges of the at least one lid panel.

The blank may further comprise at least one closure flap, emanating from an end edge of each of the two lid panels. The at least one closure flap may comprise two closure flaps, emanating from opposing end edges of each of the lid panels.

In an embodiment in which the at least one outer support panel has a width which is substantially the same as the end panel adjacent to which it is positioned, the blank may further comprise two second outer support panels, emanating from opposing end edges of the at least one outer support panel.

The present invention also comprises in part, a method for forming a carton, fabricated from a blank formed from at least one of paper, paperboard and corrugated paperboard, the method comprising the steps of:

providing a bottom panel;

providing two side panels emanating from opposing side edges of the bottom panel;

providing two end panels emanating from opposing end edges of the bottom panel, the opposing end edges of the bottom panel extending substantially perpendicular to the opposing side edges of the bottom panel;

providing at least one connection panel, emanating from a top edge region of at least one of the two side panels, with a foldable line of weakness disposed between each side panel and its respective at least one connection panel;

providing at least one outer support panel, emanating from an end edge of at least one connection panel, with a foldable line of weakness disposed between each connection panel and its corresponding at least one outer support panel;

at least one first inner support panel, emanating from an end edge of at least one of the two end panels, with a line of foldable weakness disposed between the first inner support panel, and its respective end panel;

providing at least one second inner support panel, emanating from an edge of the at least one first inner support panel, with a line of foldable weakness disposed between each second inner support panel and its corresponding first inner support panel; and providing at least one third inner support panel, emanating from an edge of the at least one second inner support panel, with a line of foldable weakness disposed between each third inner support panel and its corresponding second inner support panel.

The method may comprise the steps of:

folding the at least one first inner support panel inwardly to a position substantially perpendicular to its corresponding end panel;

folding the at least one second inner support panel inwardly to a position substantially parallel to and overlying an inwardly facing surface of the at least one first inner support panel;

folding the at least one third inner support panel outwardly to a position substantially perpendicular to the at least one second inner support panel, and substantially parallel to an inside surface of an end panel from which the first, second, and third inner support panels emanate, so that the first, second and third inner support panels form an L-shaped cross-section;

affixing the at least one inner support panel to the inside surface of the end panel;

folding the two end panels to positions substantially perpendicular to the bottom panel;

folding the two side panels up to positions substantially perpendicular to the bottom panel;

affixing at least one of the side panels to an outside surface of the at least one inner support panel;

folding the at least one connection panel inwardly to a position substantially parallel to the bottom panel;

folding the at least one outer support panel downwardly to a position substantially parallel to and overlying at least a portion of an adjacent end panel.

The method may comprise the steps of:

folding the at least one first inner support panel inwardly to a position substantially perpendicular to its corresponding end panel;

folding the at least one second inner support panel inwardly to a position oblique to the at least one first inner support panel;

folding the at least one third inner support panel outwardly to a position oblique to the at least one second inner support panel, and substantially parallel to an inside surface of an end panel from which the first, second, and third inner support panels emanate, so that the first and second inner support panels and the adjacent end panel form a triangular cross-section;

affixing the at least one inner support panel to the inside surface of the end panel;

folding the two end panels to positions substantially perpendicular to the bottom panel;

folding the two side panels up to positions substantially perpendicular to the bottom panel;

affixing at least one of the side panels to an outside surface of the at least one inner support panel;

folding the at least one connection panel inwardly to a position substantially parallel to the bottom panel;

folding the at least one outer support panel downwardly to a position substantially parallel to and overlying at least a portion of an adjacent end panel.

The method may comprise the step of:

affixing the at least one outer support panel to the adjacent end panel.

The method may comprise the step of:

affixing the at least one outer support panel to the adjacent end panel.

The method may comprise the steps of:

providing at least one second outer support panel, emanating from an edge of the at least one outer support panel; and folding the at least one second outer support panel to a position substantially perpendicular to the at least one outer support panel; affixing the at least one second outer support panel to an outer surface of a side panel.

The method may comprise the step of:

providing at least one top panel, emanating from a top edge of a side panel.

The method may comprise the step of:

providing two top panels, emanating from top edges of the side panels.

The method may comprise the steps of:

providing at least one closure panel, emanating from an end edge of the at least one lid panel.

The method may comprise the steps of:

filling the carton with articles;

folding the at least one lid panel to a position substantially parallel to the bottom panel;

folding the at least one closure panel to a position substantially perpendicular to the at least one lid panel; and affixing the at least one lid panel to an outer surface of an end panel.

The method may comprise the steps of:

providing at least one closure panel, emanating from end edges of each of the lid panels.

The method may comprise the steps of:

filling the carton with articles;

folding the lid panels to positions substantially parallel to the bottom panel;

folding the closure panels to positions substantially perpendicular to the at least one lid panel; and affixing the lid panels to outer surfaces of at least one end panel.

The method may comprise the step of:

providing the at least one second inner support panel with a width less than a width of the at least one first inner support panel.

The method may comprise the step of:

providing the at least one second inner support panel with a width less than a width of the at least one first inner support panel.

The method may comprise the step of:

providing the at least one second inner support panel with a width greater than a width of the at least one first inner support panel.

BRIEF DESCRIPTION OF THE DRAWINGS

FIG. 19A is a perspective view of the container of FIG. 17A shown partially articulated.

FIG. 19B is a perspective view of the container of FIG. 19A, shown further along in the articulation process.

FIG. 19C is a perspective view of the container of FIG. 17A, shown partially articulated, via a different sequence of articulation steps.

FIG. 19D is a perspective view of the container of FIG. 19C, shown further along the articulation process.

FIG. 19E is a perspective view of the container of FIG. 19D, shown further along the articulation process.

FIG. 19F is a perspective view of the container of FIG. 19E, shown fully articulated.

FIG. 28A is a perspective view of a container according to the blank of FIG. 27.

FIG. 28B is a perspective view of the container of FIG. 27, further along the articulation process.

FIG. 28C is an enlarged cross-sectional view of a portion of the container of FIG. 27, showing the reinforced transverse closure seal that is formed upon full articulation of the container blank.

DETAILED DESCRIPTION OF THE INVENTION

Figure 1:
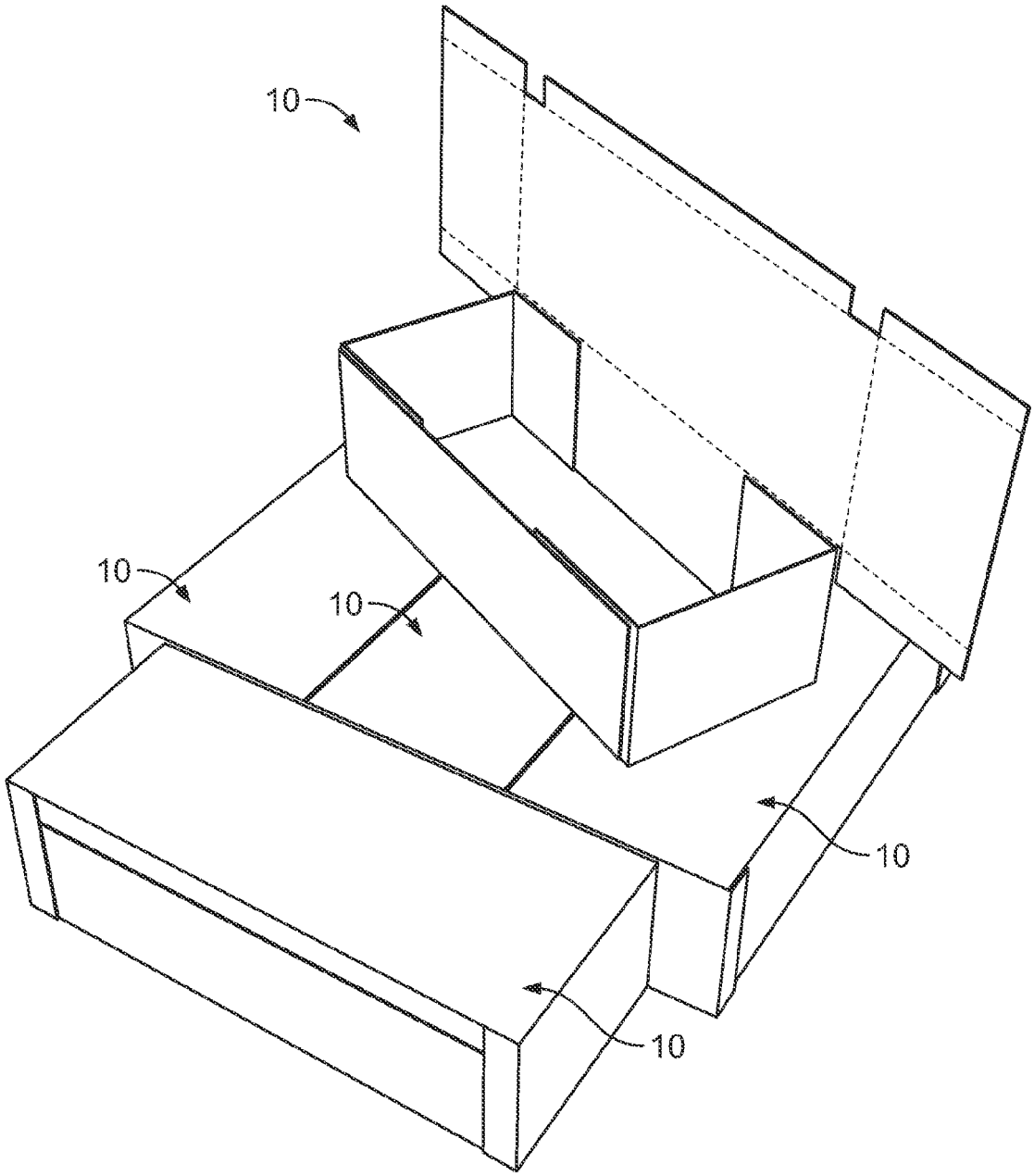
FIG. 1 is a perspective view of a quadcorner tray wrapper container according to one embodiment, shown in an open configuration, atop other containers of the same configuration.

While this invention is susceptible of embodiment in many different forms, there are shown in the drawings and will be described in detail, several specific embodiments, with the understanding that the present disclosure is to be considered as an exemplification of the principles of the invention and is not intended to limit the invention to the embodiments illustrated.

When referring to the plan illustrations of the blanks, the usual drawing conventions are applied. That is, unless otherwise noted, broken lines indicate fold lines; scalloped lines indicate lines of weakness forming a tear strip or similar structure; and interior solid lines indicate through-cuts.

In preferred embodiments, the blanks are fabricated from corrugated paperboard material, although other materials having similar suitable performance characteristics may be employed if desired.

The basic premise underlying the quadcorner tray wrapper designs of FIGS. 1-28, is that of providing a wrapper type blank construction, in which the blank comprises four panels, consecutively arranged on the blank: top panel; rear (side) panel; bottom panel; and front (side) panel, contiguously connected along interpanel fold lines. Major flaps (end panels) emanate from the end edges of the top and bottom panels, each of which major flaps (end panels) are sized to cover the ends of the articulated carton. Minor flaps emanate from the leading and trailing edges of the major flaps. A closure tab emanates from a free edge of either the top or the front (i.e., the leading or trailing edges of the blank).

Upon articulation, the minor flaps emanating from the major (end) flaps of the bottom panel are folded to the inside of the front and rear panels, and form vertical supports for the container. The described minor flaps may or may not be adhered to the stated front and rear panels. If adhered, improved stacking strength can result. The interior folded (and adhered) minor flaps form vertical supports for the container. The front and rear (side) panels are then folded up perpendicular to the bottom panel. Within this phase of container articulation, adhesive can be dispensed to adhere the minor flaps juxtaposed to the front and rear panels. The top panel is then folded down parallel to the bottom panel and the extension from the top panel (closure tab or glue lap) is further folded down and adhered over the front panel and parallel to the front and rear panels. The major flaps (external end panels) emanating from the top panel are folded down over the major flaps (internal end panels) of the bottom panel and once juxtaposed are adhered to each other. The minor reinforcing flaps of the major flaps (external end panels) emanating from the top panel are folded and adhered to the outside of the front and rear panels. This creates a laminated and adhered triple thickness of container material along the end edge regions of the front and rear panels, as well as a laminated and adhered double thickness of material on the ends of the carton.

In a first variation of the general design (FIGS. 1-9), the width of the carton is considerably greater than the depth or height. The minor flaps are all each substantially less than one-half the width of the carton, so that there is a substantial gap between facing free edges of the minor flaps on the interior and exterior faces of the front and rear walls, thus creating "corner post" reinforcement structures, rather than complete end or side walls. The closure tab emanates from the free edge of the top panel, and is folded to be juxtaposed and adhesively affixed to the front panel.

Figure 2:
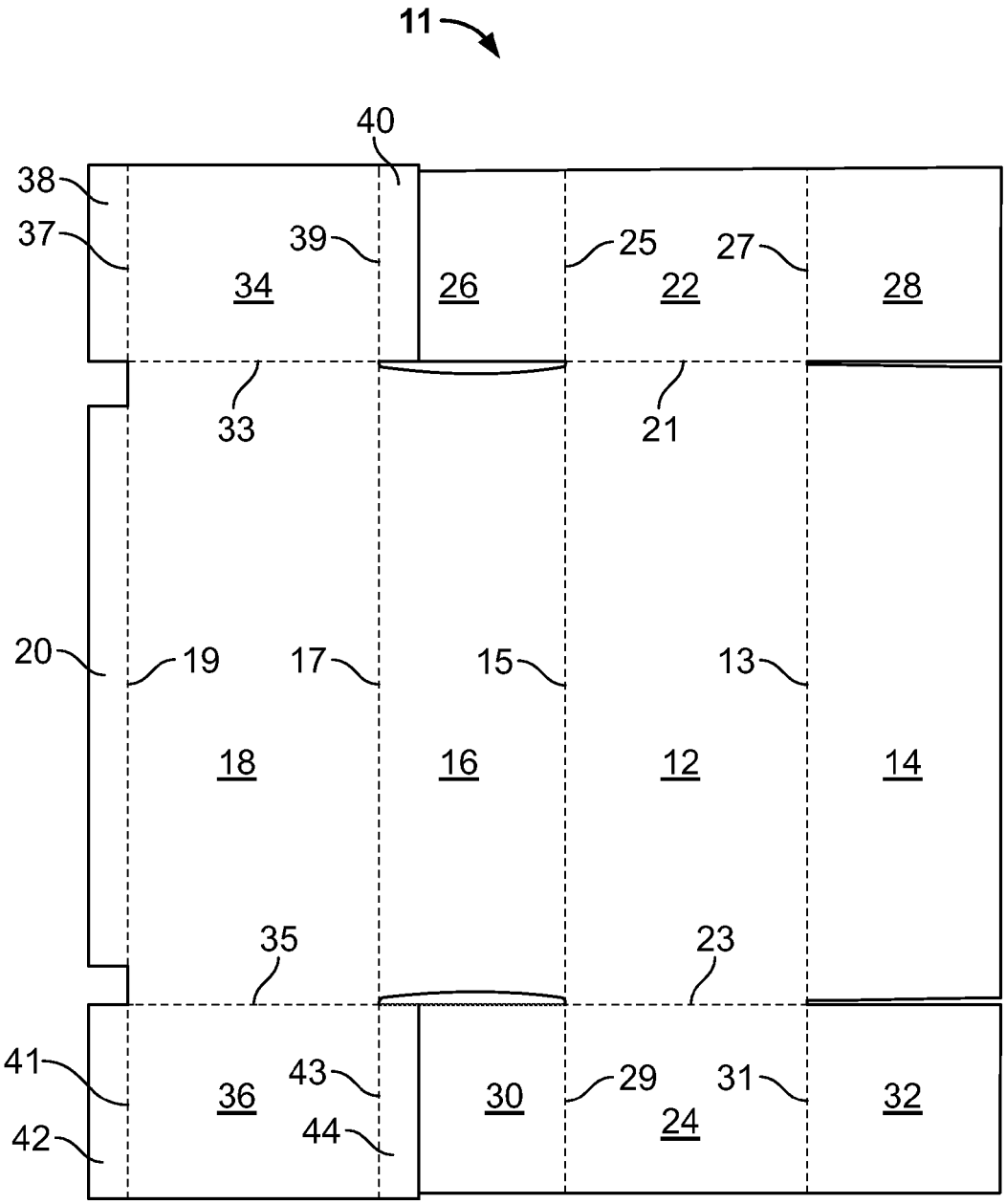
FIG. 2 is a plan view of a blank for forming the tray wrapper container according to the embodiment of FIG. 1.
Figure 3:
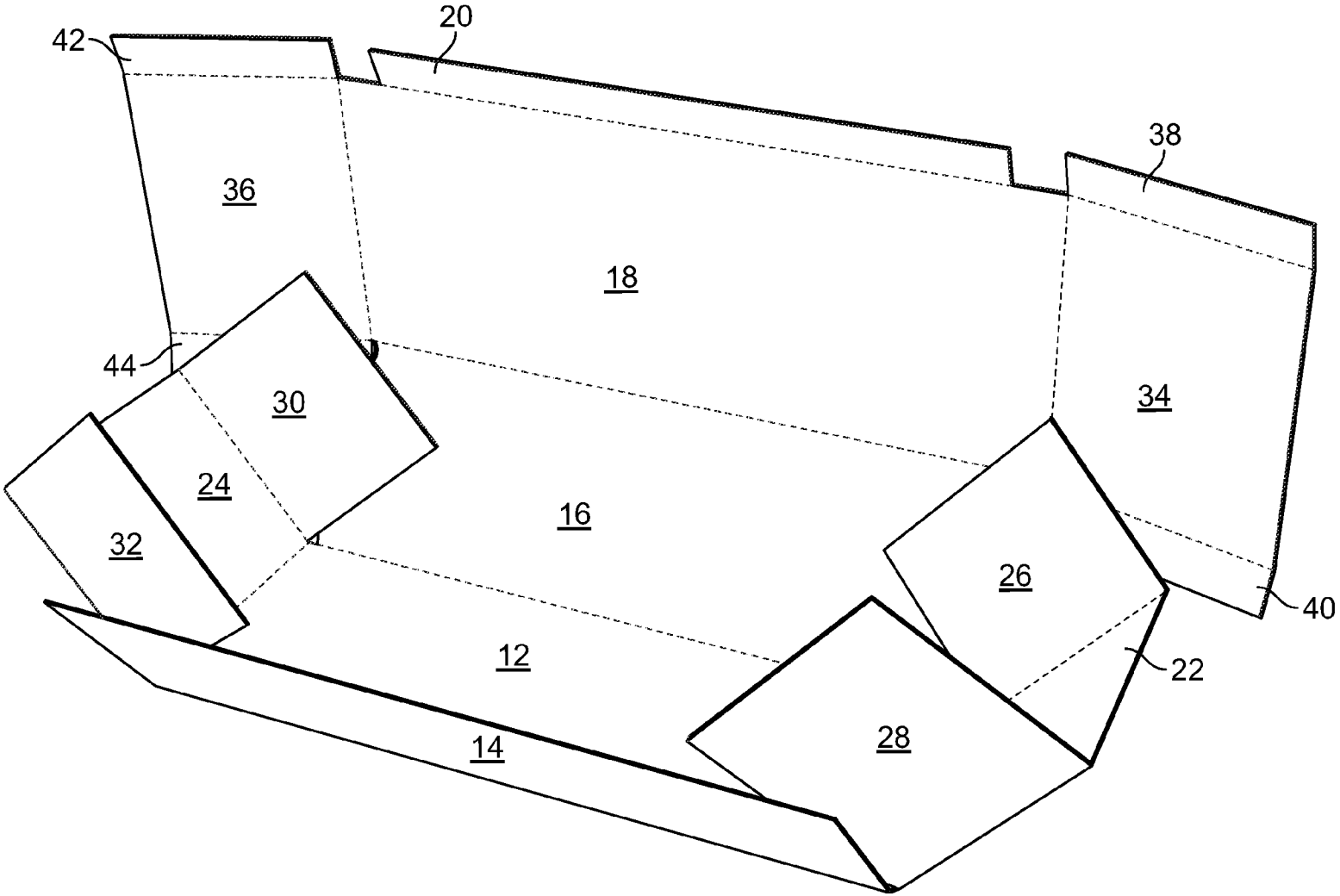
FIG. 3 is a perspective view of the blank of FIG. 2, at an early stage in the process of being articulated into a container, with the goods to be packaged being omitted from the illustration.
Figure 4:
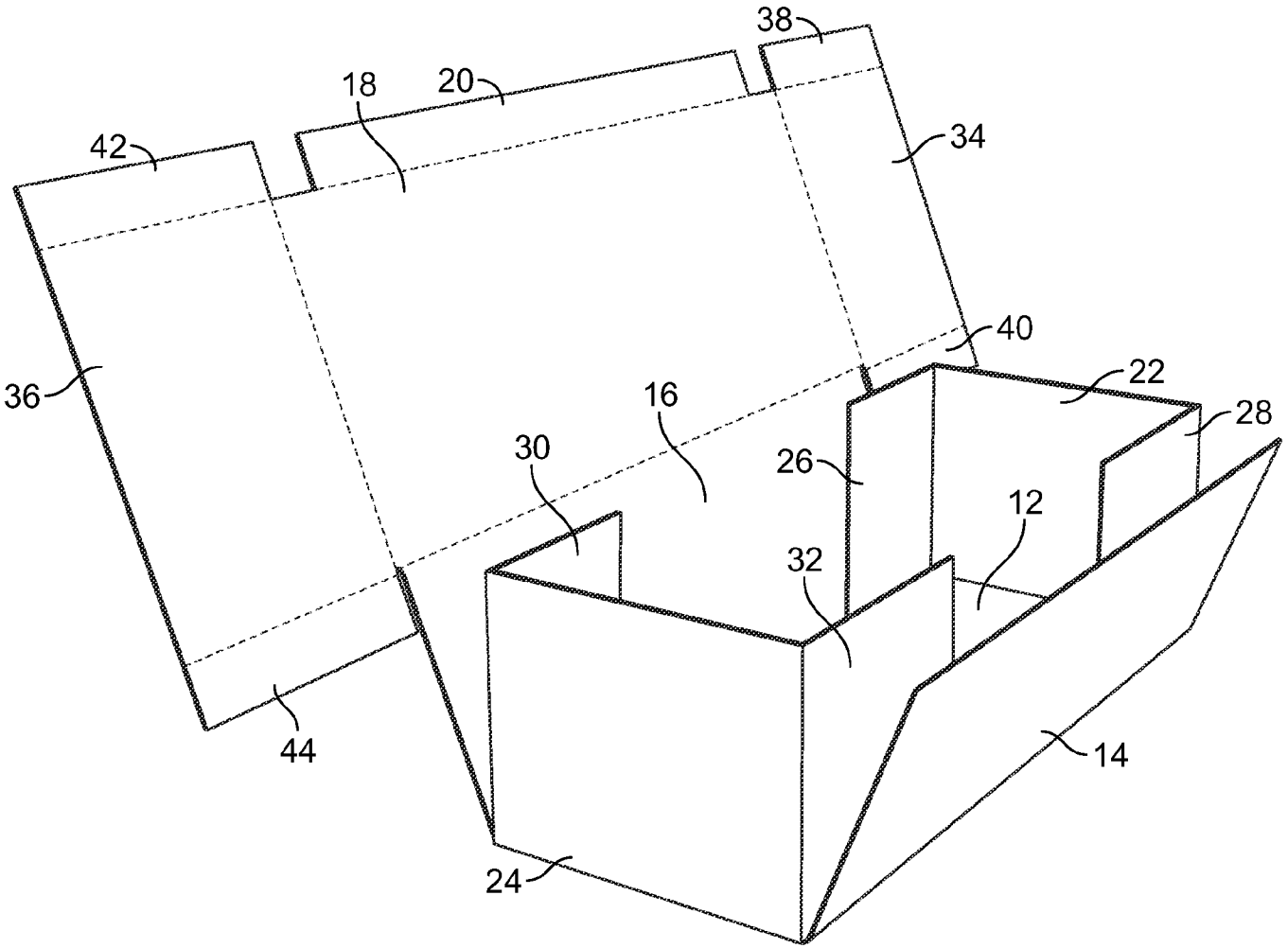
FIG. 4 is a perspective view of the blank of FIG. 2, at a later stage in the process of being articulated into a container, with the goods to be packaged being omitted from the illustration.
Figure 5:
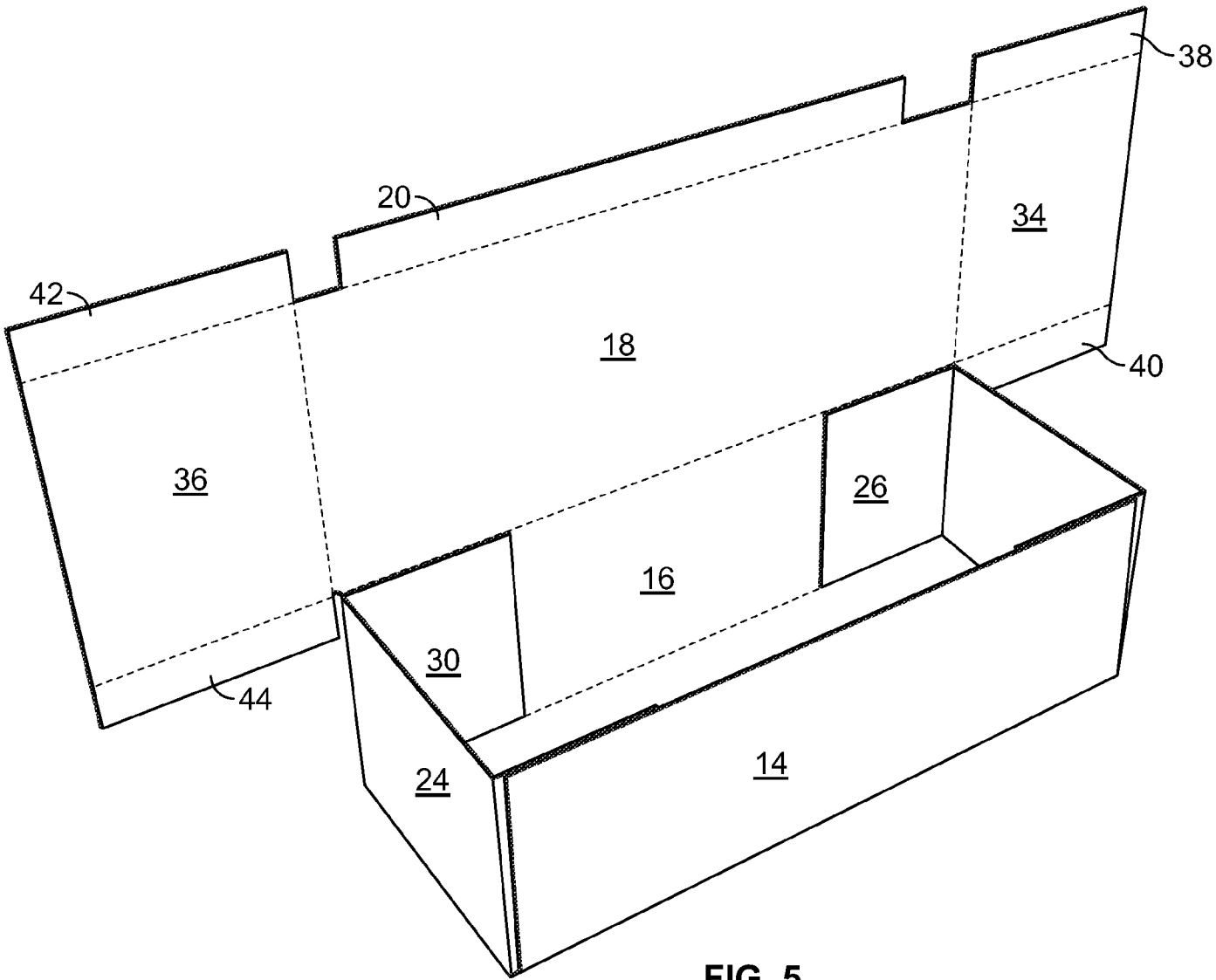
FIG. 5 is a perspective view of the container of FIG. 1, near the end of the process of articulation into a completed container, prior to closure of the container, with the goods to be packaged being omitted from the illustration.

Container 10 is formed from blank 11 (FIG. 2). Blank 11 includes bottom panel 12, front (side) panel 14, rear (side) panel 16, top panel 18 and closure flap 20; as well as fold lines 13, 15, 17 and 19. Blank 11 also includes inner end panels 22, 24 (emanating along fold lines 21, 23, respectively) from which interior minor flaps 26, 28, 30, 32 emanate along fold lines 25, 27, 29 and 31, respectively. Outer end panels 34, 36 emanate from top panel 18 along fold lines 33, 35, respectively. Reinforcing flanges 38, 40, 42, 44 emanate from outer end panels 34, 36, along fold lines 37, 39, 41 and 43, respectively. The end edges of panels 14 and 16 may be vertical. Alternatively, the end edges of rear panel 16 preferably may be concavely bowed and the end edges of front panel 14 preferably may be inwardly inclined from bottom to top (both as illustrated), because this style of slot configuration may permit ease of removing and ease of stripping the waste material from the designated and created aperture in the blank sheet. As an alternative, rather than the described designated slot, a singular cut including offsets as required may be implemented thereby eliminating a need to remove waste material.

Figure 6:
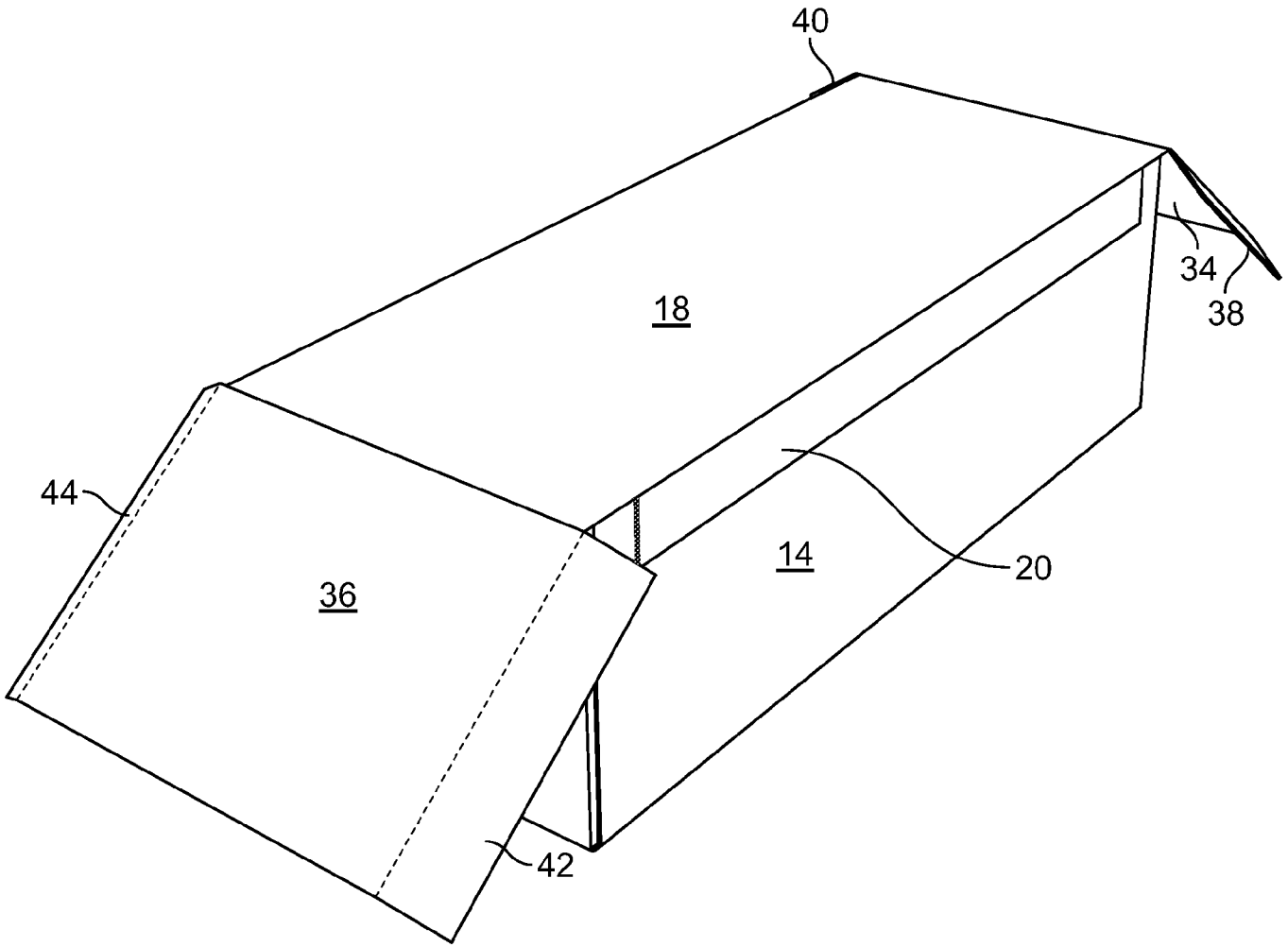
FIG. 6 is a perspective view of the container of FIG. 5, as the top panel is being brought into closure position, the major (outside) end flaps are being folded down, and the minor (reinforcing) flaps are being folded around to provide the final closure of the container.
Figure 7:
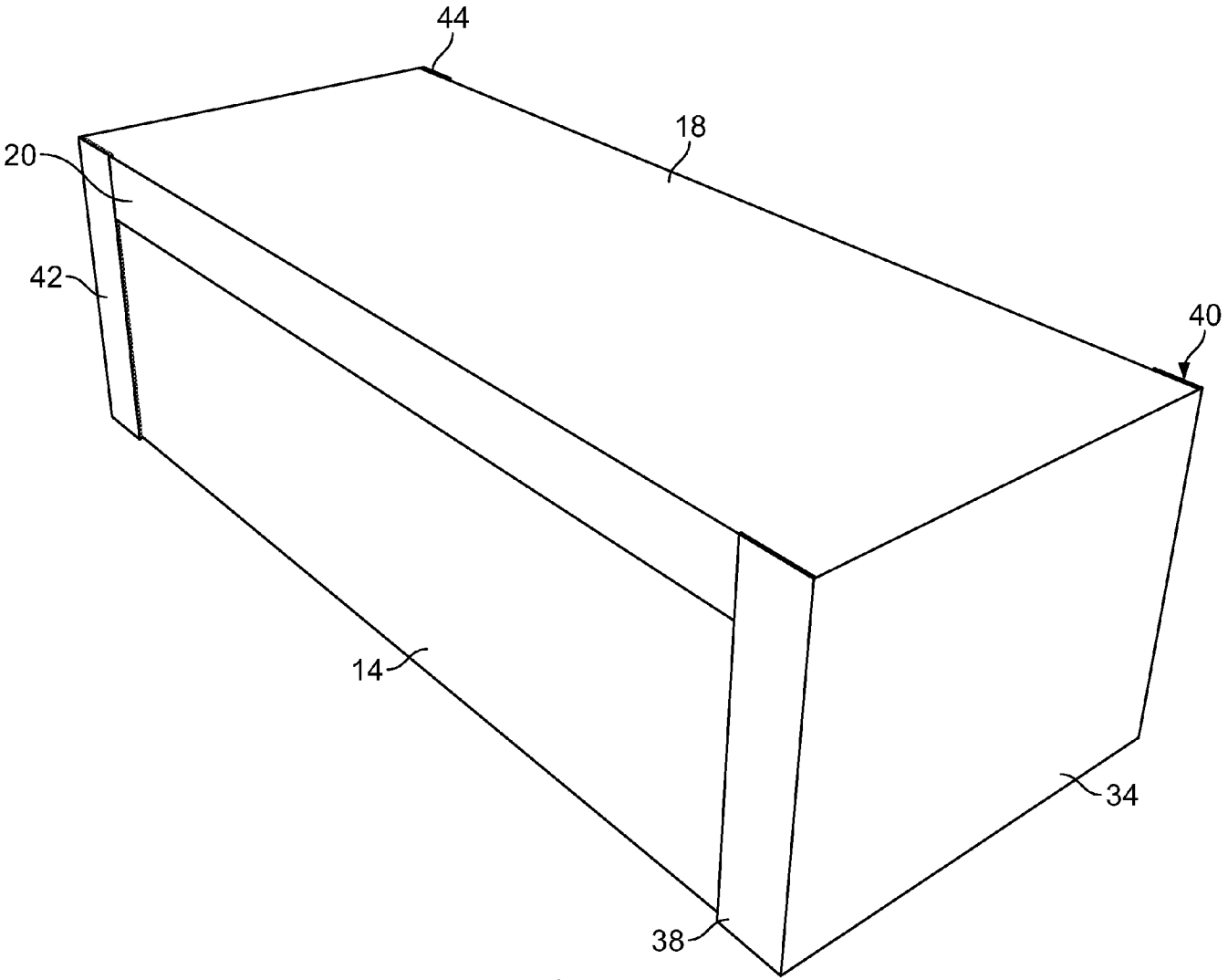
FIG. 7 is a perspective view of the container of FIGS. 1-6, in fully articulated, closed configuration.
Figure 8:
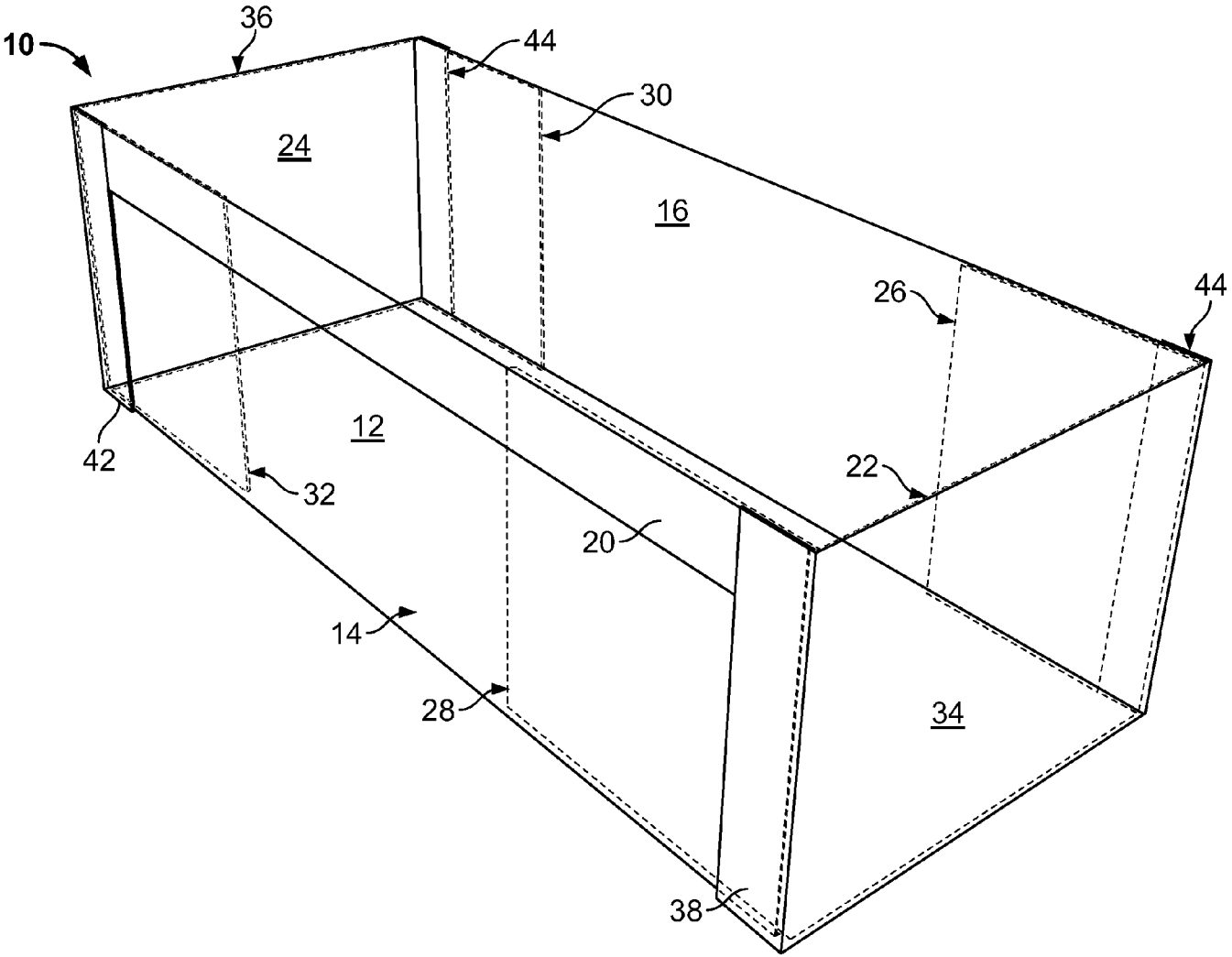
FIG. 8 is a perspective "transparent" view of the container of FIG. 7.
Figure 9:
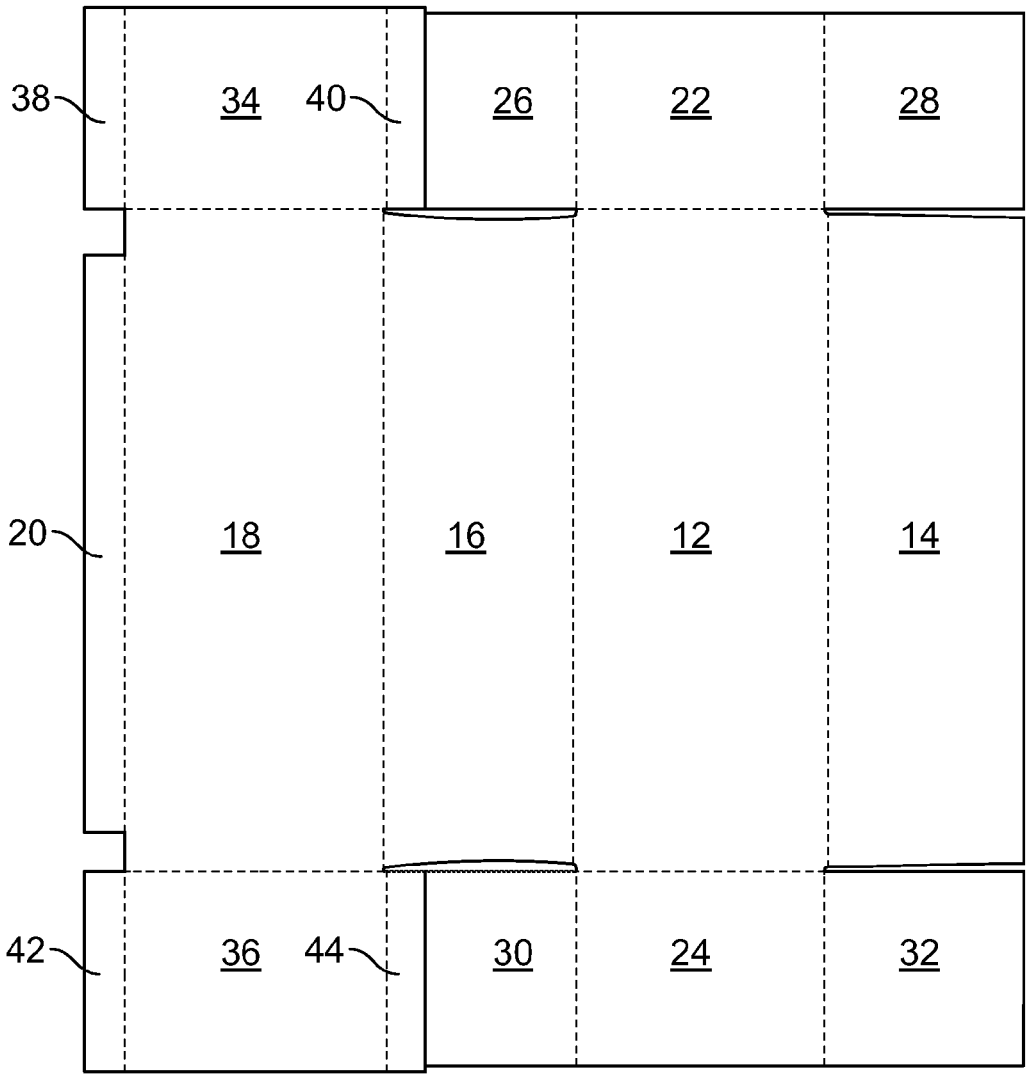
FIG. 9 is a further view of the blank of FIG. 2.

In a typical articulation procedure, first, the product to be contained will be pushed onto blank 11, which will be laid flat on a packaging apparatus. Flaps 30, 32 will be folded perpendicular to panel 24, and flaps 26, 28 will be folded perpendicular to panel 22. Panels 22, 24 will be folded upwardly perpendicularly to bottom panel 12. Rear (side) panel 16 and front (side) panel 14 will then be folded upwardly perpendicular to bottom panel 12, as shown sequentially in FIGS. 3-5. Top panel 18 is then folded down, toward and parallel to bottom panel 12; and outer end panels 34, 36 are folded over inner end panels 22, 24, respectively and adhered to end panels 22, 24. Finally, reinforcing flanges (minor flaps) 38, 40, 42, 44 are folded perpendicular to outer end panels 34, 36, and adhesively adhered to the outer surfaces of front and rear (side) panels 14, 16. When top panel 18 is folded down, closure flap 20 is preferably folded to the outside of front panel 14, and adhesively affixed to the outer surface 15 thereof (FIG. 6).

Figure 14:
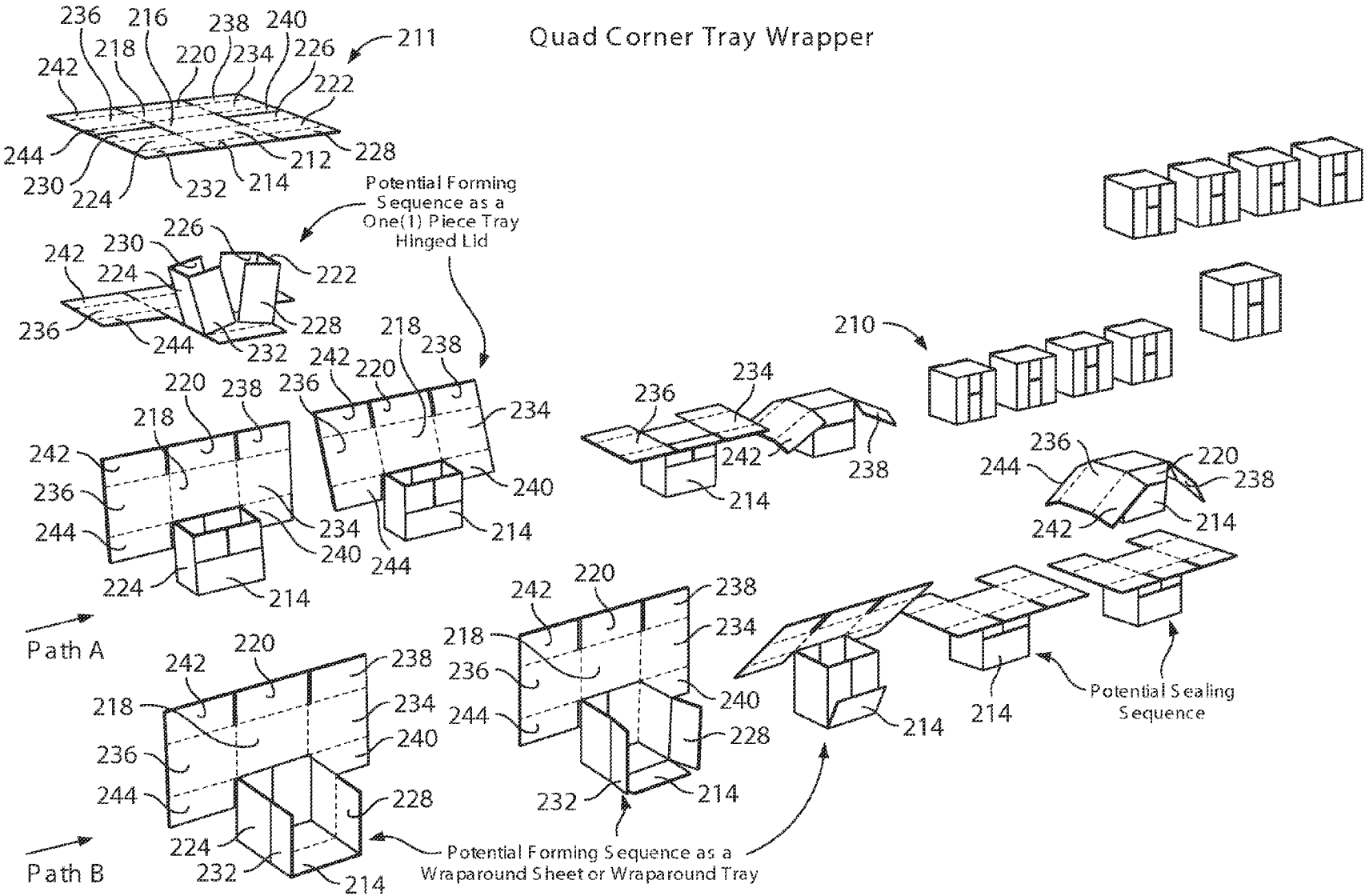
FIG. 14 is a perspective view of a container according to another embodiment, showing two different articulation "paths" for two different possible container loading "paths".

In an alternative sequence, which is described in detail with respect to the embodiment of FIG. 14, but which is understood to be applicable to all of the embodiments described and/or illustrated herein, the goods to be packaged are not placed on the bottom panel prior to any articulation. Instead, the front inner minor flaps and the front panel may not be folded with respect to the inner end panels and the bottom panel, respectively, at the same time that the rear inner minor flaps and the rear panel are folded and adhered with respect to the inner end panels and the bottom panel, respectively. This would result in a partially erected container, having an open frontal area, into which the goods to be packaged would be thrust, relying upon the inner surfaces of the rear inner minor flaps to provide stacking or other alignment structures. Upon insertion of the goods, the remaining panels and flaps are articulated and glued substantially as previously described.

The first variation of the general design of FIGS. 1-9 may be addressed in an alternative manner. The width of the carton is still considerably greater than the depth or height. The minor flaps are all each substantially less than one-half the width of the carton, so that there is a substantial gap between facing free edges of the minor flaps on the interior and exterior faces of the front and rear walls, thus creating "corner post" reinforcement structures, rather than complete end or side walls. The closure tab emanates from the free edge of the top panel, and is folded to be juxtaposed and adhesively affixed to the front panel.

Container 10 will be formed from blank 11 (FIG. 2). Blank 11 includes bottom panel 12, front (side) panel 14, rear (side) panel 16, top panel 18 and closure flap 20; as well as fold lines 13, 15, 17 and 19. Blank 11 also includes inner end panels 22, 24 (emanating along fold lines 21, 23, respectively) from which interior minor flaps 26, 28, 30, 32 emanate along fold lines 25, 27, 29 and 31, respectively. Outer end panels 34, 36 emanate from top panel 18 along fold lines 33, 35, respectively. Reinforcing flanges 38, 40, 42, 44 emanate from outer end panels 34, 36, along fold lines 37, 39, 41 and 43, respectively. The end edges of panels 14 and 16 may be vertical. Alternatively, the end edges of rear panel 16 preferably may be concavely bowed and the end edges of front panel 14 preferably may be inwardly inclined from bottom to top (both as illustrated), because this style of slot configuration may permit ease of removing and ease of stripping the waste material from the designated and created aperture in the blank sheet. As an alternative, rather than the described designated slot, a singular cut including offsets as required may be implemented thereby eliminating a need to remove waste material.

In a typical alternative articulation procedure, first the blank 11 is formed into a tray-like container as per FIG. 10 whereby inner minor panels 26, 28, 30 and 32 are folded along folds 25, 27, 29 and 31, respectively, perpendicular to inner end panels 22 and 24. End panels 22 and 24 are then folded along folds 21 and 23, respectively, perpendicular to bottom panel 12. Inner minor panels 26, 28, 30 and 32 are adhesively adhered to front (side) panel 14 and rear (side) panel 16. Product to be contained will be drop packed into the formed cavity whose perimeter can consist of inner minor flaps 26, 28, 30 and 32, front (side) panel 14 and rear (side) panel 16, inner end panels 22 and 24 along with bottom panel 12 of blank 16 and as shown sequentially in FIGS. 3-5. Top panel 18 is then folded down, toward and parallel to bottom panel 12; and outer end panels 34, 36 are folded over inner end panels 22, 24, respectively and adhered to end panels 22, 24. Finally, reinforcing flanges (minor flaps) 38, 40, 42 and 44 are folded perpendicular to outer end panels 34, 36 and adhesively adhered to the outer surfaces of front and rear (side) panels 14, 16. When top panel 18 is folded down, closure flap 20 is preferably folded to the outside of front panel 14, and adhesively affixed to the outer surface thereof (FIG. 6).

In an alternative sequence, which is described in detail with respect to the embodiment of FIG. 14, but which is understood to be applicable to all of the embodiments described and/or illustrated herein, the goods to be packaged are not placed on the bottom panel prior to any articulation. The product will be drop packed into the described walled cavity whose perimeter is formed from inner minor flaps 226, 228, 230 and 232 along with inner end panels 222 and 224 and bottom panel 212. Depending upon proportions, the rear perimeter will be formed by the addition of rear (side) panel 216. The front (side) panel of the tray may only be a portion of the front perimeter panel and would be completed by the top panel 220. The front inner minor flaps and the partial front panel may be folded with respect to the inner end panels and the bottom panel, respectively, at the same time that the rear inner minor flaps and the rear panel are folded and adhered with respect to the inner end panels and the bottom panel, respectively. This would result in an erected tray container, having a partially open frontal area, into which the goods to be packaged would be drop packed, relying upon the inner surfaces of the rear inner minor flaps, the inner end panels, the front minor flaps, and potentially, a partial front (side) panel as well as a rear (side) panel to provide stacking or other alignment structures. Upon insertion of the goods, the remaining panels and flaps are articulated and glued substantially as previously described.

A second variation of the design (FIGS. 10A-10D and 11) is substantially the same as that of FIGS. 1-9, except that the closure tab 20' is trapezoidal. Accordingly, the blank forming container 10' is substantially identical to blank 11 forming container 10 of FIGS. 1-9, and the method of articulation of the blank forming container 10' is substantially identical to the method of articulation of blank 11.

Therefore, the panels and fold lines forming blank 11' which are similar or identical to corresponding panels and fold lines of blank 11 are provided with like reference numerals, augmented by a prime (').). The process of articulation of blank 11' is illustrated in FIGS. 10A-10D.

Figure 11:
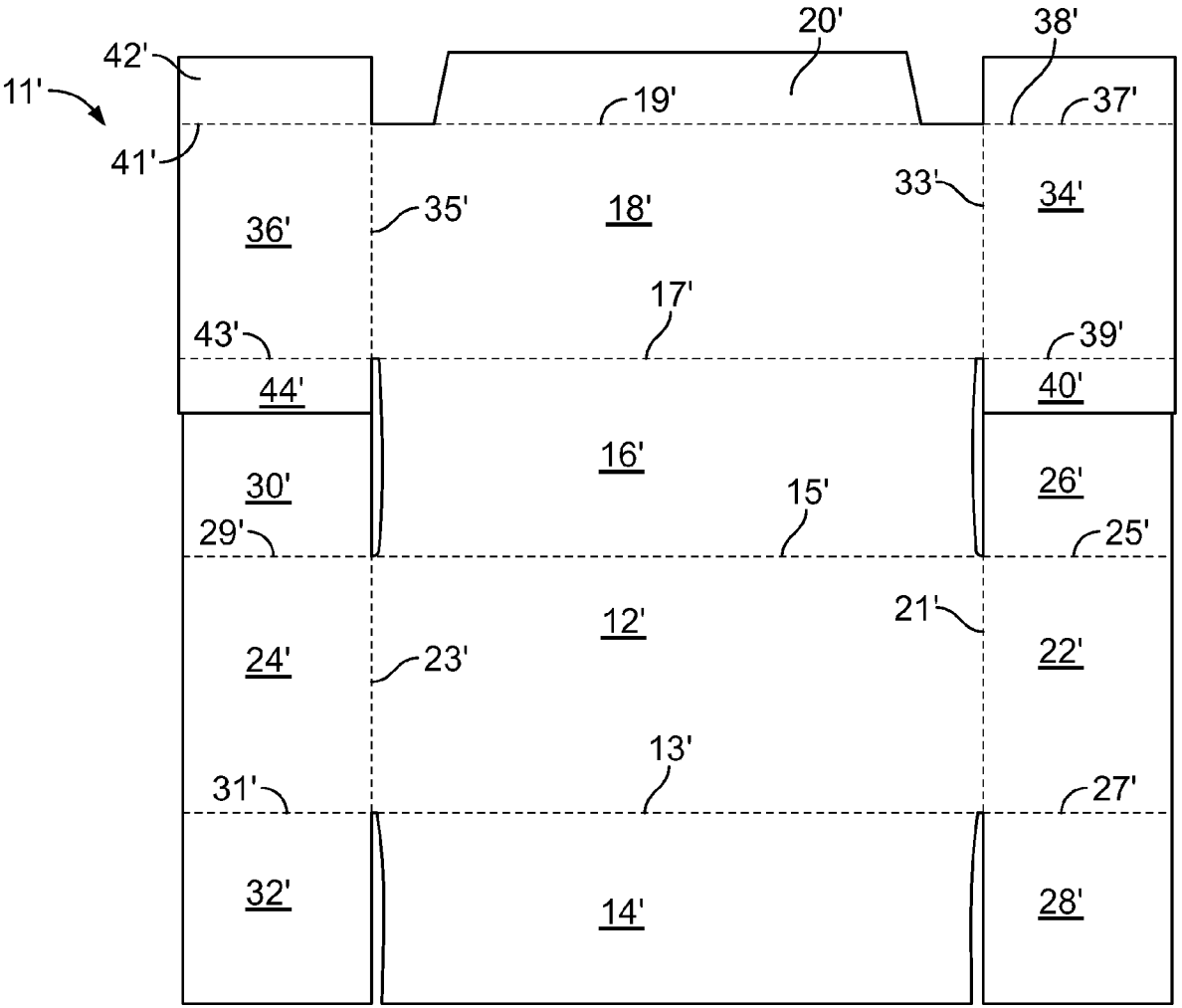
FIG. 11 is a plan view of a blank for the container of FIGS. 10A-10D.

Container 10' is formed from blank 11' (FIG. 11). Blank 11' includes bottom panel 12', front (side) panel 14', rear (side) panel 16', top panel 18' and closure flap 20'; as well as fold lines 13', 15', 17' and 19'. Blank 11' also includes inner end panels 22', 24' (emanating along fold lines 21', 23', respectively) from which interior minor flaps 26', 28', 30', 32' emanate along fold lines 25', 27', 29' and 31', respectively. Outer end panels 34', 36' emanate from top panel 18' along fold lines 33', 35', respectively. Reinforcing flanges 38', 40', 42', 44' emanate from outer end panels 34', 36', along fold lines 37', 39', 41' and 43', respectively. The end edges of panel 14' and 16' may be vertical. Alternatively, the end edges of both rear panel 16' and front panel 14' preferably may be concavely bowed or notched (as illustrated), because this style of slot configuration may permit ease of removing and ease of stripping the waste material from the designated and created aperture in the blank sheet. As an alternative, rather than the designated and created slot, a singular cut including offsets as required may be implemented thereby eliminating a need to remove waste material.

Figure 10C:
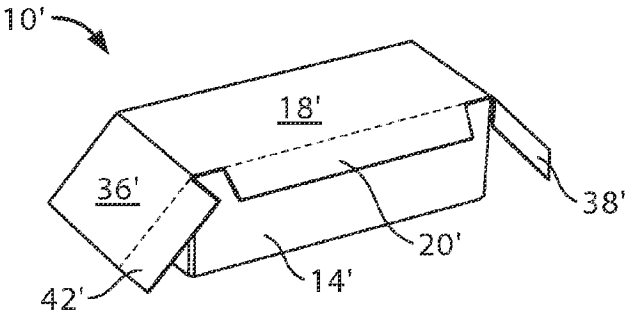
FIG. 10C is a perspective view of the container according to FIG. 10A, shown in a further stage of articulation.
Figure 10D:
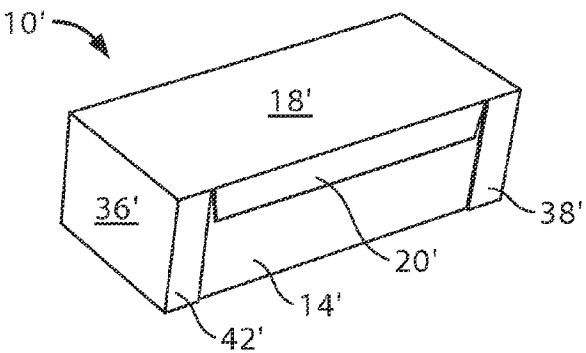
FIG. 10D is a perspective view of the container of FIG. 10A shown fully articulated.
Figure 10B:
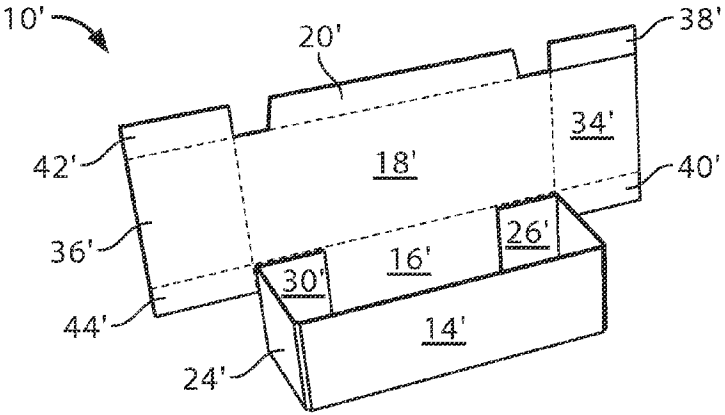
FIG. 10B is a perspective view of the container according to FIG. 10A, shown in a further stage of articulation.
Figure 10A:
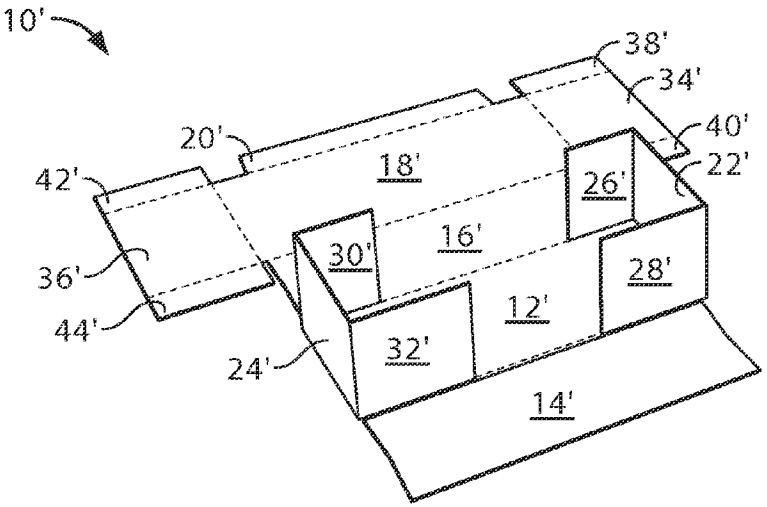
FIG. 10A is a perspective view of a container according to another embodiment, shown partially articulated.

In a typical articulation procedure, first, the product to be contained will be pushed onto blank 11', which will be laid flat on a packaging apparatus. Flaps 30', 32' will be folded perpendicular to panel 24', and flaps 26', 28' will be folded perpendicular to panel 22'. Panels 22', 24' will be folded upwardly perpendicularly to bottom panel 12'. Rear (side) panel 16' and front (side) panel 14' will then be folded upwardly perpendicular to bottom panel 12', as shown sequentially in FIGS. 10A-10D. Top panel 18' is then folded down, toward and parallel to bottom panel 12'; and outer end panels 34', 36' are folded over and adhered to inner end panels 22', 24', respectively. Finally, reinforcing flanges (minor flaps) 38', 40', 42' and 44' are folded perpendicular along folds 37', 39', 41' and 42', respectively to outer end panels 34', 36', and adhesively adhered to the outer surfaces of front and rear (side) panels 14', 16'. When top panel 18' is folded down, closure flap 20' is preferably folded to the outside of front panel 14', and adhesively affixed to the outer surface thereof (FIGS. 10C and 10D).

A third variation of the design (FIGS. 12 and 13) is similar to the variations of FIGS. 1-9 and 10-11, except that the closure tab emanates from the free edge of the front panel 114, and is trapezoidal.

Figure 12:
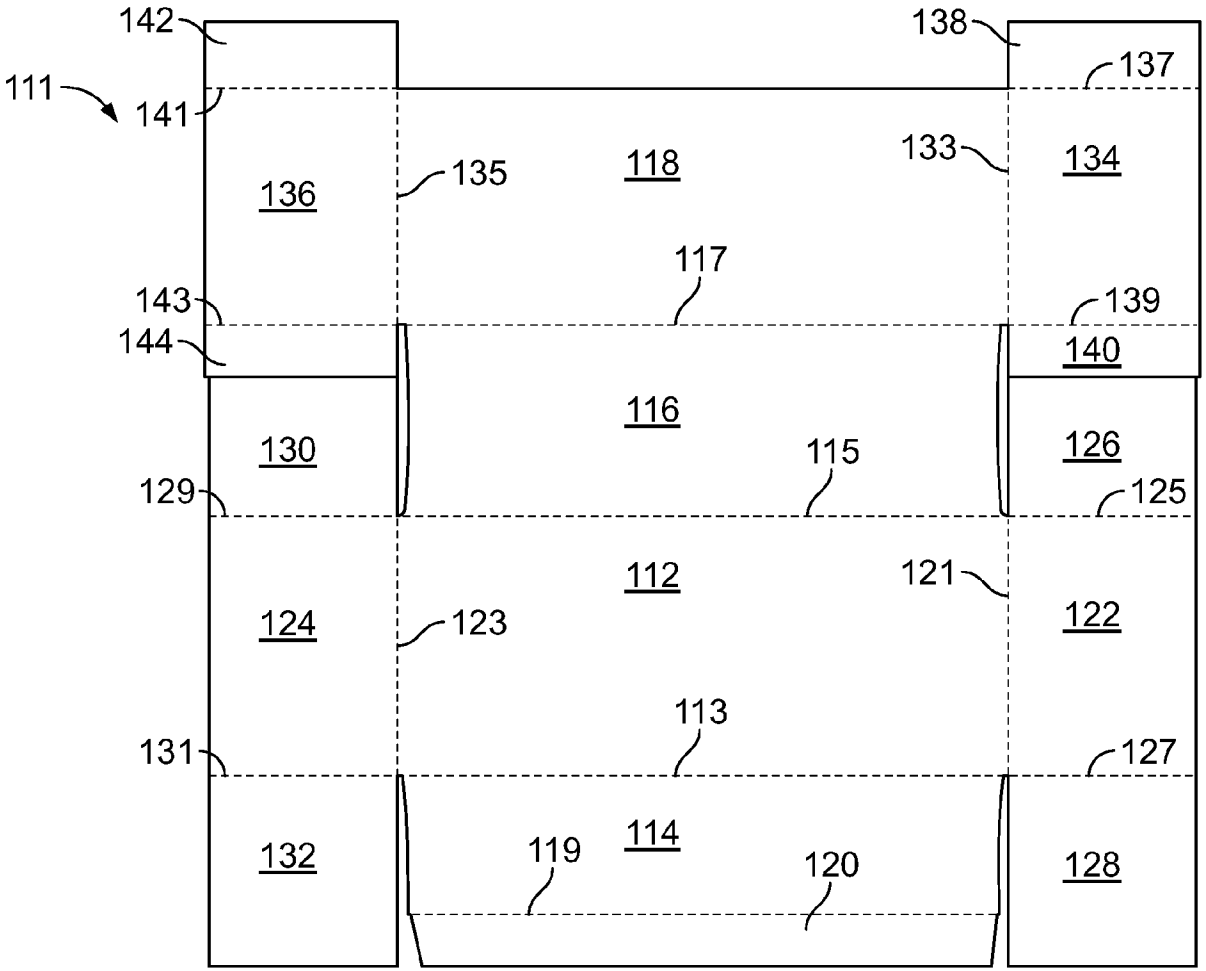
FIG. 12 is a plan view of a blank for a container according to another embodiment.
Figure 13C:
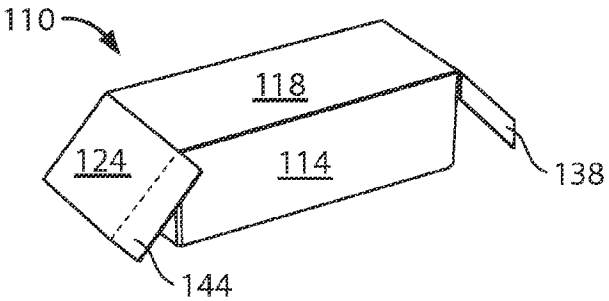
FIG. 13C is a perspective view of the container according to FIG. 13A, shown in a further stage of articulation.
Figure 13D:
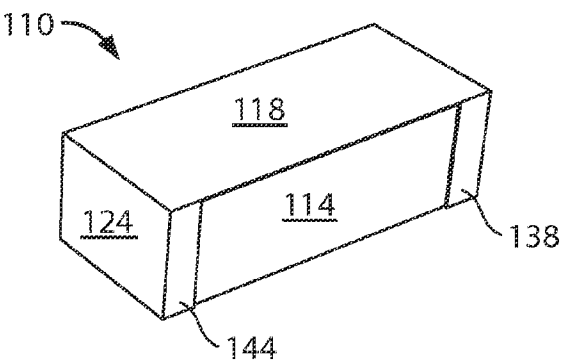
FIG. 13D is a perspective view of the container of FIG. 13A, shown fully articulated.
Figure 13B:
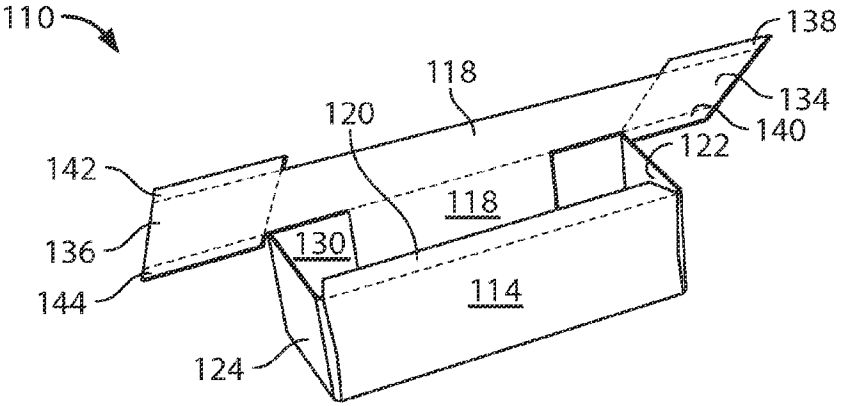
FIG. 13B is a perspective view of the container according to FIG. 13A, shown in a further stage of articulation.
Figure 13A:
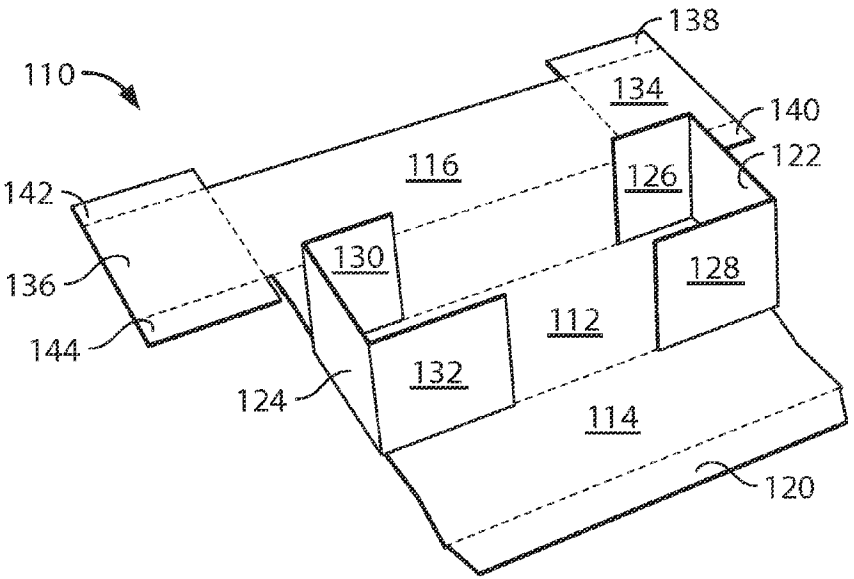
FIG. 13A is a perspective view of a container according to the embodiment of FIG. 12, shown partially articulated.

Container 110 is formed from blank 111 (FIG. 12). Blank 111 includes bottom panel 112, front (side) panel 114, rear (side) panel 116, top panel 118 and closure flap 120; as well as fold lines 113, 115, 117 and 119. Blank 111 also includes inner end panels 122, 124 (emanating along fold lines 121, 123, respectively) from which interior minor flaps 126, 128, 130, 132 emanate along fold lines 125, 127, 129 and 131, respectively. Outer end panels 134, 136 emanate from top panel 118 along fold lines 133, 135, respectively. Reinforcing flanges 138, 140, 142, 144 emanate from outer end panels 134, 136, along fold lines 137, 139, 141 and 143, respectively. The end edges of panels 114 and 116 may be vertical. Alternatively, the end edges of both rear panel 116 and front panel 114 preferably may be concavely bowed or notched (as illustrated), because this style of slot configuration may permit ease of removing and ease of stripping the waste material from the designated and created aperture in the blank sheet. As an alternative, rather than the described designated slot, a singular cut including offsets as required may be implemented, thereby eliminating a need to remove waste material.

In a typical articulation procedure, first, the product to be contained will be pushed onto blank 111, which will be laid flat on a packaging apparatus. Flaps 130, 132 will be folded perpendicular to panel 124, and flaps 126, 128 will be folded perpendicular to panel 122. Panels 122, 124 will be folded upwardly perpendicularly to bottom panel 112. Rear (side) panel 116 and front (side) panel 114 will then be folded upwardly perpendicular to bottom panel 112, as shown in FIGS. 13A-13D. Top panel 118 is then folded down, toward and parallel to bottom panel 112; and outer end panels 134, 136 are folded over and adhesively affixed to inner end panels 122, 124, respectively. Finally, reinforcing flanges (minor flaps) 138, 140, 142 and 144 are folded perpendicular to outer end panels 134, 136, and adhesively adhered to the outer surfaces of front and rear (side) panels 114, 116. When top panel 118 is folded down, closure flap 120 is preferably folded to the inside of top panel 118, and adhesively affixed to the inside surface thereof.

In a fourth variation of the design (FIG. 14), which is generally similar to the embodiment of FIGS. 1-9, the ratio of the width of the carton to the depth of the carton is still greater than one, but substantially less than in the variations of FIGS. 1-9; 10-11; or 12-13. As such, the widths of the "minor" flaps equals one-half the width of the carton, so that the minor-flap-facing free edges meet or nearly meet, along the side-to-side midpoint of the carton, along the inside and outside surfaces of the front and rear panels.

Container 210 is formed from blank 211 (FIG. 14). Blank 211 includes bottom panel 212, front (side) panel 214, rear (side) panel 216, top panel 218 and closure flap 220; as well as fold lines positioned similarly to fold lines 13, 15, 17 and 19 of FIG. 2. Blank 211 also includes inner end panels 222, 224 (emanating along fold lines positioned similarly to fold lines 21, 23, of FIG. 2, respectively) from which interior minor flaps 226, 228, 230, 232 emanate along fold lines positioned similarly to fold lines 25, 27, 29 and 31 of FIG. 2, respectively. Outer end panels 234, 236 emanate from top panel 218 along fold lines positioned similarly to fold lines 33, of FIG. 2. Reinforcing flanges 238, 240, 242, 244 emanate from outer end panels 234, 236, along fold lines positioned similarly to fold lines 37, 39, 41 and 43 of FIG. 2, respectively. The end edges of rear panel 216 and front panel 214 may be concavely bowed or notched, or inwardly inclined from bottom to top, or vertical, as disclosed in previously described embodiments, if so desired or deemed necessary in accordance with the requirements of any particular application.

In a typical articulation procedure, first, the product to be contained will be pushed onto blank 211, which will be laid flat on a packaging apparatus. Flaps 230, 232 will be folded perpendicular to panel 224, and flaps 226, 228 will be folded perpendicular to panel 222. Panels 222, 224 will be folded upwardly perpendicularly to bottom panel 212. Rear (side) panel 216 and front (side) panel 214 will then be folded upwardly perpendicular to bottom panel 212, as shown in Path A of FIG. 14. Top panel 218 is then folded down, toward and parallel to bottom panel 212; and outer end panels 234, 236 are folded over and adhesively affixed to inner end panels 222, 224, respectively. Finally, reinforcing flanges (minor flaps) 238, 240, 242, 244 are folded along folds 237, 239, 241 and 243, respectively, perpendicular to outer end panels 234, 236, and adhesively adhered to the outer surfaces of front and rear (side) panels 214, 216 and 220. When top panel 218 is folded down, closure flap 220 is preferably folded to the outside of front minor flaps 228 and 234, and adhesively affixed to the outer surface thereof, but to the inside of reinforcing flanges 242, 238, due to the breadth of those flanges.

In an alternative embodiment of the method for forming the package, shown in Path B, front panel 214 is not raised at the same time as rear panel 216, and minor flaps 232 and 228 are likewise not folded inwardly, at the same time as flaps 230, 226. This provides for a "tray-like" function, in that instead of placing the product on bottom panel 212, prior to any articulation, positioning of the product may be delayed until the configuration that is the first step (as reflected by the arrow) in Path B is attained. In this configuration, because there is a "back wall" formed by minor flaps 230, 226, the container can serve as a straightening or alignment structure, for more or less loosely collected, stacked or otherwise aligned, products.

Regardless of the path taken, the structure and configuration of the container according to FIG. 14 will be the same, as shown in the right-hand side of that figure.

A fifth variation of the design (FIG. 15) is similar to the design of FIGS. 1-9, except that, upon articulation, the sides of the carton are all inclined, so that the resultant container is frusto-pyramidal in configuration.

Figure 15:
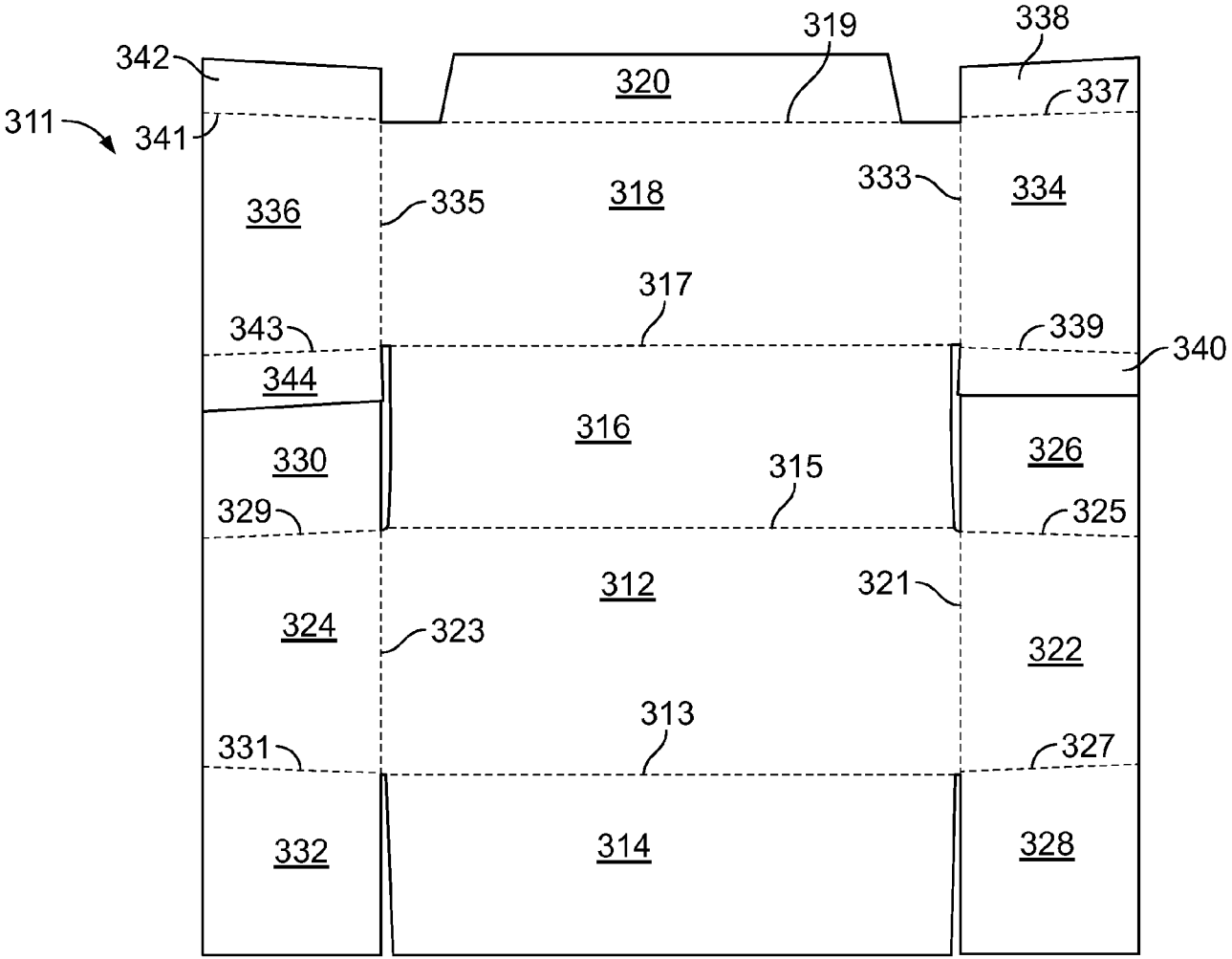
FIG. 15 is a plan view of a container according to another embodiment, similar to the container of FIGS. 1-9, but resulting in a container having a frusto-pyramidal configuration.

The frusto-pyramidal container is formed from blank 311 (FIG. 15). Blank 311 includes bottom panel 312, front (side) panel 314, rear (side) panel 316, top panel 318 and closure flap 320; as well as fold lines 313, 315, 317 and 319. Blank 311 also includes inner end panels 322, 324 (emanating along fold lines 321, 323, respectively) from which interior minor flaps 326, 328, 330, 332 emanate along fold lines 325, 327, 329 and 331, respectively. Outer end panels 334, 336 emanate from top panel 318 along fold lines 333, 335, respectively. Reinforcing flanges 338, 340, 342, 344 emanate from outer end panels 334, 336, along fold lines 337, 339, 341 and 343, respectively. The end edges of rear panel 316 may be concavely bowed (as illustrated), notched, inclined or vertical, while the end edges of front panel 314 may be vertical (as illustrated), inwardly inclined from bottom to top, or concave, because this style of slot configuration may permit ease of removing and ease of stripping the waste material from the designated and created aperture in the blank sheet. As an alternative, rather than the described designated slot, a singular cut including offsets as required may be implemented thereby eliminating a need to remove waste material.

In a typical articulation procedure, first, the product to be contained will be pushed onto blank 311, which will be laid flat on a packaging apparatus. Flaps 330, 332 will be folded perpendicular to panel 324, and flaps 326, 328 will be folded perpendicular to panel 322. Panels 322, 324 will be folded upwardly perpendicularly to bottom panel 312. Rear (side) panel 316 and front (side) panel 314 will then be folded upwardly perpendicular to bottom panel 312. Top panel 318 is then folded down, toward and parallel to bottom panel 312; and outer end panels 334, 336 are folded over inner end panels 322, 324, respectively. Finally, reinforcing flanges (minor flaps) 338, 340, 342 and 344 are folded along folds 337, 339, 341 and 343 perpendicular to outer end panels 334, 336, and adhesively adhered to front and rear (side) panels 314, 316. When top panel 318 is folded down, closure flap 320 is preferably folded to the outside of front panel 314, and adhesively affixed to the outer surface thereof.

Fold lines 329, 331, 325, and 327 are all at non-perpendicular angles with respect to fold lines 323, 321, respectively. Similarly, fold lines 341, 343, 337 and 339 are all at non-perpendicular angles with respect to fold lines 335 and 333, respectively. In addition, panels 342, 344, 330, 332, 338, 340, 326, 328 are all non-rectangular. Further, bottom panel 312 is deeper, from front to back, than top panel 318. Thus, upon articulation, the resultant container has inwardly inclined front, rear, and end regions, to create a frusto-pyramidal container.

A sixth variation of the design (FIG. 16) is similar to the design of FIGS. 12-13, except that, upon articulation, the sides of the carton are all inclined, so that the resultant carton is frusto-pyramidal in configuration.

Figure 16:
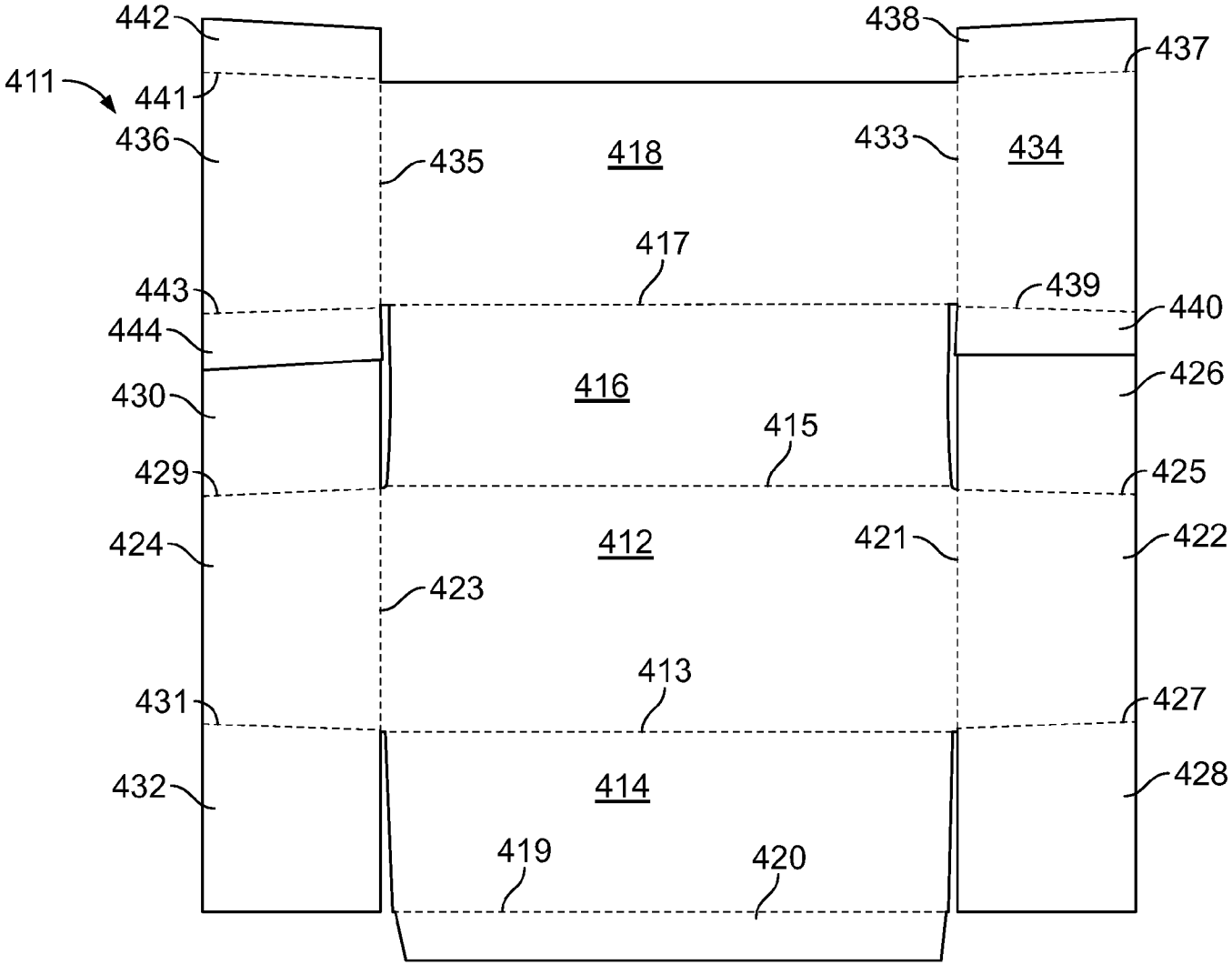
FIG. 16 is a plan view of a container according to another embodiment, similar to the container of FIGS. 13A-13D and 14.
Figure 17A:
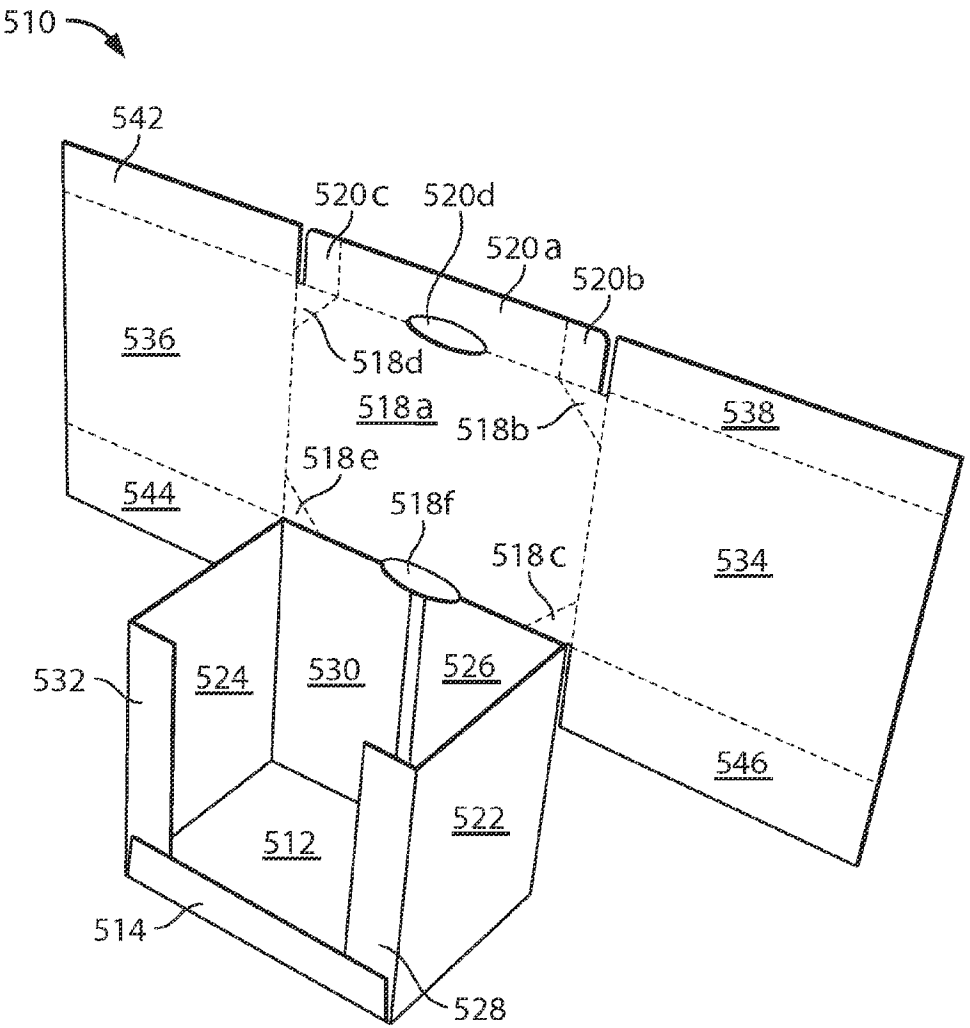
FIG. 17A is a perspective view of a container according to another embodiment, with the container substantially fully articulated except for final closure, wherein the container further includes removable portions for display conversion.
Figure 17B:
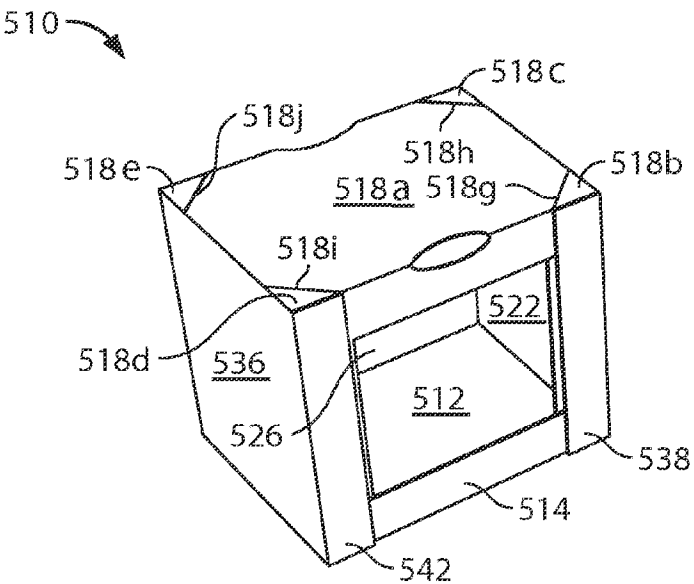
FIG. 17B is a perspective view of a container according to the embodiment of FIG. 17A, in its fully articulated configuration.
Figure 18B:
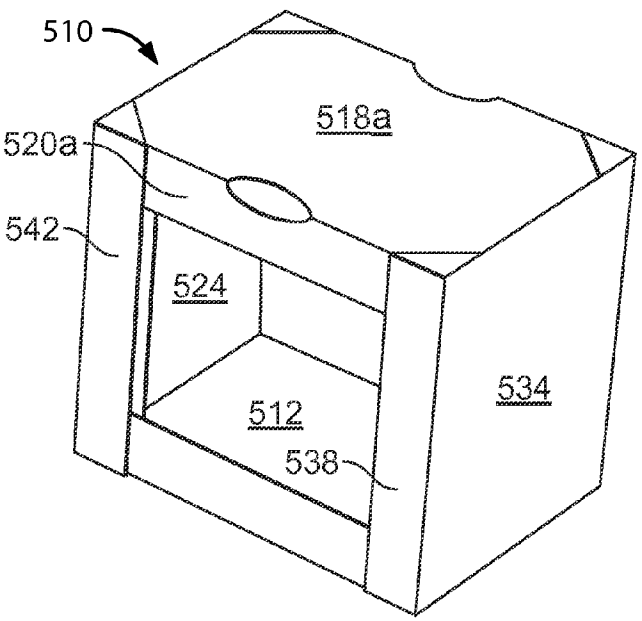
FIG. 18B is a perspective view of the container of FIGS. 17A-18A.
Figure 18A:
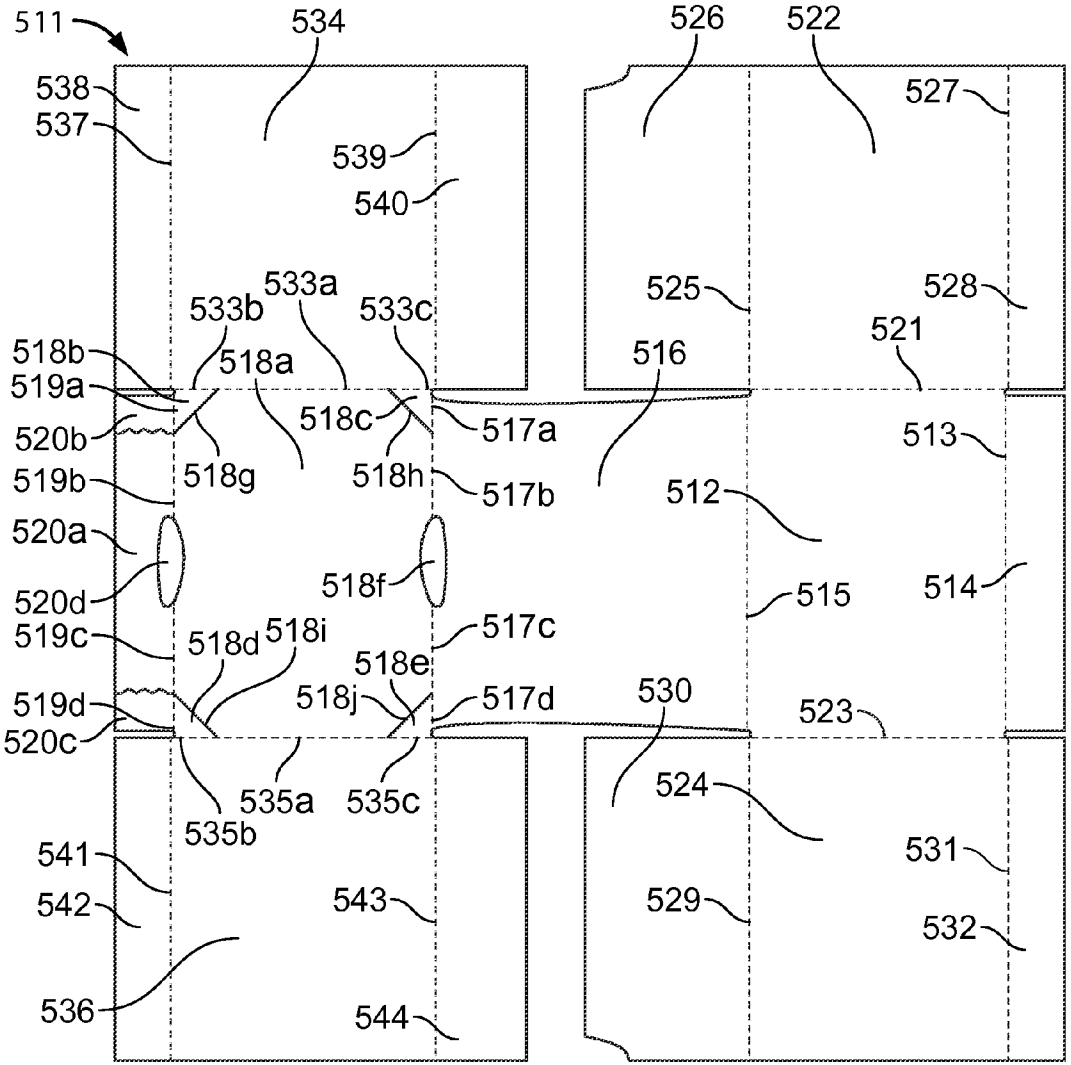
FIG. 18A is a plan view of the blank for the container of FIGS. 17A and 17B.

The container is formed from blank 411 (FIG. 16). Blank 411 includes bottom panel 412, front (side) panel 414, rear (side) panel 416, top panel 418 and closure flap 420; as well as fold lines 413, 415, 417 and 419. Blank 411 also includes inner end panels 422, 424 (emanating along fold lines 421, 423, respectively) from which interior minor flaps 426, 428, 430, 432 emanate along fold lines 425, 427, 429 and 431, respectively. Outer end panels 434, 436 emanate from top panel 418 along fold lines 433, 435, respectively. Reinforcing flanges 438, 440, 442, 444 emanate from outer end panels 434, 436, along fold lines 437, 439, 441 and 443, respectively. The end edges of panels 414 and 416 may be vertical. Alternatively, the end edges of both rear panel 416 and front panel 414 preferably may be concavely bowed or notched (as illustrated), because this style of slot configuration may permit ease of removing and ease of stripping the waste material from the designated and created aperture in the blank sheet. As an alternative, rather than the described designated slot, a singular cut including offsets as required may be implemented thereby eliminating a need to remove waste material.

In a typical articulation procedure, first, the product to be contained will be pushed onto blank 411, which will be laid flat on a packaging apparatus. Flaps 430, 432 will be folded perpendicular to panel 424, and flaps 426, 428 will be folded perpendicular to panel 422. Panels 422, 424 will be folded upwardly perpendicularly to bottom panel 412. Rear (side) panel 416 and front (side) panel 414 will then be folded upwardly perpendicular to bottom panel 412. Top panel 418 is then folded down, toward and parallel to bottom panel 412; and outer end panels 434, 436 are folded over inner end panels 422, 424, respectively. Finally, reinforcing flanges (minor flaps) 438, 440, 442 and 444 are folded perpendicular to outer end panels 434, 436, and adhesively adhered to the outer surfaces of front and rear (side) panels 414, 416. When top panel 418 is folded down, closure flap 420 is preferably folded to the inside of top panel 418, and adhesively affixed to the inside surface thereof.

Fold lines 429, 431, 425, and 427 are all at non-perpendicular angles with respect to fold lines 423, 421, respectively. Similarly, fold lines 441, 443, 437 and 439 are all at non-perpendicular angles with respect to fold lines 435 and 433, respectively. In addition, panels 442, 444, 430, 432, 438, 440, 426, 428 are all non-rectangular. Further, bottom panel 412 is deeper, from front to back, than top panel 418. Thus, upon articulation, the resultant container has inwardly inclined front, rear, and end regions, to create a frusto-pyramidal container.

The seventh variation (FIGS. 17A-19F) of the design are similar to the basic design of FIGS. 1-9; except that the front panel is substantially shorter than the rear panel, to create an open display region, and lines of weakness are provided in the closure tab, along the middle portions of the front, rear, and side edges of the top panel and along diagonals at the corners of the top panel. This permits the bulk of the top panel to be removed, leaving triangular-shaped top panel sections remaining, for strength, stability and stacking ability.

Container 510 is formed from blank 511. Blank 511 includes bottom panel 512, front (side) panel 514, rear (side) panel 516, top center panel 518*a* with top corner panels 518*b*-518*e*, and closure flap 520*a*; as well as fold lines 513, 515, 517*a* and 517*d* and 519*a* and 519*d*. Blank 511 also includes inner end panels 522, 524 (emanating along fold lines 521, 523, respectively) from which interior minor flaps 526, 528, 530, 532 emanate along fold lines 525, 527, 529 and 531, respectively. Outer end panels 534, 536 emanate from top center panel 518*a* and its respective corner panels, along fold lines 533*b*-*c*, 535*b*-*c*, and perforations 533*a*, 535*a*, respectively. Reinforcing flanges 538, 540, 542, 544 emanate from outer end panels 534, 536, along fold lines 537, 539, 541 and 543, respectively. Blank 511 also includes perforation lines 517*b*, 517*c*, 518*g*-*j*, 519*b* and 519*c*, as well as apertures 518*f* and 520*d*.

The end edges of panels 514 and 516 may be vertical. Alternatively, the end edges of rear panel 516 preferably may be concavely bowed and the end edges of front panel 514 preferably may be inwardly inclined from bottom to top (both as illustrated), because this style of slot configuration may permit ease of removing and ease of stripping the waste material from the designated and created aperture in the blank sheet. As an alternative, rather than the described designated slot, a singular cut including offsets as required may be implemented thereby eliminating a need to remove waste material.

In a typical articulation procedure, first, the product to be contained will be pushed onto blank 511, which will be laid flat on a packaging apparatus. Flaps 530, 532 will be folded perpendicular to panel 524, and flaps 526, 528 will be folded perpendicular to panel 522. Panels 522, 524 will be folded upwardly perpendicularly to bottom panel 512. Rear (side) panel 516 and front (side) panel 514 will then be folded upwardly perpendicular to bottom panel 512, as shown sequentially in FIGS. 17A and 19A-19F. Top panel 518 is then folded down, toward and parallel to bottom panel 512; and outer end panels 534, 536 are folded over and adhesively adhered to the outer surfaces of inner end panels 522, 524, respectively. Finally, reinforcing flanges (minor flaps) 538, 540, 542 and 544 are folded perpendicular to outer end panels 534, 536, and adhesively adhered to the outer surface of rear (side) panel 516, outer surface of front (side) panel 514 and outer surfaces of closure flap 520*a*, specifically outer surfaces of top closure front panels 520*c* and 520*b*. When top panel 518 is folded down, closure flap 520*a* is preferably folded to the outside surfaces of interior minor flaps 532 and 528 and adhesively affixed to the outer surface thereof.

Instead of ripping or cutting the container apart, as in other wraparound container constructions, access to the interior of container 510 is achieved, via removal of top center panel 518*a*, tearing along perforation lines 533*a*, 518*h*, 517*b*, 517*c*, 518*j*, 535*a*, 518*i*, 519*c*, 519*b* and 518*g*, leaving behind a display tray having four corner posts, with triangular top corner panels for still enabling stacking of the opened tray. FIGS. 19A-19F show different ways in which articulation of blank 511 may be accomplished, to arrive at the fully articulated configuration of FIG. 19F.

In the eighth variation of the design (FIGS. 20-24), there is no closure tab along either of the leading or trailing edges of the blank. Instead, there are trapezoidal areas of both the top and front panels that are die cut out, to leave an open area along the top and front panels, for display and dispensing purposes, without removal of material from the carton.

Figure 20:
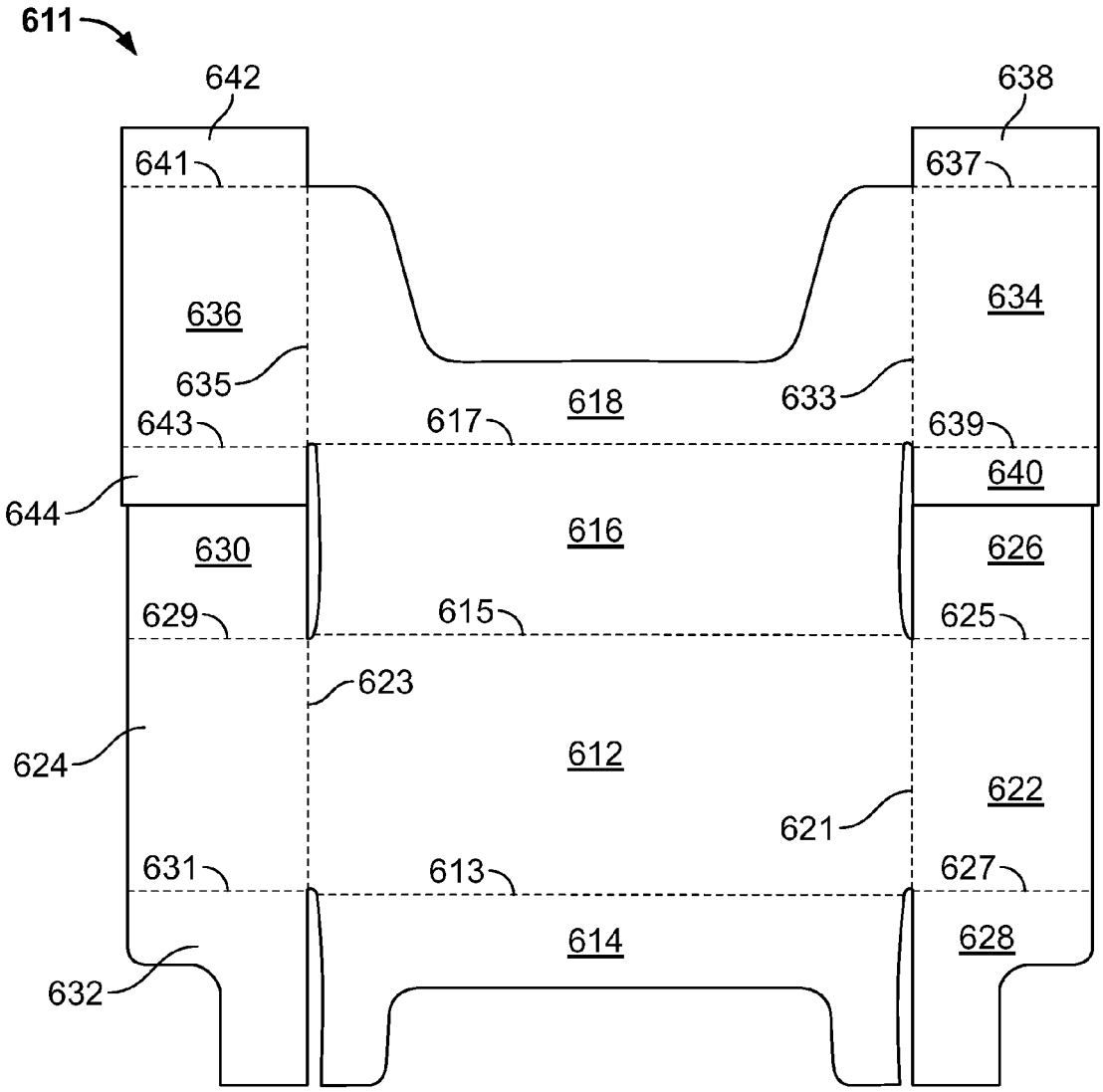
FIG. 20 is a plan view of a blank for a container according to another embodiment.
Figure 21A:
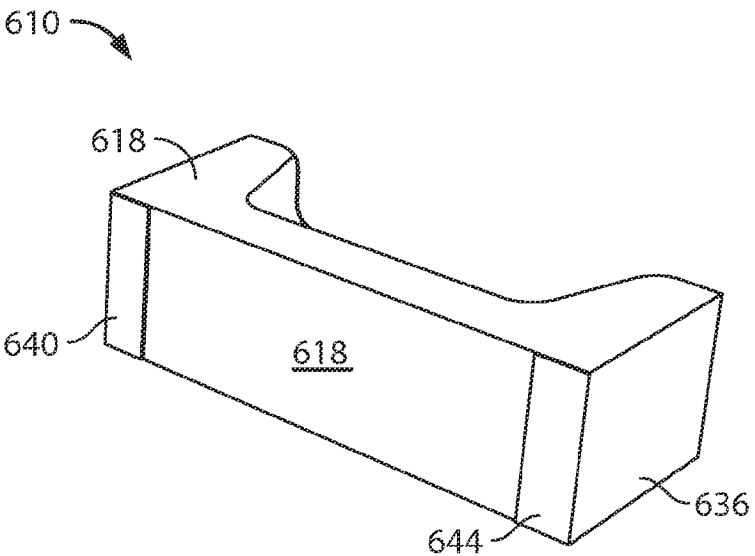
FIG. 21A is a rear perspective view of the container formed from the blank of FIG. 20.
Figure 21B:
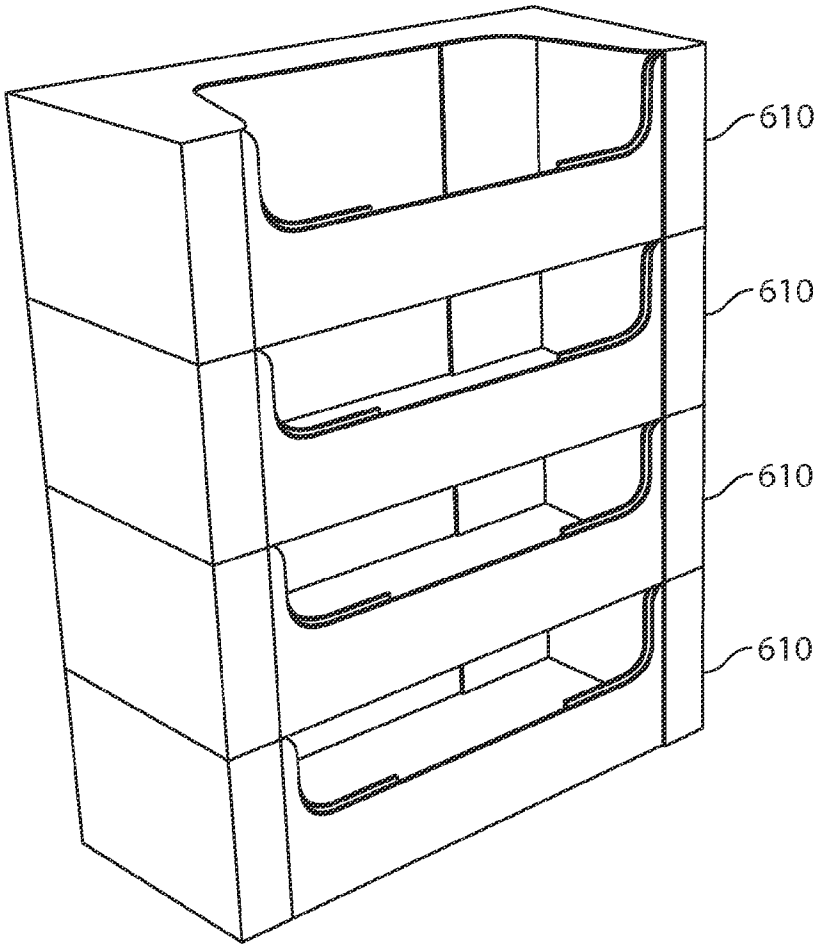
FIG. 21B is a front perspective view of a plurality of stacked containers according to FIGS. 20 and 21A.
Figure 22:
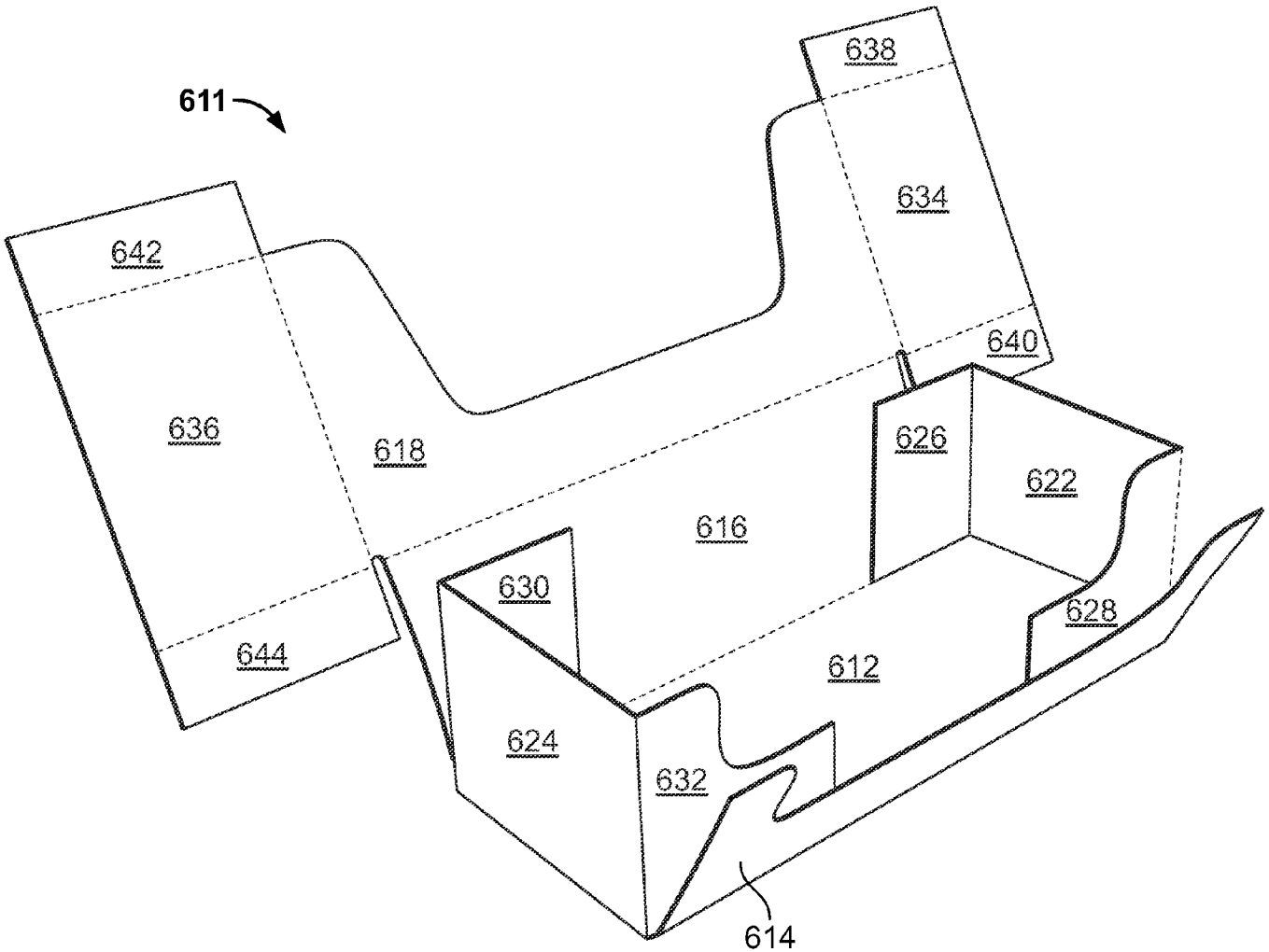
FIG. 22 is a perspective view of a container according to the embodiment of FIGS. 20, 21A-B, shown partially articulated.
Figure 23:
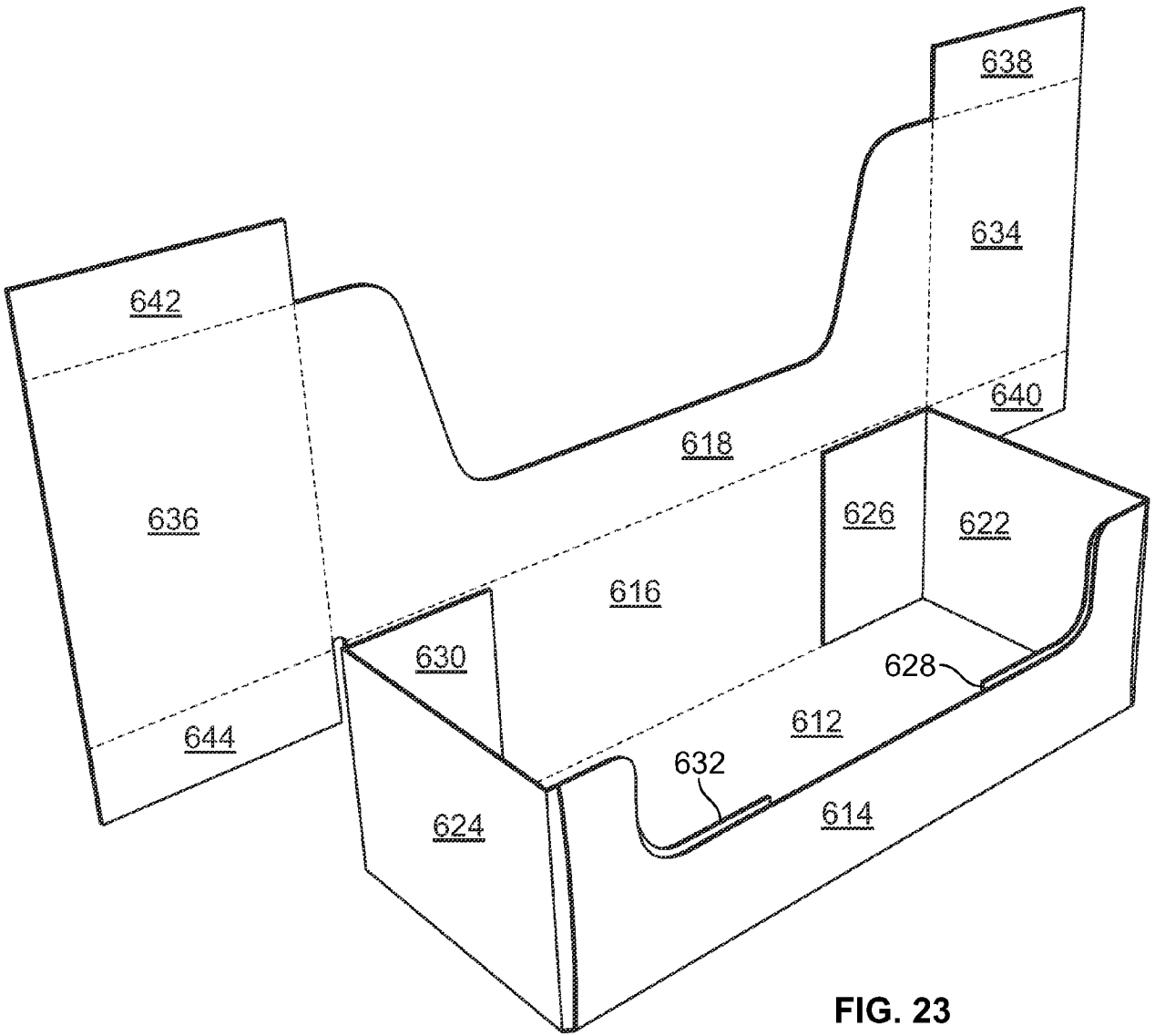
FIG. 23 is a perspective view of a container according to the embodiment of FIG. 22, shown further along the process of articulation.
Figure 24:
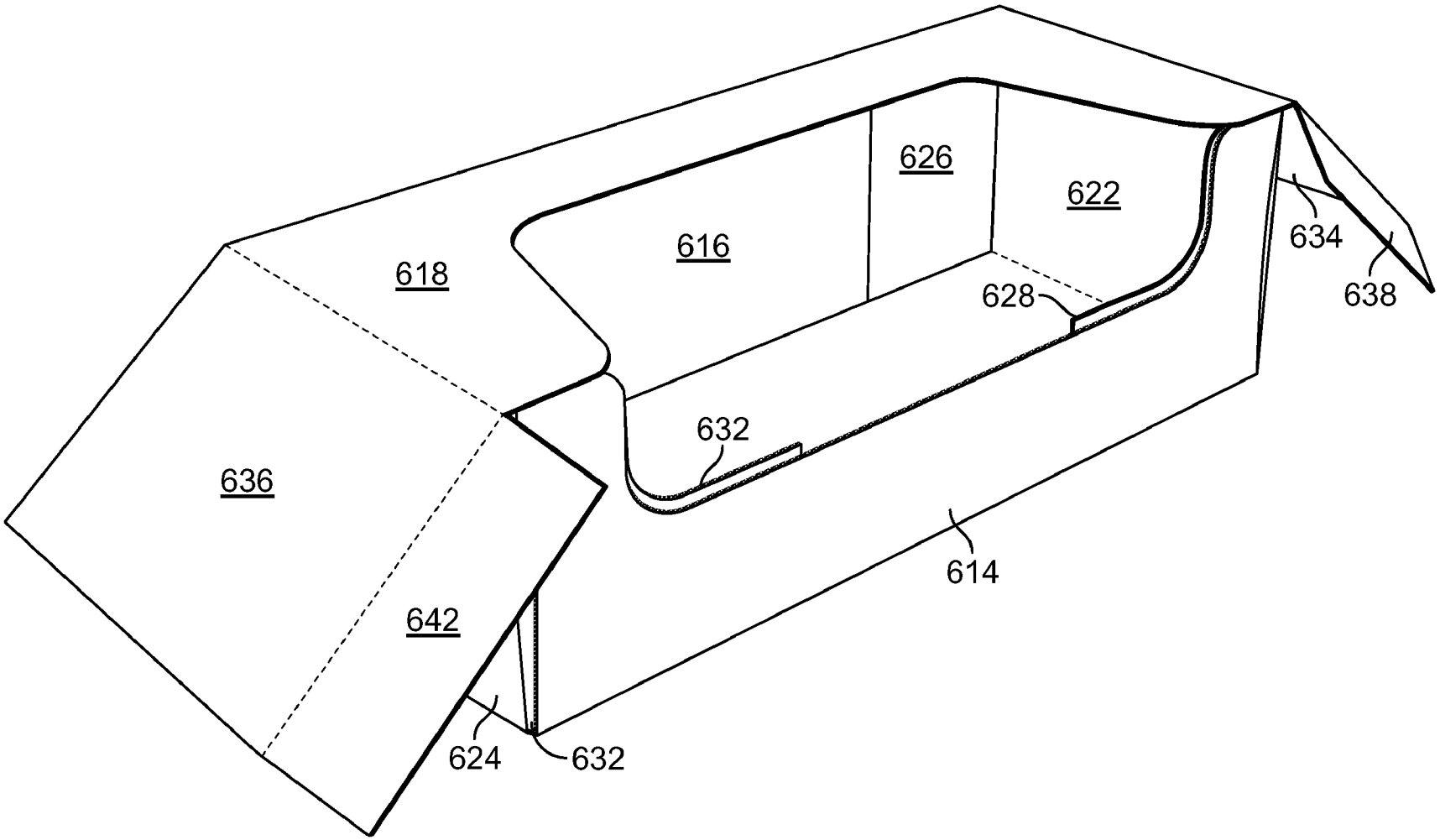
FIG. 24 is a perspective view of the container of FIG. 23, shown further articulated toward closure.

Container 610 is formed from blank 611 (FIG. 20). Blank 611 includes bottom panel 612, front (side) panel 614, rear (side) panel 616, and top panel 618; as well as fold lines 613, 615, and 617. Blank 611 also includes inner end panels 622, 624 (emanating along fold lines 621, 623, respectively) from which interior minor flaps 626, 628, 630, 632 emanate along fold lines 625, 627, 629 and 631, respectively. Outer end panels 634, 636 emanate from top panel 618 along fold lines 633, 635, respectively. Reinforcing flanges 638, 640, 642, 644 emanate from outer end panels 634, 636, along fold lines 637, 639, 641 and 643, respectively. The end edges of rear panel 616 may be concavely bowed (as illustrated), notched, inclined or vertical, while the end edges of front panel 614 may be vertical (as illustrated), inwardly inclined from bottom to top, or concave, because this style of slot configuration may permit ease of removing and ease of stripping the waste material from the designated and created aperture in the blank sheet. As an alternative, rather than the described designated slot, a singular cut including offsets as required may be implemented thereby eliminating a need to remove waste material.

In a typical articulation procedure, first, the product to be contained will be pushed onto blank 611, which will be laid flat on a packaging apparatus. Interior minor flaps 630, 632 will be folded perpendicular to end panel 624, and interior minor flaps 626, 628 will be folded perpendicular to end panel 622. End panels 622, 624 will be folded upwardly perpendicularly to bottom panel 612. Rear (side) panel 616 and front (side) panel 614 will then be folded upwardly perpendicular to bottom panel 612 and be adhesively affixed to exterior surfaces of interior minor flaps 626, 628, 630 and 632. Top panel 618 is then folded down, toward and parallel to bottom panel 612; and outer end panels 634, 636 are folded over and adhesively affixed to exterior surfaces of inner end panels 622, 624, respectively. Finally, reinforcing flanges (minor flaps) 638, 640, 642 and 644 are folded along folds 637, 639, 641 and 643 perpendicular to outer end panels 634, 636, and adhesively adhered to the outer surfaces of front and rear (side) panels 614, 616.

In a ninth variation (FIGS. 25 and 26A-C), the container is provided with gusseted corner panel structures, instead of "minor flaps emanating from the inner end panel side edges, to create a so-called "slotless" container.

Figure 25:
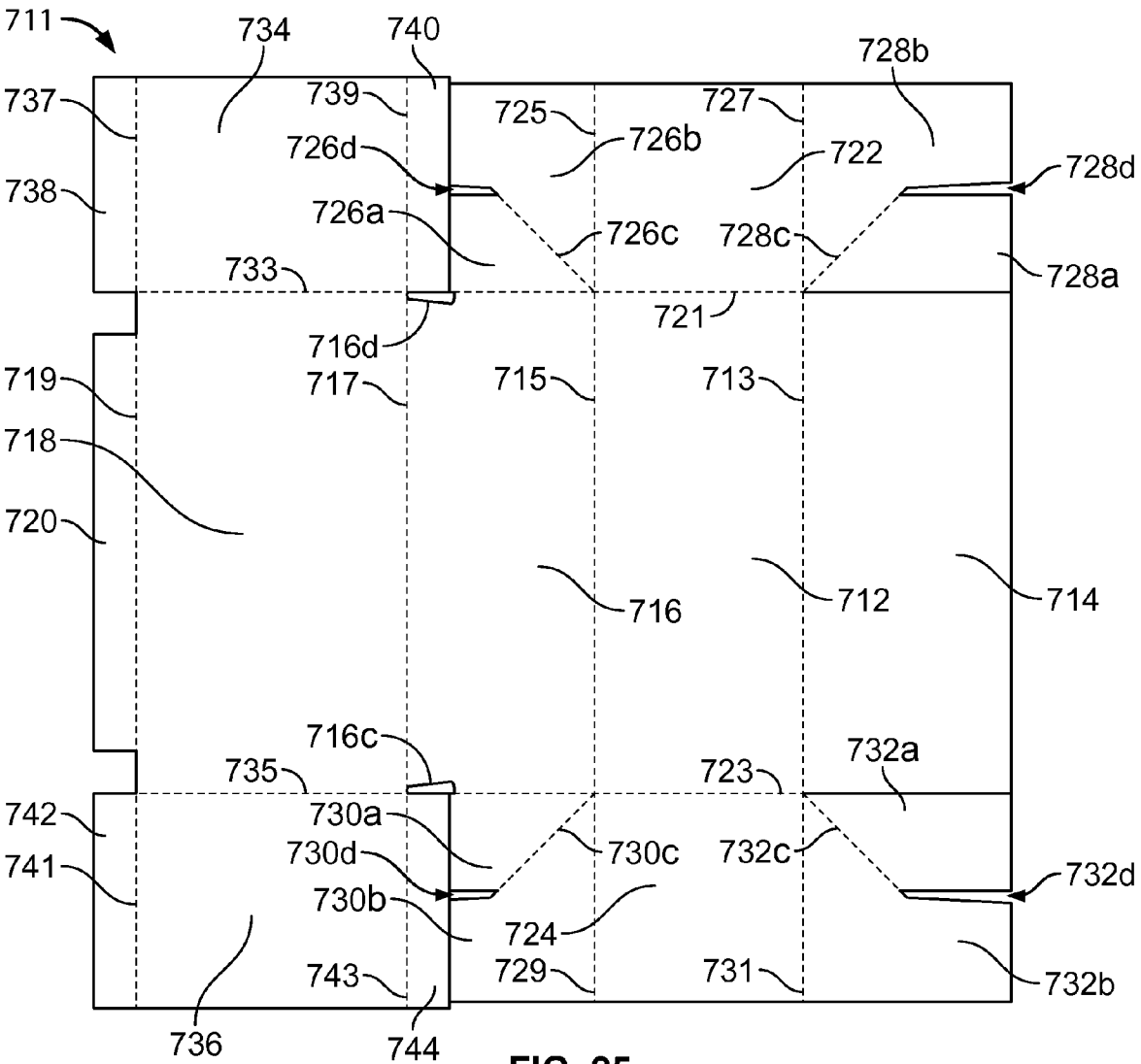
FIG. 25 is a plan view of a blank for a container according to another embodiment, in which the container has "slotless" gusseted corners.

Container 710 is formed from blank 711 (FIG. 25). Blank 711 includes bottom panel 712, front (side) panel 714, rear (side) panel 716, top panel 718 and closure flap 720; as well as fold lines 713, 715, 717 and 719. Blank 711 also includes inner end panels 722, 724 (emanating along fold lines 721, 723, respectively) from which interior minor flaps 726, 728, 730, 732 emanate along fold lines 725, 727, 729 and 731, respectively. Outer end panels 734, 736 emanate from top panel 718 along fold lines 733, 735, respectively. Reinforcing flanges 738, 740, 742, 744 emanate from outer end panels 734, 736, along fold lines 737, 739, 741 and 743, respectively. In addition, blank 711 includes gusset panels 726*a*, 726*b*, 730*a*, 730*b*, 728*a*, 728*b*, 732*a* and 732*b*; gusset fold lines 726*c*, 730*c*, 728*c* and 732*c*; and gusset notches 726*d*, 730*d*, 728*d* and 732*d*. Blank 711 also includes clearance diecuts 716*c*, 716*d*.

Figure 26A:
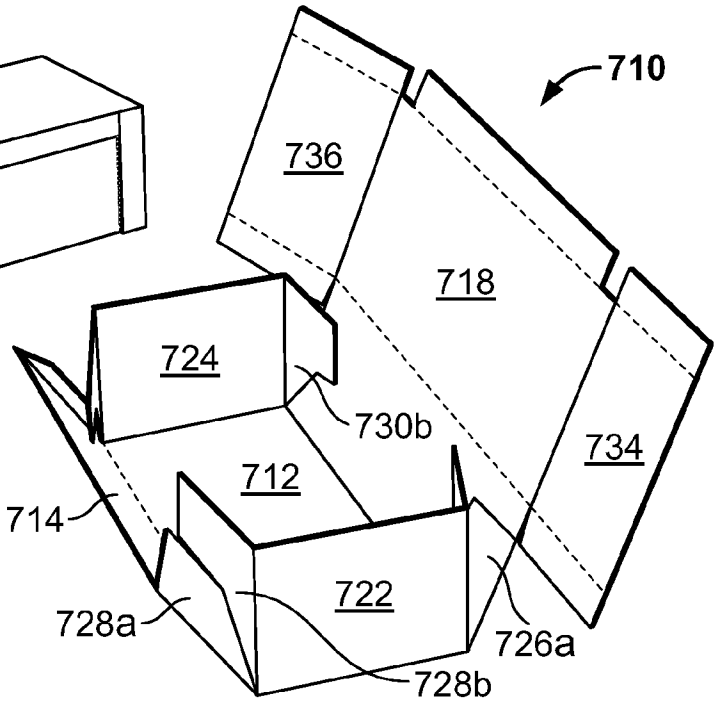
FIG. 26A is a perspective view of a container according to the blank of FIG. 25, shown partially articulated.

In a typical articulation procedure, first, the product to be contained will be pushed onto blank 711, which will be laid flat on a packaging apparatus. Interior end panels 722, 724 will be folded upwardly perpendicularly to bottom panel 712, while rear (side) panel 716 and front (side) panel 714 are drawn by the corner gusset structures to be folded upwardly perpendicular to bottom panel 712, as shown in FIGS. 26A-

26C. At each corner, the respective gusset panel pairs are folded inwardly, so that panels 730*b*, 726*b* are brought parallel to the inside surface of panel 716, capturing and adhesively affixing panels 730*a*, 726*b* between them, respectively; and panels 728*b*, 732*b* are brought parallel to the inside surface of panel 714, capturing and adhesively affixing panels 728*a*, 732*a* between them, respectively.

Figure 26C:
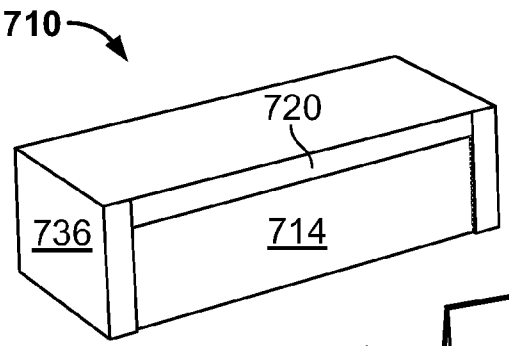
FIG. 26C is a perspective view of the container of FIGS. 26A and 26B, shown fully articulated.
Figure 26B:
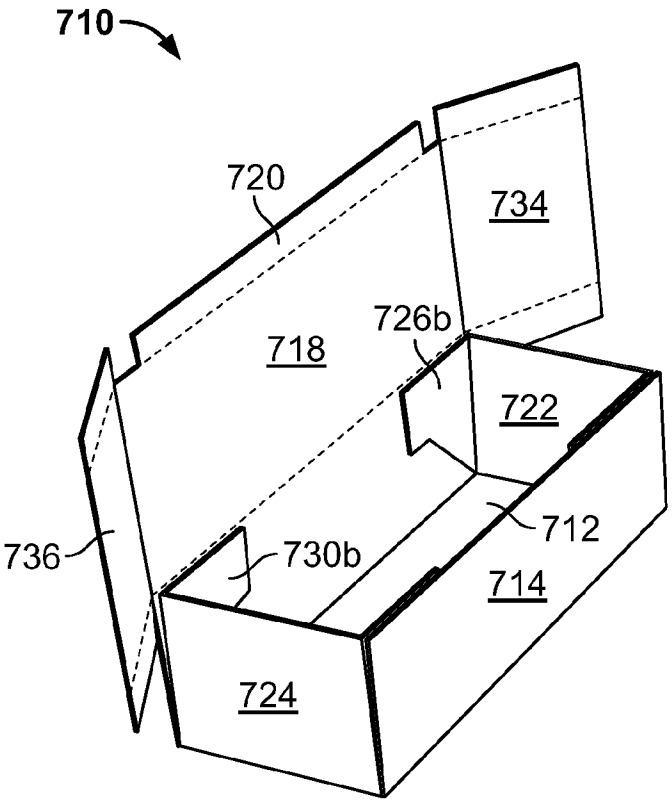
FIG. 26B is a perspective view of the container of FIG. 26A, shown further along the articulation process.

Top panel 718 is then folded down, toward and parallel to bottom panel 712; and outer end panels 734, 736 are folded over inner end panels 722, 724, respectively. Finally, reinforcing flanges (minor flaps) 738, 740, 742 and 744 are folded along fold lines 737, 739, 741 and 743, respectively, perpendicular to outer end panels 734, 736, and adhesively adhered to the outer surfaces of front and rear (side) panels 714, 716. When top panel 718 is folded down, closure flap 720 is preferably folded to the outside of front panel 714, and adhesively affixed to the outer surface thereof (FIG. 26C). The resultant container 710 is thus a "slotless" container, suitable for the prevention of leakage of liquids (if suitably coated on the inside surfaces thereof), and otherwise suitable for the prevention of leakage of granular or particulate dry materials.

In a tenth variation (FIGS. 27 and 28A-C), a container similar to that of the embodiment of FIGS. 1-9 is provided with a second closure flap, so that the two closure flaps from the top and front panels overlap to form a reinforced "bar" across the front of the container, at what would otherwise be the weakest corner region, depending upon the proportions, of the sealed container.

Figure 27:
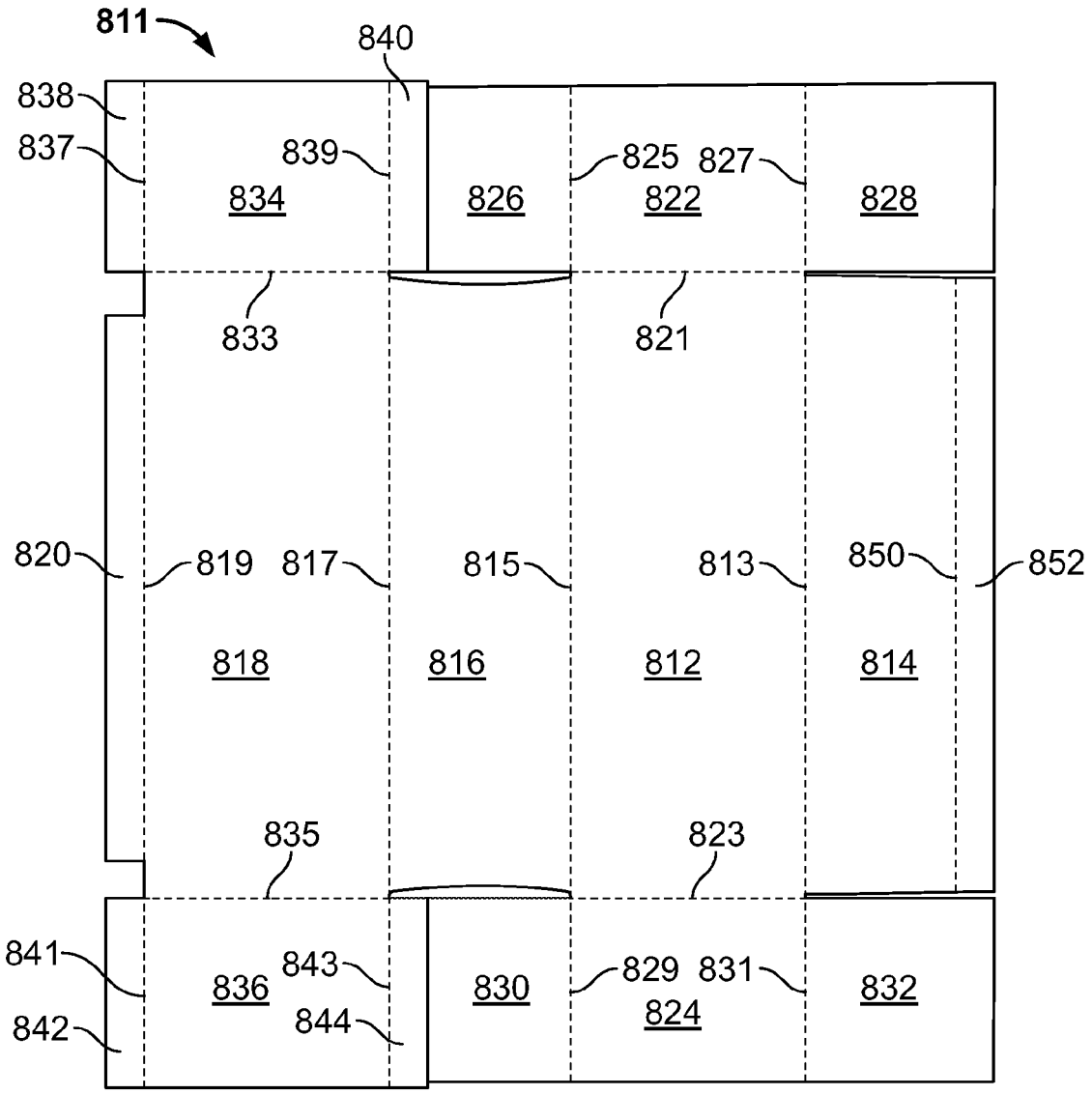
FIG. 27 is a plan view of a blank for a container according to another embodiment, in which the container as a reinforced transverse closure seal.

Container 810 is formed from blank 811 (FIG. 27). Blank 811 includes bottom panel 812, front (side) panel 814, rear (side) panel 816, top panel 818 and top closure flap 820 and front closure flap 852; as well as fold lines 813, 815, 817, 819 and 850. Blank 811 also includes inner end panels 822, 824 (emanating along fold lines 821, 823, respectively) from which interior minor flaps 826, 828, 830, 832 emanate along fold lines 825, 827, 829 and 831, respectively. Outer end panels 834, 836 emanate from top panel 818 along fold lines 833, 835, respectively. Reinforcing flanges 838, 840, 842, 844 emanate from outer end panels 834, 836, along fold lines 837, 839, 841 and 843, respectively. The end edges of panels 814 and 816 may be vertical. Alternatively, the end edges of the rear panel 816 and front panel 814 preferably may be concavely bowed or notched (as illustrated) or inwardly inclined from bottom to top because this style of slot configuration may permit ease of removing and ease of stripping the waste material from the designated and created aperture in the blank sheet. As an alternative, rather than the described designated slot, a singular cut including offsets as required may be implemented thereby eliminating a need to remove waste material.

In a typical articulation procedure, first, the product to be contained will be pushed onto blank 811, which will be laid flat on a packaging apparatus. Flaps 830, 832 will be folded perpendicular to panel 824, and flaps 826, 828 will be folded perpendicular to panel 822. Panels 822, 824 will be folded upwardly perpendicularly to bottom panel 812. Rear (side) panel 816 and front (side) panel 814 will then be folded upwardly perpendicular to bottom panel 812, as shown in FIGS. 28A-28C. Top panel 818 is then folded down, toward and parallel to bottom panel 812; and outer end panels 834, 836 are folded over inner end panels 822, 824, respectively. Finally, reinforcing flanges (minor flaps) 838, 840, 842 and 844 are folded along fold lines 837, 839, 841 and 843 perpendicular to outer end panels 834, 836, and adhesively adhere to the outer surfaces of front and rear (side) panels 814, 816. When top panel 818 is folded down, closure flap 820 is preferably folded to the outside of front panel 814, and adhesively affixed to the outer surface thereof, while front closure panel 852 is folded inwardly, and affixed to the underside surface of top panel 818, both as shown in FIG. 28C.

The cartons of FIGS. 29-78 are preferably fabricated from paper, paperboard and/or corrugated paperboard, although other materials having similar performance characteristics may be employed, as desired or dictated by the requirements of a particular application.

When referring to the plan illustrations of the blanks, the usual drawing conventions for illustration of carton blanks fabricated from paper, paperboard and/or corrugated paperboard, as are customarily employed in the art, are applied. That is, unless otherwise noted, broken lines indicate scores, fold lines or other lines of weakness such as perforations; scalloped lines indicate lines of weakness forming a tear strip or similar structure; and solid lines within the interior of, or extending to the edge of, a blank, indicate through-cuts.

Figure 29:
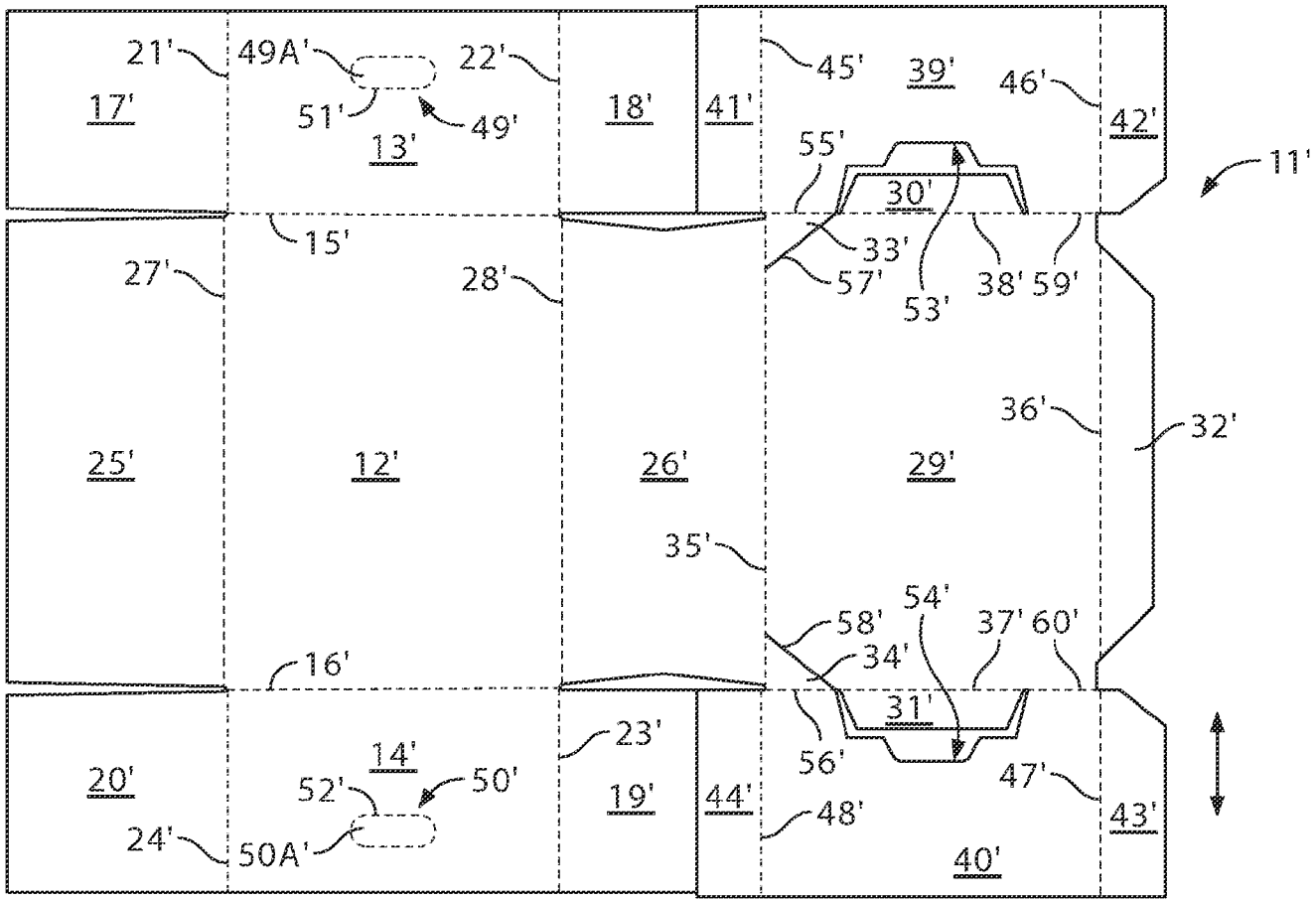
FIG. 29 is a plan view of a blank of a carton with integrated lid according to a preferred embodiment.
Figure 30:
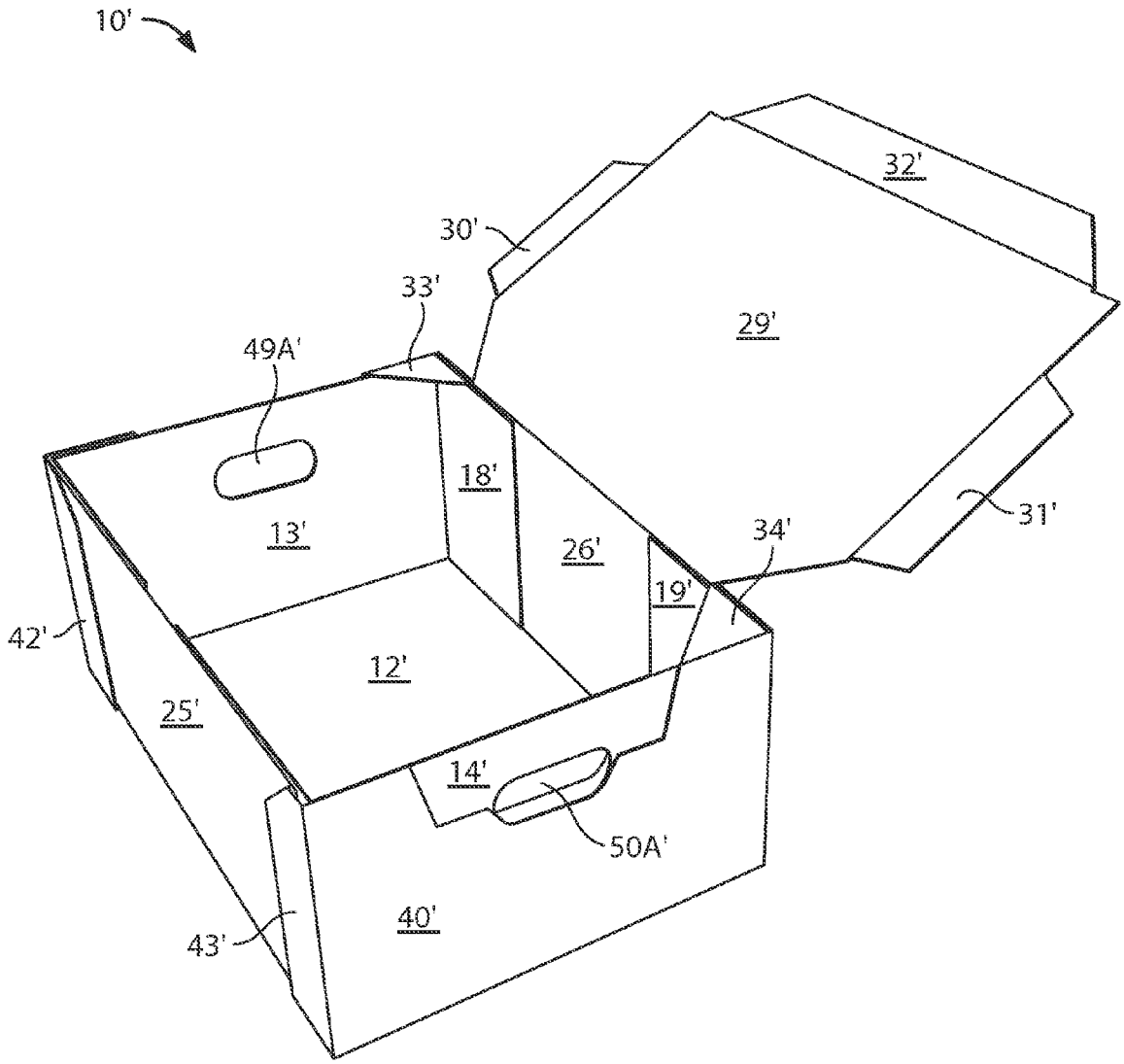
FIG. 30 is a simplified perspective view of a carton with integrated lid according to the embodiment of FIG. 29, shown in its erected configuration, with the top open prior to loading and sealing.

A first embodiment is illustrated in FIGS. 29 and 30, which features a single top panel. Carton 10' (FIG. 30) is formed from blank 11', which is preferably fabricated from corrugated paperboard, although similarly performing alternative materials may be employed. If corrugated paperboard is employed, the preferred direction of the flutes is indicated by the double-headed arrow in FIG. 29. Blank 11' includes bottom panel 12'; side panels 13', 14'; fold lines 15', 16'; minor flaps 17'-20'; fold lines 21'-24'; (front) end panel 25'; (rear) end panel 26'; fold lines 27', 28'; top panel 29'; top side closure flaps 30', 31'; top front closure flap 32'; top corner panels 33', 34'; fold lines 35'-38'; first overlap panels 39', 40'; second overlap panels 41'-44'; and fold lines 45'-48'.

Inner side panels 13', 14' include hand-holes 49', 50', which are preferably formed by oval perforations 51', 52', to enable the centers 49A, 50A to be pushed out, as desired. Outer side panels 39', 40' include upper edge cutouts 53', 54'. In this embodiment, front panel 25' Is slightly trapezoidal (although it could be rectangular in alternative embodiments). Rear panel 26' has an hourglass shape, though it too, could be rectangular in alternative embodiments. Blank 11' also includes fold lines 55', 56' and perforations 57', 58', 59', 60'.

In order to erect carton 10', side panels 13' and 14' have been folded up perpendicular to bottom panel 12'. Minor flaps 17'-20' have been folded perpendicular to side panels 13', 14' and may be, if desired, adhered to the inside surfaces of (front) end panel 25' and (rear) end panel 26'. First overlap panels 39', 40' have been positioned to the outside of and adhered to side panels 13', 14'. First overlap panels 41'-44' have been folded perpendicular to first overlap panels 39', 40' and adhered to the outwardly facing surfaces of (front) end panel 25' and (rear) end panel 26'.

Because of perforations 57', 58', 59', 60' are maintained intact when the overlap panels are positioned and glued, top panel 29' is initially positioned over the carton opening, parallel to bottom panel 12', but top side closure flaps 30', 31' and top front closure flap 32' are not glued. To place product in carton 10' (if blank 11' was not, in fact formed around a load of product), a worker (or machine) pulls up on top panel 29', breaking perforations 57', 58'.

After product has been placed in carton 10', which placement may occur early in the carton erecting process while the carton is wrapped around the load in the usual manner of wrapper type container blanks, top panel 29' is then folded over parallel to bottom panel 12' and then top side closure flaps 30', 31' are folded down and adhered to outwardly facing surfaces of inner side panels 13', 14' and top front closure flap 32' is folded down perpendicular to top panel 29' and adhered to an outwardly facing surface of (front) end panel 25'.

Figure 75:
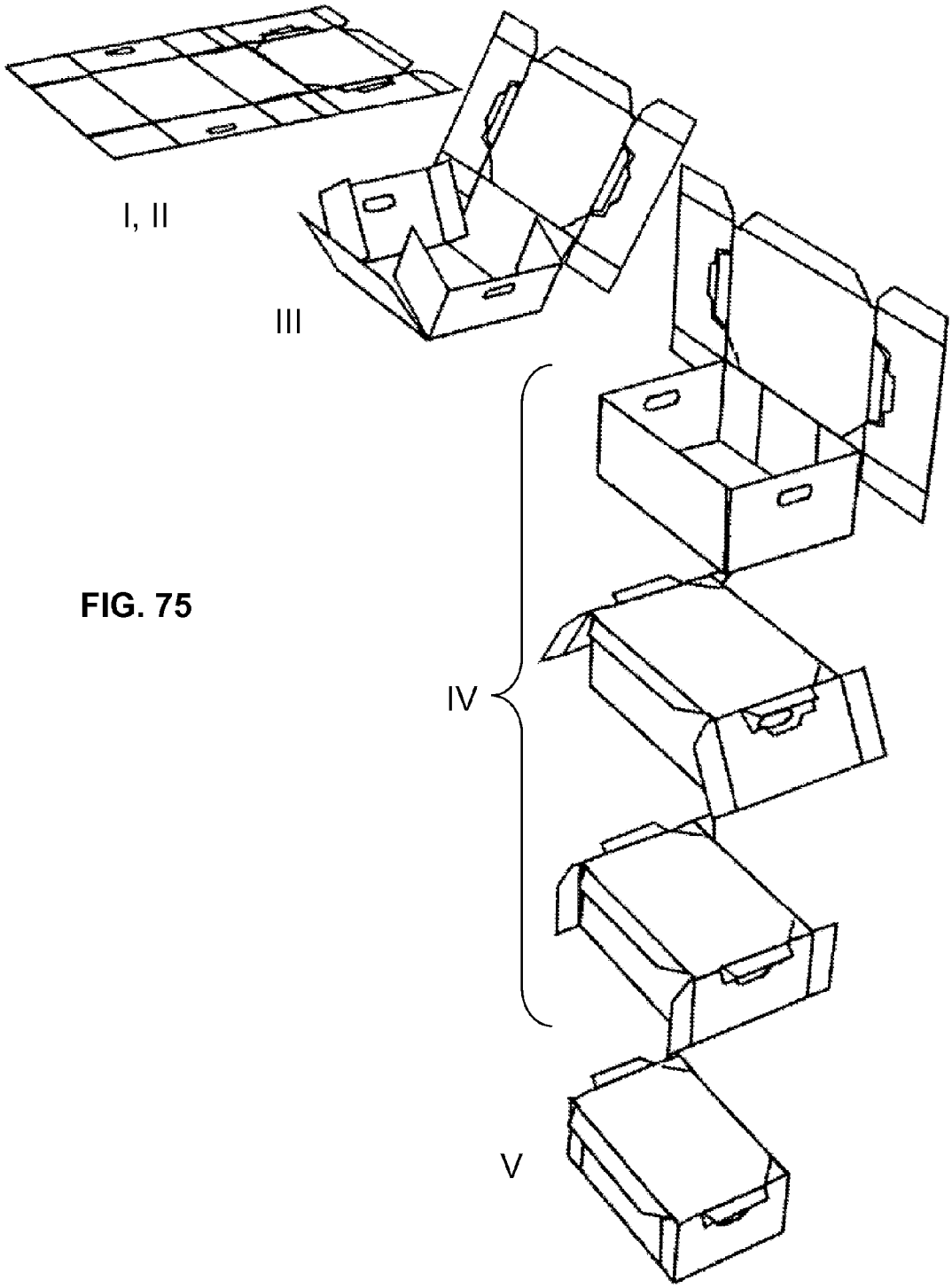
FIG. 75 illustrates the first several steps in a method for forming a package, using the carton blank from FIGS. 29-30.
Figure 76:
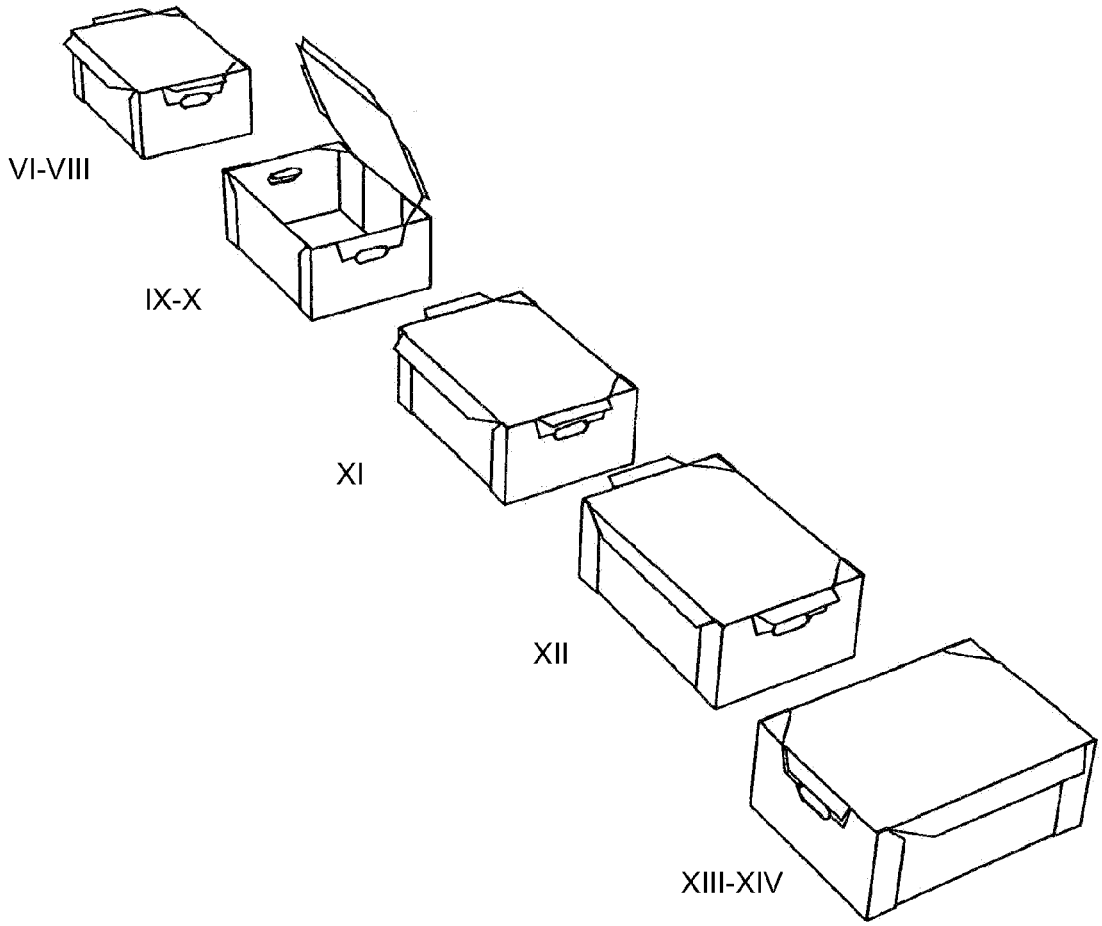
FIG. 76 illustrates the remaining steps in a method for forming a package, using the carton blank from FIGS. 29-30

FIGS. 75-76 illustrate the steps in a method for setting up a carton, such as may be fabricated from the blank of FIGS. 29-30. These methods may be performed using suitably modified carton forming machinery such as are known in the art, and such modifications may be readily accomplished by one of ordinary skill in the art, having the present disclosure before them. The steps are as follows:

I. A flat blank is indexed into a forming station from the top of a stack of blanks.

II. The blank is then indexed laterally as adhesive is applied to the inside surfaces of the blank, such as on panels 25', 26', 39', 40', 41', 42', 43', 44'.

III. A mandrel then pushes the blank down through a forming chamber in the forming station into a compression station.

IV. At a secondary forming station, the top and side panels are folded while the overlap panels are articulated and glued.

V. As a new carton is received in the forming chamber, the just-formed carton is discharged from the compression section onto a powered take-away conveyor.

VI. Formed cartons are pushed down a chute from a case-erecting room located on an upper floor to a production floor of a production facility.

VII. Cartons are moved laterally, e.g., at shoulder height, on a powered belt conveyor, past manual packing stations.

VIII. A worker selects an empty carton from the belt conveyor, and positions the carton at the worker's pack station, e.g., at waist or thigh height.

IX. The top front closure flap is pulled up to open the carton for packing.

X. Product, such as Cryovac™ wrapped meat cuts are packed into the open carton.

XI. The filled carton is pushed forward onto a take-away conveyor to a sealing device, such as an Elliott Top & Side Sealer, a Pearson side flange sealer or a Smurfit-Stone Container Corporation side flange sealer.

XII. The top panel is plowed down and the top front closure flap is sealed with hot melt adhesive.

XIII. The carton is then rotated 90° and the top side closure flaps are sealed with hot melt adhesive.

XIV. Sealed cartons are then transported, e.g., by roller conveyor to a manual palletizing area. Pallet Loads are built, transferred by lift trucks to temporary storage, and then shipped to customers as required.

FIGS. 21-32 illustrate an embodiment which features a two panel top. Carton 100' is formed from a blank 101', which is preferably symmetrical about longitudinal axis L and transverse axis T. Again, for a corrugated paperboard blank, the preferred direction of the flutes is indicated by the double arrow in FIG. 31. Blank 101' includes bottom panel 102'; side panels 103', 104'; fold lines 105', 106', which are interrupted by cutouts 107', 108' and 109', 110', respectively; end panel 111'; fold line 112' interrupted by cutouts 113', 114'; end panel 115'; fold line 116' interrupted by cutouts 117', 118'; gusset panels 119'-122'; minor flaps 123'-126'; fold lines 127'-134'; first top panels 135', 136'; second top panels 137', 137A; top corner panels 138'-141'; fold line 142', interrupted by vent hole 143' and die-cut tabs 144', 145'; fold line 146', interrupted by vent hole 147' and die-cut tabs 148', 149'; fold lines 150', 151'; first overlap panels 152'-155', second overlap panels 156'-159'; fold lines 160'-167'. Blank 102' also includes slots 168'-171', which are configured to receive or fit over hooked tabs 172'-175', as shown in FIG. 28. Side panels 103', 104' also may include hand holes 176', 177'. Separation lines 180'-183', between top corner panels 138'-141' and first top panels 135', 136' may be perforations or through-cuts. If perforations, upon gluing and folding down of first overlap panels 152'-155' and second overlap panels 156'-159', first top panels 135', 136' will be in a "closed" position, and will have to be pulled up (in the manner described relative to the embodiment of FIGS. 29-30) to permit loading of the carton, if carton 100' were not already formed around a load.

In forming carton 100', side panels 103' and 104' have been folded perpendicular to bottom panel 102' as have end panel 111' and end panel 115'. Minor flaps 124' and 125' have been adhered to the inside surface of end panel 115' while minor flaps 123' and 126' have been adhered to an inner surface of end panel 111' so that gusset panels 119'-122' extend diagonally across the corners of the interior of the carton, acting as stacking support structures. (See gusset panel 120' in FIG. 32). In an embodiment in which this carton 100' is wrapped around a load, after the load has been placed and the front rear and side panels have been folded up, the first and second top panels 135'-137A may be folded over. In particular, corner panels 138'-141' are folded over to positions parallel to bottom wall 102'. Then first overlap panels 152'-155' are folded down to positions parallel to and the outside surfaces of side panels 103', 104'. Second overlap panels 156'-159' are then folded perpendicular to first overlap panels 152'-155' and adhered to outwardly facing surfaces of end panel 111' and end panel 115'. Carton 100' is a self-locking carton, in that stacking tabs 172'-175' are provided with notches which engage end edge regions of slots 168'-171' of second top panels 137' and 137A.

Figure 32:
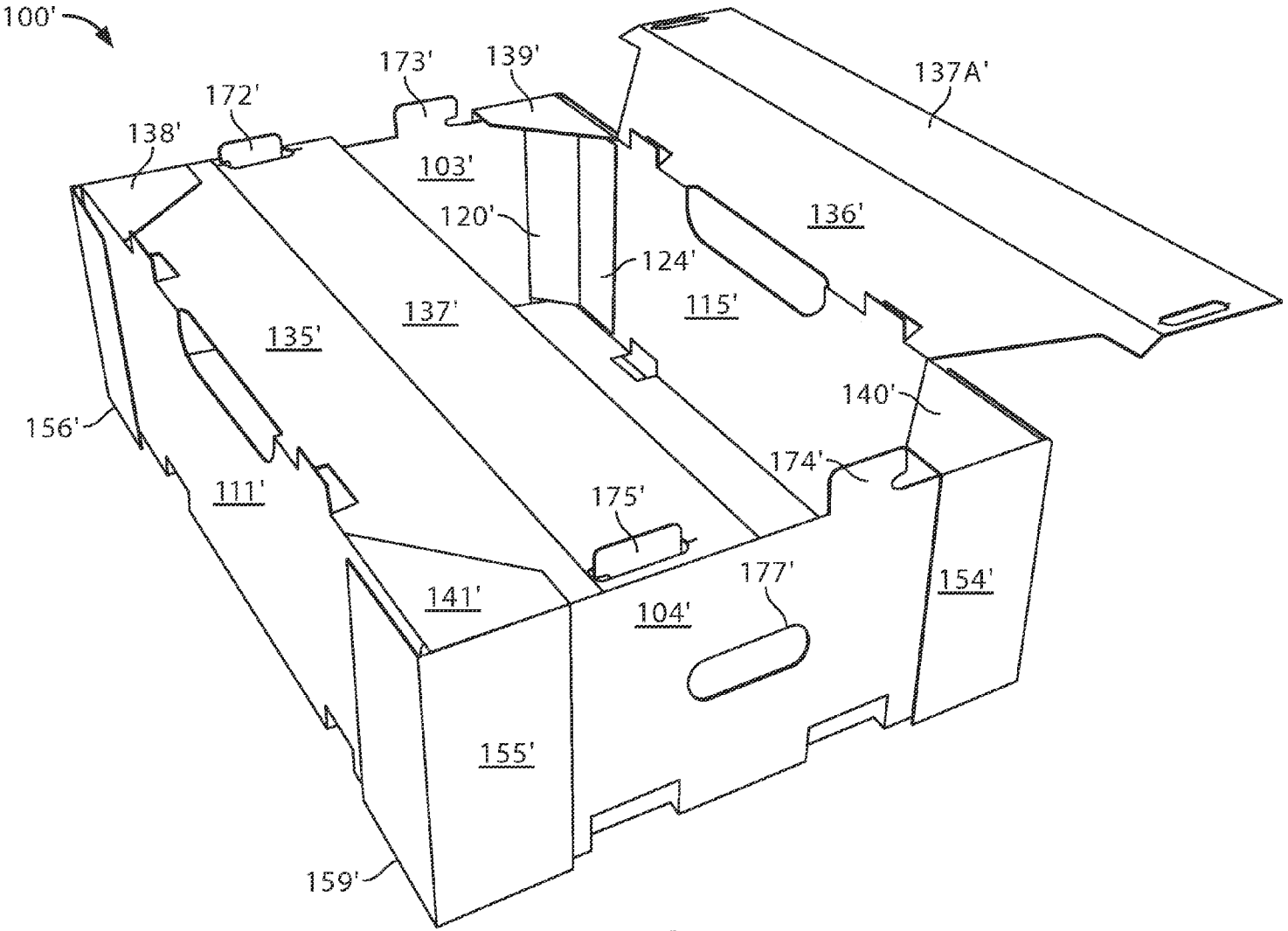
FIG. 32 is a simplified perspective view of a carton with integrated lid according to the embodiment of FIG. 31, shown in its erected configuration, with the top open prior to loading and sealing.
Figure 33:
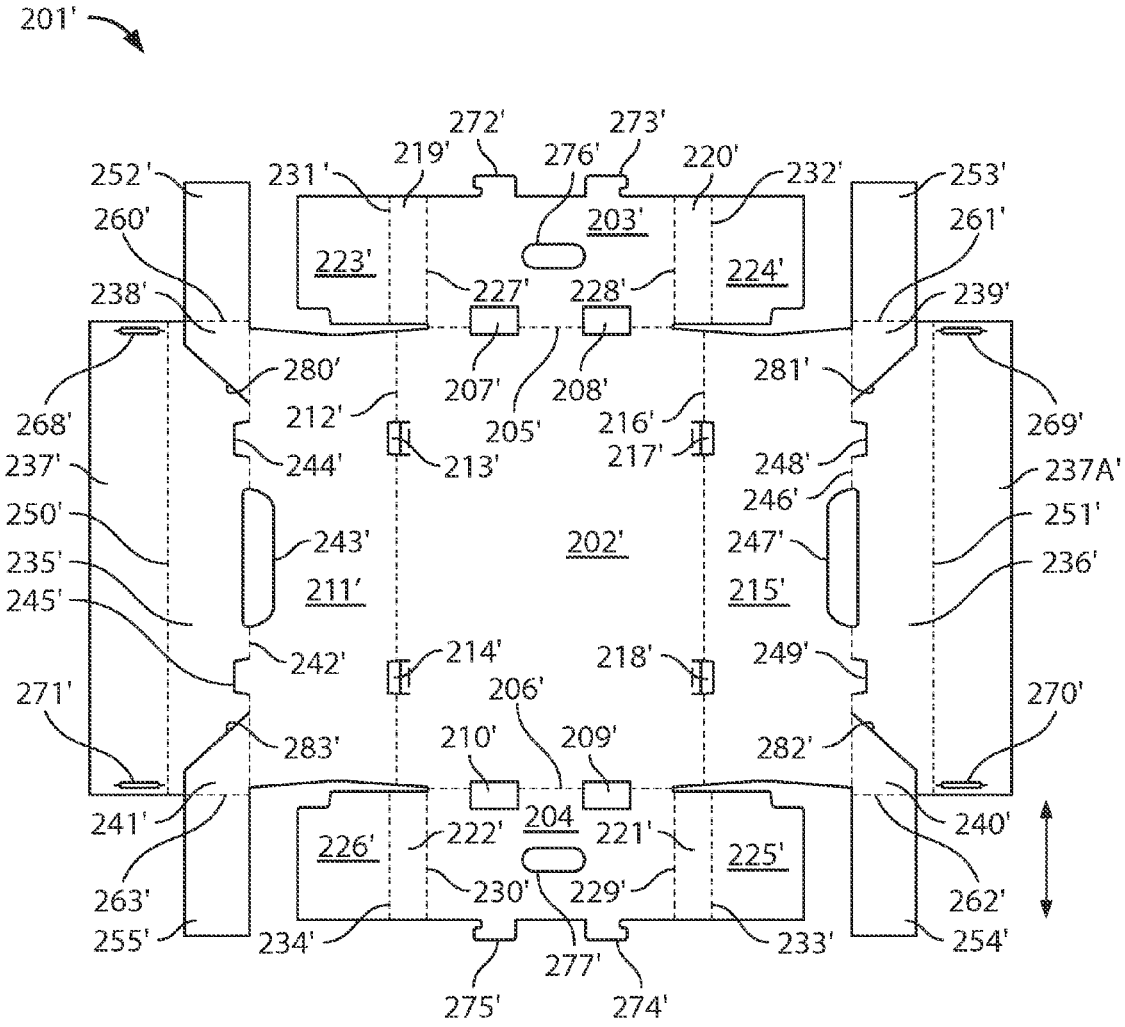
FIG. 33 is a plan view of a blank of a carton with integrated lid according to another preferred embodiment.
Figure 34:
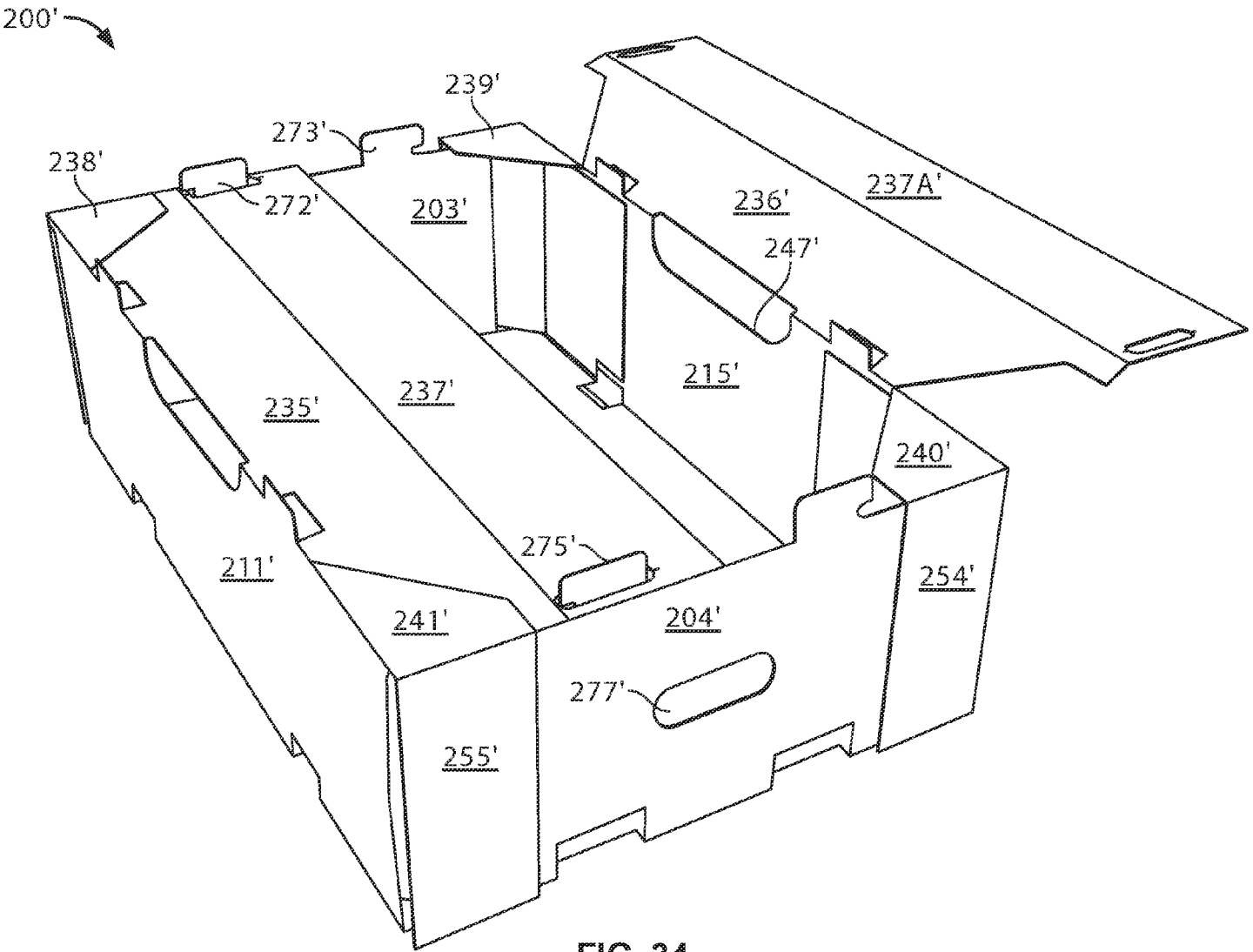
FIG. 34 is a simplified perspective view of a carton with integrated lid according to the embodiment of FIG. 33, shown in its erected configuration, with the top open prior to loading and sealing.

FIGS. 33-34 illustrate an embodiment which features a two panel top. Carton 200' is formed from a blank 201', which is preferably bilaterally symmetrical, in the manner of the embodiment of FIGS. 31 and 32. Again, for a corrugated paperboard blank, the preferred direction of the flutes is indicated by the double arrow in FIG. 36. Blank 201' includes bottom panel 202'; side panels 203', 204'; fold lines 205', 206', which are interrupted by cutouts 207', 208' and 209', 210', respectively; end panel 211'; fold line 212' interrupted by cutouts 213', 214'; end panel 215'; fold line 216' interrupted by cutouts 217', 218'; gusset panels 219'-222'; minor flaps 223'-226'; fold lines 227'-234'; first top panels 235', 236'; second top panels 237', 237A; top corner panels 238'-241'; fold line 242', interrupted by vent hole 243' and die-cut tabs 244', 245'; fold line 246', interrupted by vent hole 247' and die-cut tabs 248', 249'; fold lines 250', 251'; overlap panels 252'-255'; fold lines 260'-263'. Blank 202' also includes slots 268'-271', which are configured to receive or fit over hooked tabs 272'-275', as shown in FIG. 37. Side panels 203', 204' also may include hand holes 276', 277', and separation lines 280'-283', which as in the embodiment of FIGS. 33-32, may be perforations or through-cuts, with the corresponding modes of operation as discussed in that embodiment.

Figure 31:
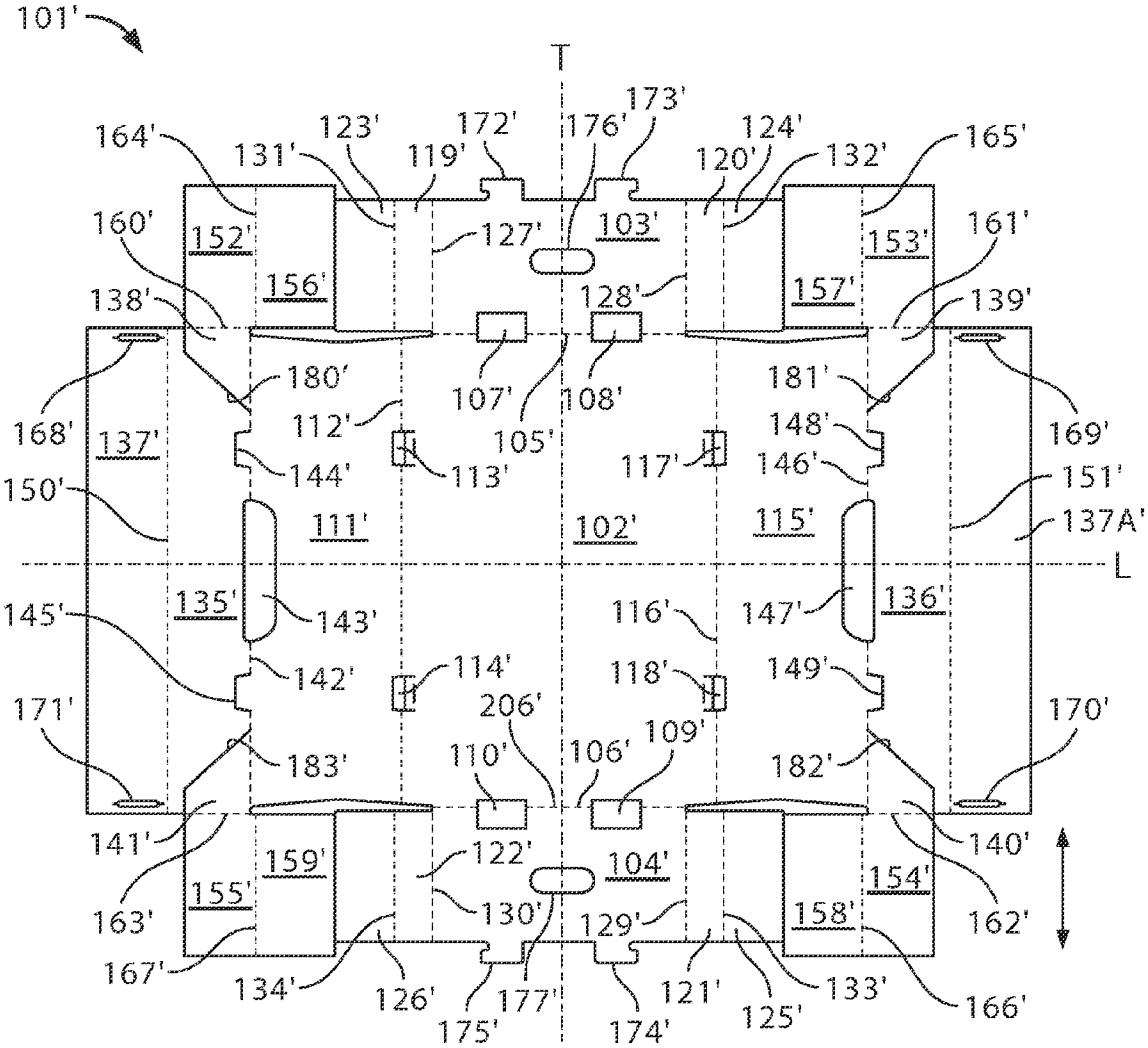
FIG. 31 is a plan view of a blank of a carton with integrated lid according to another preferred embodiment.

Carton 200' of FIGS. 33-34 is erected and affixed to itself in substantially the same manner as the carton of FIGS. 31-32, except that since there are only overlap panels 252'-255', they must be adhered to outer facing surfaces of side panels 203', 204', to be held in place there. The closure of the top panels is accomplished in the same manner as in the embodiment of FIGS. 31-32.

Figure 35:
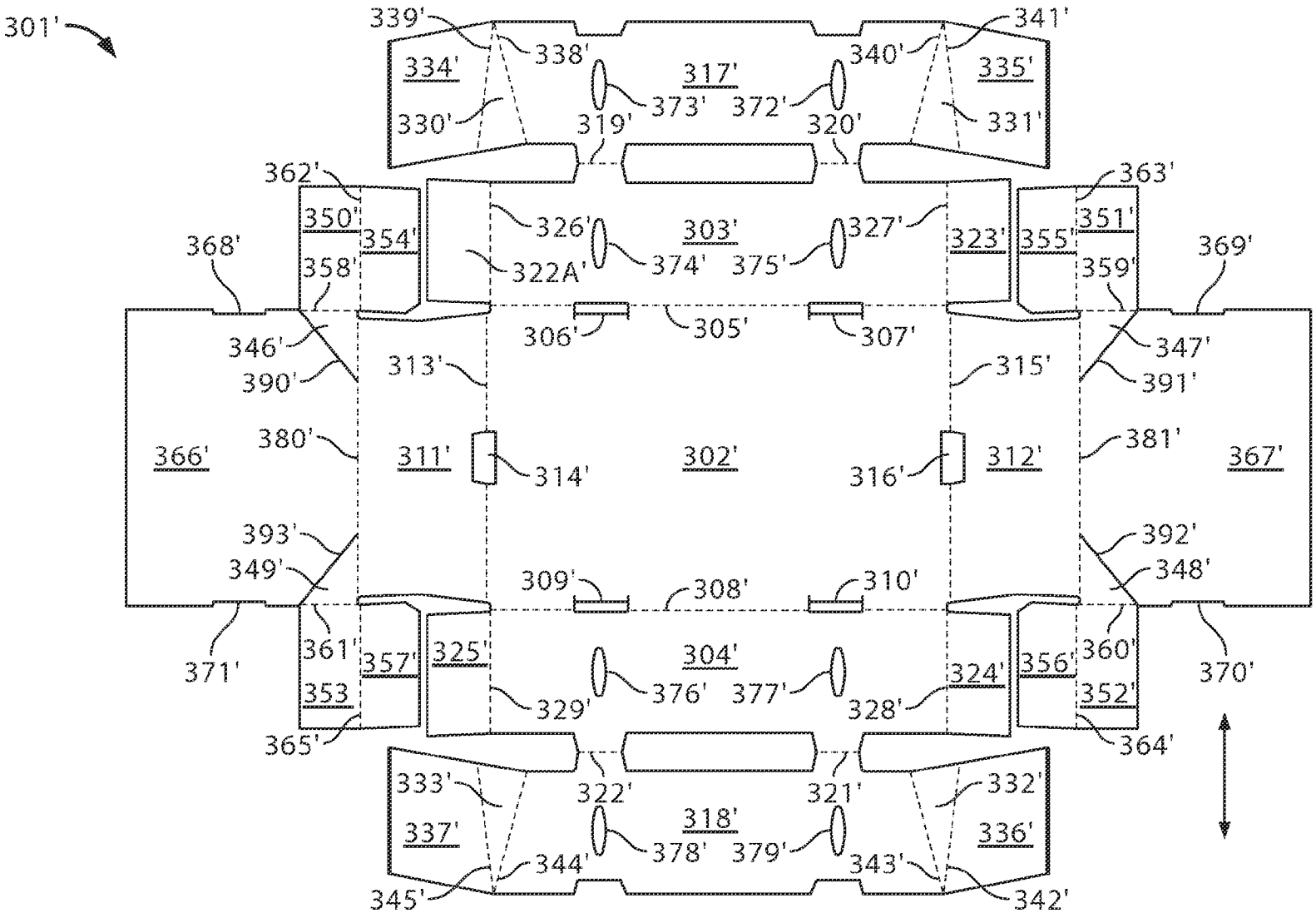
FIG. 35 is a plan view of a blank of a carton with integrated lid according to another preferred embodiment.
Figure 36:
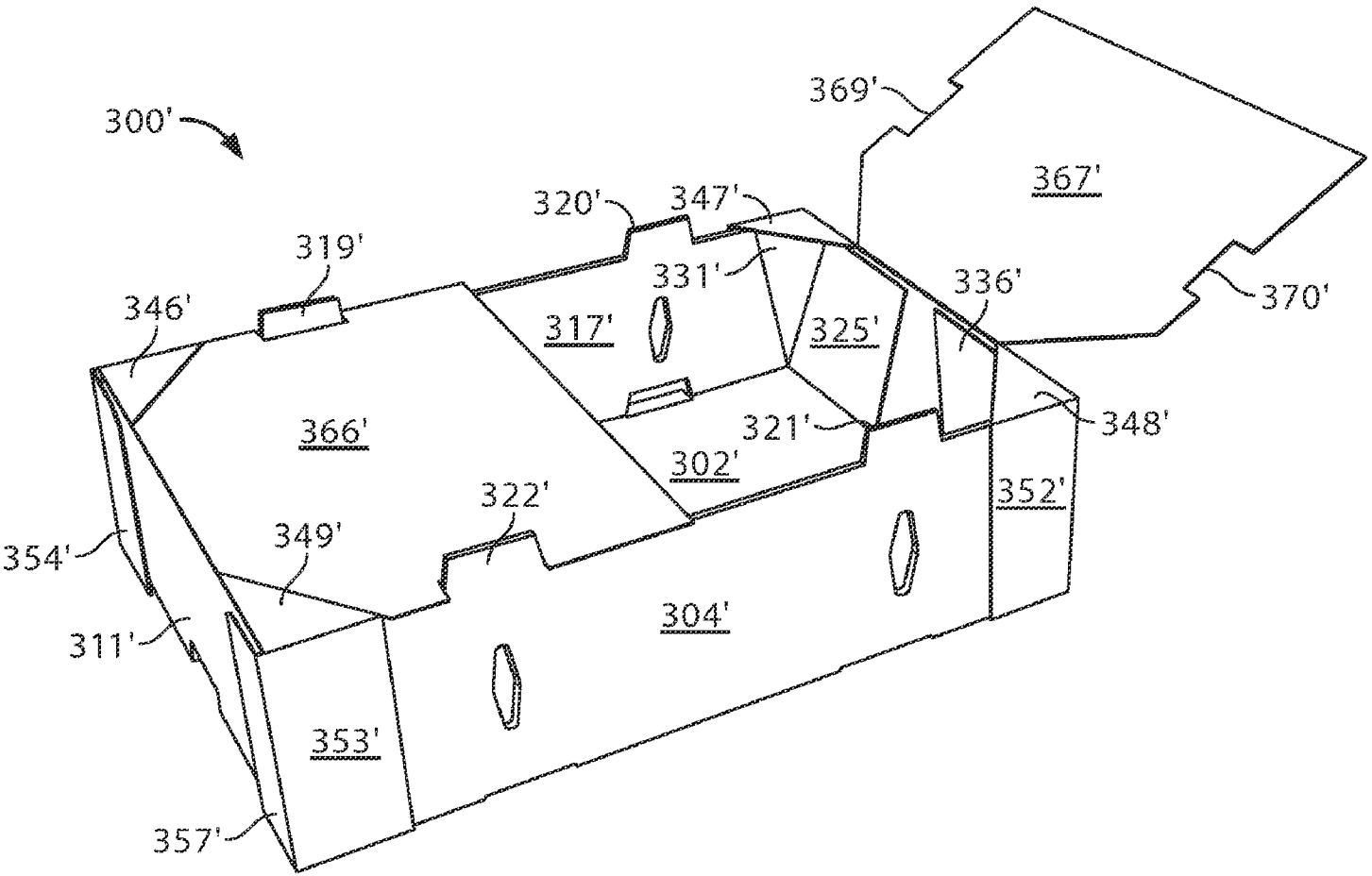
FIG. 36 is a simplified perspective view of a carton with integrated lid according to the embodiment of FIG. 35, shown in its erected configuration, with the top open prior to loading and sealing.
Figure 37:
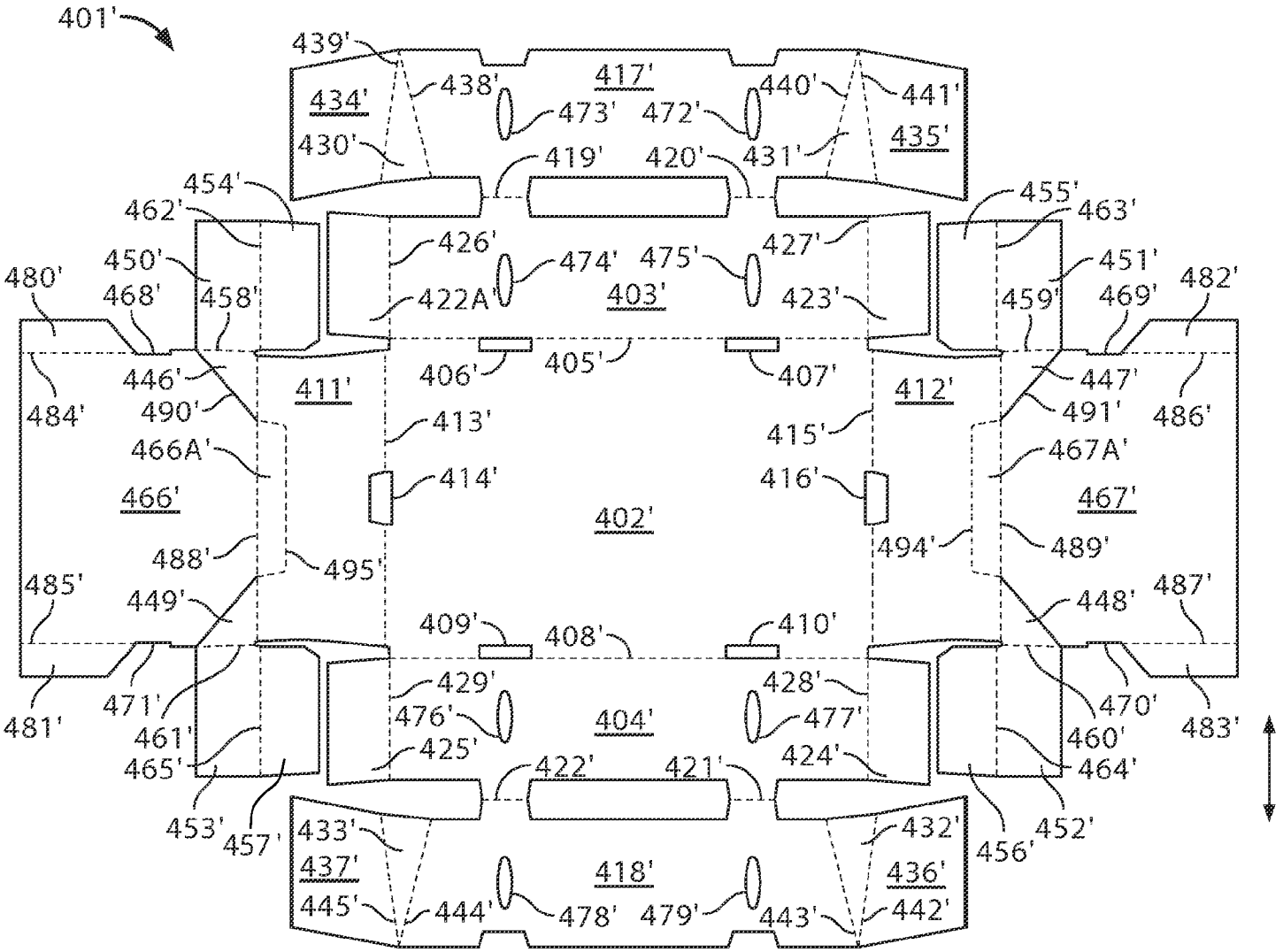
FIG. 37 is a plan view of a blank of a carton with integrated lid according to another preferred embodiment.

FIGS. 35-36 illustrate a covered tray with integral lid structure. Again, for a corrugated paperboard blank, the preferred direction of the flutes is indicated by the double arrow in FIG. 35. Tray 300' is formed from blank 301' (preferably bilaterally symmetrical), which includes bottom panel 302'; outer side panels 303', 304'; fold line 305' interrupted by die-cut slots 306', 307'; fold line 308' interrupted by die-cut slots 309', 310'; end panels 311', 312'; fold line 313' interrupted by vent hole 314'; fold line 315' interrupted by vent hole 316'; inner side panels 317', 318'; web fold lines 319'-322'; minor flaps 322A-325'; fold lines 326'-329'; gusset panels 330'-333';

inner side panel minor flaps 334'-337'; fold lines 338'-345'; top corner panels 346'-349'; first overlap panels 350'-353'; second overlap panels 354'-357'; fold lines 358'-361'; fold lines 362'-365'; top panels 366', 367'; notches 368'-371'; vent holes 372'-379'; and fold lines 380'-381'. In addition, blank 301' includes separation lines 390'-393', which may be perforations or through-cuts, as in the embodiment of FIGS. 29-30, with similar modes of operation as discussed. When the inner side panels are folded in, the webs that connect the inner side panels and the outer side panels form stacking tabs, the top edges of which are defined by the fold lines 319'-322'.

Covered tray 300' is formed by folding up outer side panels 303', 304' perpendicular to bottom panel 302' while folding up end panels 311', 312' perpendicular to bottom 302'. Inner side panel minor flaps 322A-325' are adhered to inside surfaces of end panels 311' and 312', while panels 334'-337' are adhered to inside surfaces of minor flaps 322A-325', so that gusset panels 330'-333' are positioned spanning the corners of the interior of the carton. Triangular top panels 346'-349' are folded to positions over the corners of the carton parallel to bottom panel 302' to enable first overlap panels 350'-353' to be folded down over the outside surfaces of and adhered to, if desired, to outer side panels 303', 304'. Second overlap panels 354'-357' are folded perpendicular to first overlap panels 350'-353' and adhered to outer surfaces of end panels 311', 312'. Top panels 366', 367' are then folded down parallel to bottom panel 302' so that notches 368'-371' fit along the inside surfaces of the stacking tabs formed by the webs connecting outer side panels 303', 304' with their respective inner side panels 317', 318'. Panels 317', 318' are folded over 180 degrees to be located parallel and to the inside of panels 303' and 304', so that the two sets of inner and outer minor flaps overlap one another, with the inner minor flaps not contacting the outer walls of the container.

Figure 38:
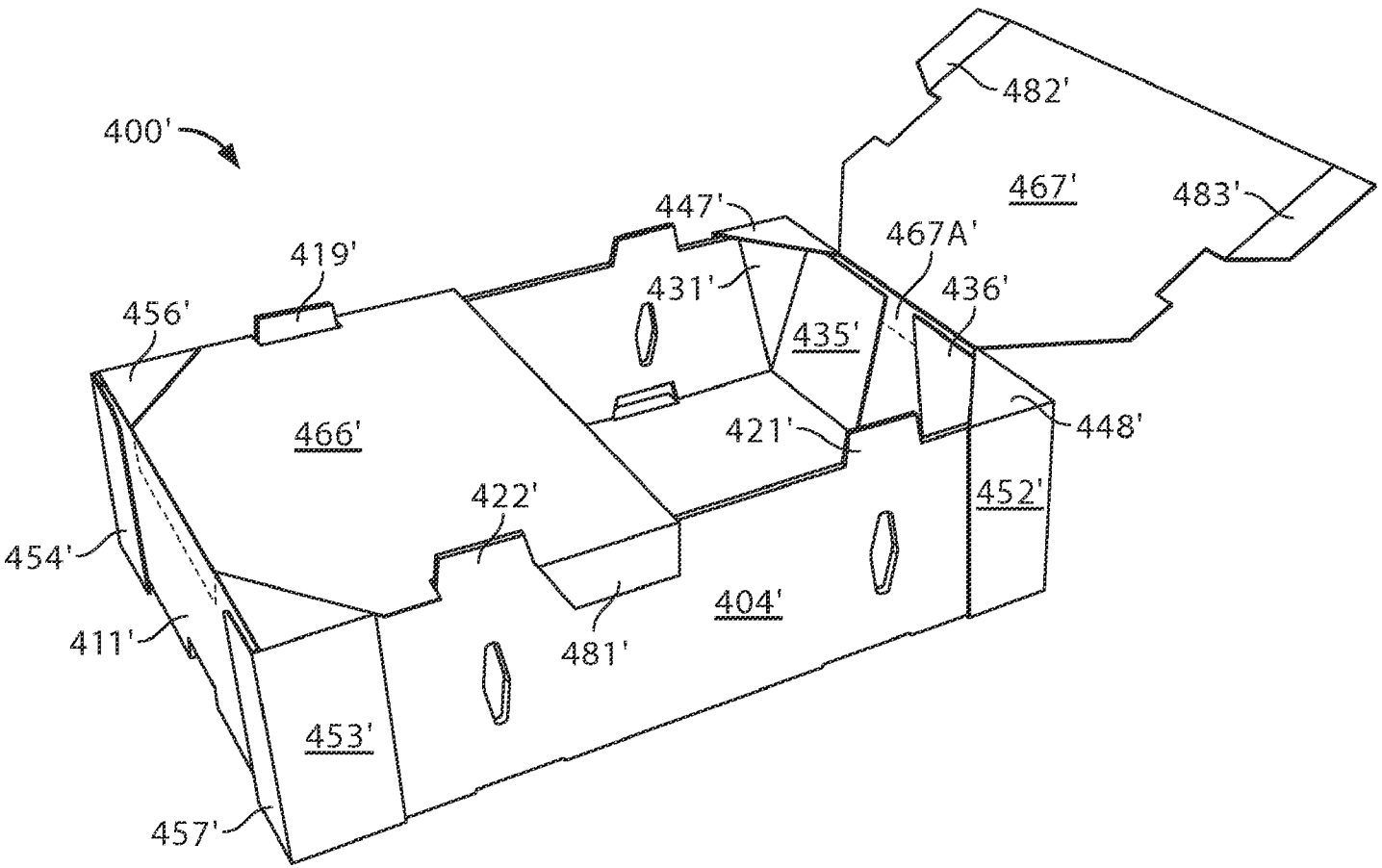
FIG. 38 is a simplified perspective view of a carton with integrated lid according to the embodiment of FIG. 37, shown in its erected configuration, with the top open prior to loading and sealing.

FIGS. 37-38 illustrate a covered tray with integral lid structure. For a corrugated paperboard blank, the preferred direction of the flutes is indicated by the double arrow in FIG. 37. Tray 400' is formed from blank 401' (preferably bilaterally symmetrical), which includes bottom panel 402'; outer side panels 403', 404'; fold line 405' interrupted by die-cut slots 406', 407'; fold line 408' interrupted by die-cut slots 409', 410'; end panels 411', 412'; fold line 413' interrupted by vent hole 414'; fold line 415' interrupted by vent hole 416'; inner side panels 417', 418'; web fold lines 419'-422'; minor flaps 422A-425'; fold lines 426'-429'; gusset panels 430'-433'; inner side panel minor flaps 434'-437'; fold lines 438'-445'; top corner panels 446'-449'; first overlap panels 450'-453'; second overlap panels 454'-457'; fold lines 458'-461'; fold lines 462'-465'; top panels 466', 467' with extensions 466A, 467A; notches 468'-471'; vent holes 472'-479'; top side closure flaps 480'-483'; fold lines 484'-487'; and fold lines 488', 489'. When the inner side panels are folded in, the webs that connect the inner side panels and the outer side panels form stacking tabs, the top edges of which are defined by the fold lines 419'-422'.

Blank 401' further includes separation lines 490', 491' which are preferably continuous perforations. To load carton 400' (if not formed around a load), top panels 466', 467' are pulled up, breaking the perforations of separation lines 490', 491', up to (but preferably not beyond) fold lines 488', 489'. After filling, top panels 466', 467' are folded down, and top side closure flaps 480'-483' will be glued and folded down. Removal of top panels 466', 467' are accomplished, in part, by tearing along the remaining unbroken perforated portions of separation lines 490', 491'.

Carton 400' is formed in substantially the same manner as carton 300' except that for carton 400', blank 401' is provided with additional closure flaps 480'-483', which are adhered to outside surfaces of outer side panels 403', 404'. In addition, top panels 466', 467' terminate in extensions 466A and 467A, which are defined by perforations 494', 495'. Extensions 466A and 467A can be used to open the container, and permit removal of the lid portion.

Figure 39:
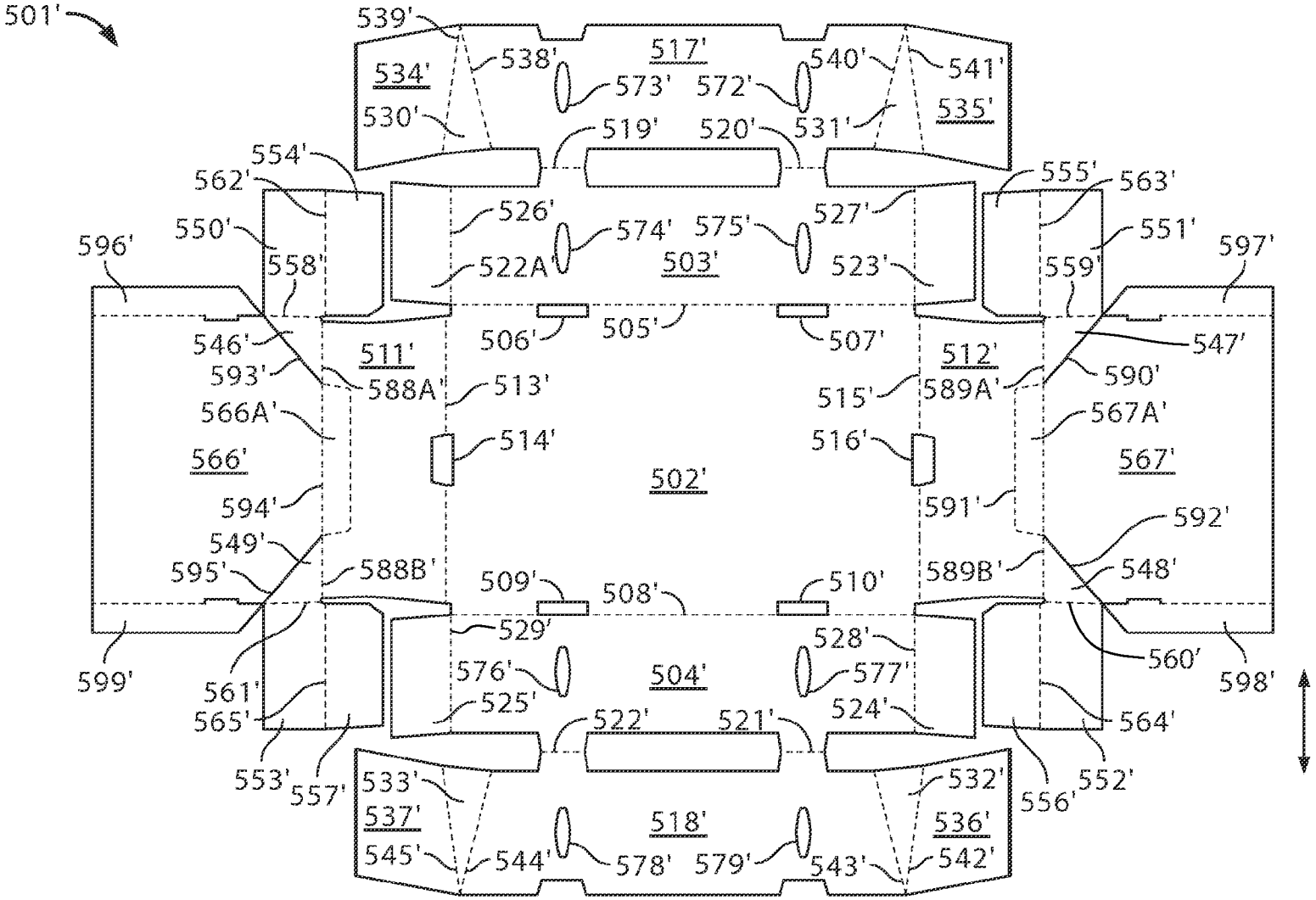
FIG. 39 is a plan view of a blank of a carton with integrated lid according to another preferred embodiment.
Figure 40:
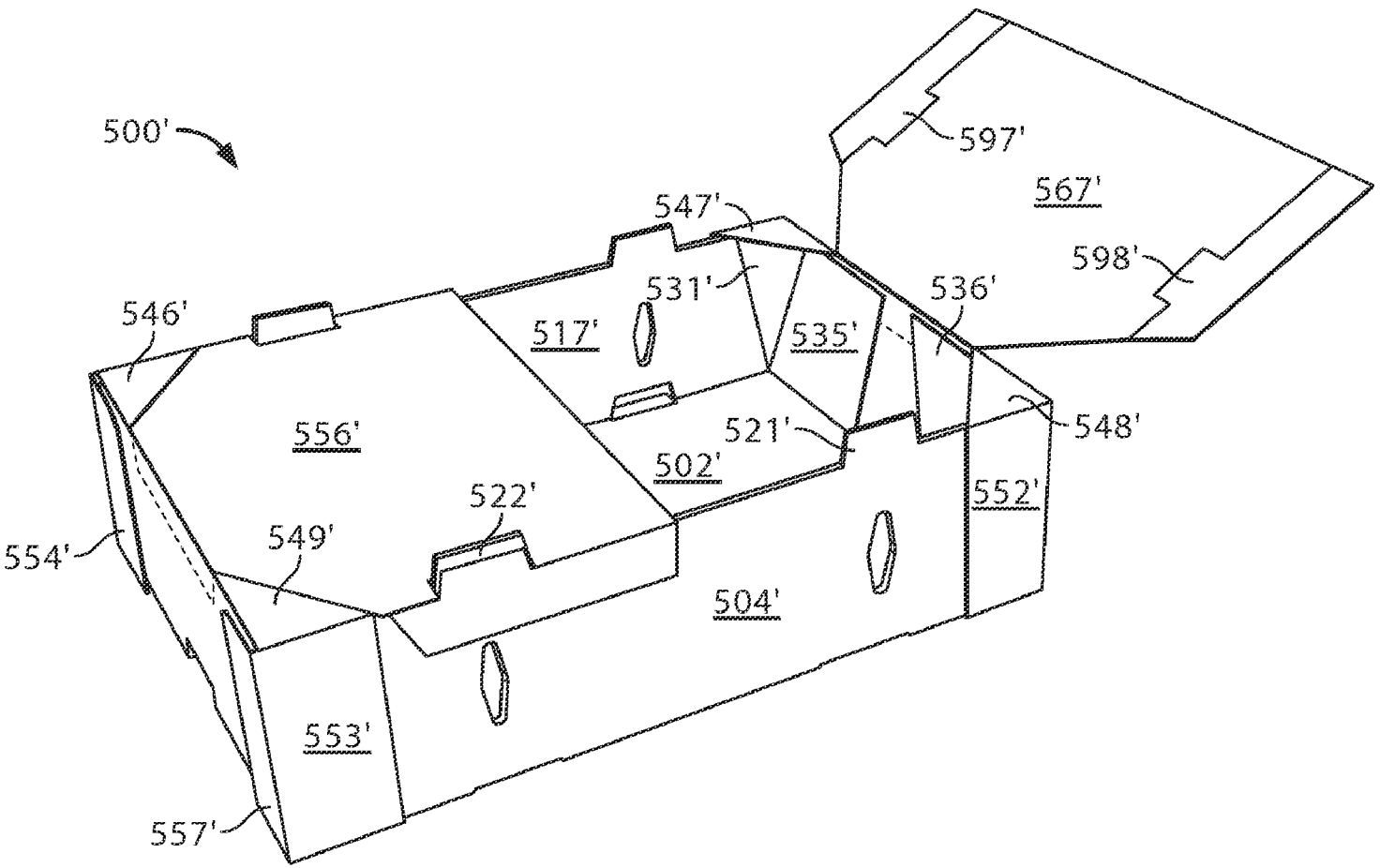
FIG. 40 is a simplified perspective view of a carton with integrated lid according to the embodiment of FIG. 39, shown in its erected configuration, with the top open prior to loading and sealing.

FIGS. 39-40 illustrate a covered tray, similar to tray 400'. Tray 500' is formed from blank 501' (preferably bilaterally symmetrical), which includes bottom panel 502'; outer side panels 503', 504'; fold line 505' interrupted by die-cut slots 506', 507'; fold line 508' interrupted by die-cut slots 509', 510'; end panels 511', 512'; fold line 513' interrupted by vent hole 514'; fold line 515' interrupted by vent hole 516; inner side panels 517', 518'; web fold lines 519'-522'; minor flaps 522A-525; fold lines 526'-529'; gusset panels 530'-533'; inner side panel minor flaps 534'-537'; fold lines 538'-545'; top corner panels 546'-549'; first overlap panels 550'-553'; second overlap panels 554'-557'; fold lines 558'-561'; fold lines 562'-565'; top panels 566', 567' with extensions 566A, 567A; top side closure flaps 596'-599' (which when folded, form or expose slots, for fitting over the stacking tabs formed when the inner side panels are folded in against the outer side panels) and fold lines 588A, 588B, 589A, 589B. For a corrugated paperboard blank, the preferred direction of the flutes is indicated by the double arrow in FIG. 39. When the inner side panels are folded in, the webs that connect the inner side panels and the outer side panels form stacking tabs, the top edges of which are defined by the fold lines 519'-522'. Separation lines 590', 592', 593' and 595' are preferably through-cuts, while separation lines 591', 594' are preferably perforation lines.

Figure 41:
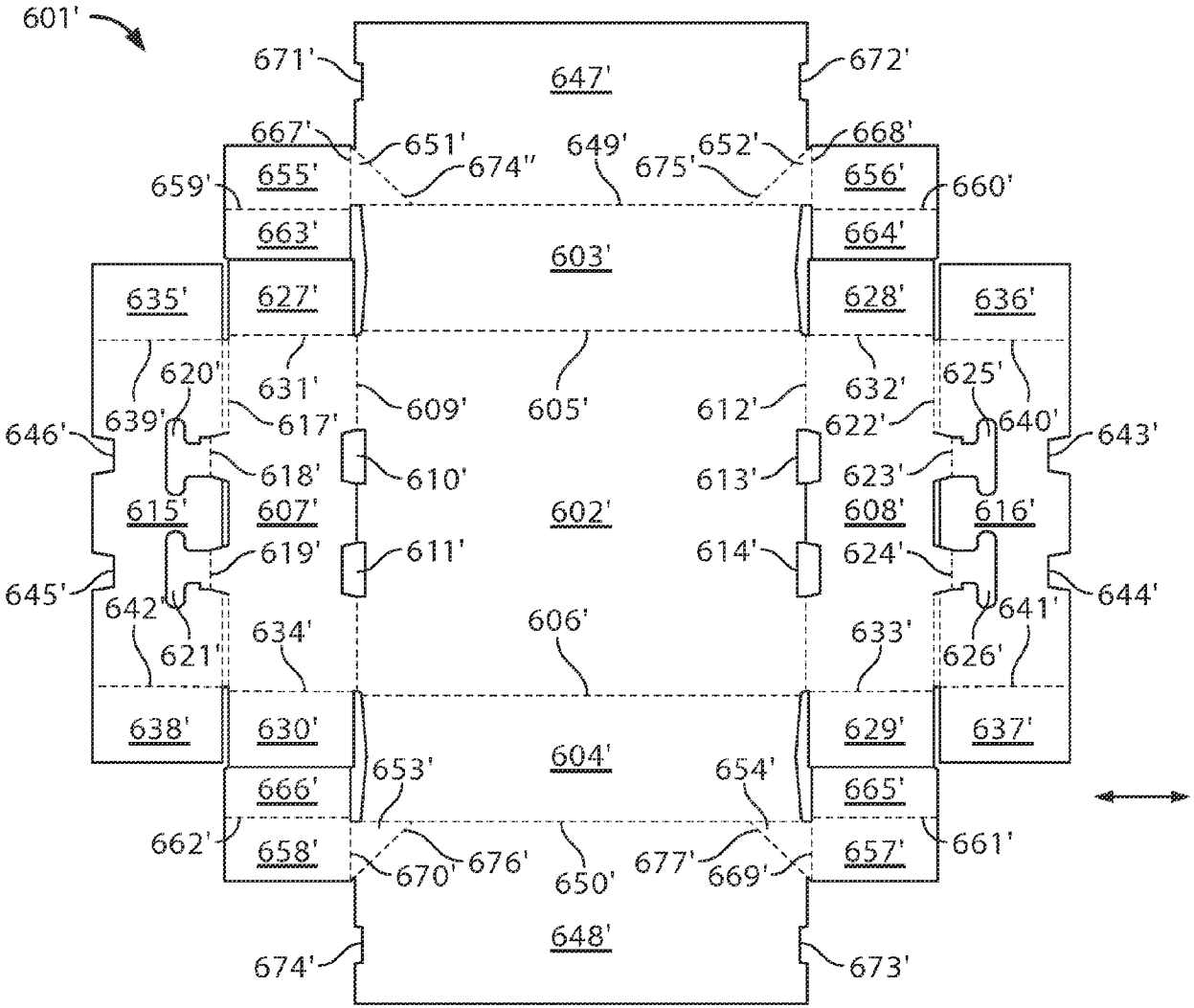
FIG. 41 is a plan view of a blank of a carton with integrated lid according to another preferred embodiment.
Figure 42:
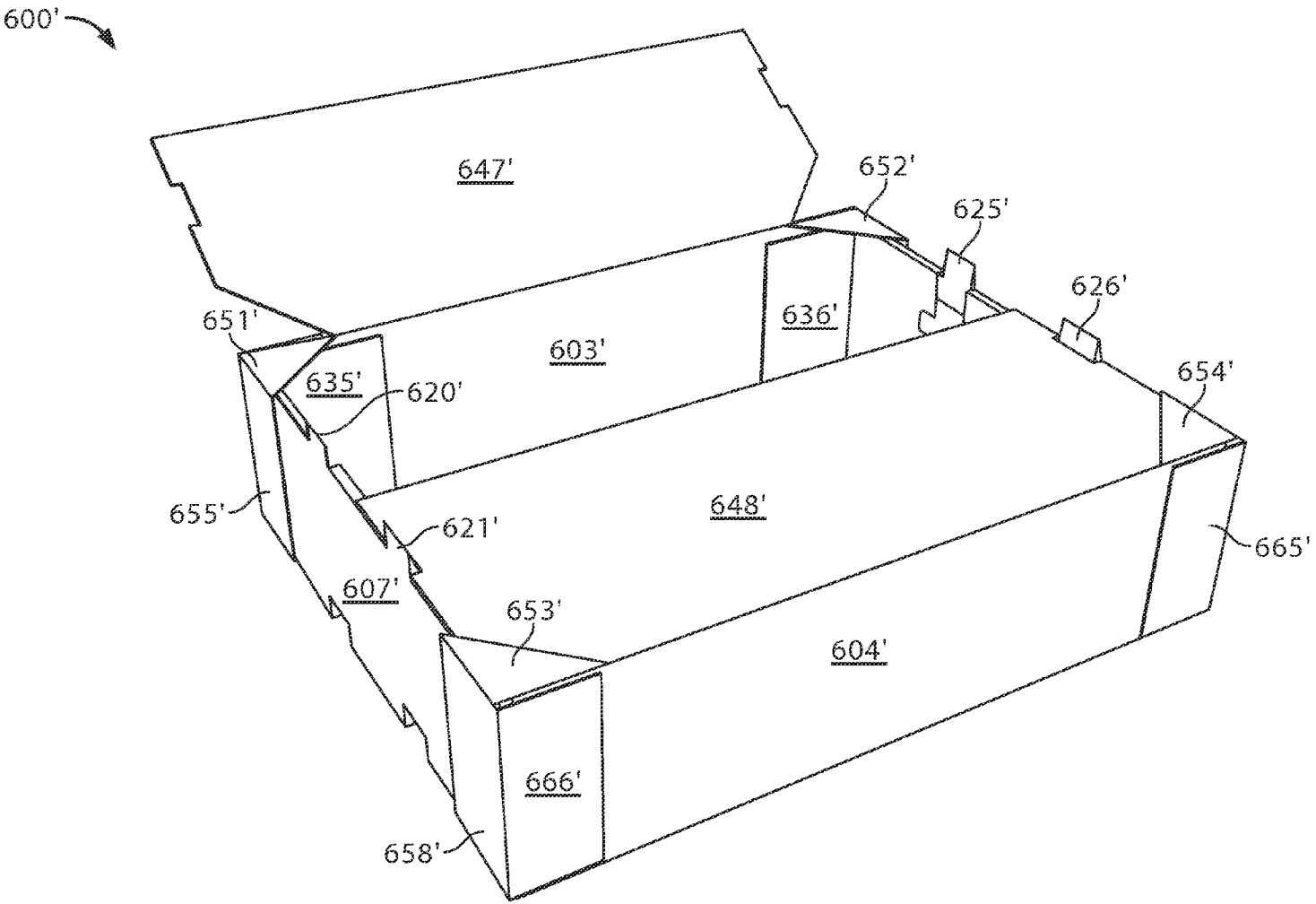
FIG. 42 is a simplified perspective view of a carton with integrated lid according to the embodiment of FIG. 41, shown in its erected configuration, with the top open prior to loading and sealing.

FIGS. 41-42 illustrate a covered tray with integral lid, and having stacking tabs. For a corrugated paperboard blank, the preferred direction of the flutes is indicated by the double arrow in FIG. 41. Covered tray 600' is formed from blank 601' (preferably bilaterally symmetrical), which includes bottom panel 602', end panels 603', 604'; fold lines 605', 606'; outer side panels 607', 608'; fold line 609', interrupted by vent holes 610', 611'; fold line 612', interrupted by vent holes 613', 614'; inner side panels 615', 616'; double fold line 617', interrupted by T-tab structures 620', 621' including offset tab fold lines 618', 619'; double fold line 622', interrupted by T-tab structures 625', 626' including offset tab fold lines 623', 624'; outer side panel minor flaps 627'-630'; fold lines 631'-634'; inner side panel minor flaps 635'-638'; fold lines 639'-642'; inner side panel notches 643'-646'; top panels 647', 648'; fold lines 649', 650'; top corner panels 651'-654'; first overlap panels 655'-658'; fold lines 659'-662'; second overlap panels 663'-666'; fold lines 667'-670'; top panel notches 671'-674'. Blank 601' also includes through-cuts 674"-676' (which may be substituted by perforations, with the corresponding modes of operation as discussed herein).

In carton 600', when inner side panel 615', 616' are folded over their respective double fold lines to positions parallel to and overlying the inside surfaces of outer side panels 607', 608', the offset fold line 618', 619', 623' and 624' cause the upside down t-shaped tab 620', 621', 625', 626' to separate from the surrounding portions of the inner side panels 615', 616', as shown in FIG. 42. Inner side panel minor flaps 635'-638' are adhered to the inside surfaces of minor flaps 627'-630'. Outer side panel minor flaps 627'-630' are adhered to the inside surfaces of side panels 603', 604'. First overlap panels 655'-658' have been folded down to positions overlying the outside surfaces of outer side panels 607', 608' with second overlap panels 663'-666' folded perpendicular thereto and adhered to outside surfaces of end panels 603', 604'. The closure of carton 600' is an indicated in FIG. 42.

Figure 43:
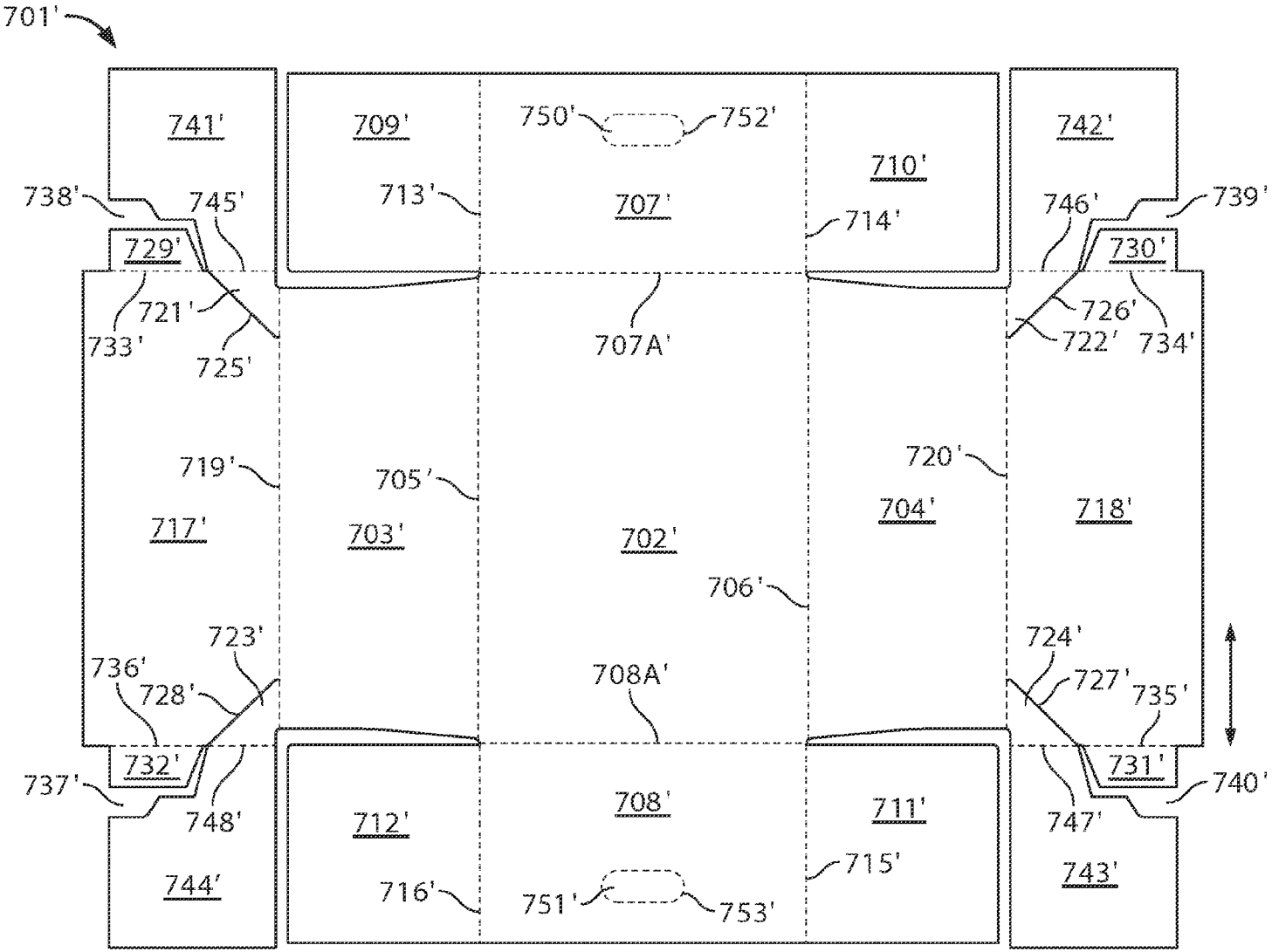
FIG. 43 is a plan view of a blank of a carton with integrated lid according to another preferred embodiment.
Figure 44:
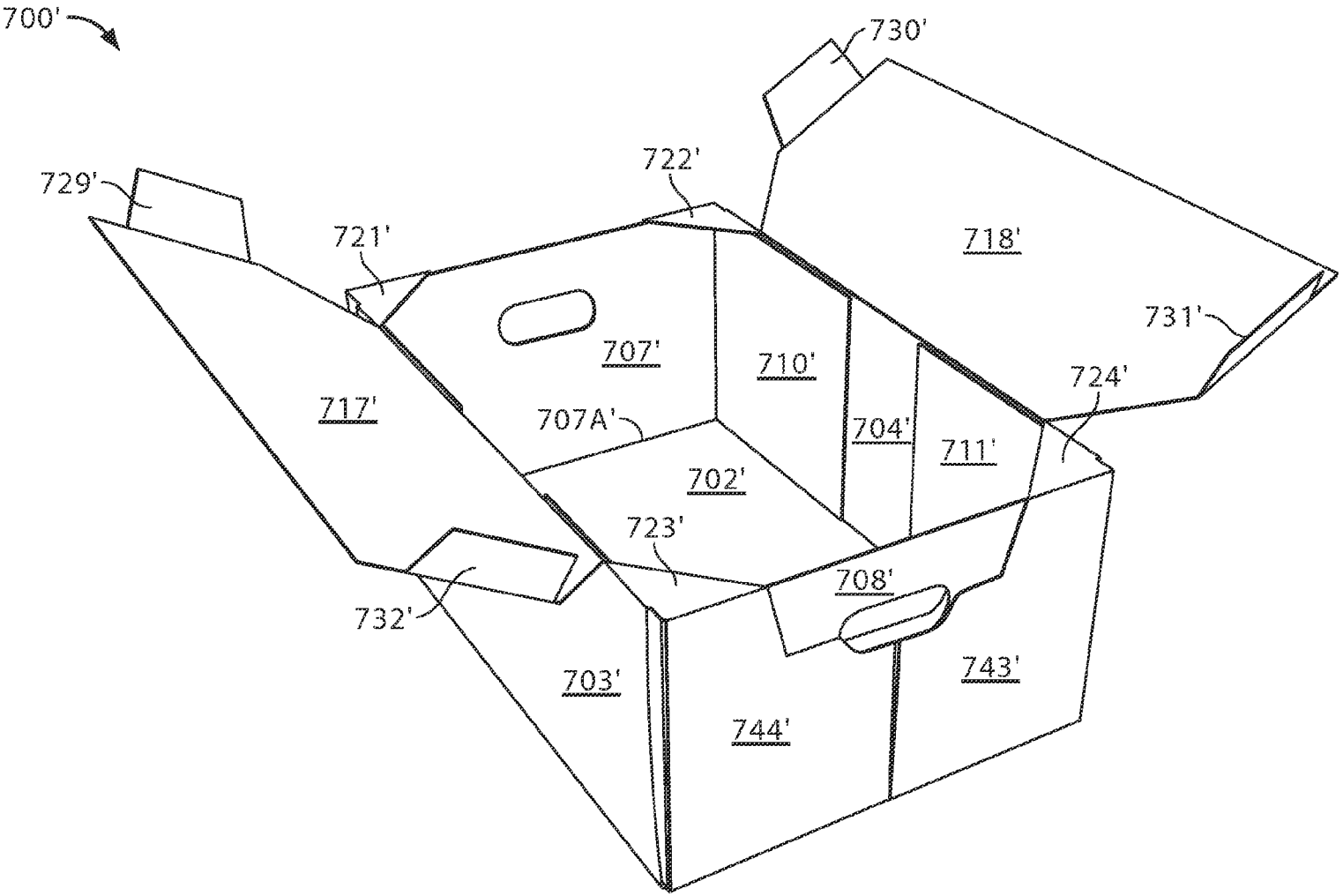
FIG. 44 is a simplified perspective view of a carton with integrated lid according to the embodiment of FIG. 43, shown in its erected configuration, with the top open prior to loading and sealing.

FIGS. 43-44 illustrate a carton with integral lid according to another embodiment of the invention. For a corrugated paperboard blank, the preferred direction of the flutes is indicated by the double arrow in FIG. 43. Carton 700' is formed from blank 701' (preferably bilaterally symmetrical), which includes bottom panel 702'; end panels 703', 704'; fold lines 705', 706'; side panels 707', 708'; fold lines 707A, 708A; side panel minor flaps 709'-712'; fold lines 713'-716'; top panels 717', 718'; fold lines 719', 720'; top corner panels 721'-724'; perforations 725'-728'; top flaps 729'-732'; fold lines 733'-736'; contoured cuts 737'-740'; overlap 741'-744'; and fold lines 745'-748'. Blank 701' also includes knock-outs 750', 751', formed by perforations 752', 753'.

In carton 700', side panel minor flaps 709'-712' have been adhered to the inside surfaces the end panels 703', 704' and overlap panels 741'-744' have been preferably adhered to outside surfaces of side panels 707', 708'. Upon closure of top panel 717', 718' the inner facing edges of these two panels may overlap and top flap 729'-732' are folded down and adhered to outer surfaces of end panels 707', 708' where they are exposed by the contoured cuts 737'-740'.

Figure 45:
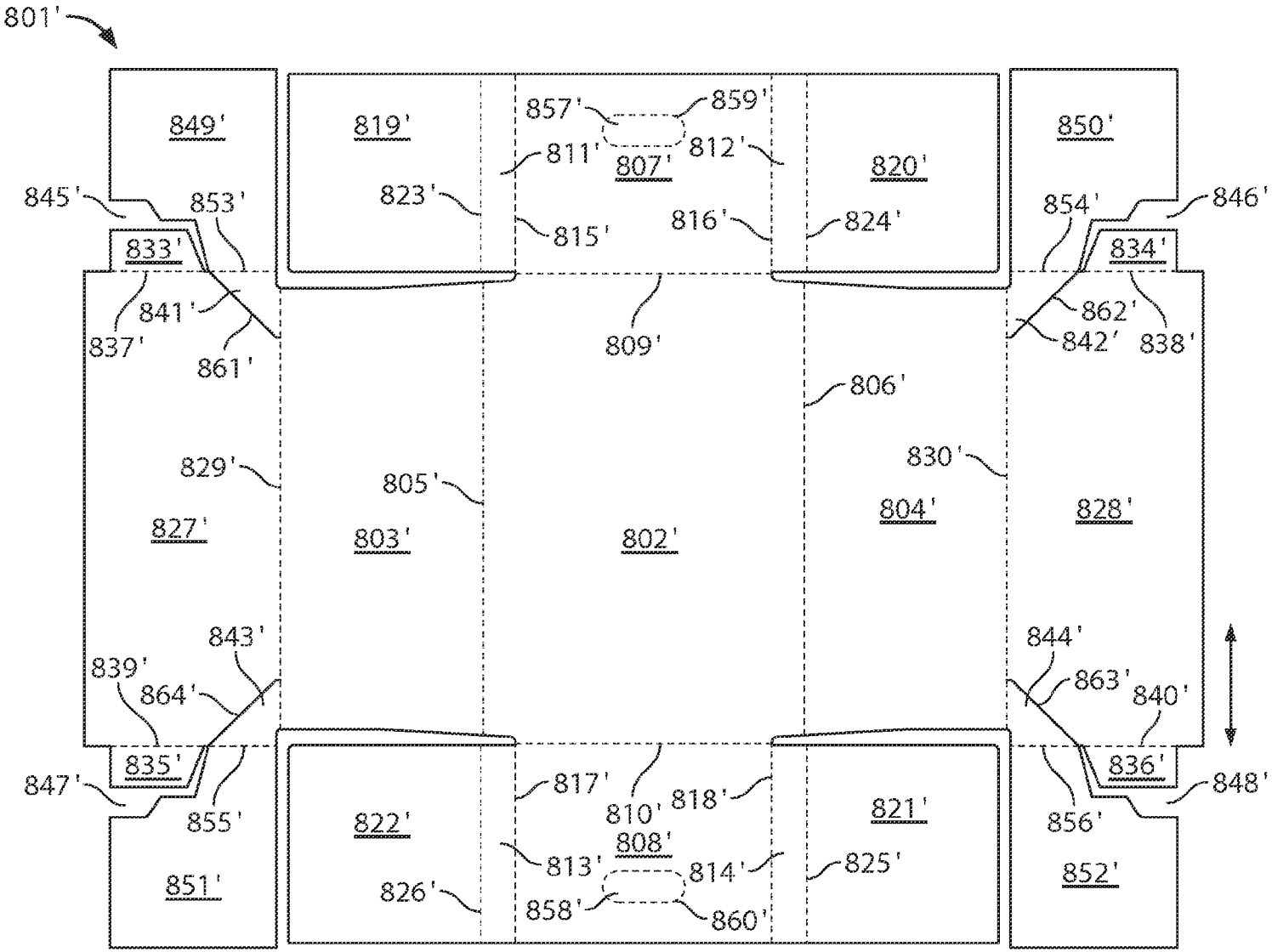
FIG. 45 is a plan view of a blank of a carton with integrated lid according to another preferred embodiment.
Figure 46:
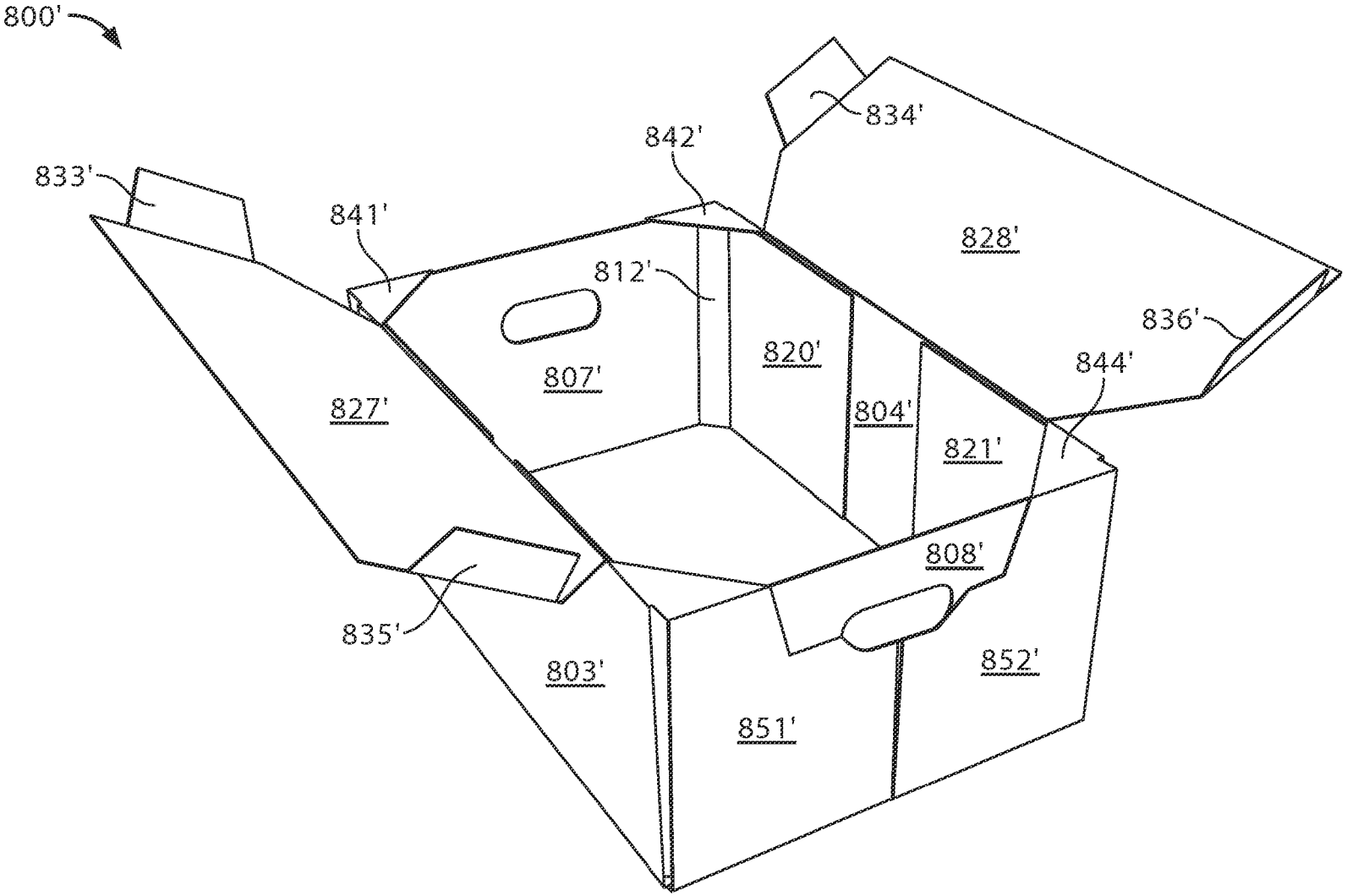
FIG. 46 is a simplified perspective view of a carton with integrated lid according to the embodiment of FIG. 45, shown in its erected configuration, with the top open prior to loading and sealing.

FIGS. 45-46 illustrate a carton with integral lid, including diagonal corner support panels. For a corrugated paperboard blank, the preferred direction of the flutes is indicated by the double arrow in FIG. 45. Carton 800' is formed from blank 801' (preferably bilaterally symmetrical), and includes bottom panel 802'; end panels 803', 804'; fold lines 805', 806'; side panels 807', 808'; fold lines 809', 810'; gusset panels 811'-814'; fold lines 815'-818'; side panel minor flaps 819'-822'; fold lines 823'-826'; top panels 827', 828'; fold lines 829', 830'; top panel flaps 833'-836'; fold lines 837'-840'; top corner panels 841'-844'; countered cuts 845'-848'; overlap panels 849'-852'; fold lines 853'-856'; knockouts 857', 858', formed by perforations 859', 860'. Blank 801' also includes cuts 861'-864' (which may be substituted with perforations, if desired, with the corresponding modes of operation as discussed herein).

Carton 800' is formed in a substantially similar manner as carton 700', except that blank 801' for 800' includes gusset panels 811'-814'.

Figure 47:
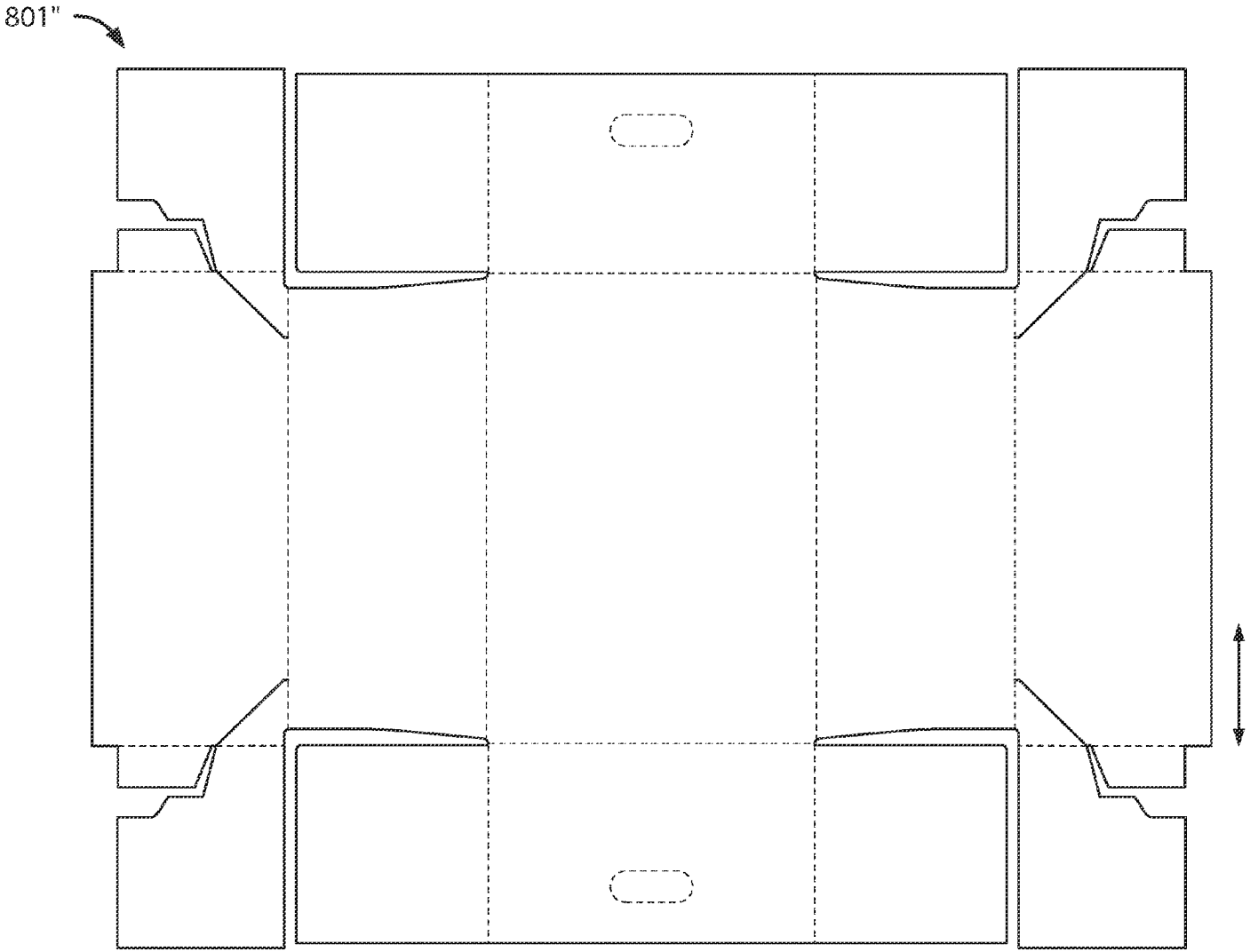
FIG. 47 is a plan view of a blank of a carton with integrated lid according to another preferred embodiment.
Figure 48:
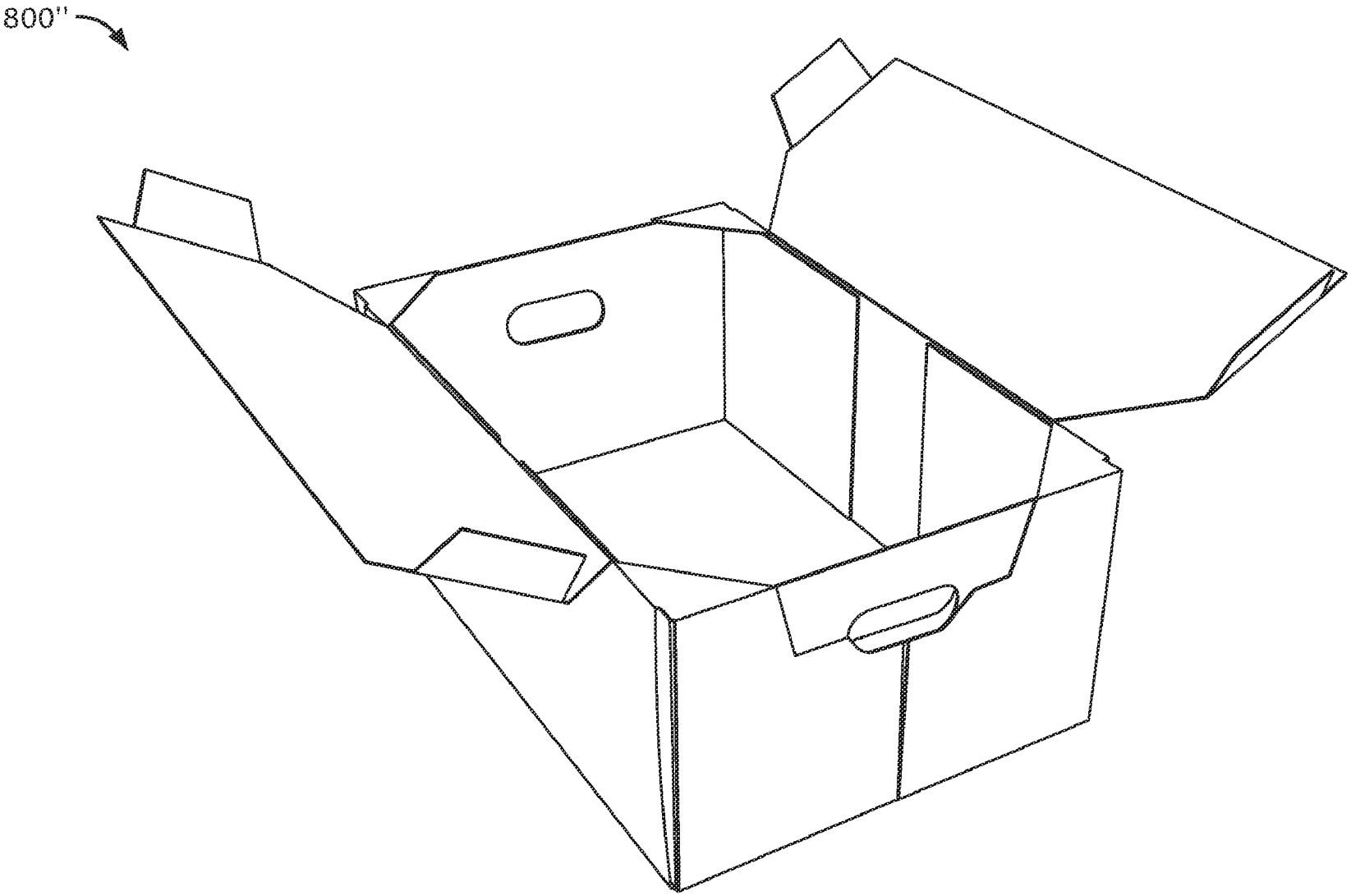
FIG. 48 is a simplified perspective view of a carton with integrated lid according to the embodiment of FIG. 47, shown in its erected configuration, with the top open prior to loading and sealing.

In a further alternative embodiment of the carton of FIGS. 45-46, gusset panels 811'-814' may be omitted, by eliminating fold lines 815'-818'. Such an alternative construction is illustrated in FIGS. 47-48, by carton 800", formed by blank 801" (preferably bilaterally symmetrical), which has all the other panels, fold lines and other features of blank 800' of FIGS. 45-46. For a corrugated paperboard blank, the preferred direction of the flutes is indicated by the double arrow in FIG. 47.

Figure 49:
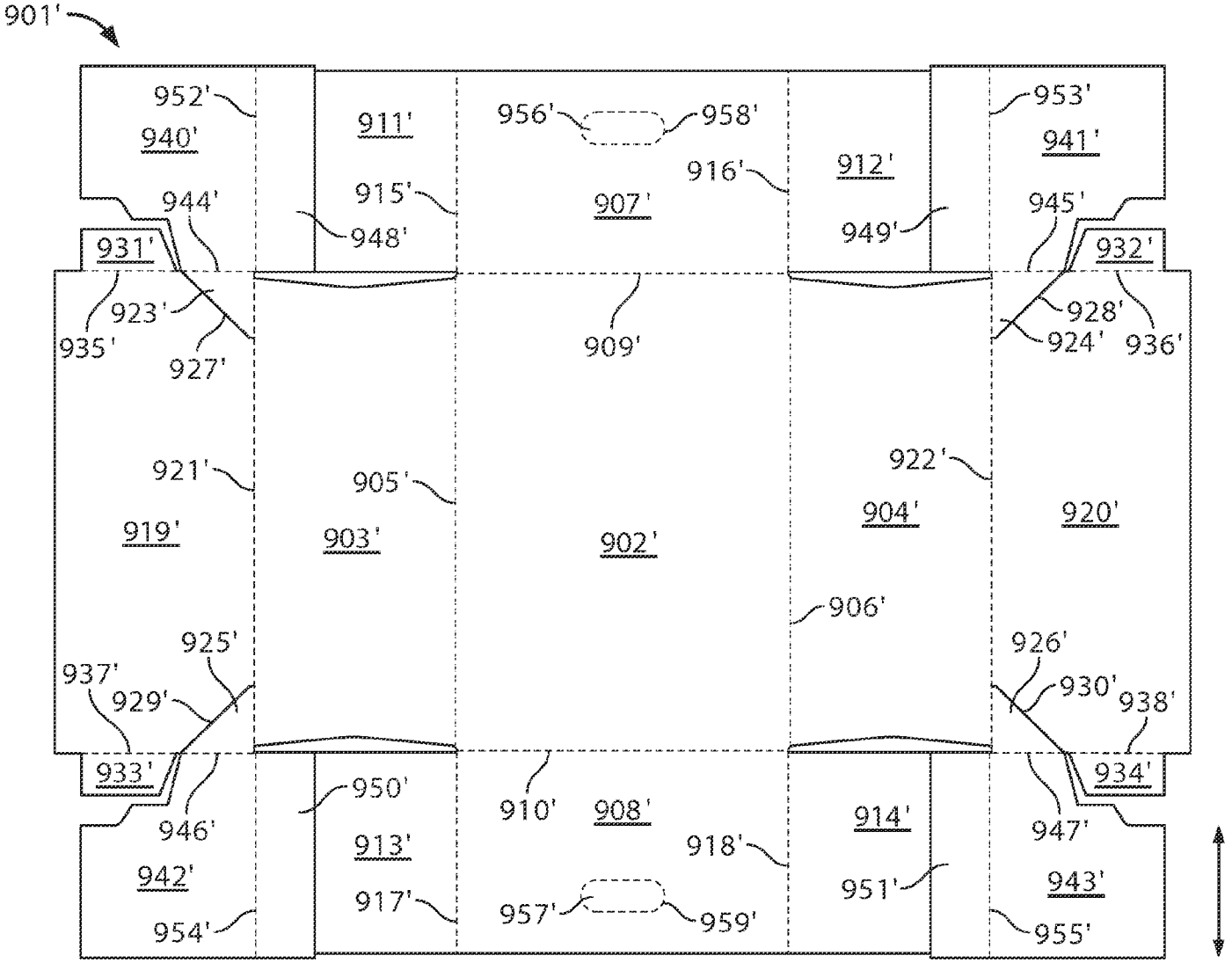
FIG. 49 is a plan view of a blank of a carton with integrated lid according to another preferred embodiment.
Figure 50:
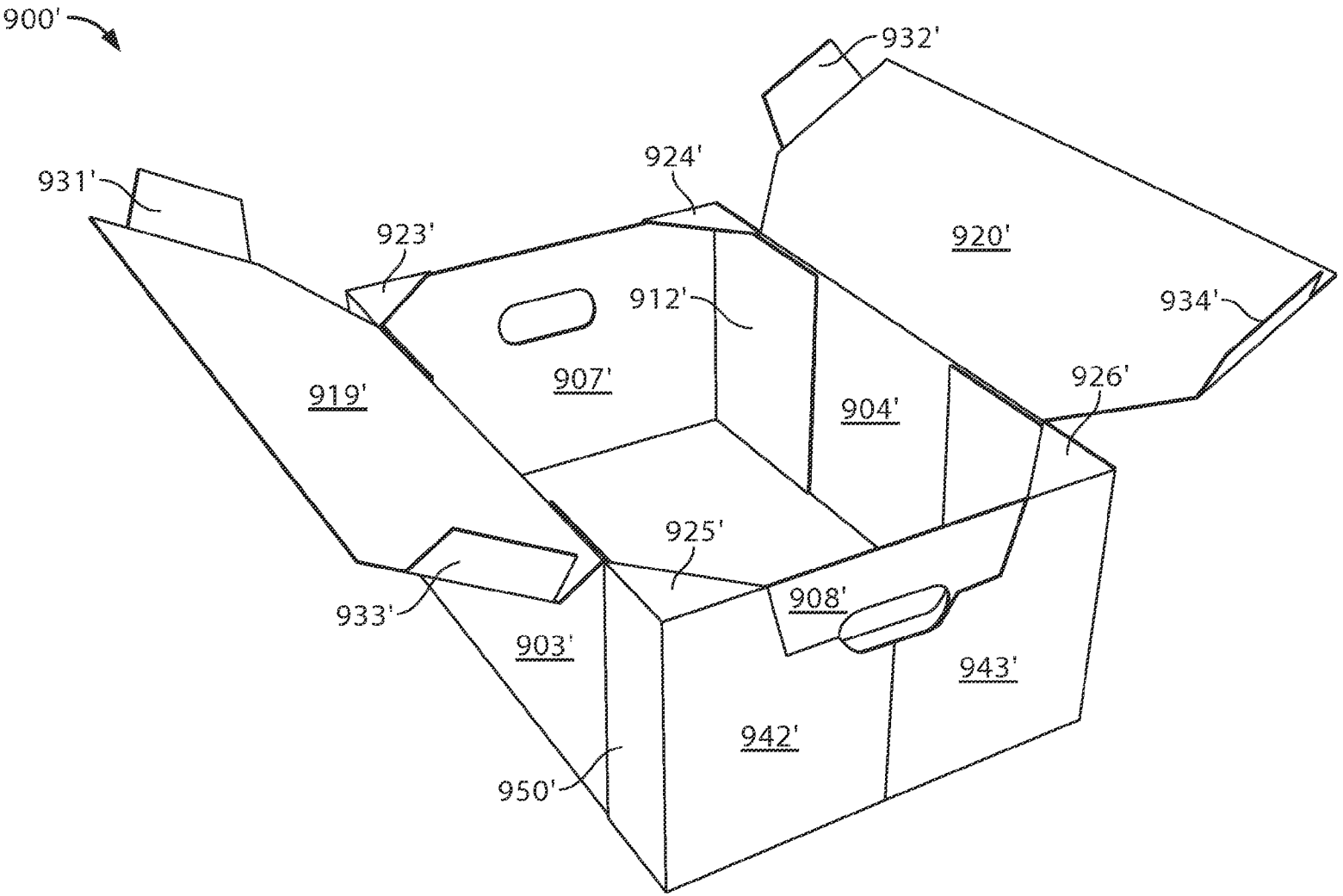
FIG. 50 is a simplified perspective view of a carton with integrated lid according to the embodiment of FIG. 49, shown in its erected configuration, with the top open prior to loading and sealing.

In another alternative embodiment, shown in FIGS. 49-50, a covered carton with two top panels, and with outer corner support panels, is shown. For a corrugated paperboard blank, the preferred direction of the flutes is indicated by the double arrow in FIG. 49. Carton 900' is formed from blank 901' (preferably bilaterally symmetrical), which includes bottom panel 902'; end panels 903', 904'; fold lines 905', 906'; side panels 907', 908'; fold lines 909', 910'; minor flaps 911'-914'; fold lines 915'-918'; top panels 919', 920'; fold lines 921', 922'; top corner panels 923'-926'; perforations 927'-930' (which may be replaced by straight cuts); top side closure flaps 931'-934'; fold lines 935'-938'; first overlap panels 940'-943'; fold lines 944'-947'; second overlap panels 948'-951'; fold lines 952'-955'; and knock-outs 956', 957', formed by perforations 958', 959'.

Carton 900' is substantially similar to carton 700', but for the addition of second overlap panels 948'-951', which are adhered to the outside surfaces of side panels 907', 908'.

Figure 77:
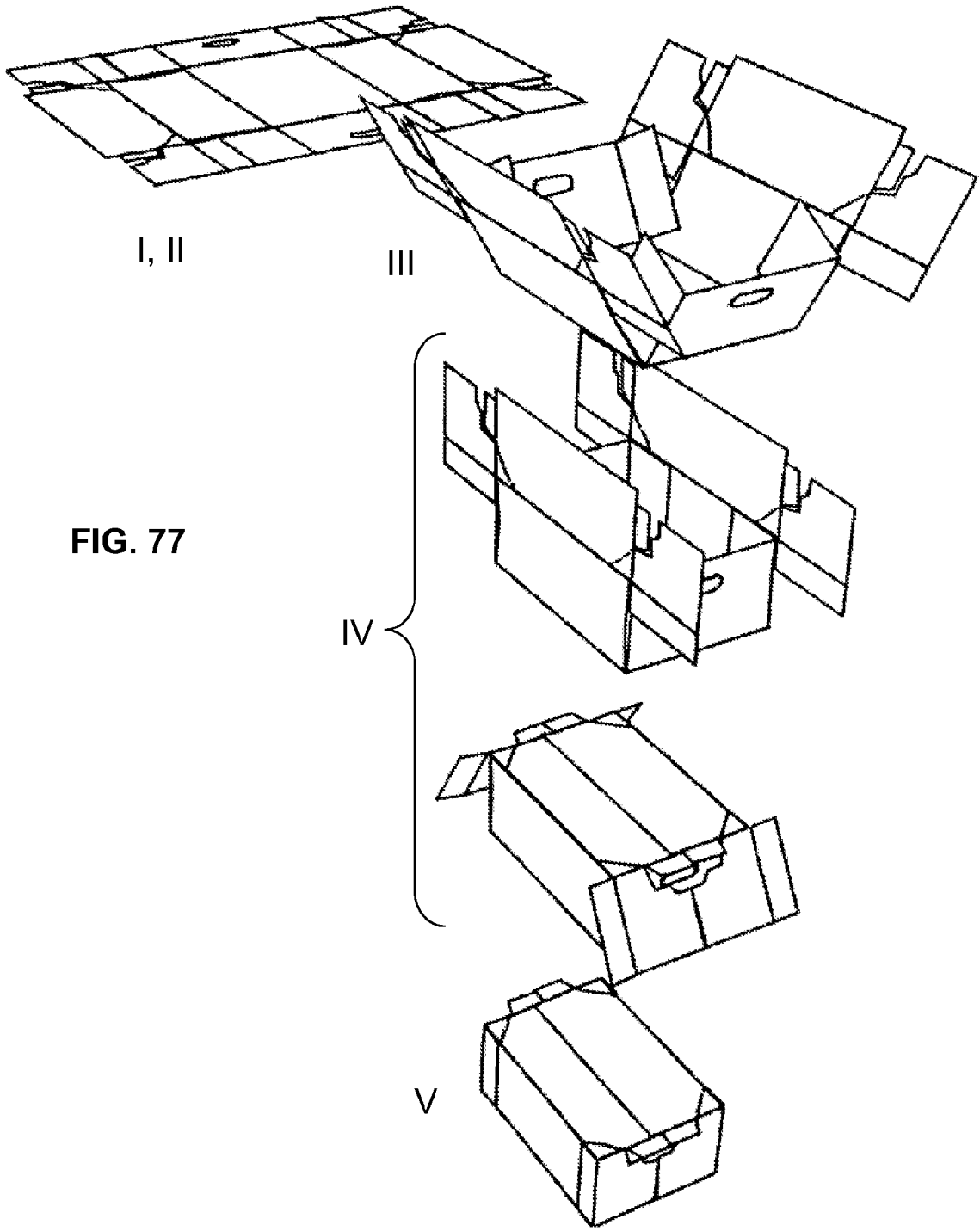
FIG. 77 illustrates the first several steps in a method for forming a package, using the carton blank from FIGS. 49-50.
Figure 78:
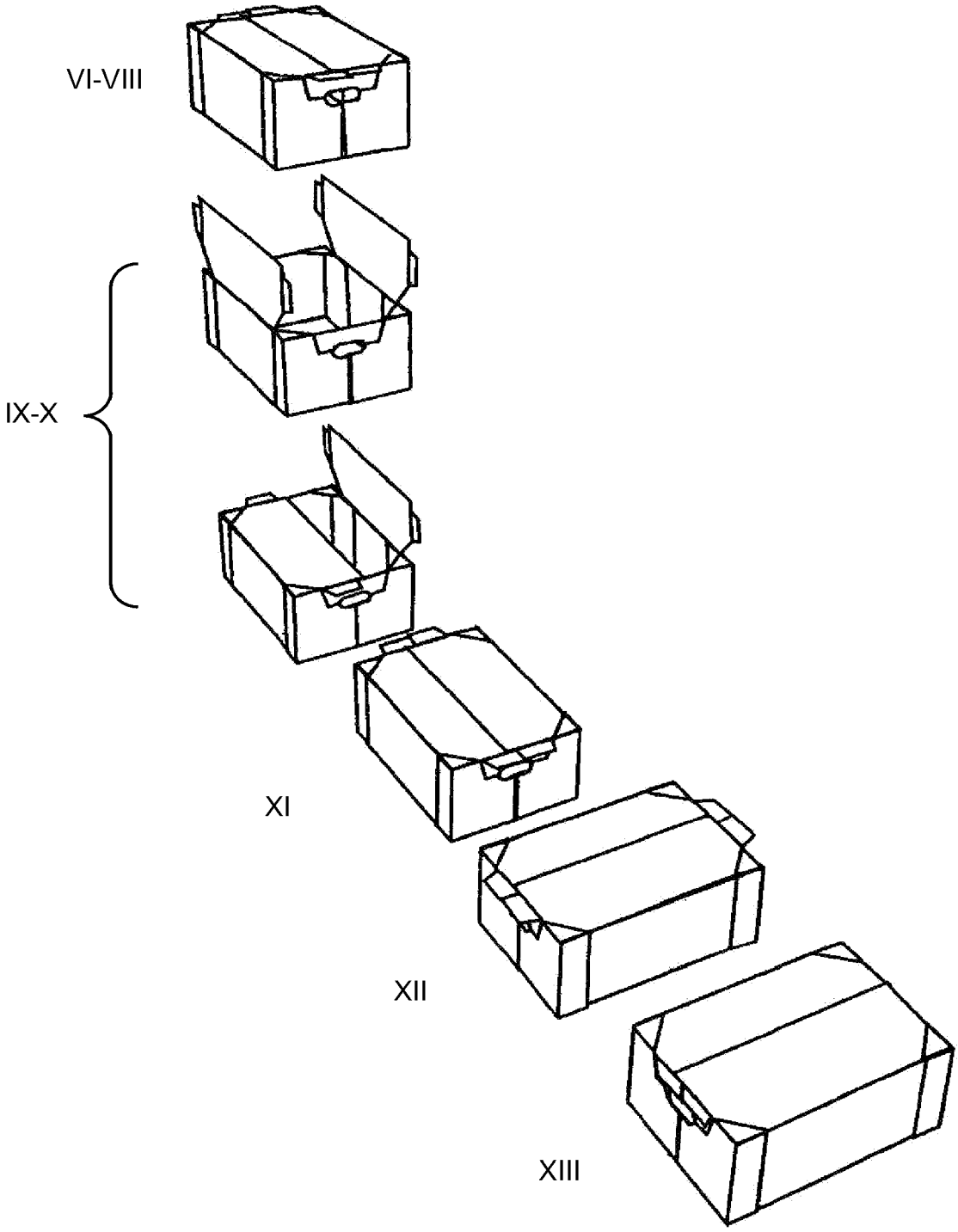
FIG. 78 illustrates the remaining steps in a method for forming a package, using the carton blank from FIGS. 49-50.

FIGS. 77-78 illustrate the steps in a method for setting up a carton, such as may be fabricated from the blank of FIGS. 49-50. These methods may be performed using suitably modified carton forming machinery such as are known in the art, and such modifications may be readily accomplished by one of ordinary skill in the art, having the present disclosure before them. The steps are as follows:

I. A flat blank is indexed into a forming station from the top of a stack of blanks.

II. The blank is indexed laterally as adhesive is applied to the inside surfaces of panels '903', 904', 948'-951' and 940'-943', particularly in a series of parallel glue lines, extending in a direction parallel to the direction of the flutes (as shown by the double arrow). In panels 903', 904', the glue lines may be placed near the top and bottom of those panels (as observed in FIG. 49), but not along the mid-regions of those panels, if desired.

III. A mandrel pushes the blank down through a forming chamber into a compression section.

IV. At a secondary forming station, the top panels and first overlap panels are folded down while the second overlap panels are articulated and glued.

V. As a new carton is received in the forming chamber, the just formed carton is discharged from the compression section onto a powered take-away conveyor.

VI. Formed cartons are pushed down a chute from a case erecting room located on an upper floor to a production floor of a production facility.

VII. Cartons are moved laterally, e.g., at shoulder height, on a powered belt conveyor, past manual packing stations.

VIII. A worker selects an empty carton from the belt conveyor, and positions the carton at the worker's pack station, e.g., at waist or thigh height.

IX. The top panels are pulled up (breaking perforations as necessary) to open the carton for packing.

X. Product, such as Cryovac™ wrapped meat cuts are packed into the open carton.

XI. The filled carton is pushed forward onto a take-away conveyor to a sealing device, such as an Elliott Top & Side Sealer, a Pearson side flange sealer or a Smurfit-Stone Container Corporation side flange sealer.

XII. The top panels are plowed down and the top side closure flaps are sealed with hot melt adhesive.

XIII. Sealed cartons are then transported, e.g., by roller conveyor to a manual palletizing area. Pallet Loads are built, transferred by lift trucks to temporary storage, and then shipped to customers as required.

Figure 51:
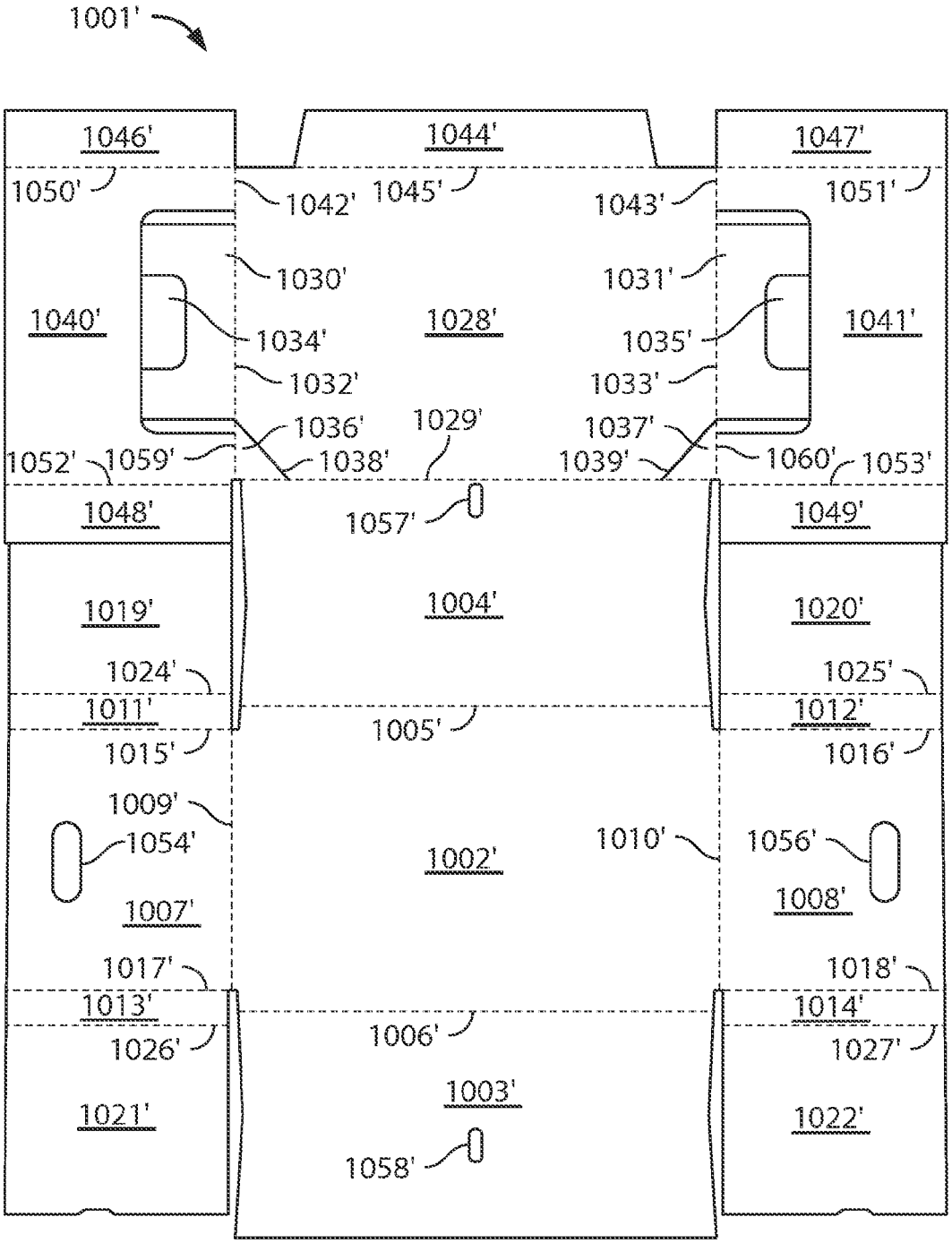
FIG. 51 is a plan view of a blank of a carton with integrated lid according to another preferred embodiment.
Figure 52:
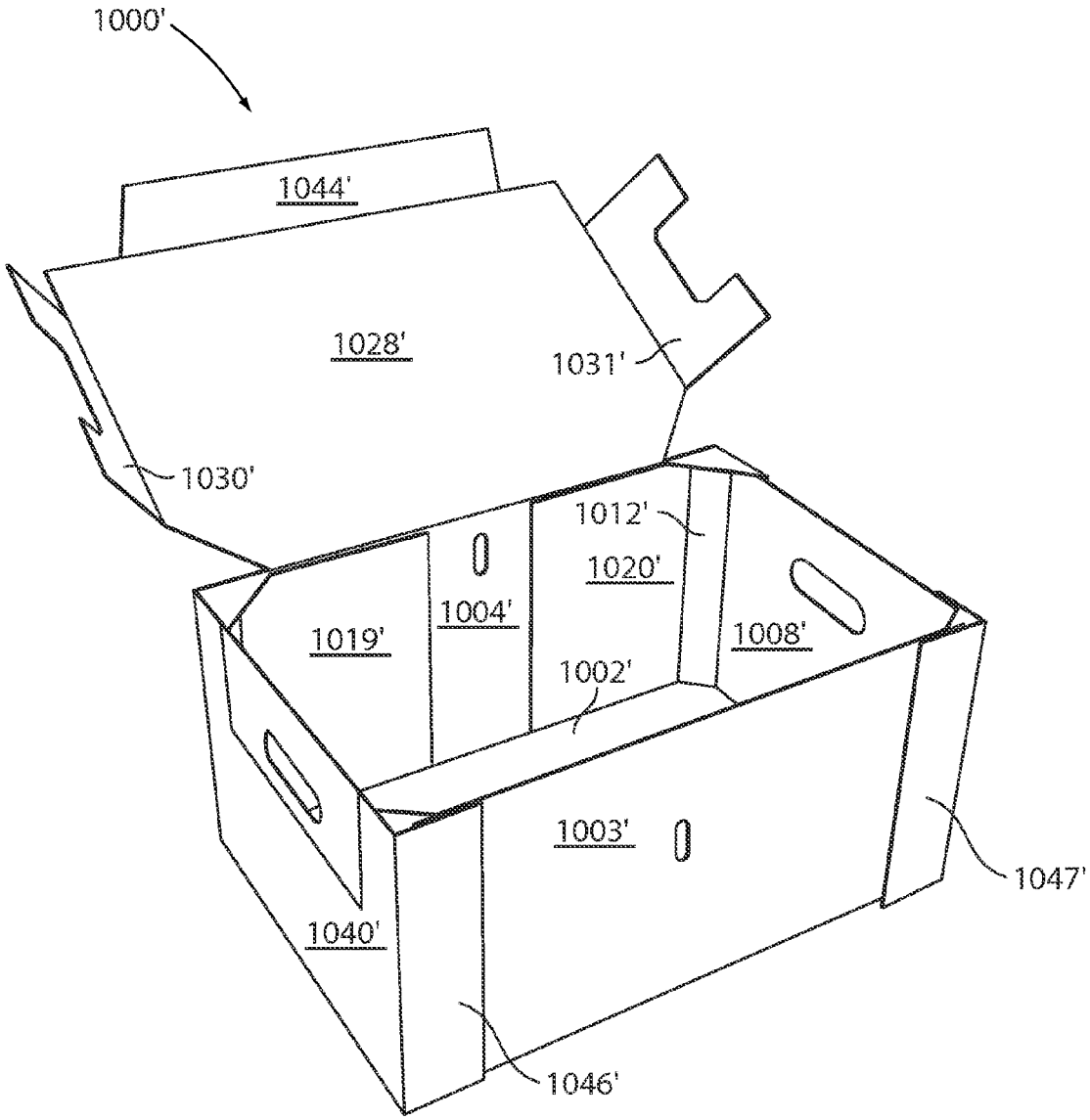
FIG. 52 is a simplified perspective view of a carton with integrated lid according to the embodiment of FIG. 51, shown in its erected configuration, with the top open prior to loading and sealing.

In the embodiment of FIGS. 51-52, carton 1000' is formed by blank 1001', to create a single top panel carton. For a corrugated paperboard blank, the preferred direction of the flutes is indicated by the double arrow in FIG. 51. Blank 1001' includes bottom panel 1002'; (front) end panel 1003'; (rear) end panel 1004'; fold lines 1005', 1006'; side panels 1007', 1008'; fold lines 1009', 1010'; gusset panels 1011'-1014'; fold lines 1015'-1018'; minor flaps 1019'-1022'; fold lines 1024'-1027'; top panel 1028'; fold line 1029'; top side closure flaps 1030', 1031'; fold lines (or perforation lines) 1032', 1033'; cutouts 1034', 1035'; top corner panels 1036', 1037'; perforations or through cuts 1038', 1039'; first overlap panels 1040', 1041'; fold lines 1059', 1060'; perforations 1042', 1043'; top front closure flap 1044'; fold line 1045'; second overlap panels 1046'-1049'; fold lines 1050'-1053'; hand holes 1054', 1056'; and vent apertures 1057', 1058'.

Carton 1000' is formed by placing side panels 1007', 1008' perpendicular to bottom panel 1002'. Minor flaps 1019'-1022' are affixed to inside surfaces of (front) end panel 1003' and (rear) end panel 1004'. Closure of carton 1000' is accomplished by folding top panel 1028' to a position parallel to bottom panel 1002'. At this point, top panel 1028' is still attached along perforations 1042' and 1043' to first overlap panels 1040', 1041'. First overlap panels 1040', 1041' are affixed to outside surfaces of side panels 1007', 1008' with second overlap panels 1046'-1049' being affixed to outside surfaces of (front) end panel 1003' and (rear) end panel 1004'. Top front closure flap 1044' is affixed to an outer surface of (front) end panel 1003'. In addition, top side closure panels 1030' and 1031' are adhered to outside surfaces of side panels 1007' and 1008'. Opening of carton 1000' is accomplished by peeling back top front closure panel 1044', and top side closure panels 1030' and 1031' (or tearing along their respective fold lines/perforations), and tearing along perforations 1042' and 1043'.

Figure 53:
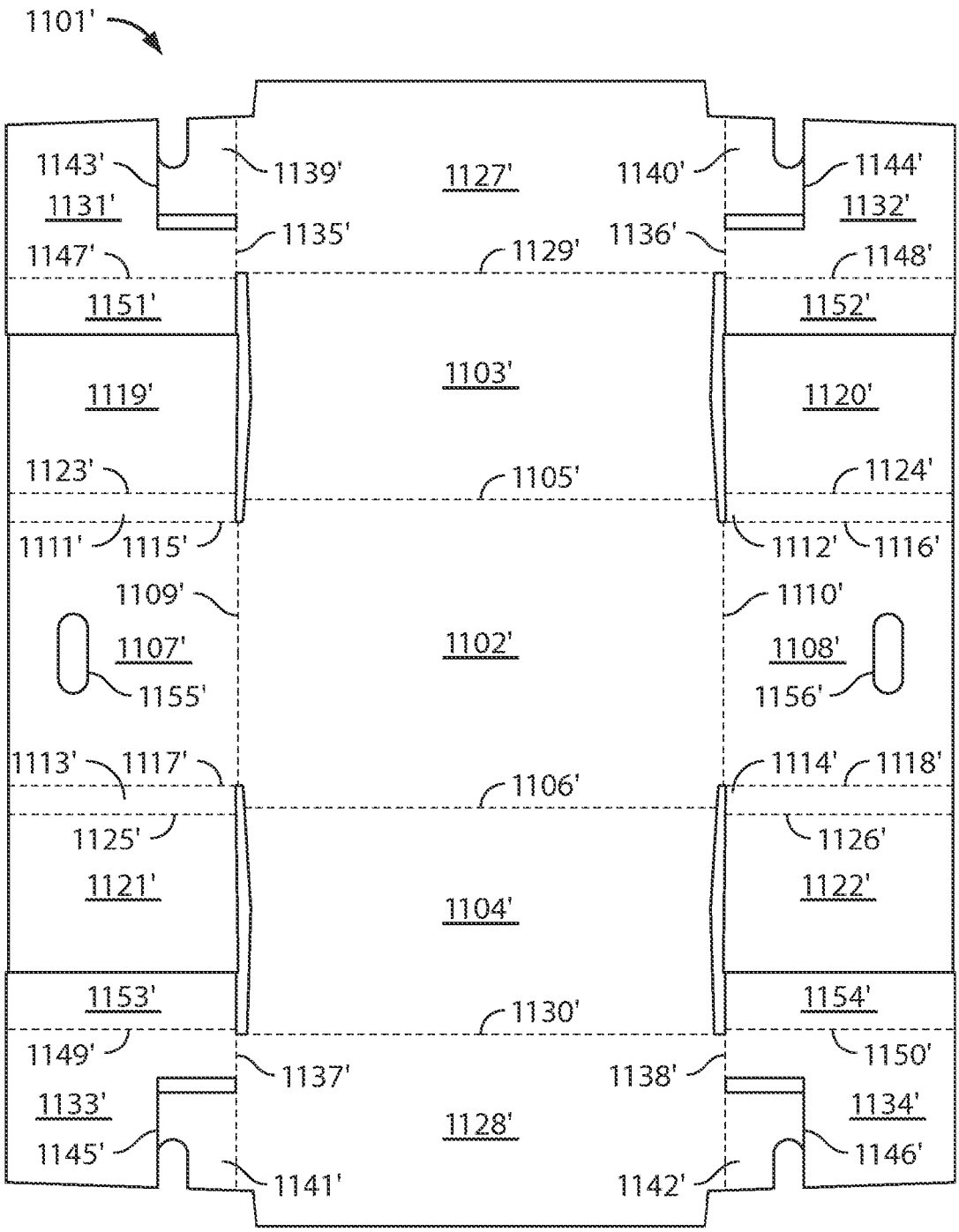
FIG. 53 is a plan view of a blank of a carton with integrated lid according to another preferred embodiment.
Figure 54:
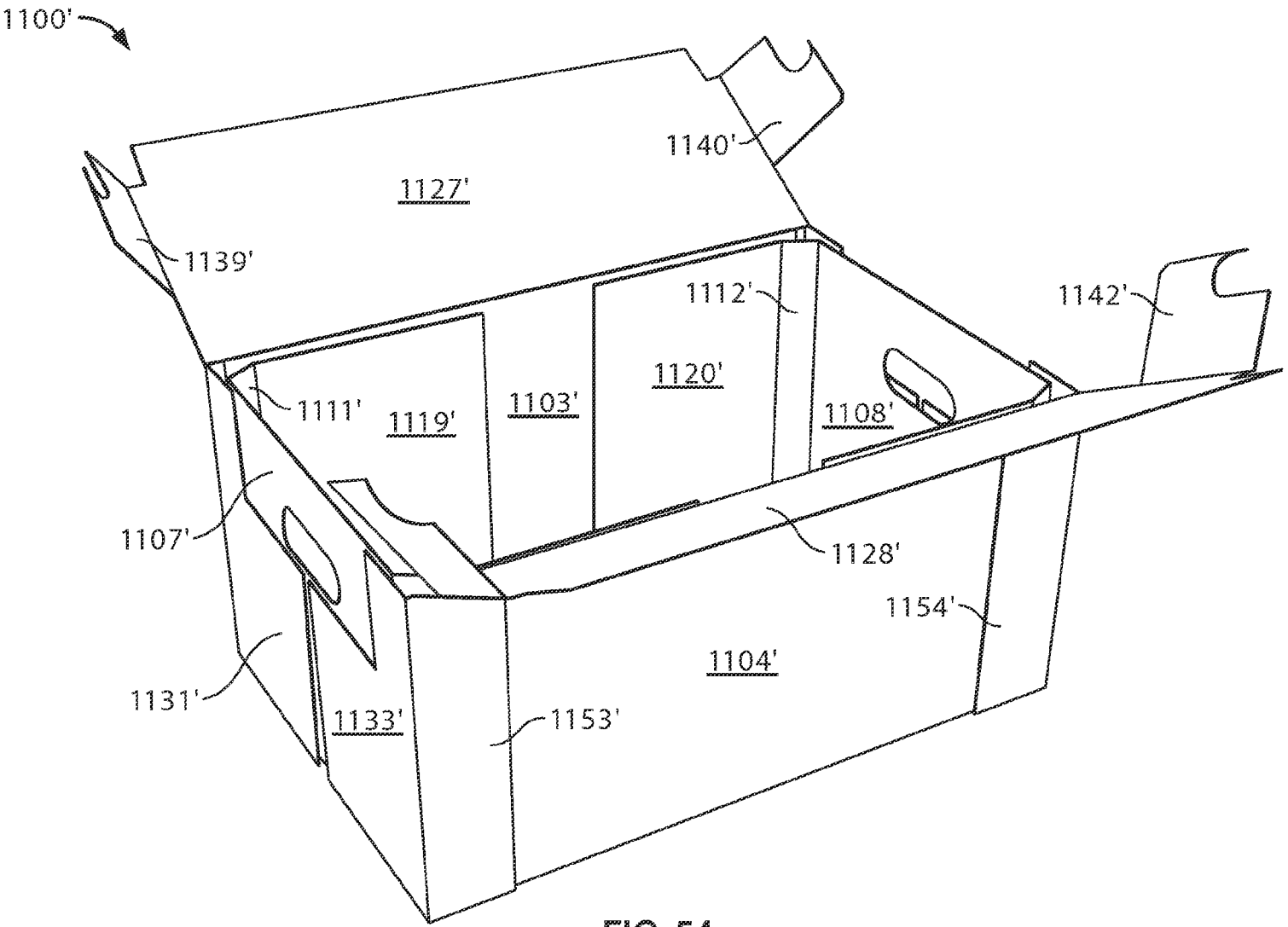
FIG. 54 is a simplified perspective view of a carton with integrated lid according to the embodiment of FIG. 53, shown in its erected configuration, with the top open prior to loading and sealing.

The embodiment of FIGS. 53-54 is a carton 1100' provided with a two-panel top, and is formed from blank 1101' (preferably bilaterally symmetrical). For a corrugated paperboard blank, the preferred direction of the flutes is indicated by the double arrow in FIG. 53. Blank 1101' includes bottom panel 1102', end panels 1103', 1104'; fold lines 1105', 1106'; side panels 1107', 1108'; fold lines 1109', 1110'; gusset panels 1111'-1114'; fold lines 1115'-1118'; minor panels 1119'-1122'; fold lines 1123'-1126'; top panels 1127', 1128'; fold lines 1129', 1130'; first overlap panels 1131'-1134'; perforations 1135'-1138'; top side closure flaps 1139'-1142'; cuts 1143'-1146'; fold lines 1147'-1150'; second overlap panels 1151'-1154'; and hand holes 1155', 1156'.

In carton 1100', minor panels 1119'-1122' are adhered to inside surfaces of side panels 1103', 1104', so that gusset panels 1111'-1114' extend diagonally across the corners of the interior of carton 1100' to provide vertical stacking strength. First overlap panels 1131'-1134' are adhered to outside surfaces of side panels 1107', 1108'. Top panels 1128', 1127' are pulled up, tearing perforations 1135'-1138' where the top panels are joined to first overlap panels 1131'-1134', to permit the top panels to be raised for loading. After loading, top side closure flaps 1139'-1142' are folded down and glued in place, later to be separated from the top panels along the perforations to enable access to the interior of carton 1100'.

Figure 55:
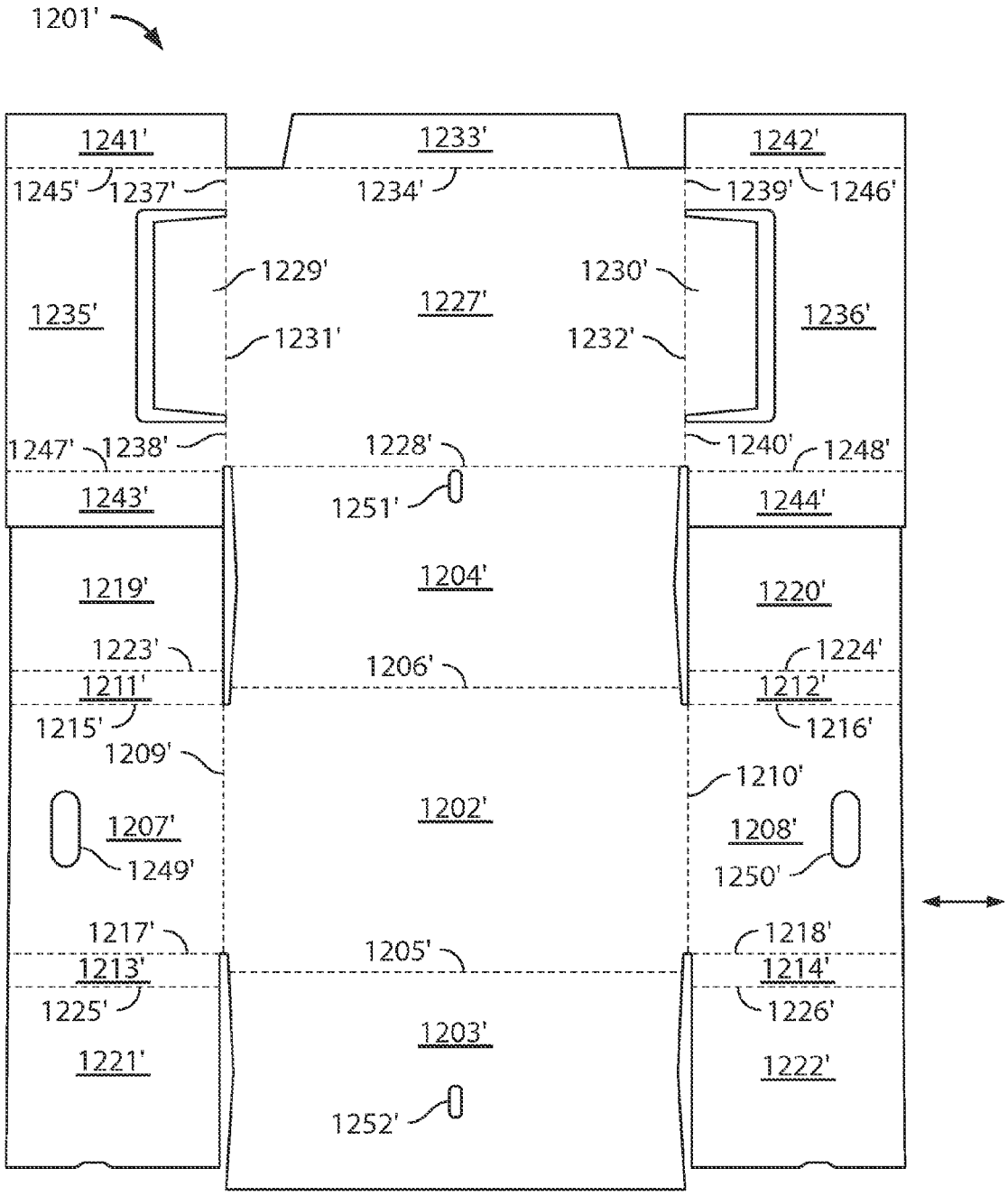
FIG. 55 is a plan view of a blank of a carton with integrated lid according to another preferred embodiment.
Figure 56:
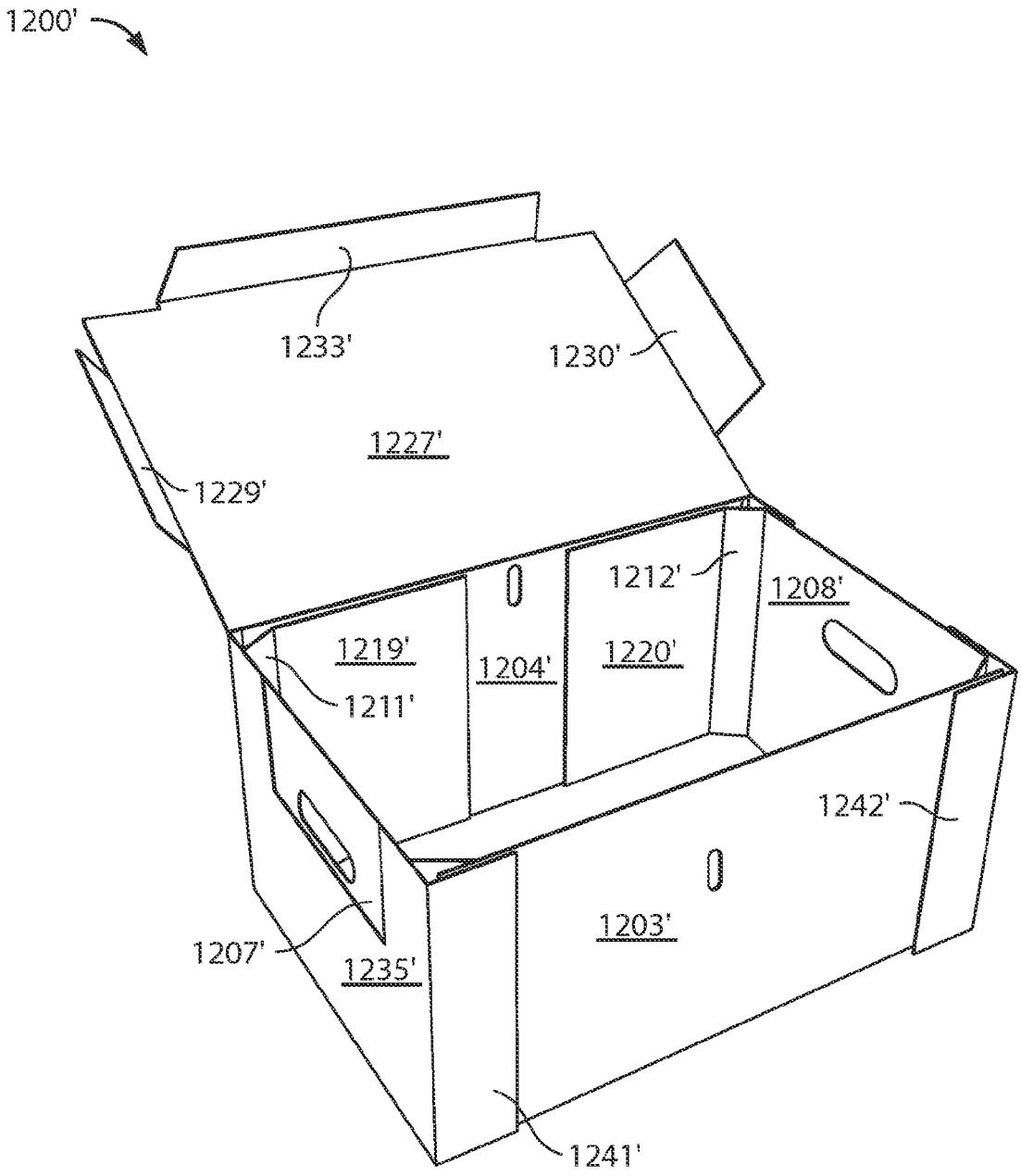
FIG. 56 is a simplified perspective view of a carton with integrated lid according to the embodiment of FIG. 55, shown in its erected configuration, with the top open prior to loading and sealing.

Carton 1200' of FIGS. 55-56 is formed from blank 1201'. For a corrugated paperboard blank, the preferred direction of the flutes is indicated by the double arrow in FIG. 55. Blank 1201' includes bottom panel 1202'; (front) end panel 1203'; (rear) end panel 1204'; fold lines 1205', 1206'; side panels 1207', 1208'; fold lines 1209', 1210'; gusset panels 1211'-1214'; fold lines 1215'-1218'; minor flaps 1219'-1222'; fold lines 1223'-1226'; top panel 1227'; fold line 1228'; top side closure flaps 1229', 1230'; fold lines 1231', 1232'; top front closure flap 1233'; fold line 1234'; first overlap panels 1235', 1236'; perforations 1237'-1240'; second overlap panels flaps 1241'-1244'; fold lines 1245'-1248'; hand holes 1249', 1250'; and vent holes 1251', 1252'.

Carton 1200' is formed from a blank 1201', which is similar to carton 1000' previously described, the primary difference being that the blank of carton 1200' is not provided with the top corner panels along the rear panel of the blank as in the embodiment of carton 1000'.

Figure 57:
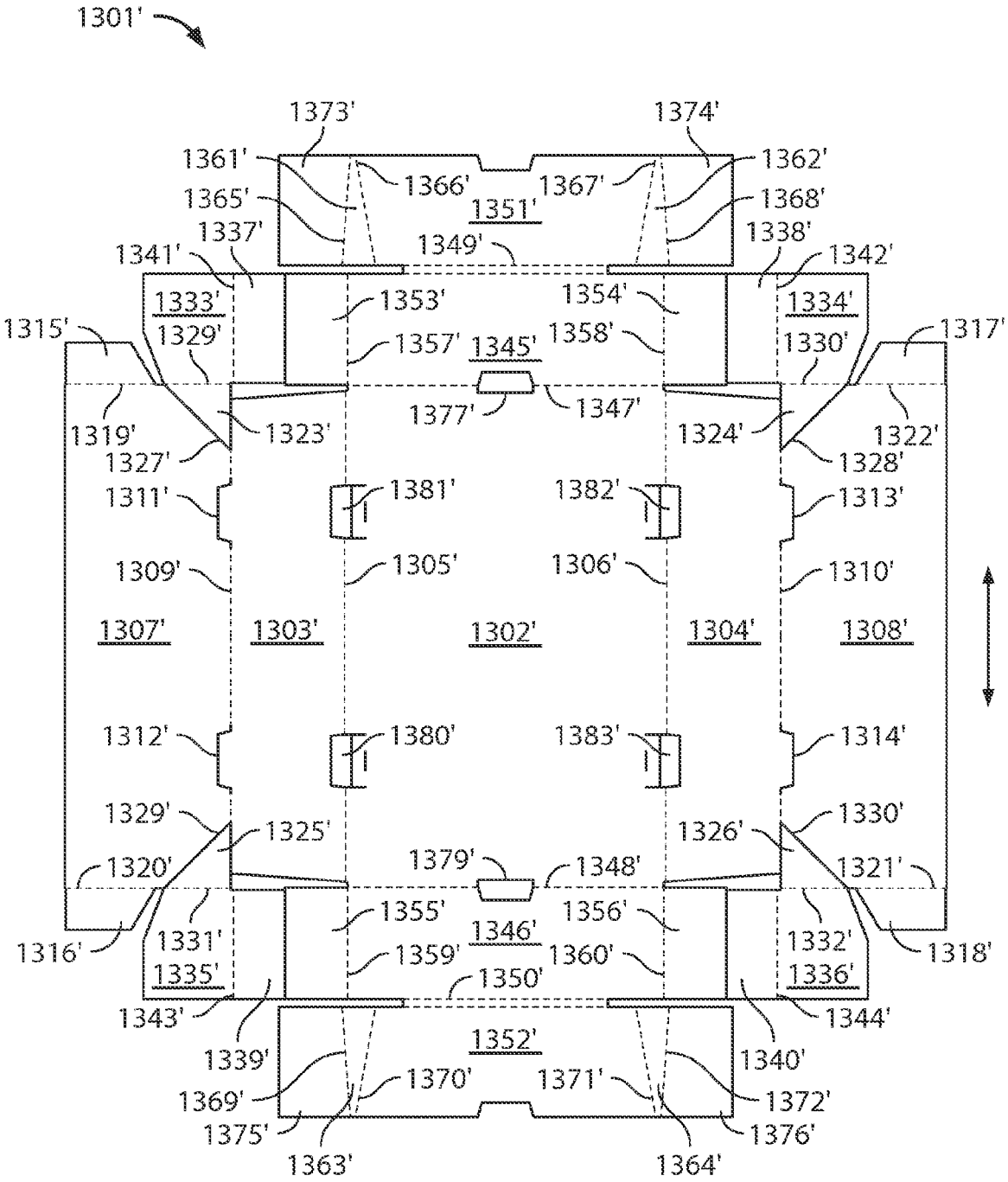
FIG. 57 is a plan view of a blank of a carton with integrated lid according to another preferred embodiment.
Figure 58:
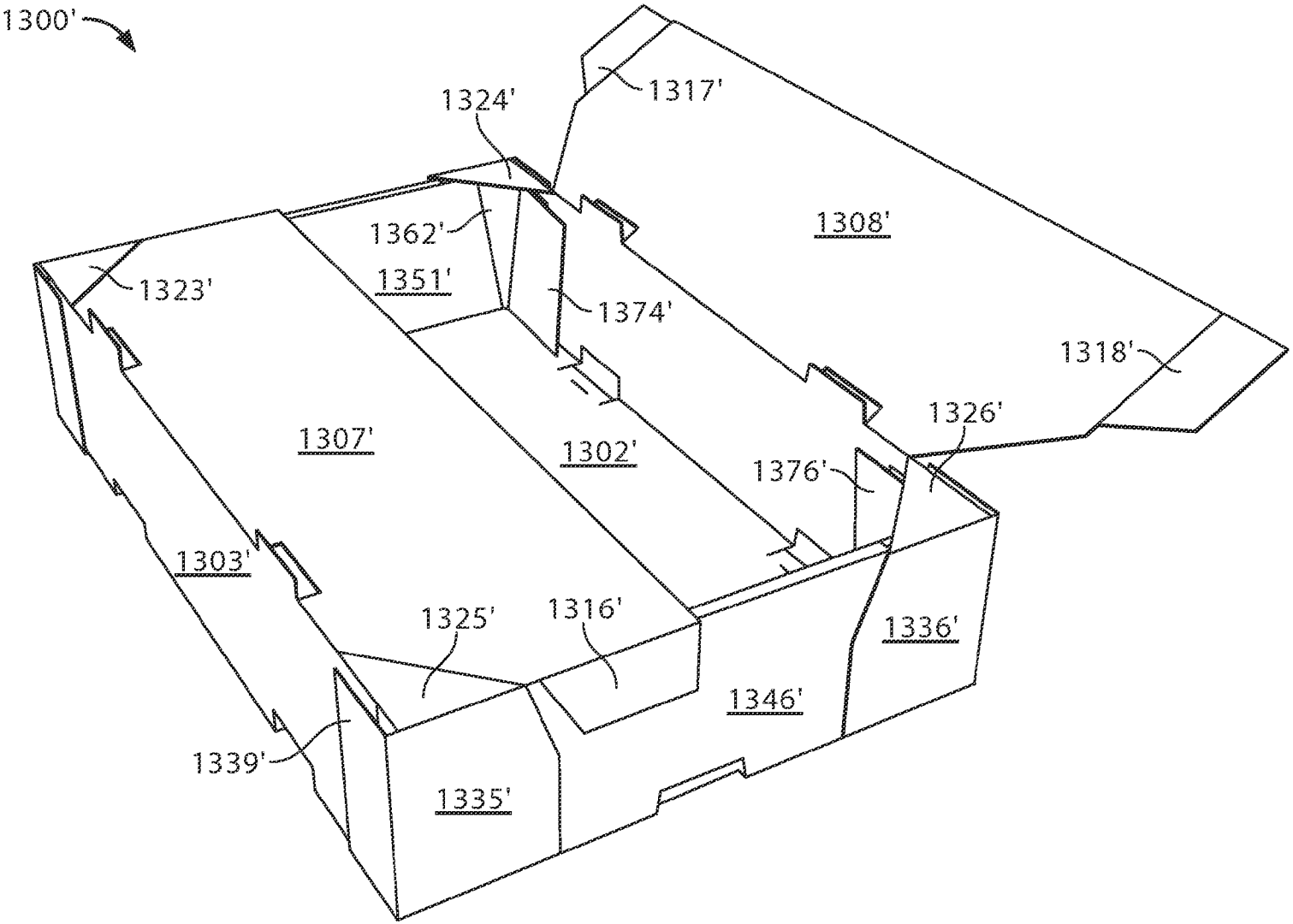
FIG. 58 is a simplified perspective view of a carton with integrated lid according to the embodiment of FIG. 57, shown in its erected configuration, with the top open prior to loading and sealing.

Carton 1300' of FIGS. 57-58 is formed from blank 1301'. For a corrugated paperboard blank, the preferred direction of the flutes is indicated by the double arrow in FIG. 57. Blank 1301' includes bottom panel 1302'; end panels 1303', 1304'; fold lines 1305', 1306'; top panels 1307', 1308'; fold line 1309' interrupted by die-cut stacking tabs 1311', 1312'; fold line 1310' interrupted by die-cut stacking tabs 1313', 1314'; top side closure flaps 1315'-1318'; fold lines 1319'-1322'; top corner panels 1323'-1326'; through-cuts 1327'-1330' (which could be replaced by perforations); fold lines 1331'-1334'; first overlap panels 1333'-1336'; second overlap panels 1337'-1340'; fold lines 1341'-1344'; outer side panels 1345', 1346'; fold lines 1347'-1348'; double fold lines 1349', 1350'; inner side panels 1351', 1352'; outer side panel minor flaps 1353'-1356'; fold lines 1357'-1360'; V-shaped gusset panels 1361'-1364'; fold lines 1365'-1372'; inner side panel minor flaps 1373'-1376'; vent openings 1377', 1379'; die-cut stacking slots 1380'-1383'.

Carton 1300', shown in FIGS. 57-58, is, except for the proportions, substantially similar in the structure and mode of operation to carton 300'. In addition, top side closure flaps 1315'-1318' extend from end edges of the top panels and are adhered to outside surfaces of side panels 1345', 1346'.

Figure 59:
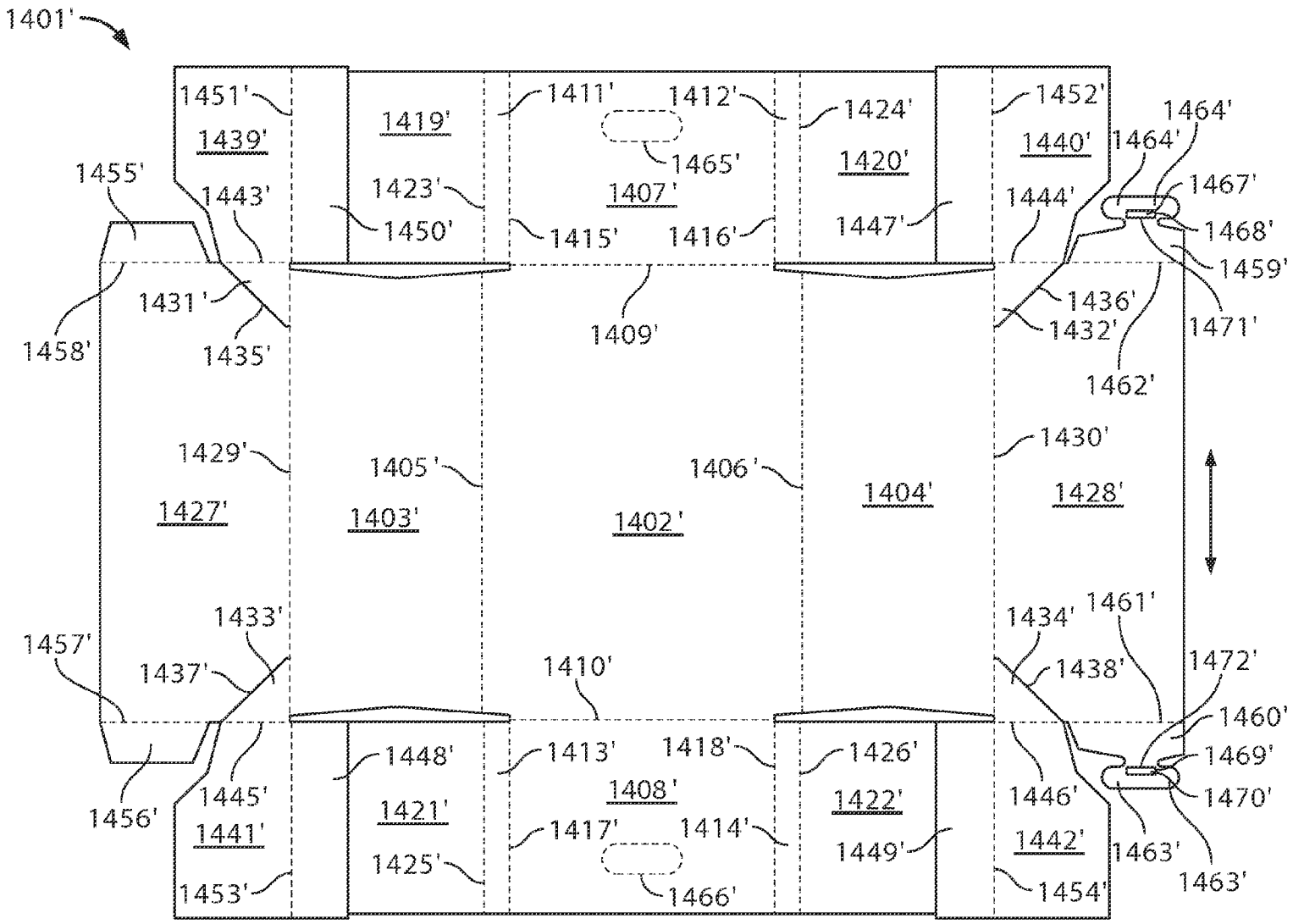
FIG. 59 is a plan view of a blank of a carton with integrated lid according to another preferred embodiment.
Figure 60:
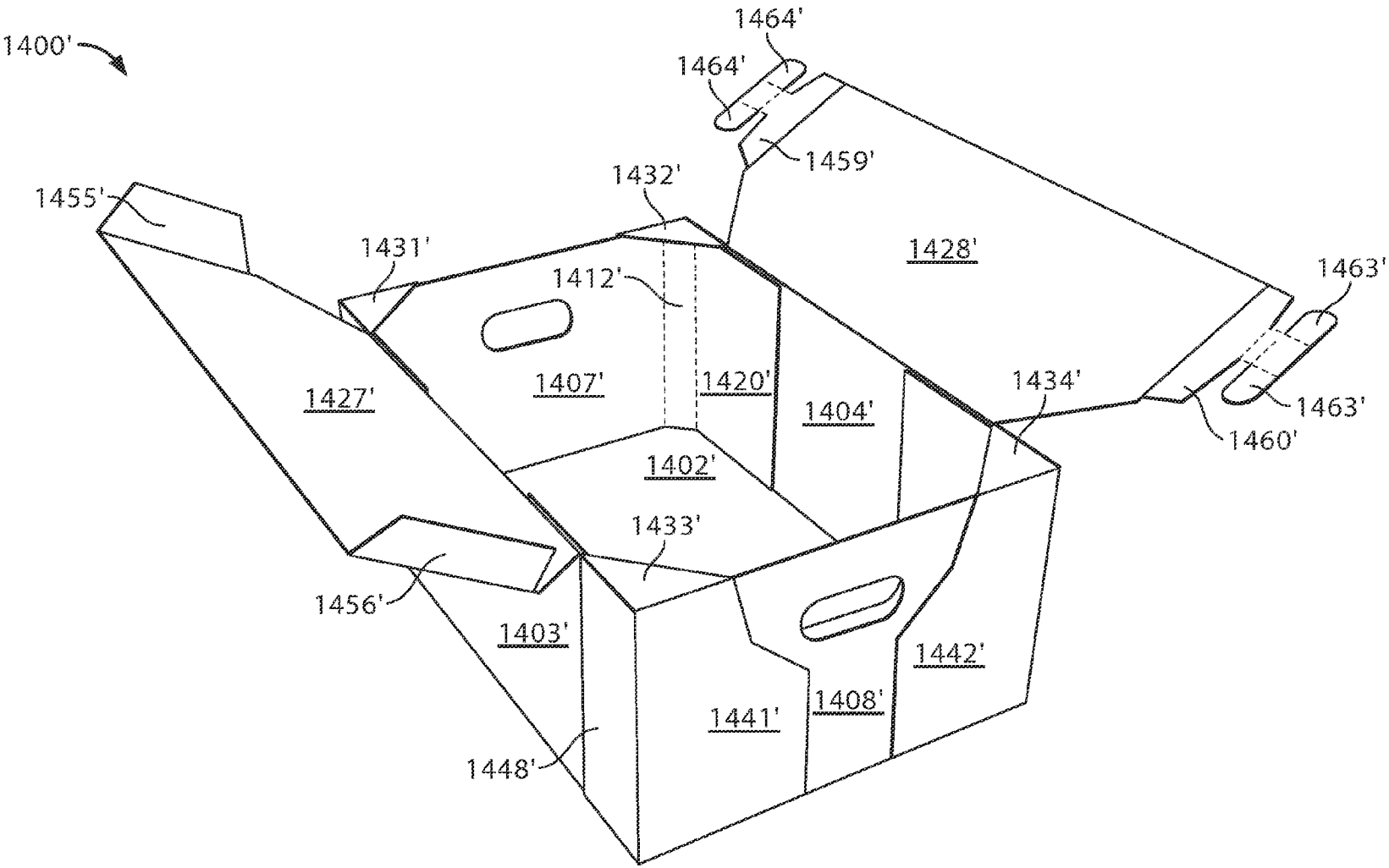
FIG. 60 is a simplified perspective view of a carton with integrated lid according to the embodiment of FIG. 59, shown in its erected configuration, with the top open prior to loading and sealing.

Carton 1400', shown in FIGS. 59-60, is a two top panel carton, but based on an asymmetrical blank 1401'. For a corrugated paperboard blank, the preferred direction of the flutes is indicated by the double arrow in FIG. 59. Blank 1401' includes bottom panel 1402'; end panels 1403', 1404'; fold lines 1405', 1406'; side panels 1407', 1408'; fold lines 1409', 1410'; gusset panels 1411'-1414'; fold lines 1415'-1418'; minor flaps 1419'-1422'; fold lines 1423'-1426'; top panels 1427', 1428'; fold lines 1429', 1430'; top corner panels 1431'-1434'; through-cuts 1435'-1438' (which could be replaced by perforations); first overlap panels 1439' 1442'; fold lines 1443'-1446'; second overlap panels 1447'-1450'; fold lines 1451'-1454'; top side closure flaps 1455', 1456'; fold lines 1457', 1458'; locking flaps 1459', 1460'; fold lines 1461', 1462'; tabs 1463', 1464'; hand holes 1465', 1466'.

In the embodiment shown in FIGS. 59-60, tabs 1463', 1464' are set off by separate score lines 1467'-1470' that extend perpendicular to fold lines 1471', 1472' that extend across locking flaps 1459', 1460'. In an alternative embodiment of the invention, score lines 1467'-1470' may be omitted.

In carton 1400', minor flaps 1419'-1422' are adhered to inside surfaces of end panels 1403', 1404'. First overlap panels 1439'-1442' are adhered to outside surfaces of side panels 1407', 1408' and/or second overlap panels 1447'-1450' are adhered to outside surfaces of end panels 1403', 1402'. To maintain closure panel 1427' in place over bottom panel 1402', closure flaps 1455', 1456' are folded down over the outer surfaces of side panels 1407', 1408', while tabs 1464', 1463' or locking flaps 1459', 1460' are inserted and received through hand holes 1465', 1466', locking the top flaps 1427', 1428' down in place.

Figure 61:
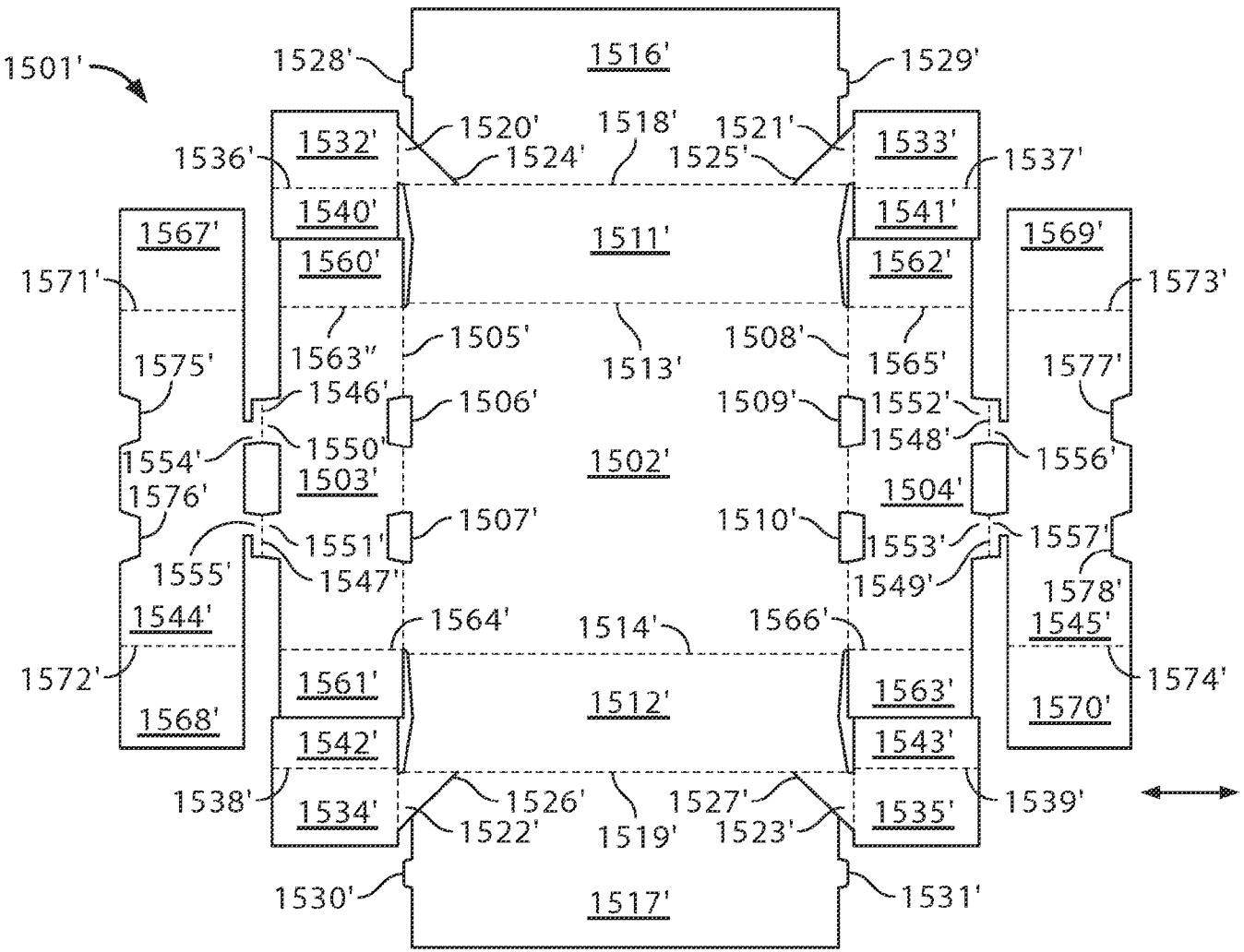
FIG. 61 is a plan view of a blank of a carton with integrated lid according to another preferred embodiment.
Figure 62:
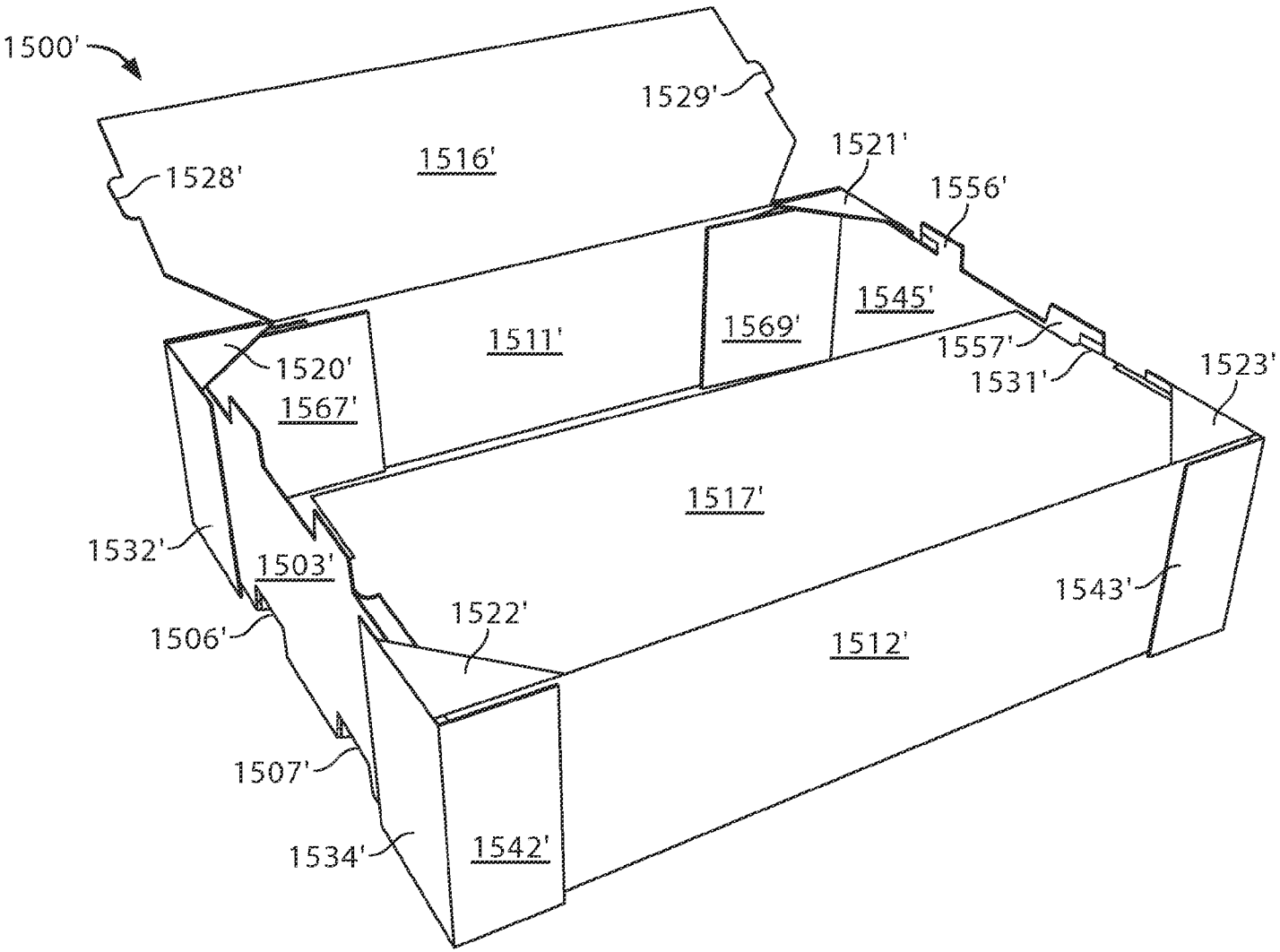
FIG. 62 is a simplified perspective view of a carton with integrated lid according to the embodiment of FIG. 61, shown in its erected configuration, with the top open prior to loading and sealing.

FIGS. 61-62 illustrate a covered carton with self-locking top panels. For a corrugated paperboard blank, the preferred direction of the flutes is indicated by the double arrow in FIG. 61. Carton 1500' is formed from blank 1501', which includes bottom panel 1502'; outer side panels 1503', 1504'; fold line 1505', interrupted by stacking notches 1506', 1507'; fold line 1508' interrupted by stacking notches 1509', 1510'; end panels 1511', 1512'; fold lines 1513', 1514'; top panels 1516', 1517'; fold lines 1518', 1519'; top corner panels 1520'-1523'; through-cuts 1524' 1527' (which may be replaced by perforations); locking tabs 1528'-1531'; first overlap panels 1532'-1535'; fold lines 1536'-1539'; second overlap panels 1540'-1543'; inner side panels 1544', 1545'; web fold lines 1546'-1549'; outer side panel stacking tabs 1550'-1553'; inner side panel stacking tabs 1554'-1557'; minor flaps 1560'-1563'; fold lines 1563"-1566'; minor flaps 1567'-1570'; fold lines 1571'-1574'; and stacking notches 1575'-1578'.

In the carton 1500', minor flaps 1560'-1563' are affixed to inside surfaces of end panels 1511', 1512' and minor flaps 1567'-1570' are affixed to inside surfaces of minor flaps 1560'-1563'. In addition, second overlap panels 1540'-1543' are affixed to outside surfaces of end panels 1511', 1512'. The stacking tab structures 1554'-1557' also serve to help keep the lid closed or re-closeable by being provided with notches that receive locking tabs 1528', 1531' as indicated in FIG. 62.

Figure 63:
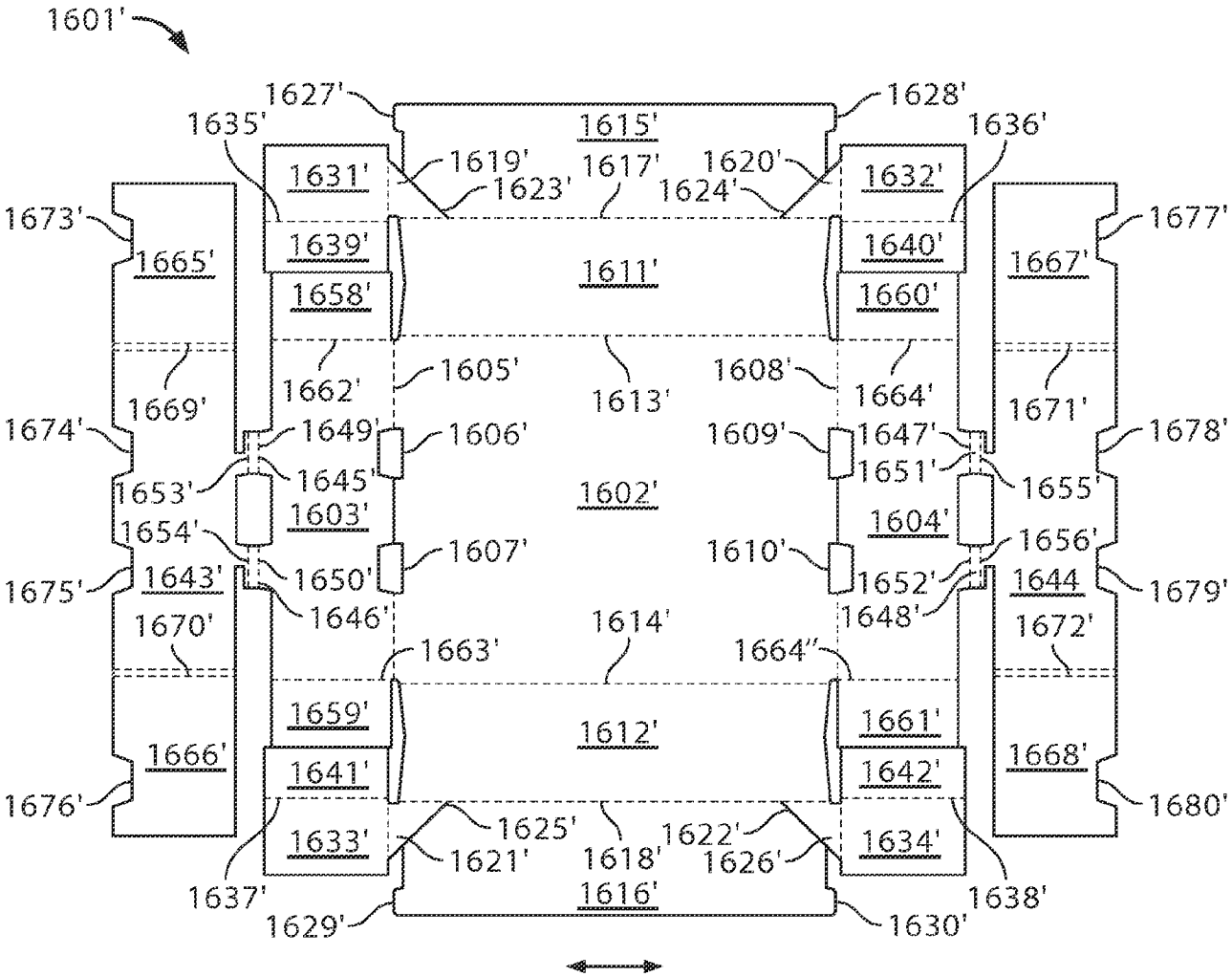
FIG. 63 is a plan view of a blank of a carton with integrated lid according to another preferred embodiment.
Figure 64:
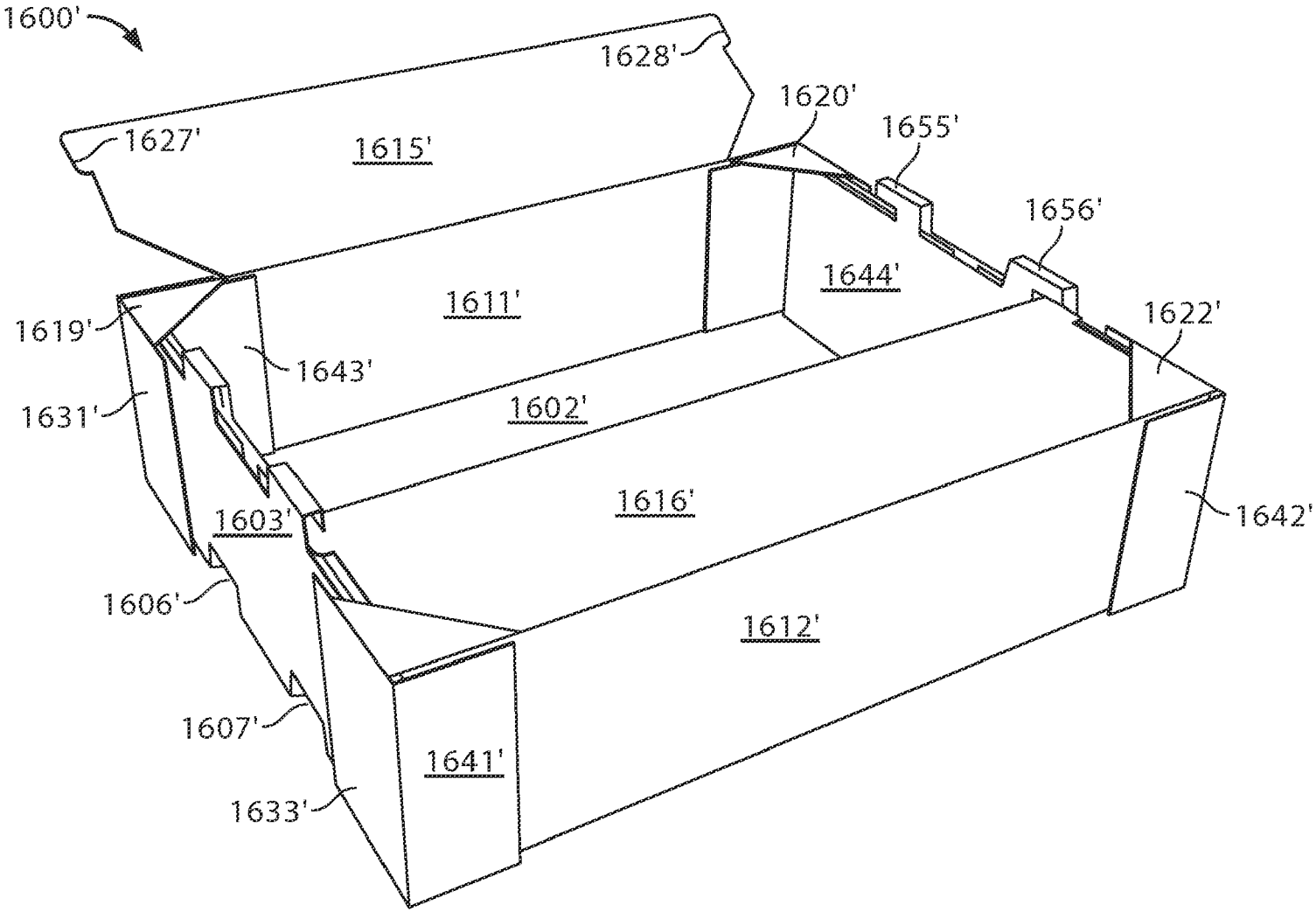
FIG. 64 is a simplified perspective view of a carton with integrated lid according to the embodiment of FIG. 63, shown in its erected configuration, with the top open prior to loading and sealing.

Carton 1600' of FIGS. 63-64 is formed from blank 1601', and has bottom panel 1602'; outer side panels 1603', 1604'; fold line 1605', interrupted by stacking openings 1606', 1607'; fold line 1608', interrupted by stacking openings 1609', 1610'; end panels 1611', 1612'; fold lines 1613', 1614'; top panels 1615', 1616'; fold lines 1617', 1618'; top corner panels 1619'-1622'; through-cuts 1623'-1626' (which may be replaced by perforations); locking tabs 1627'-1630'; first overlap panels 1631'-1634'; fold lines 1635'-1638'; second overlap panels 1639'-1642'; inner side panels 1643', 1644'; web double fold lines 1645'-1648'; outer side panel stacking tabs 1649'-1652'; notched inner side panel stacking tabs 1653'-1656'; minor flaps 1658'-1661'; fold lines 1662'-1664"; minor flaps 1665'-1668'; double fold lines 1669'-1672'; and stacking notches 1673'-1680'. For a corrugated paperboard blank, the preferred direction of the flutes is indicated by the double arrow in FIG. 63.

In carton 1600', the structure mode of operation and manner of affixation of certain panels to other panels is substantially similar to that of the embodiment of carton 1500', except that the panels emanating from the ends of the inner side panels are elongated so as to be folded back upon outwardly facing surfaces of the inner side panels. Thus, panels 1665', 1666' are captured between panels 1603' and 1643', and panels 1667' and 1668' are captured between panels 1604' and 1664'. This sandwiching so of panels is evidenced in FIG. 64, particularly on the left end of the carton where outer side panel 1603' and inner side panel 1643' capture between them panels 1665' and 1666'.

Figure 65:
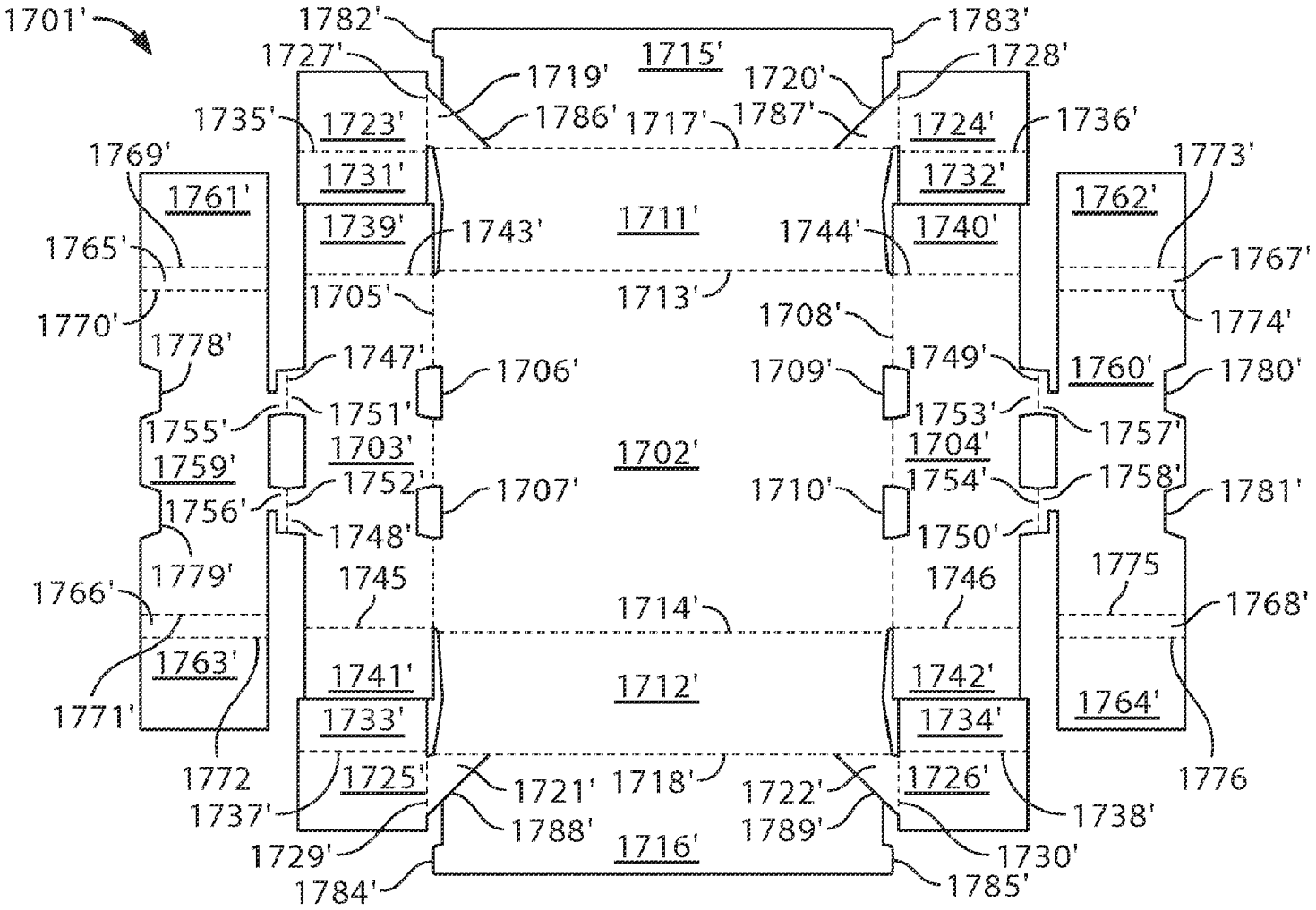
FIG. 65 is a plan view of a blank of a carton with integrated lid according to another preferred embodiment.
Figure 66:
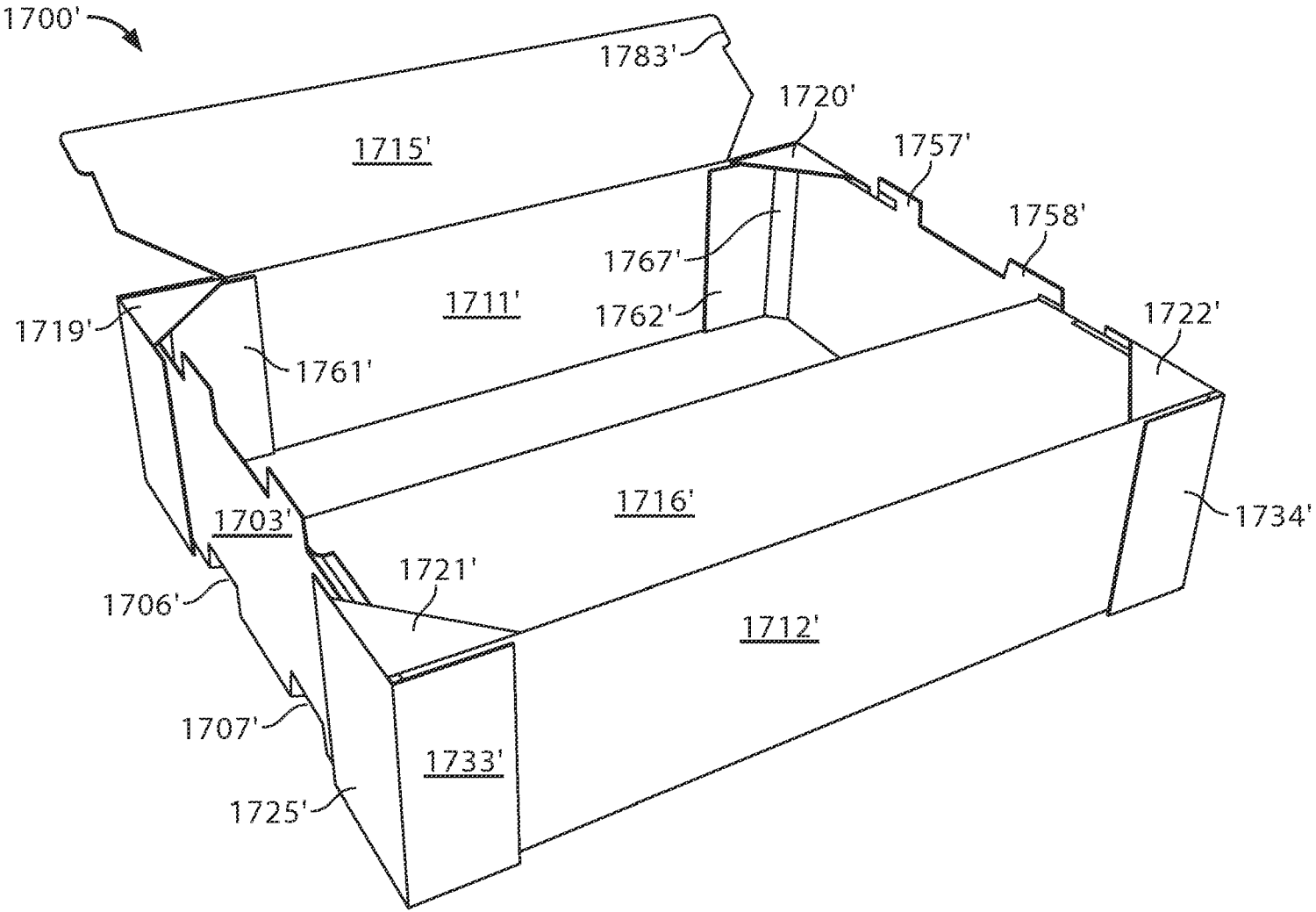
FIG. 66 is a simplified perspective view of a carton with integrated lid according to the embodiment of FIG. 65, shown in its erected configuration, with the top open prior to loading and sealing.

Carton 1700' is illustrated in FIGS. 65-66. For a corrugated paperboard blank, the preferred direction of the flutes is indicated by the double arrow in FIG. 65. Blank 1701' includes bottom panel 1702'; outer side panels 1703', 1704'; fold line 1705' interrupted by stacking openings 1706', 1707'; fold line 1708' interrupted by stacking openings 1709', 1710'; end panels 1711', 1712'; fold lines 1713', 1714'; top panels 1715', 1716'; fold lines 1717', 1718'; top corner panels 1719'-1722'; through-cuts 1786'-1789'; first overlap panels 1723'-1726'; fold lines 1727'-1730'; second overlap panels 1731'-1734'; fold lines 1735'-1738'; minor flaps 1739'-1742'; fold lines 1743'-1746'; web fold lines 1747'-1750'; outer side panel stacking tabs 1751'-1754'; inner side panel stacking tabs 1755'-1758'; inner side panels 1759', 1760'; minor flaps 1761'-1764'; gusset panels 1765'-1768'; fold lines 1769'-1776'; stacking notches 1778'-1781'; and locking tabs 1782'-1785'.

Carton 1700' is substantially similar to cartons 1600', except that gusset panels are provided adjacent inside side panels 1759' and 1760' with minor flaps 1739'-1742' being adhered to inside surfaces of end panels 1711', 1712' and minor flaps 1761'-1764' being affixed to inside minor flaps 1739'-1742'. The closure mechanism for carton 1700' is the same as it is for carton 1600'.

Carton 1800' (FIGS. 67-68) includes self-locking top panels as well as interior corner supports. For a corrugated paperboard blank, the preferred direction of the flutes is indicated by the double arrow in FIG. 67. Blank 1801' includes bottom panel 1802'; end panels 1803', 1804'; fold line 1805', interrupted by stacking openings 1806, 1807'; fold line 1808', interrupted by stacking openings 1809', 1810'; outer side panels 1811', 1812'; fold line 1813', interrupted by stacking openings 1814', 1815'; fold line 1816', interrupted by stacking openings 1817', 1818'; notched stacking tabs 1819'-1822'; side end panels 1823', 1824'; double fold lines 1825', 1826'; stacking notches 1827'-1830'; gusset panels 1831'-1834'; fold lines 1835'-1838'; minor flaps 1839'-1843'; fold lines 1843'-1846'; minor flaps 1847'-1850'; fold lines 1851'-1854'; fold line 1855', interrupted by die-cut stacking tabs 1856', 1857'; fold line 1858', interrupted by die-cut stacking tabs 1859', 1860'; outer top panels 1861', 1862'; top corner panels 1863'-1866'; through-cuts 1867'-1870'; overlap panels 1871'-1874'; fold lines 1875'-1878'; inner top panels 1879', 1880'; fold lines 1881', 1882'; locking tab receiving slots 1883'-1886'; and knock-outs 1887'-1890' (surrounded by oval lines of perforations).

In carton 1801', the stacking tab structures are incorporated into the side and end panel structures, especially upon folding over of the inner side panels to the positions inside the outer side panels exposes the hooked stacking and closure tabs 1819'-1822'. Minor flaps 1847'-1850' are affixed to inside surfaces of outer end panels 1803, 1804 and minor flaps 1839'-1843' are affixed to minor flaps 1847'-1850', while support panels 1871'-1874' are affixed to outside surfaces of outer side panels 1811', 1812'.

Figure 69:
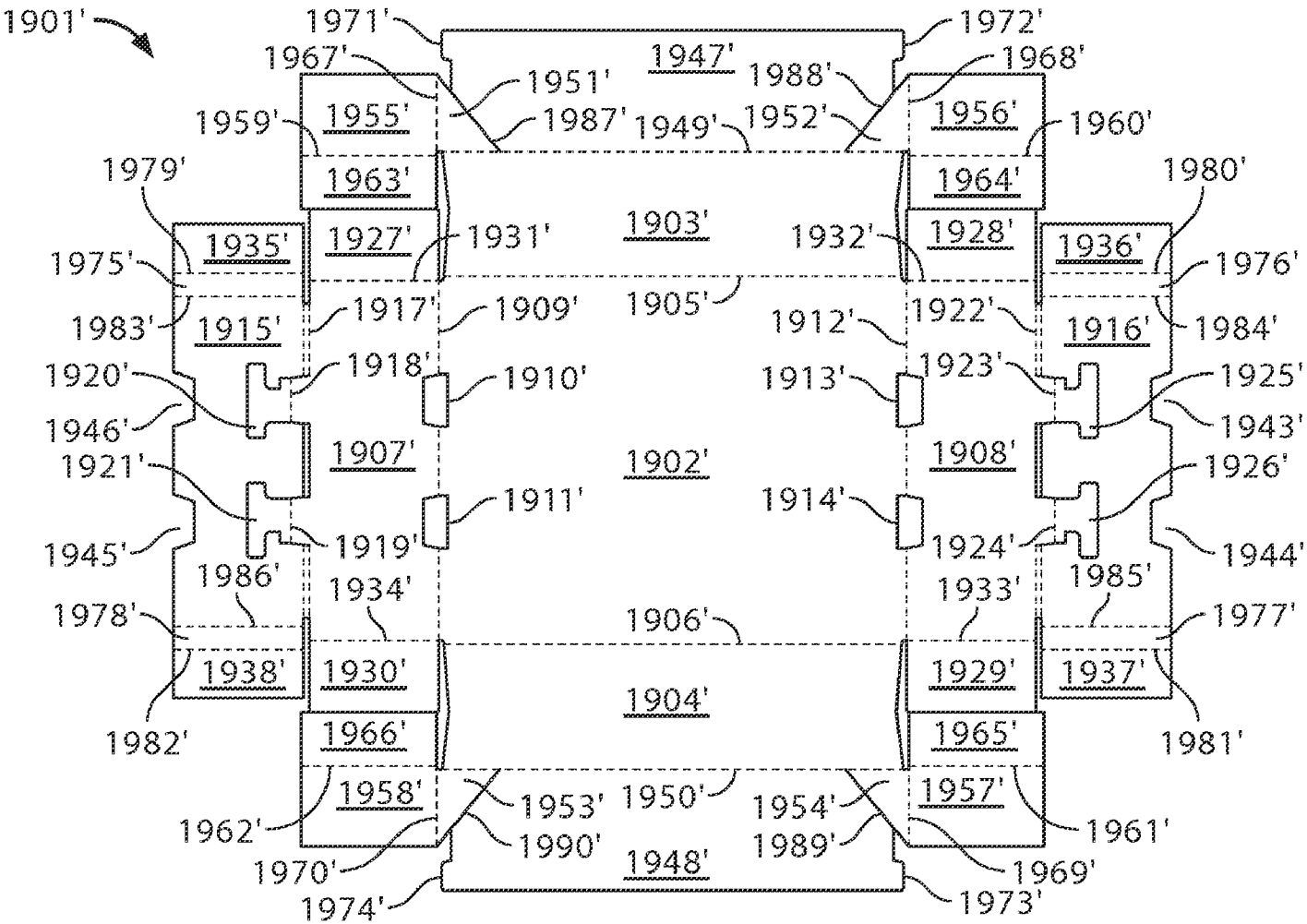
FIG. 69 is a plan view of a blank of a carton with integrated lid according to another preferred embodiment.
Figure 70:
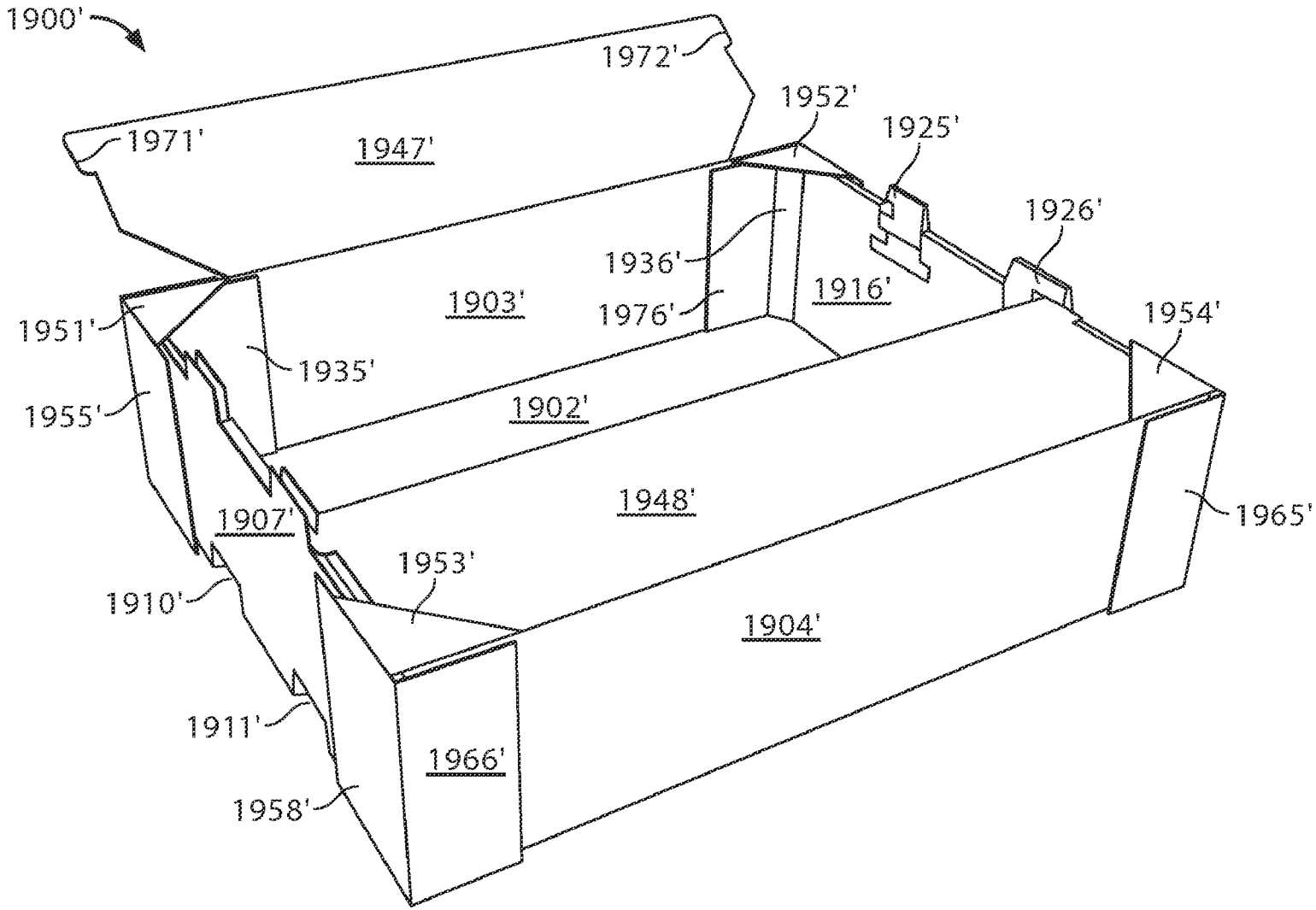
FIG. 70 is a simplified perspective view of a carton with integrated lid according to the embodiment of FIG. 69, shown in its erected configuration, with the top open prior to loading and sealing.
Figure 71:
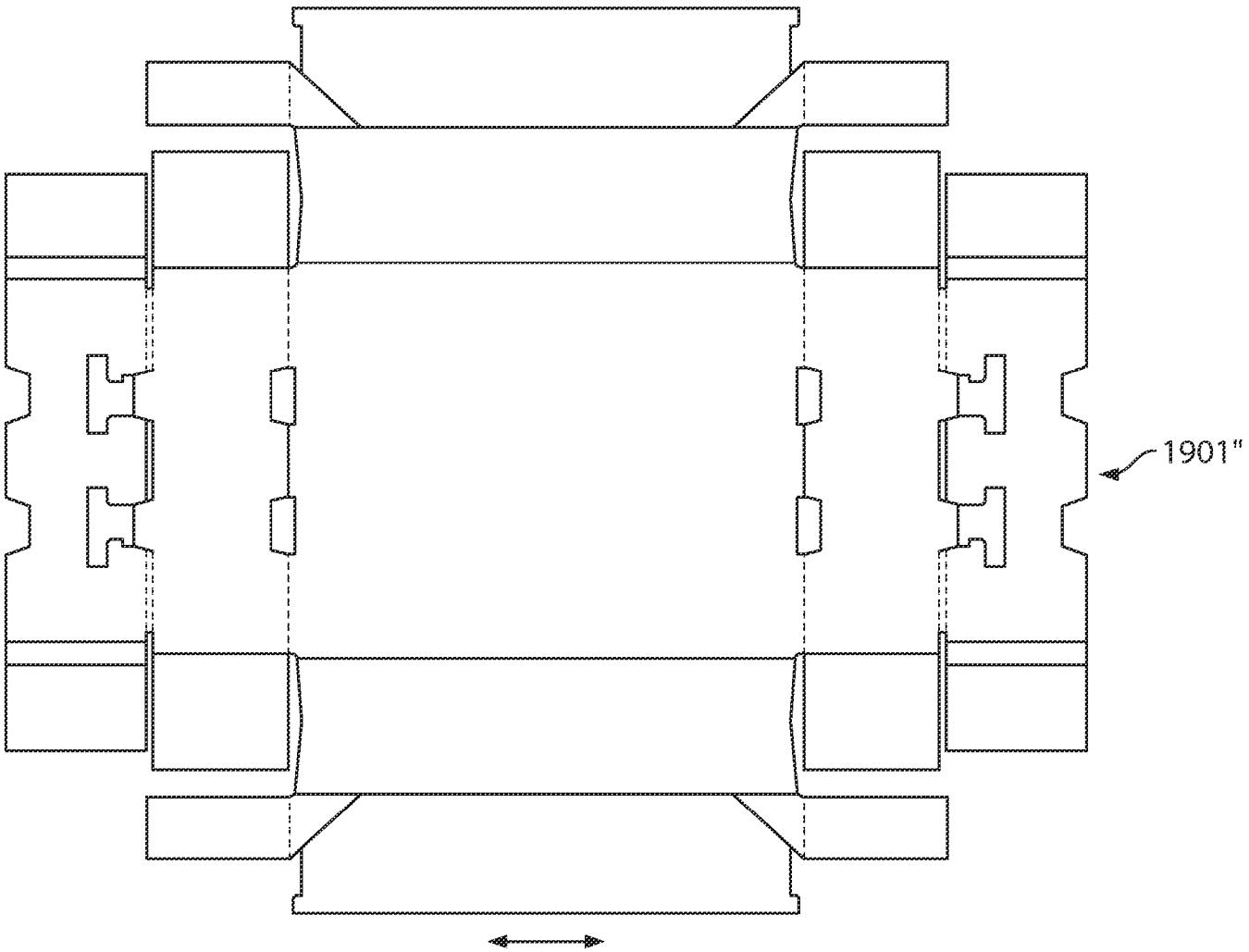
FIG. 71 is a plan view of a blank of a carton with integrated lid according to another preferred embodiment.
Figure 72:
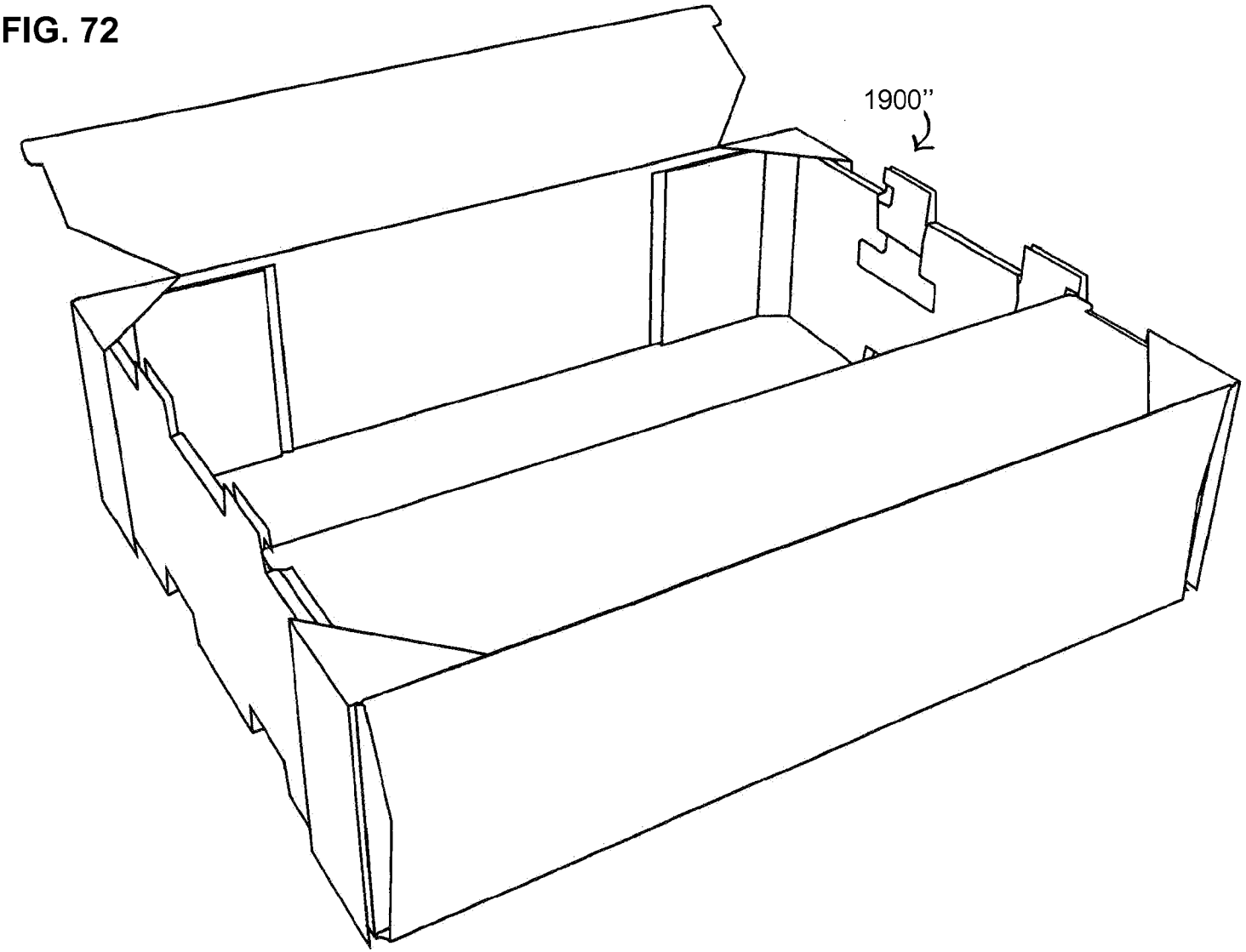
FIG. 72 is a simplified perspective view of a carton with integrated lid according to the embodiment of FIG. 71, shown in its erected configuration, with the top open prior to loading and sealing.

FIGS. 69-70 illustrate a covered tray with integral lid, and having stacking tabs. For a corrugated paperboard blank, the preferred direction of the flutes is indicated by the double arrow in FIG. 69. Covered tray 1900' is formed from blank 1901' (preferably bilaterally symmetrical), which includes bottom panel 1902', end panels 1903', 1904'; fold lines 1905', 1906'; outer side panels 1907', 1908'; fold line 1909', interrupted by vent/stacking holes 1910', 1911'; fold line 1912', interrupted by vent/stacking holes 1913', 1914'; inner side panels 1915', 1916'; double fold line 1917', interrupted by T-tab structures 1920', 1921' including offset tab fold lines 1918', 1919'; double fold line 1922', interrupted by T-tab structures 1925', 1926' including offset tab fold lines 1923', 1924'; outer side panel minor flaps 1927'-1930'; fold lines 1931'-1934'; inner side panel minor flaps 1935'-1938'; inner side panel notches 1943'-1946'; top panels 1947', 1948'; fold lines 1949', 1950'; top corner panels 1951'-1954'; first overlap panels 1955'-1958'; fold lines 1959'-1962'; second overlap panels 1963'-1966'; fold lines 1967'-1970'; top panel locking tabs 1971'-1974'. Blank 1901' also includes gusset panels 1975'-1978'; fold lines 1979'-1986'; and through cuts 1987'-1990' (which may be substituted by perforations). An alternative embodiment of this carton, carton 1900", is shown in FIGS. 71-72, wherein blank 1901' is nearly identical to blank 1900', except that panels 1963'-1966' have been omitted, and panels, corresponding to panels 1927'-1930' in blank 1900', have been lengthened. For a corrugated paperboard blank, the preferred direction of the flutes is indicated by the double arrow in FIG. 71.

Carton 1900' features T-shaped stacking tabs similar to the embodiment of carton 600', with the notches for capturing locking tabs in the lid panels as in the embodiment of carton 1800'. In carton 1900', inner side panel minor flaps 1927'-1930' are adhered to inside surfaces of end panels 1903', 1904' and minor flaps 1935'-1938' are adhered to outside minor flaps 1927'-1930', such that gusset panels 1975'-1978' extend diagonally across the corners of the interior volume. Second overlap panels 1963'-1966' are adhered to outside surfaces of end panels 1903', 1904'. As mentioned, top panels 1947', 1948' may be retained in place through the capture of locking tabs 1971'-1974' which can be received in the notches in T-tab structures 1925', 1926', 1920' and 1921'. As mentioned, carton 1900' is substantially identical in structure and mode of operation to carton 1900'.

Figure 67:
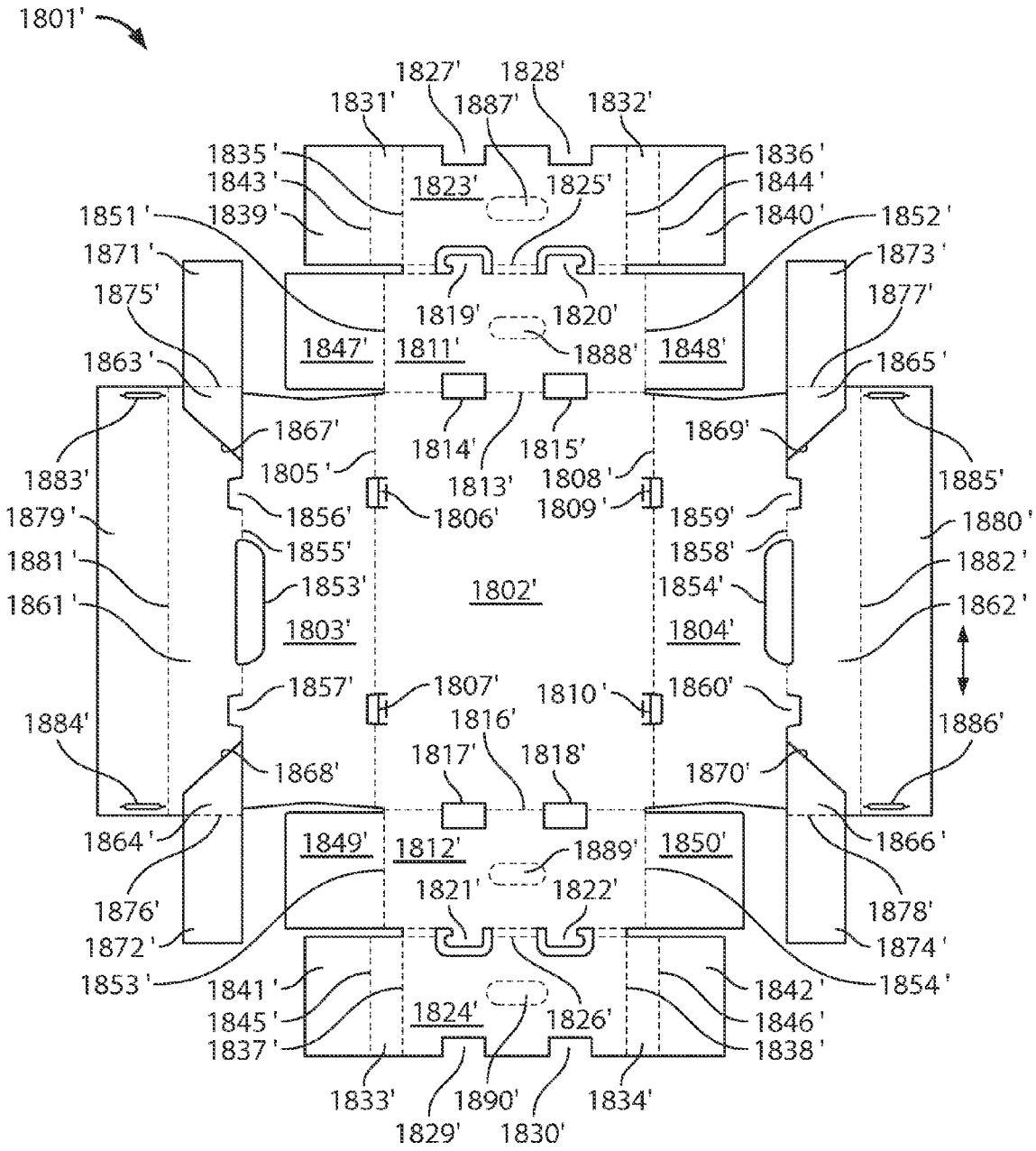
FIG. 67 is a plan view of a blank of a carton with integrated lid according to another preferred embodiment.
Figure 68:
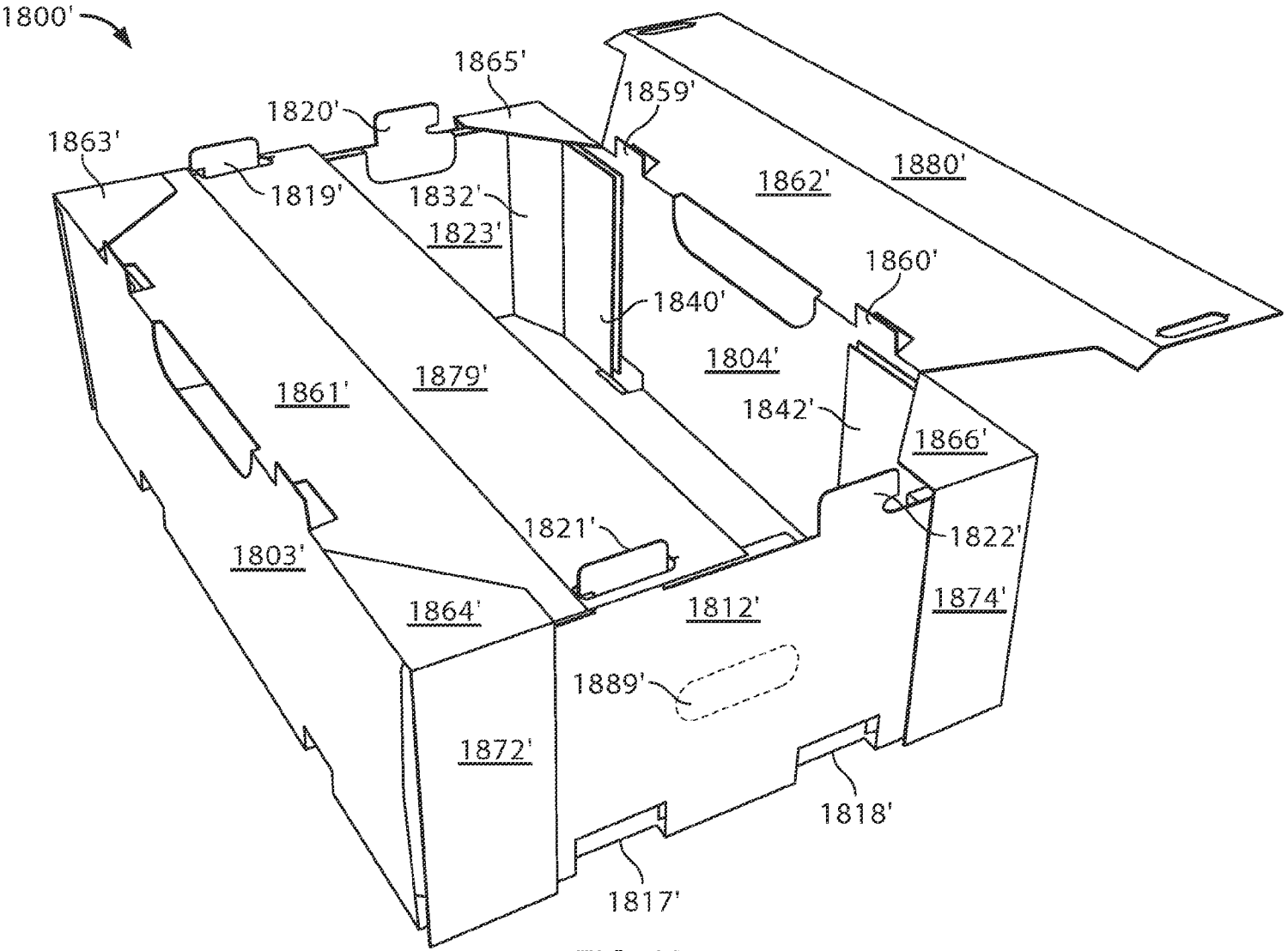
FIG. 68 is a simplified perspective view of a carton with integrated lid according to the embodiment of FIG. 67, shown in its erected configuration, with the top open prior to loading and sealing.
Figure 73:
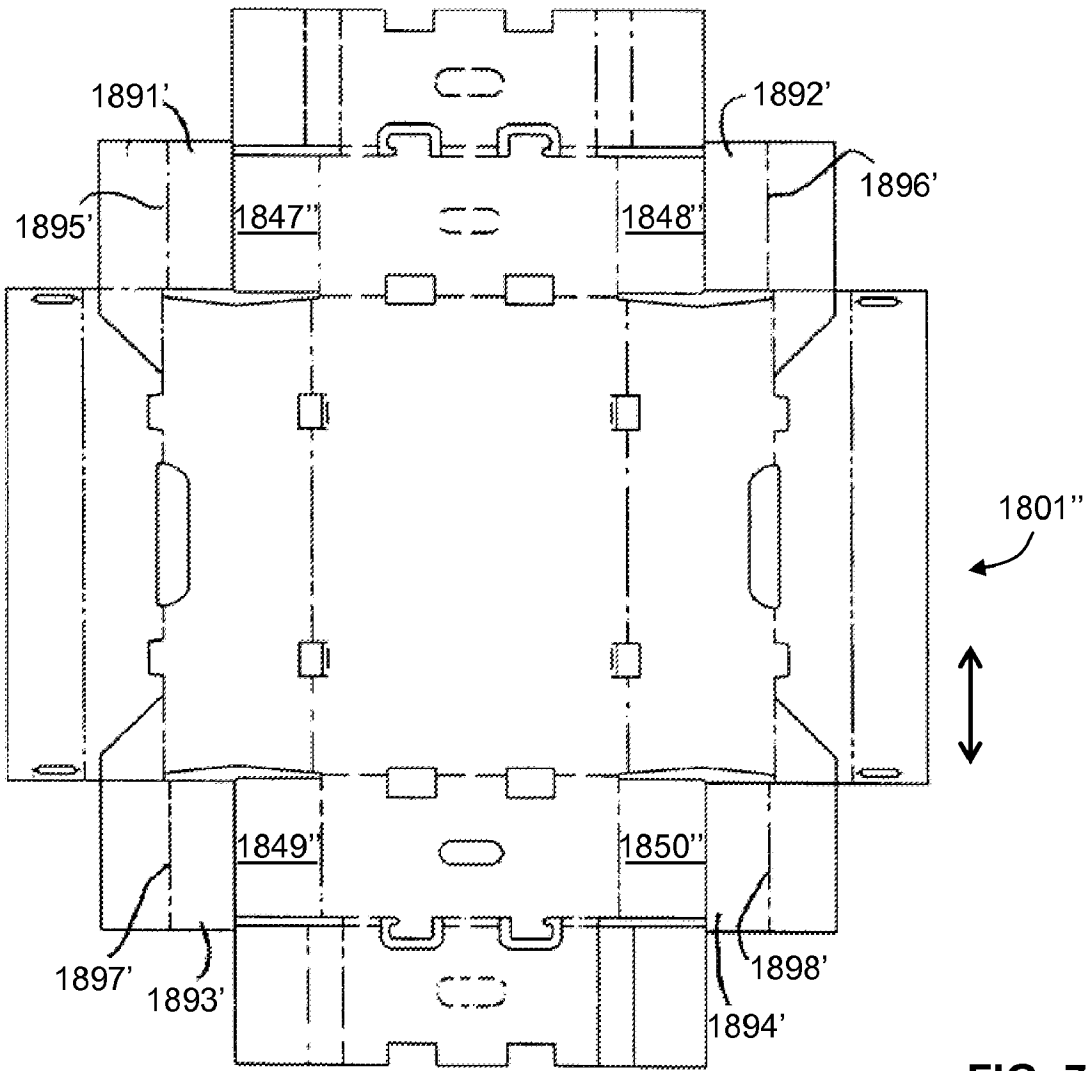
FIG. 73 is a plan view of a blank of a carton with integrated lid according to another preferred embodiment.
Figure 74:
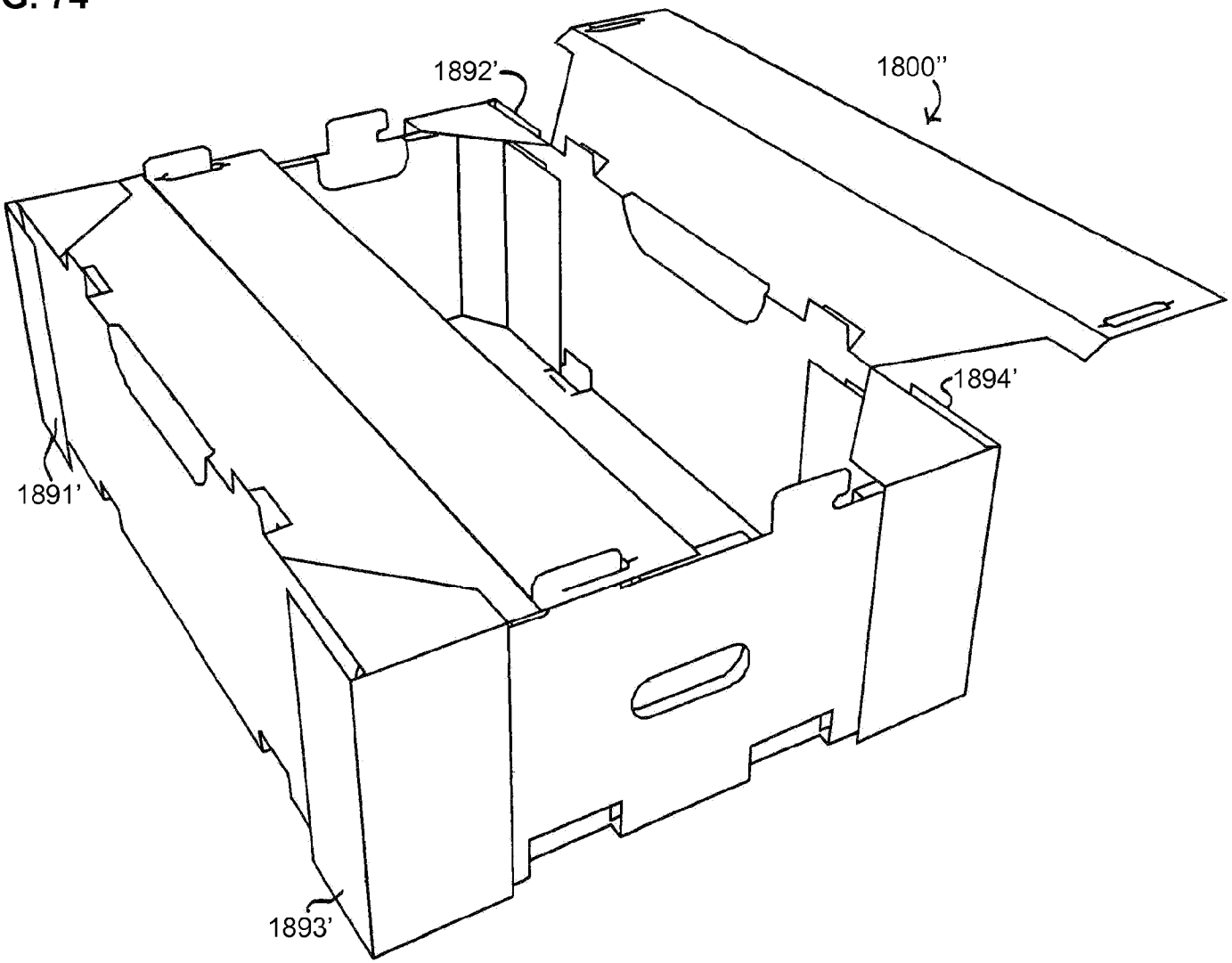
FIG. 74 is a simplified perspective view of a carton with integrated lid according to the embodiment of FIG. 73, shown in its erected configuration, with the top open prior to loading and sealing.

Carton 1800" of FIGS. 73-74 is substantially identical to carton 1800' of FIGS. 67-68, except that blank 1801" is provided with second overlap panels 1891'-1894', along fold lines 1895'-1898', and the shortening of panels 1847'-1850' as compared to panels 1847'-1850' in blank 1801'.

Although processes for forming and packing the foregoing cartons are provided specifically for the embodiments of FIGS. 28-30 and 49-50, it is to be understood that one of ordinary skill in the art, having the present disclosure before them, would readily be able to modify existing carton forming equipment, using ordinary design and engineering skills, for the purposes of erecting, and subsequently sealing, the cartons, of each of the embodiments, without departing from the scope of the present invention, and without extensive experimentation.

The carton designs of FIGS. 29-78 the present invention permit the carton to be fully erected with all of the vertical inner and outer flaps and any attached flaps to be sealed and properly positioned for maximum stacking performance, but will allow a portion of the top flaps (horizontal) to be separated from the vertical outer end flaps so that access to the carton cavity can be accomplished for loading of product. Additional design features incorporated into the separated top flap feature allow the top flaps to be sealed or locked into position as desired after the product has been loaded.

As described herein, among the critical features that enable the cartons of FIGS. 29-78, to perform well is the strategic use of slits or perforations that separate the top horizontal panel (flap) from the end flaps of a tray or wrap design having full overlapping end flaps. These fully overlapping vertical end flaps may include additional (secondary) flaps which provide additional corner structures for added stack strength. Through the utilization of the slits or perforations (nicks), this permits the erecting machine to fully set up the carton's stacking features (inner and outer full overlapping flaps and inner and where applicable outer minor flaps), but allows the horizontal top flaps to remain free or only lightly attached (nicked) to the end flaps.

This allows user access to the carton cavity for loading of the products through either manual, man-machine interface, or automatic methods. In the situation in which a slit is used to separate the top and end structures, the carton can be effectively erected with the top flaps left in an upright position upon discharge from the erecting machine. In the situation in which nicks are used, keeping the top and end panels connected, the top flaps are in a horizontal or closed position upon discharge from the machine and opened, through the breaking of the nicks (either manually or mechanically) when desired. Final sealing or closure is accomplished with special features, such as slot and tab mechanisms, or through the use of additional material removed from the vertical end flaps and left attached to the horizontal top flaps (such as a flange), which is glued to the outer container walls to facilitate final closure when desired. These features, among others, permit this strategic use of the top flap panel, while protecting the important functions of the end flaps, can be applied to a number of container designs, as shown in the accompanying description and drawings.

The cartons of FIGS. 79-84 are preferably fabricated from paper, paperboard and/or corrugated paperboard, although other materials having similar performance characteristics may be employed, as desired or dictated by the requirements of a particular application. When each of the blanks of FIGS. 79-84 are discussed, it is to be understood that the panels which form the corner support structures may emanate from panels that are longer, shorter or the same length as the panels which extend perpendicularly thereto (in the erected carton), so the terms "side" and "end" are not meant to have any binding or constrictive meaning with respect to the relative lengths of the sides of the cartons, when erected. Also, in each of the following embodiments, the preferred methods of fabrication involve the panels forming the corner structures being folded and glued, prior to the panels (from which the corner structure panels emanate) being folded up perpendicular to the bottom panels. This would be a preferred panel folding order, for mechanized fabricating systems. However, in alternative embodiments, the folding of the corner structure panels could be done after the panels from which the corner support structure panels emanate, have been folded upward, perpendicular to the bottom panel. Such an alternative process could be performed manually, at least, if not mechanically.

When referring to the plan illustrations of the blanks, the usual drawing conventions for illustration of carton blanks fabricated from paper, paperboard and/or corrugated paperboard, as are customarily employed in the art, are applied. That is, unless otherwise noted, broken lines indicate scores, fold lines or other lines of weakness such as perforations; scalloped lines indicate lines of weakness forming a tear strip or similar structure; and solid lines within the interior of, or extending to the edge of, a blank, indicate through-cuts.

Figure 79:
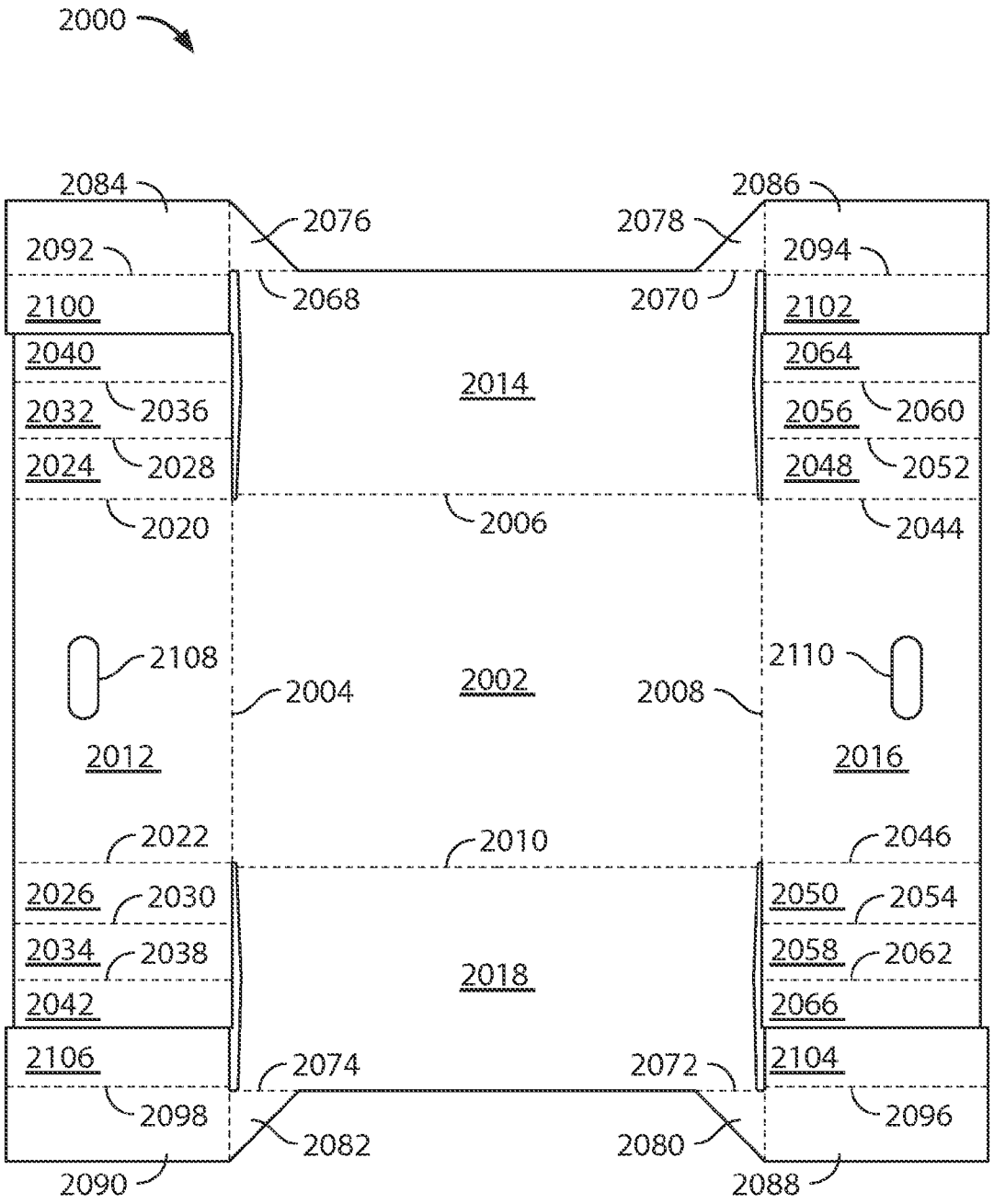
FIG. 79 is a plan view for a blank for an open-topped carton, having stacking support structures, according to a preferred embodiment of the invention.
Figure 79A:
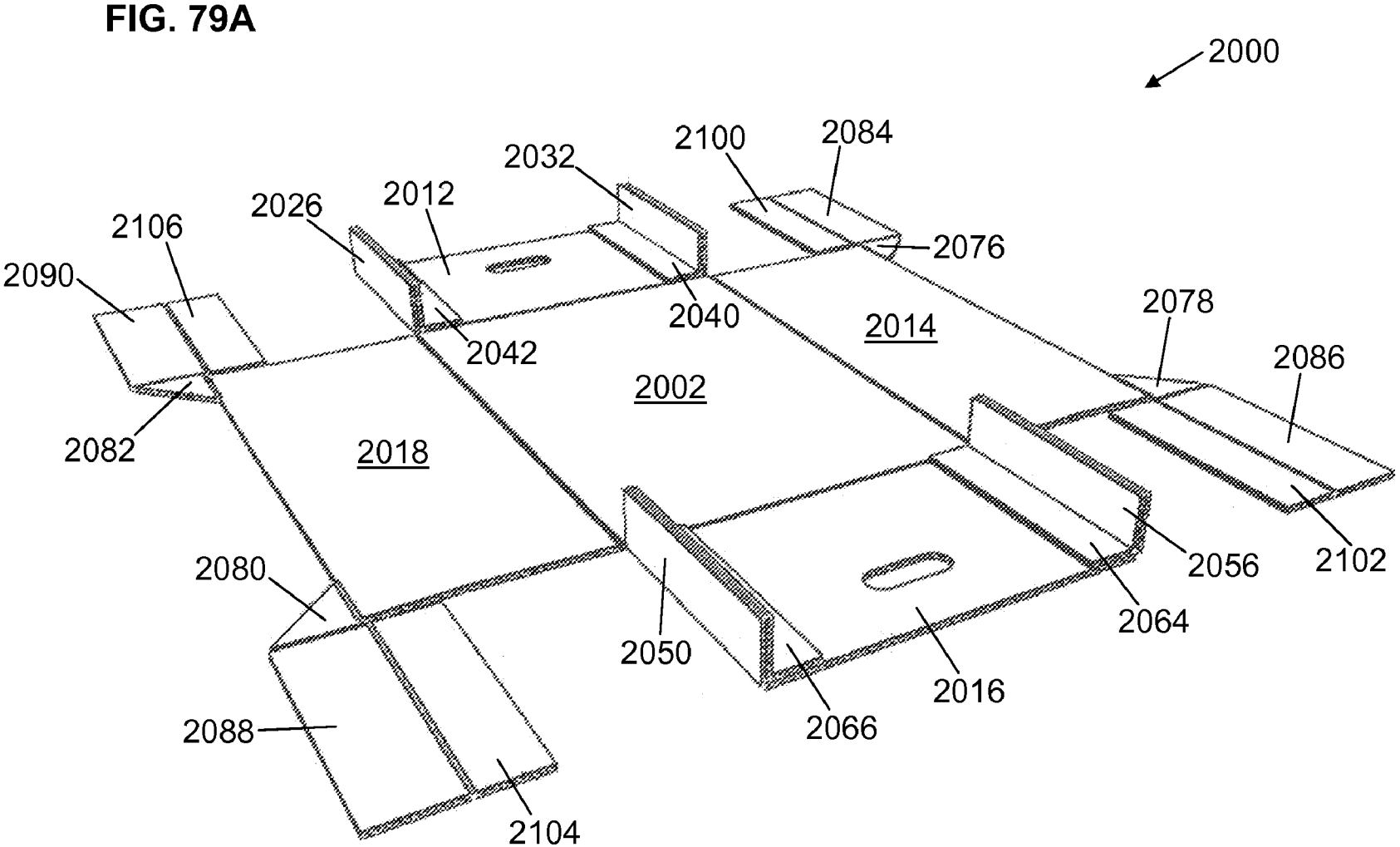
FIGS. 79A-79F illustrate various stages in the articulation of the blank of FIG. 79.
Figure 79B:
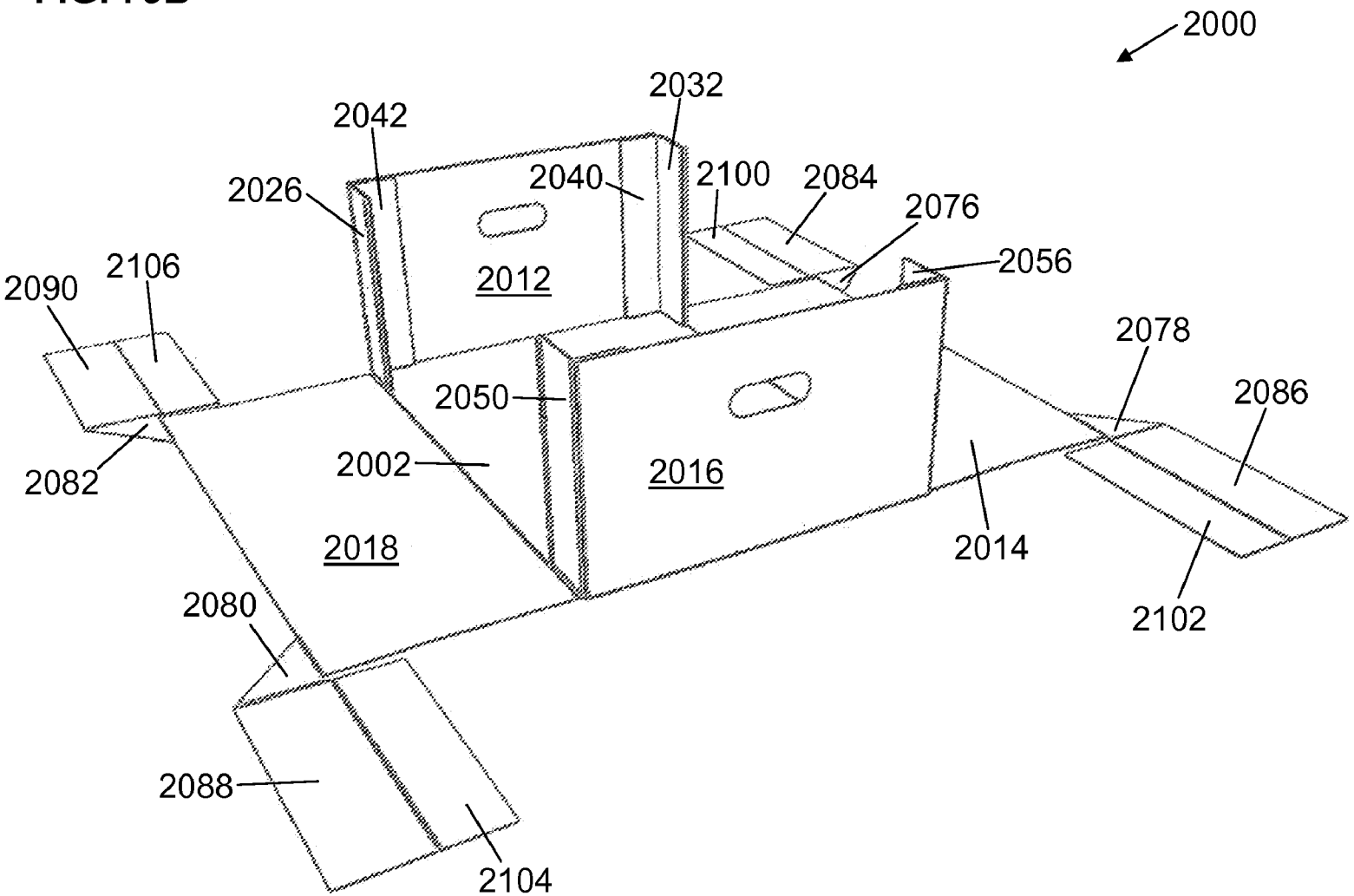
Figure 79C:
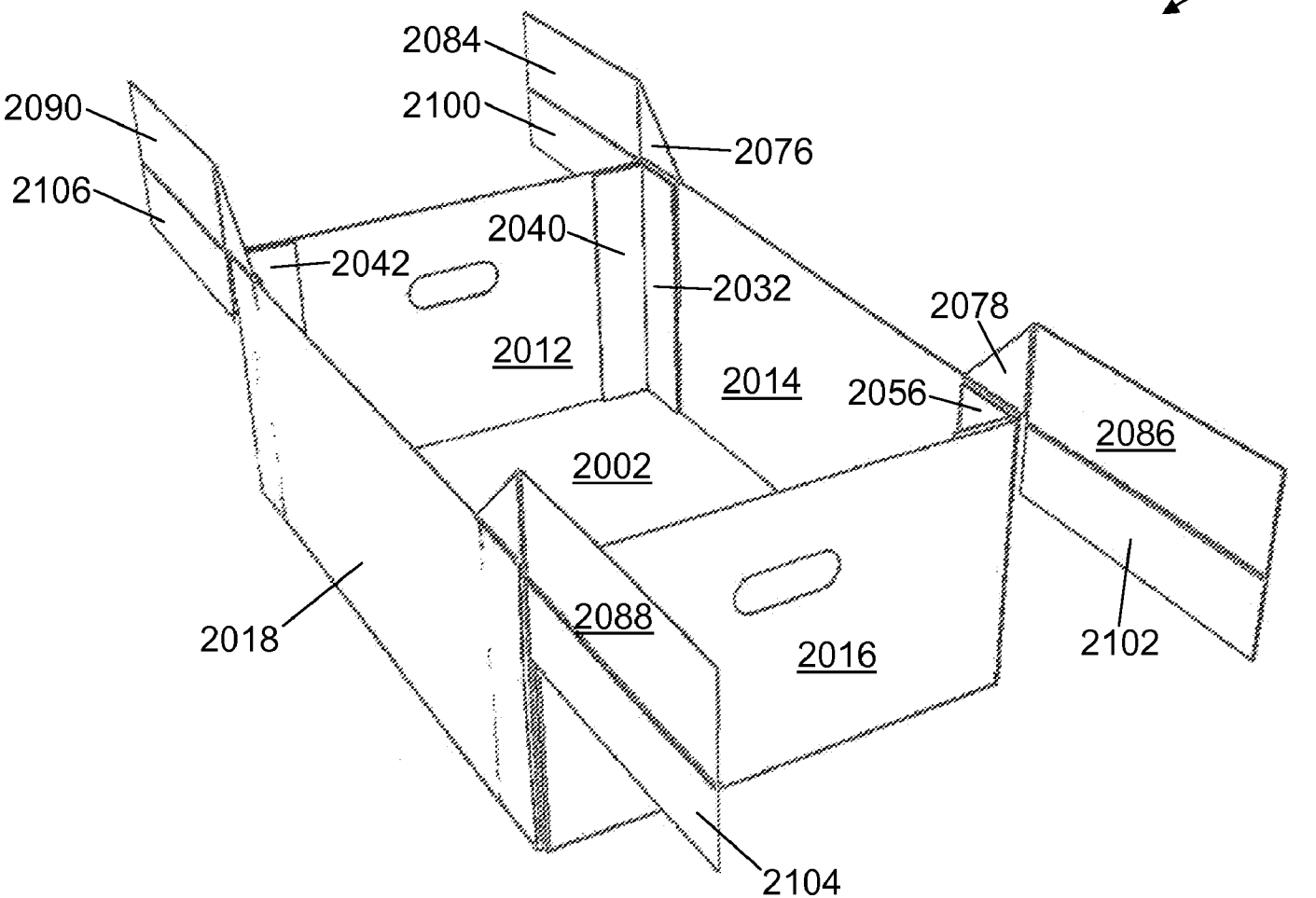
Figure 79D:
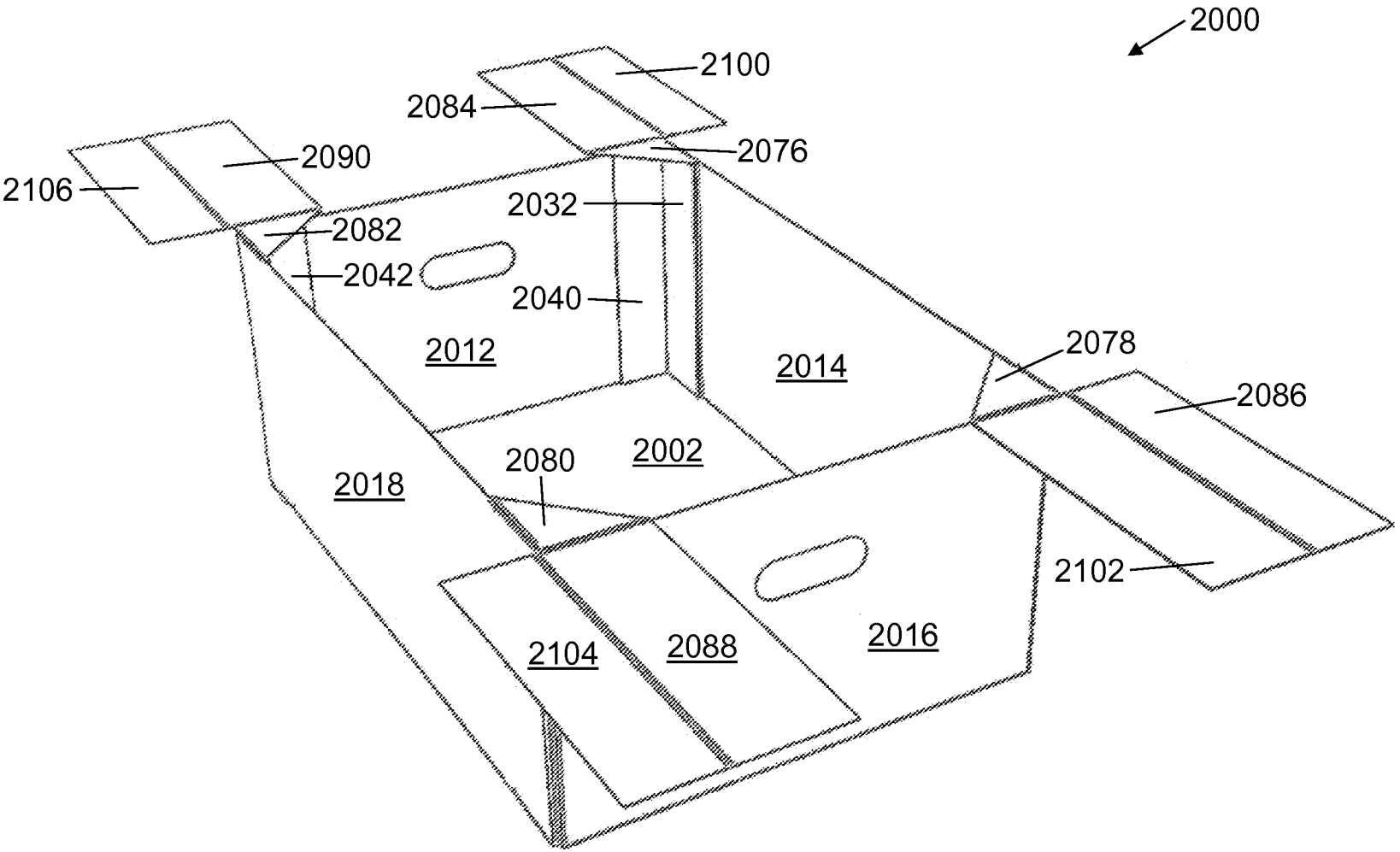
Figure 79E:
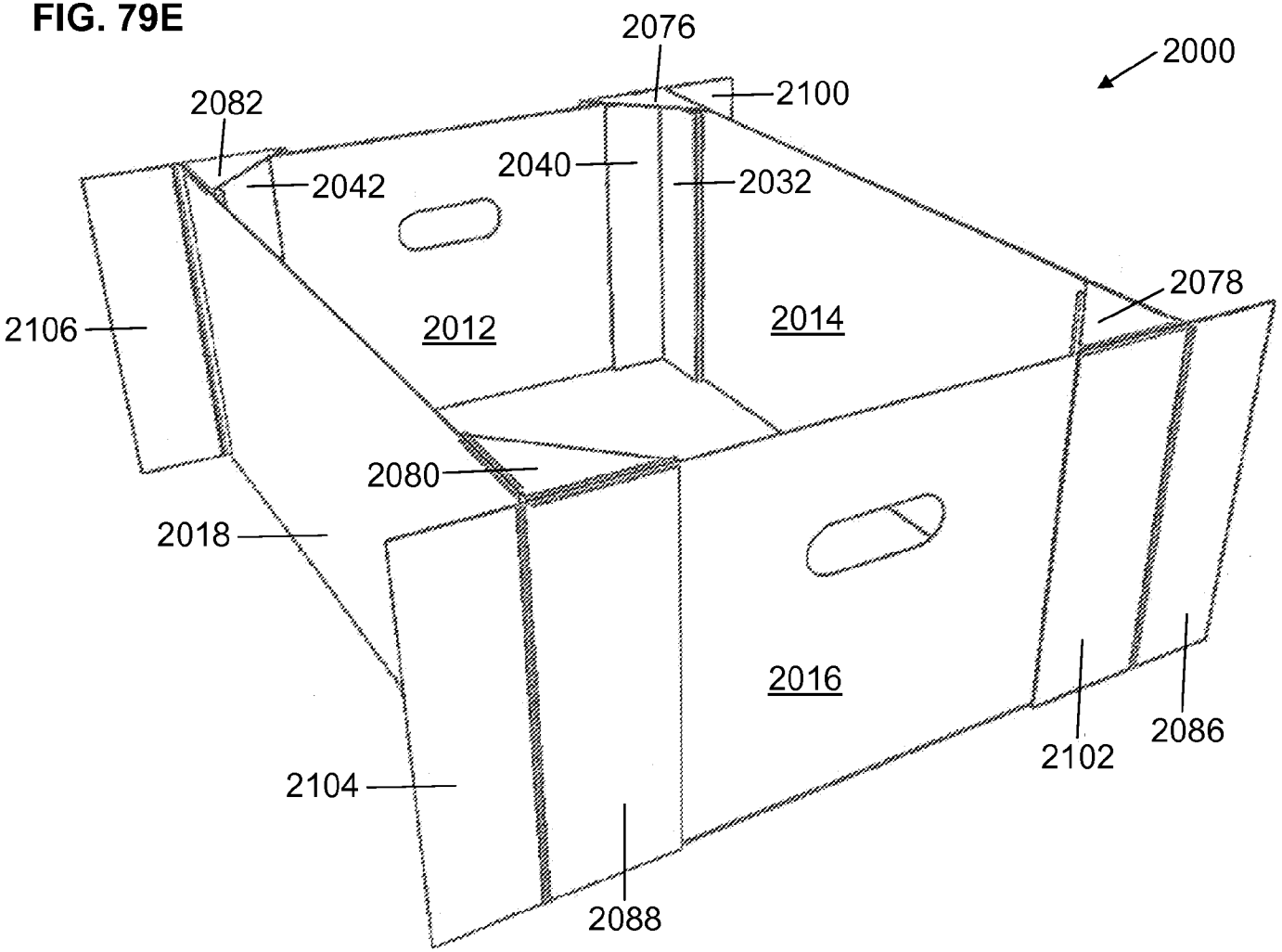
Figure 79F:
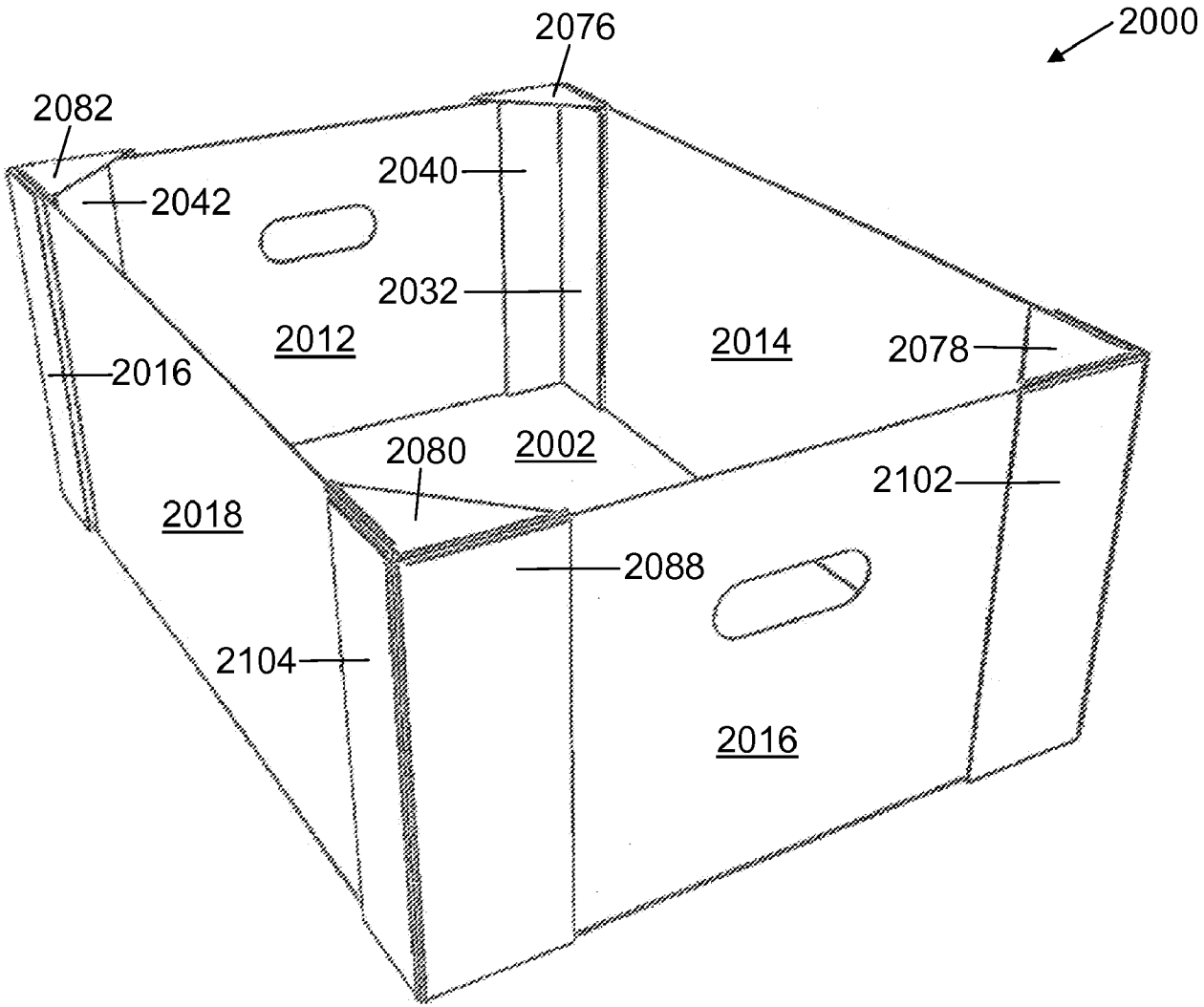

FIG. 79 is a plan view for a blank for an open-topped carton, having stacking support structures, according to a preferred embodiment of the invention. Preferably, blank 2000 is fabricated from corrugated paperboard, with the corrugations extending in the direction of the double-headed arrow. Blank 2000 includes bottom panel 2002; end panels 2012, 2016, connected by fold lines 2004, 2008, respectively; and front and rear panels 2018, 2014, connected by fold lines 2010, 2006, respectively.

Emanating from opposite front and rear edges of end panel 2012, along fold lines 2020 and 2022 are first inner support panels 2024, 2026. Emanating from fold lines 2028 and 2030, respectively are second inner support panels 2032, 2034. Emanating from fold lines 2036, 2038 are third inner support panels 2040, 2042.

Emanating from opposite front and rear edges of end panel 2016, along fold lines 2044 and 2046 are first inner support panels 2048, 2050. Emanating from fold lines 2052 and 2054, respectively are second inner support panels 2056, 2058. Emanating from fold lines 2060, 2062 are third inner support panels 2064, 2066.

Emanating from upper edges of front and rear panels 2018, 2014, respectively, along fold lines 2072, 2074, 2068, and 2070 are triangular connection panels 2080, 2082, 2076, 2078, respectively. First outer support panels 2084, 2086, 2088 and 2090 emanate from triangular connection panels 2076, 2078, 2080, 2082, respectively, along respective fold lines disposed therebetween. Second outer support panels 2100, 2102, 2104, 2106 emanate from the first outer support panels, along fold lines 2092, 2094, 2096, 2098. Openings 2108, 2110 are provided to enable visual inspection of the contents and/or to facilitate lifting of carton 2000. FIGS. 79A-79F (in which fold lines are not shown by broken lines), illustrate various stages in the articulation of carton 2000. First, first inner support panels 2024, 2026, 2048, 2050 are folded perpendicular to end panels 2012, 2016. Second inner support panels 2032, 2034, 2056, 2058 are folded 180° relative to their respective adjacent first inner support panels, so that the first and second inner support panels are face-to-face (adhesive of any suitable kind may be applied therebetween to hold the first and second inner support panels against one another). This is possible, because the second inner support panels are slightly narrower than the first inner support panels. At about the same time, third inner support panels 2040, 2042, 2064, 2066 are folded outwardly 90° (or thereabouts) to positions face-to-face against inside surfaces of end panels 2012, 2016, and adhered thereto, using any suitable adhesive. At the end of the foregoing procedures, four L-shaped support structures are positioned at the corners of bottom panel 2002. See FIG. 79B.

To assemble carton 2000, end panels 2012, 2016 are folded upwardly to positions perpendicular relative to bottom 2002. See FIG. 79A. At the same time, rear panel 2014 is folded up perpendicular to bottom panel 2002, and adhered to outwardly facing surfaces of first inner support panels 2024, 2048. Front panel 2018 is folded up perpendicular to bottom panel 2002, and adhered to outwardly facing surfaces of first inner support panels 2026, 2050. See FIG. 79C. Triangular connection panels 2076, 2078, 2080, 2082 are folded inwardly to positions parallel to bottom panel 2002, atop the L-shaped support structures. Adhesive may be applied therebetween. See FIG. 79D. First outer support panels 2084, 2086, 2088, 2090 are folded down, to positions overlying outer surfaces of end panels 2012, 2014 and adhered thereto, if desired. See FIG. 79E. Second outer support panels 2100, 2102, 2104, 2106 are then folded perpendicular to the first outer support panels, to positions overlying outer surfaces of front and rear panels 2014, 2018 and adhered thereto. See FIG. 79F.

Figure 80:
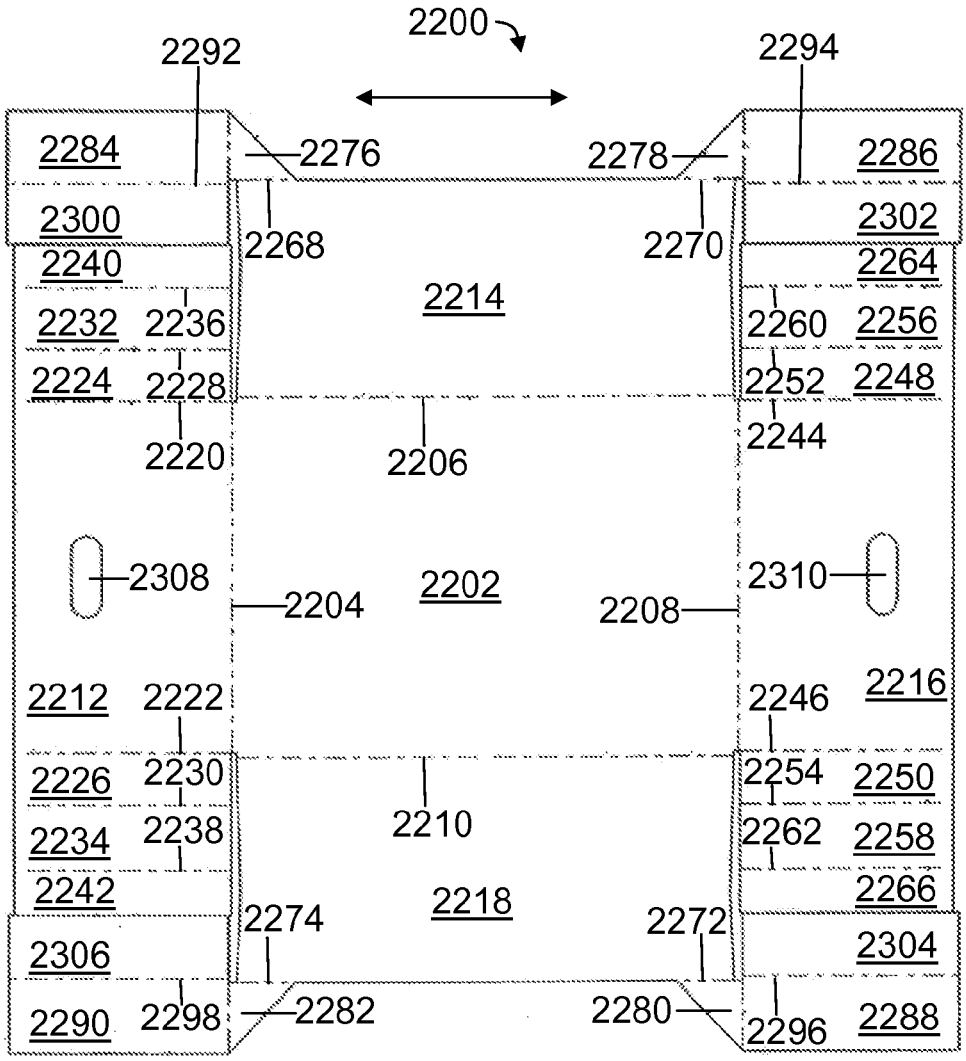
FIG. 80 is a plan view for a blank for an open-topped carton, having stacking support structures, according to another preferred embodiment of the invention.
Figure 80A:
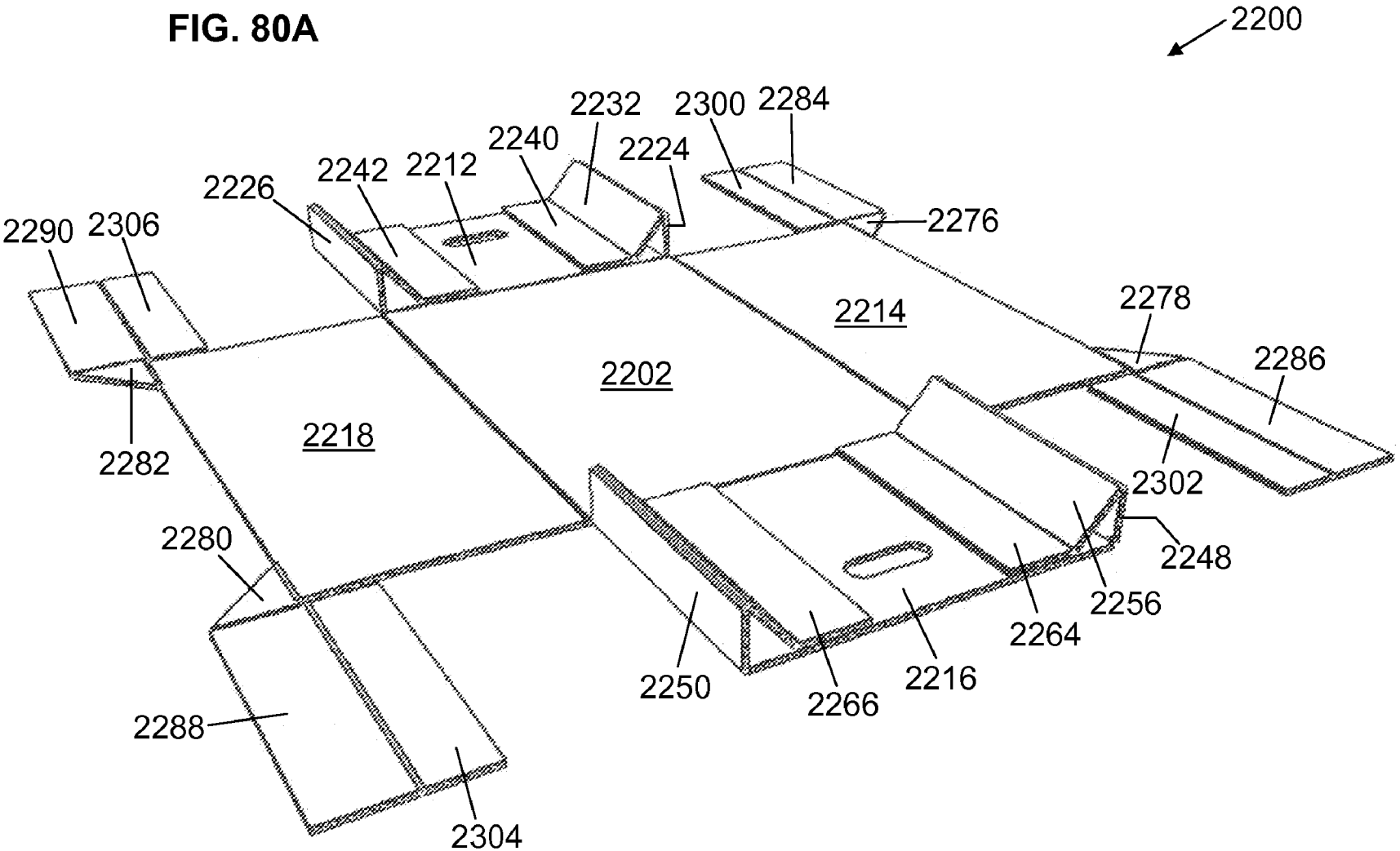
FIGS. 80A-80F illustrate various stages in the articulation of the blank of FIG. 80.
Figure 80B:
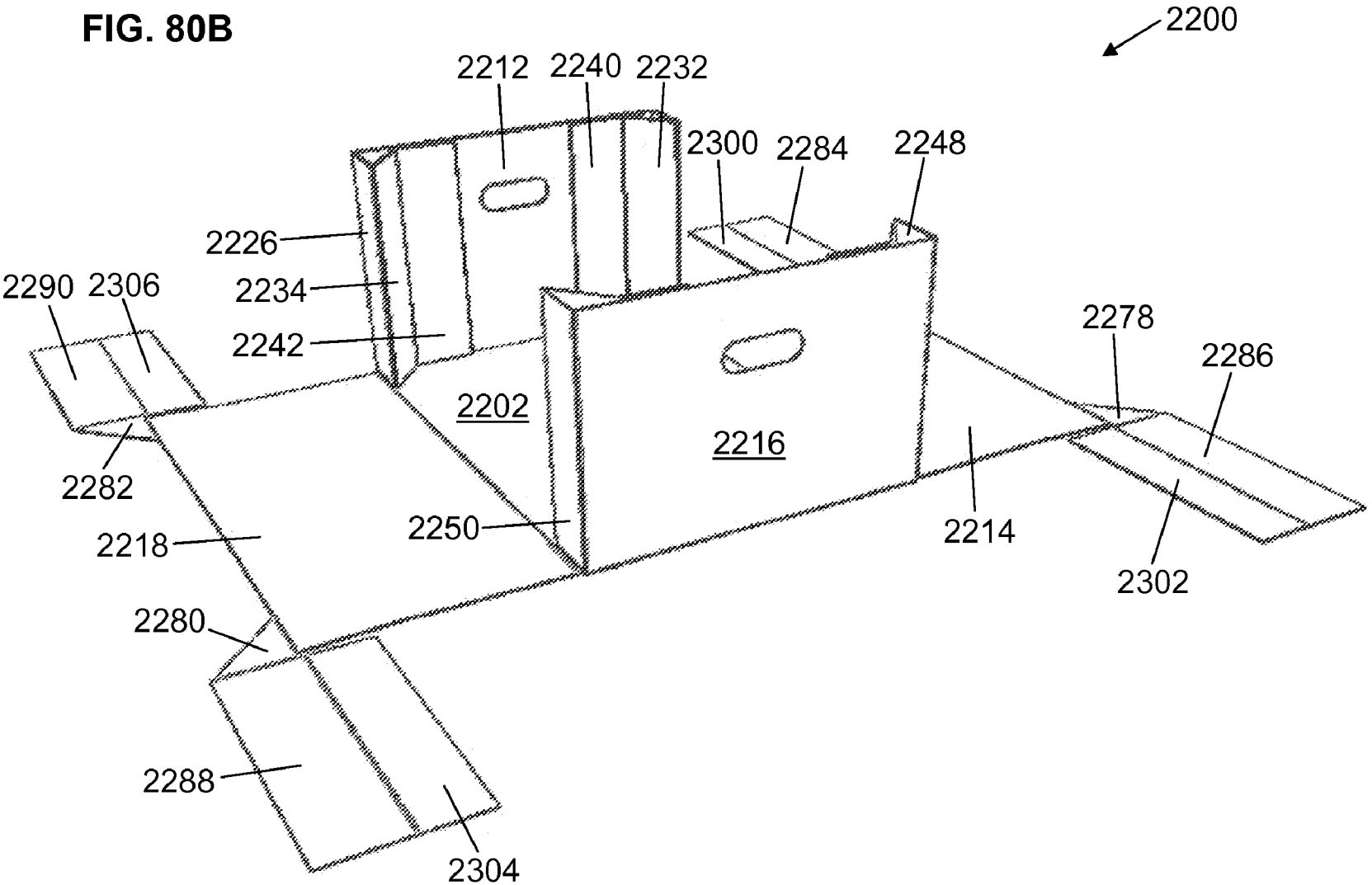
Figure 80C:
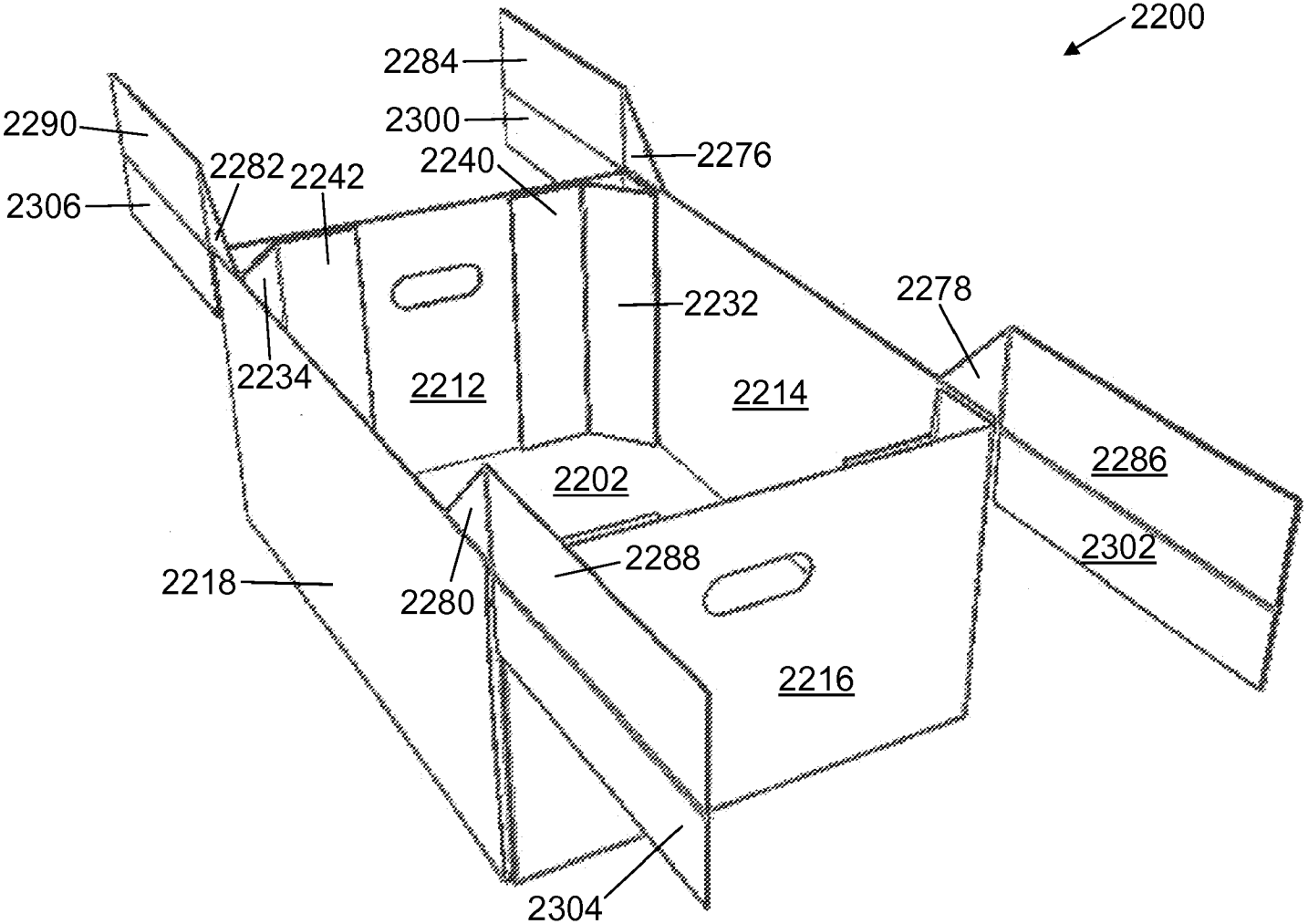
Figure 80D:
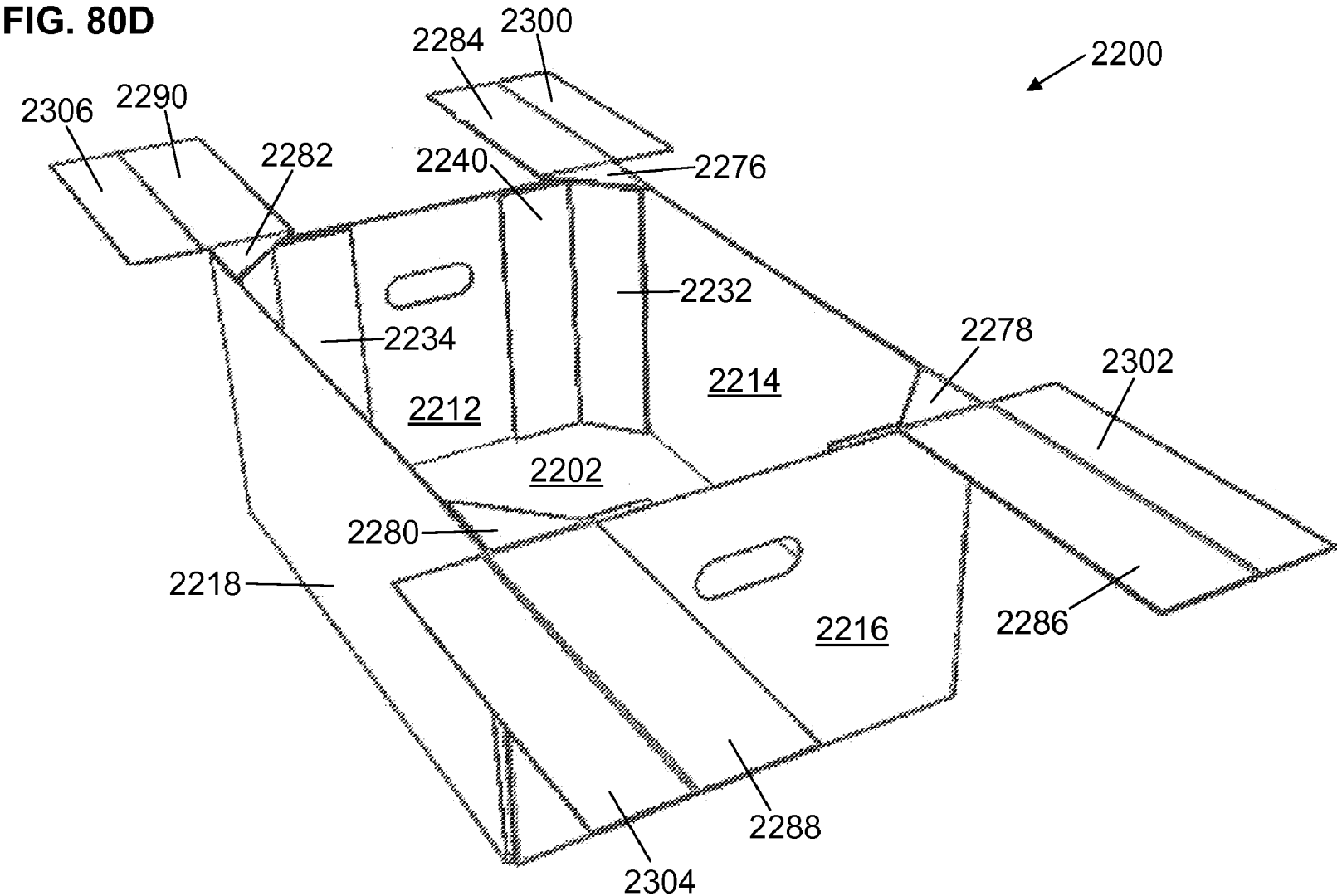
Figure 80E:
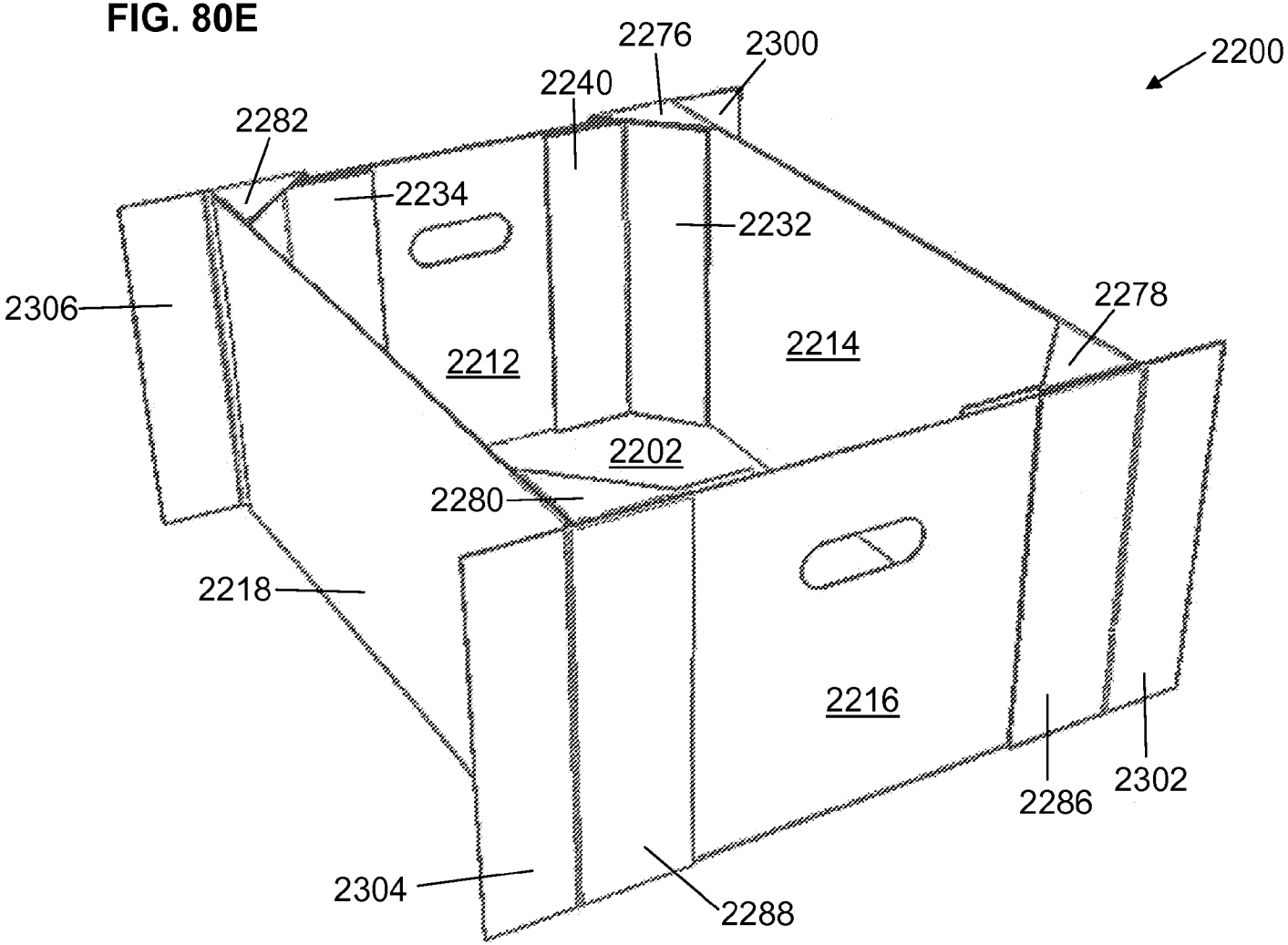
Figure 80F:
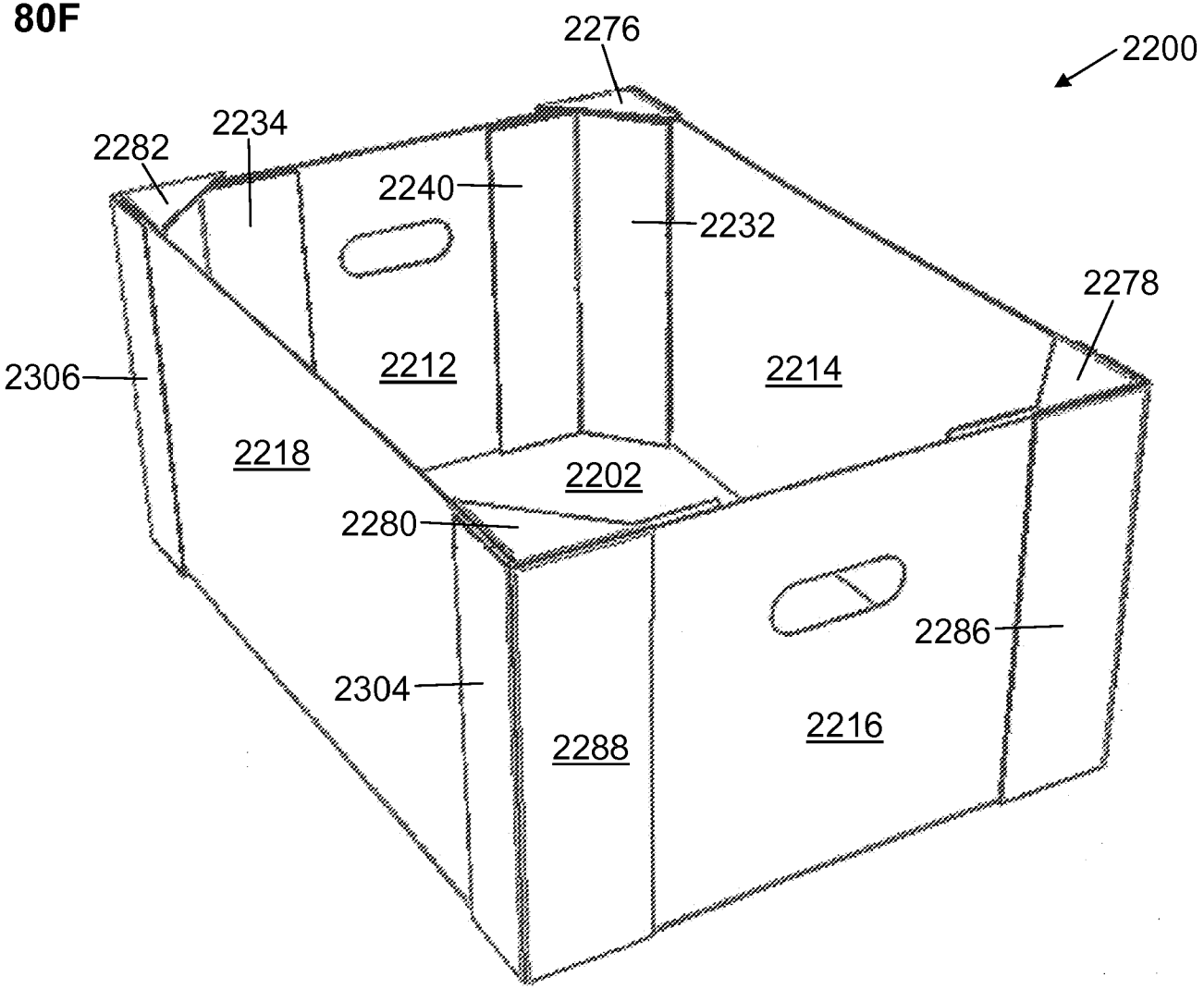

FIG. 80 is a plan view for a blank for an open-topped carton, having stacking support structures, according to another preferred embodiment of the invention. Preferably, blank 2200 is fabricated from corrugated paperboard, and the corrugations run in the direction of the double-headed arrow. Blank 2200 includes bottom panel 2202; end panels 2212, 2216, connected by fold lines 2204, 2208, respectively; and front and rear panels 2218, 2214, connected by fold lines 2210, 2206, respectively.

Emanating from opposite front and rear edges of end panel 2212, along fold lines 2220 and 2222 are first inner support panels 2224, 2226. Emanating from fold lines 2228 and 2230, respectively are second inner support panels 2232, 2234. Emanating from fold lines 2236, 2238 are third inner support panels 2240, 2242.

Emanating from opposite front and rear edges of end panel 2216, along fold lines 2244 and 2246 are first inner support panels 2248, 2250. Emanating from fold lines 2252 and 2254, respectively, are second inner support panels 2256, 2258. Emanating from fold lines 2260, 2262 are third inner support panels 2264, 2266.

Emanating from upper edges of front and rear panels 2218, 2214, respectively, along fold lines 2272, 2274, 2268 and 2270, are triangular connection panels 2280, 2282, 2276 and 2278, respectively. First outer support panels 2284, 2286, 2288 and 2290 emanate from triangular connection panels 2276, 2278, 2280, 2282, respectively, along respective fold lines disposed therebetween. Second outer support panels 2300, 2302, 2304, 2306 emanate from the first outer support panels, along fold lines 2292, 2294, 2296, 2298. Openings 2308, 2310 are provided to enable visual inspection of the contents and/or to facilitate lifting of carton 2200.

FIGS. 80A-80F illustrate various stages in the articulation of blank 2200, in which fold lines are not illustrated by broken lines. First, first inner support panels 2224, 2226, 2248, 2250 are folded perpendicular to end panels 2212, 2216. Second inner support panels 2232, 2234, 2256, 2258 are folded to an acute included angle relative to their adjacent first inner support panels, so that the first and second inner support panels, and the respective adjacent end panels describe triangular areas. This is possible, because the second inner support panels are substantially wider than the first inner support panels. At about the same time, third inner support panels 2240, 2242, 2264, 2266 are folded outwardly to positions face-to-face against inside surfaces of end panels 2212, 2216, and adhered thereto, using any suitable adhesive. At the end of the foregoing procedures, four triangle-(or "delta-") shaped support structures are positioned at the corners of bottom panel 2202. See FIG. 80B.

To assemble carton 2200, end panels 2212, 2216 are folded upwardly to positions perpendicular relative to bottom 2202. See FIG. 80A. At the same time, rear panel 2214 is folded up perpendicular to bottom panel 2202, and adhered to outwardly facing surfaces of first inner support panels 2224, 2248. Front panel 2218 is folded up perpendicular to bottom panel 2202, and adhered to outwardly facing surfaces of first inner support panels 2226, 2250. See FIG. 80C. Triangular connection panels 2276, 2278, 2280, 2282 are folded inwardly to positions parallel to bottom panel 2202, atop the delta-shaped support structures. Adhesive may be applied therebetween. See FIG. 80D. First outer support panels 2284, 2286, 2288, 2290 are folded down, to positions overlying outer surfaces of end panels 2212, 2214 and adhered thereto, if desired. See FIG. 80E. Second outer support panels 2300, 2302, 2304, 2306 are then folded perpendicular to the first outer support panels, to positions overlying outer surfaces of front and rear panels 2214, 2208 and adhered thereto. See FIG. 80F.

Figure 81:
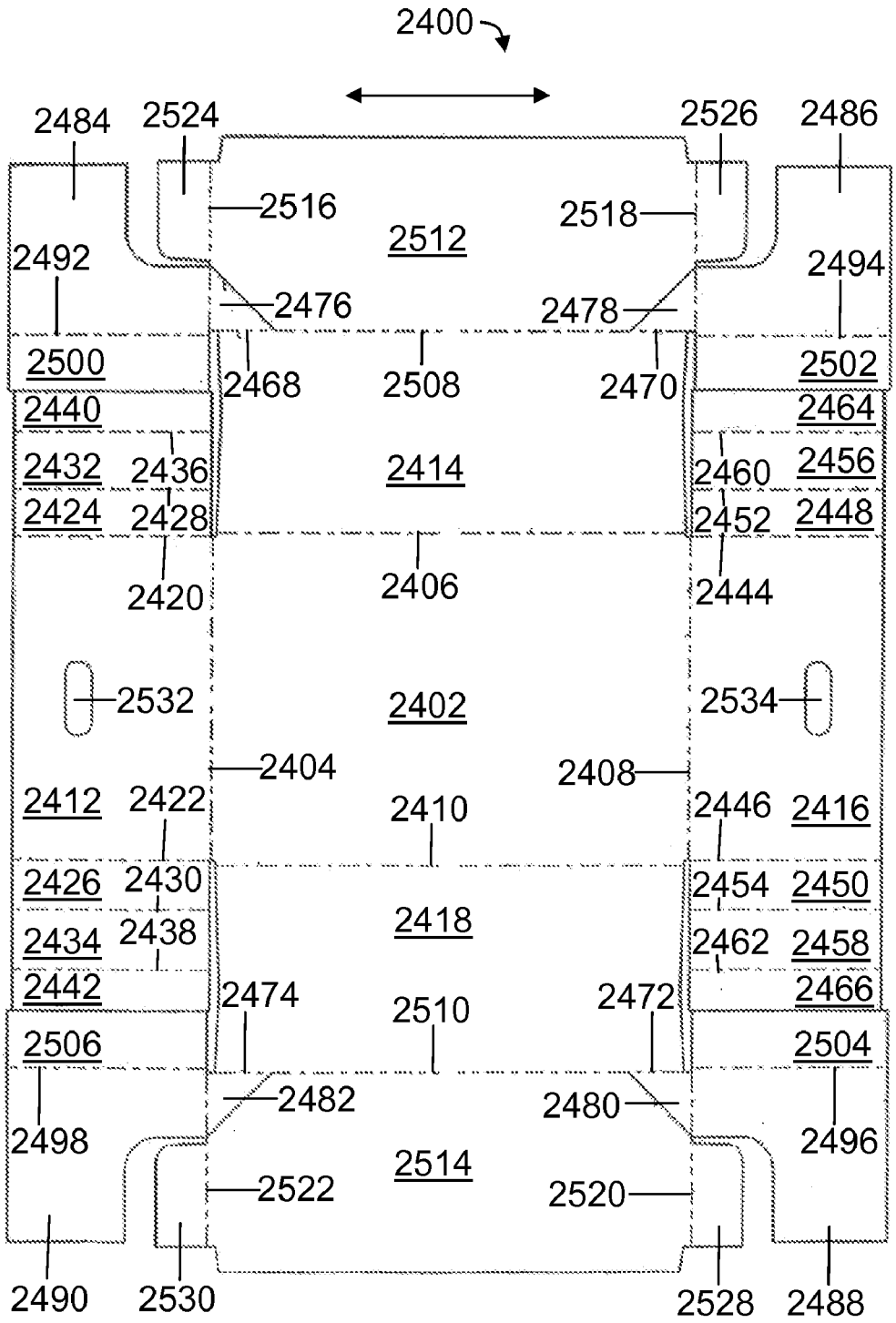
FIG. 81 is a plan view of a blank for a double-lidded carton, having stacking support structures, according to another preferred embodiment of the invention.
Figure 81A:
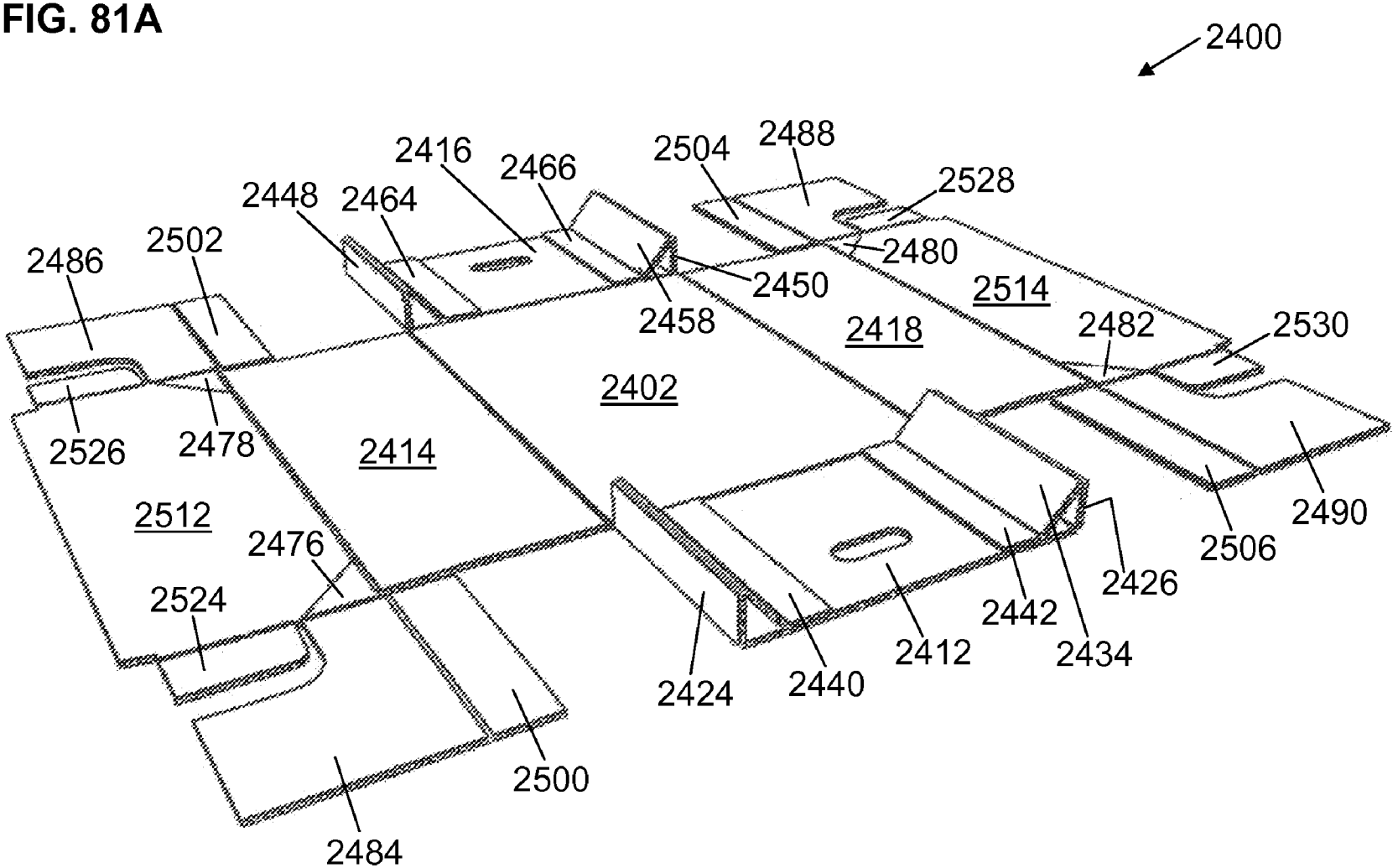
FIGS. 81A-81H illustrate various stages of the articulation of the blank of FIG. 81.
Figure 81B:
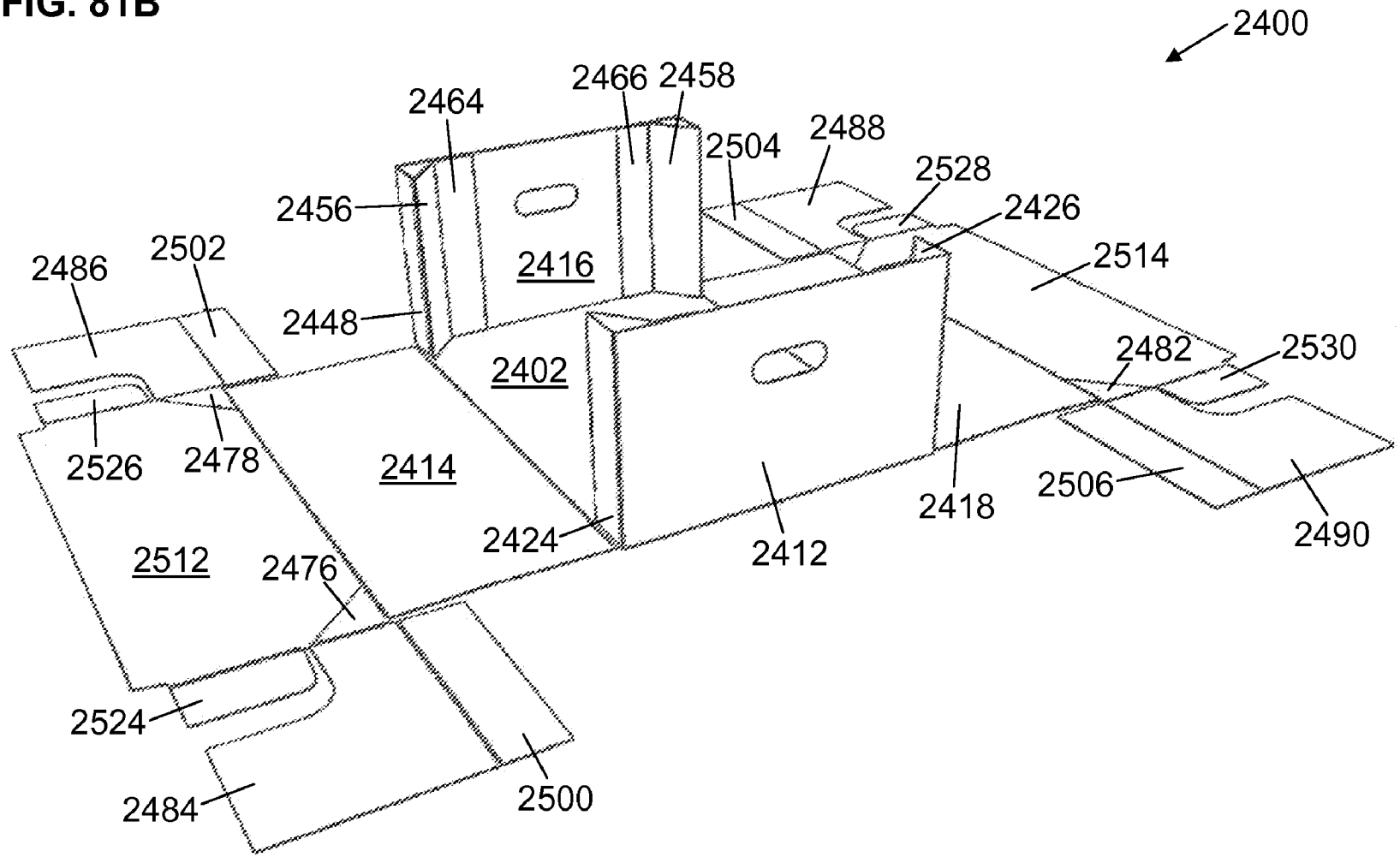
Figure 81C:
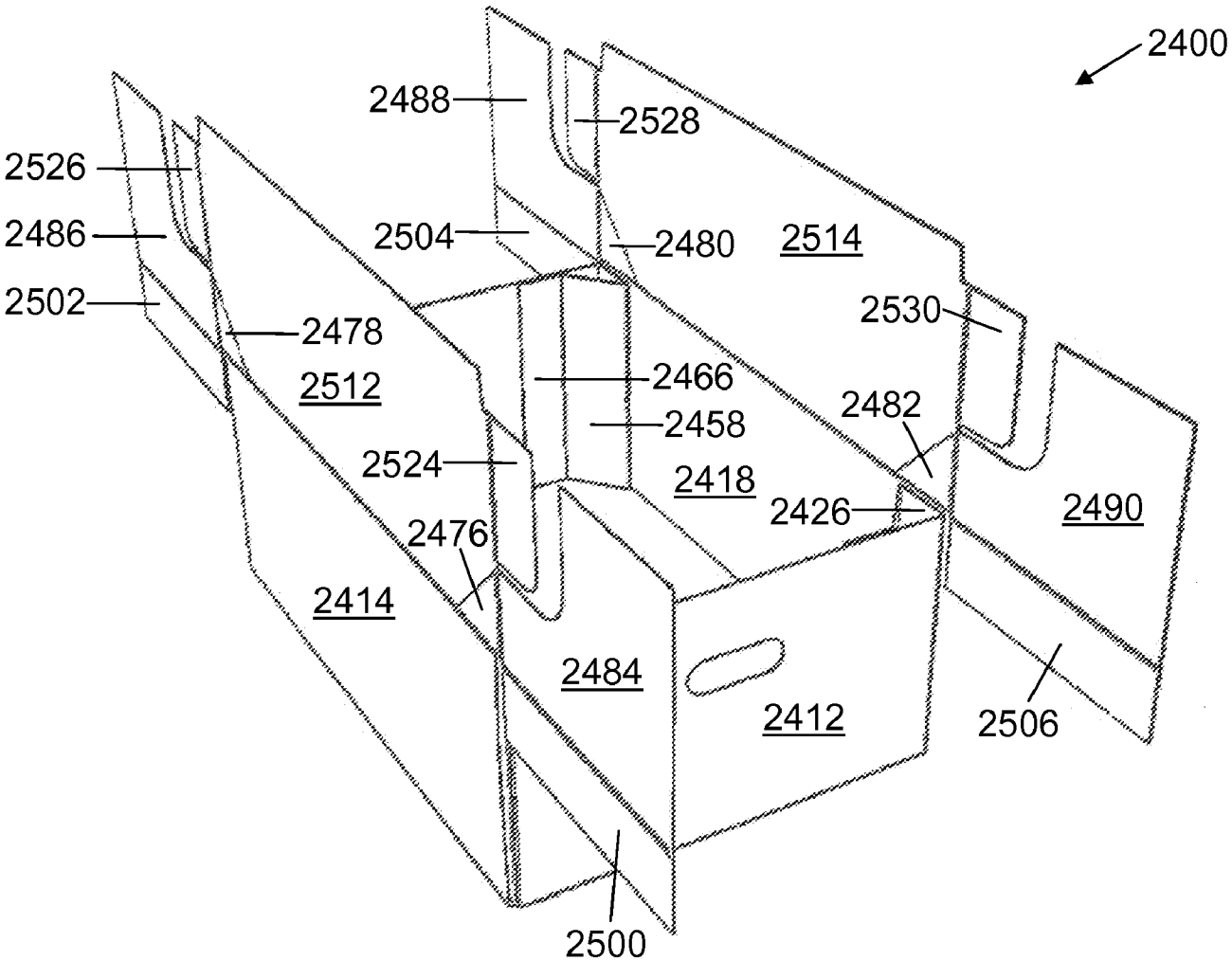
Figure 81D:
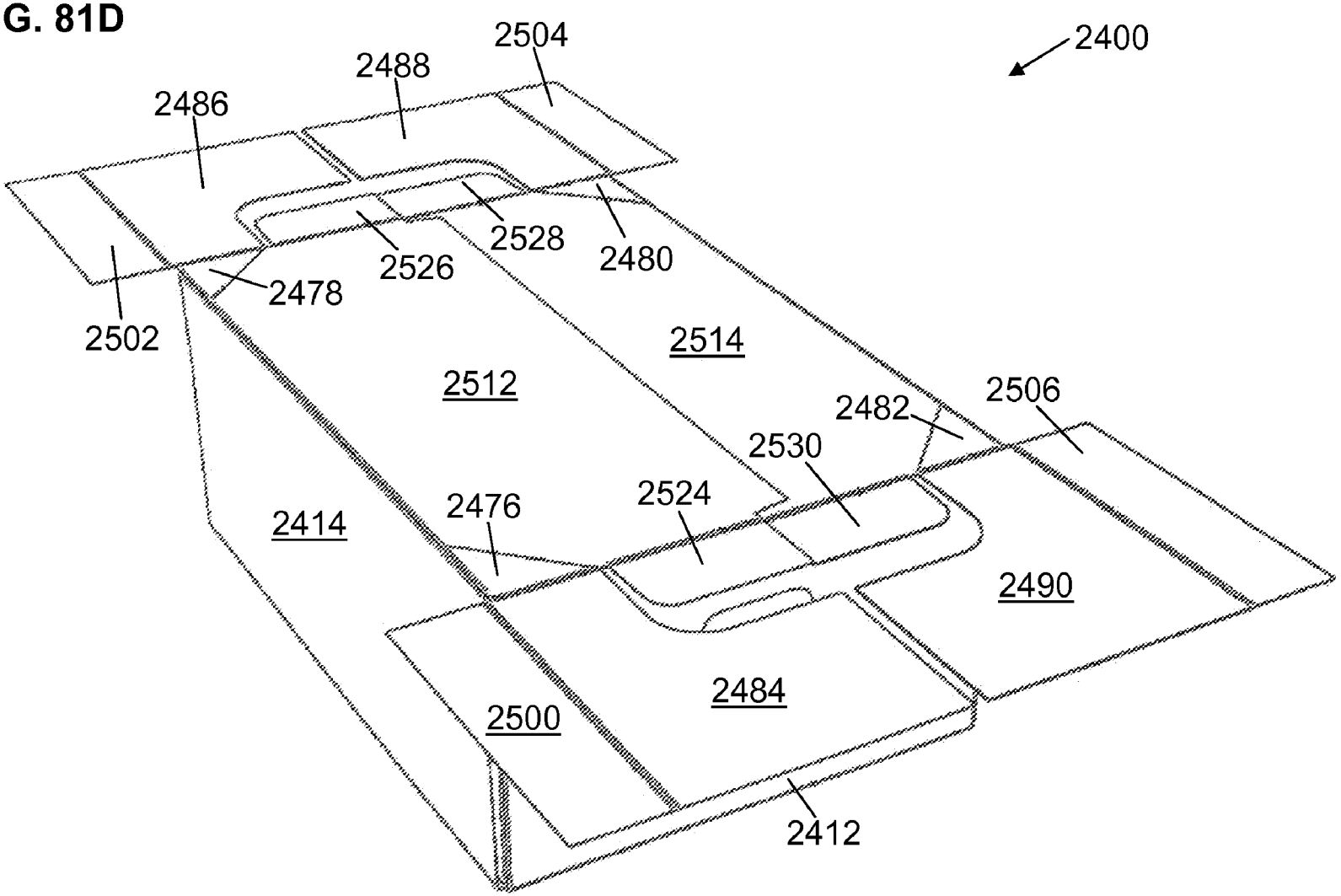
Figure 81E:
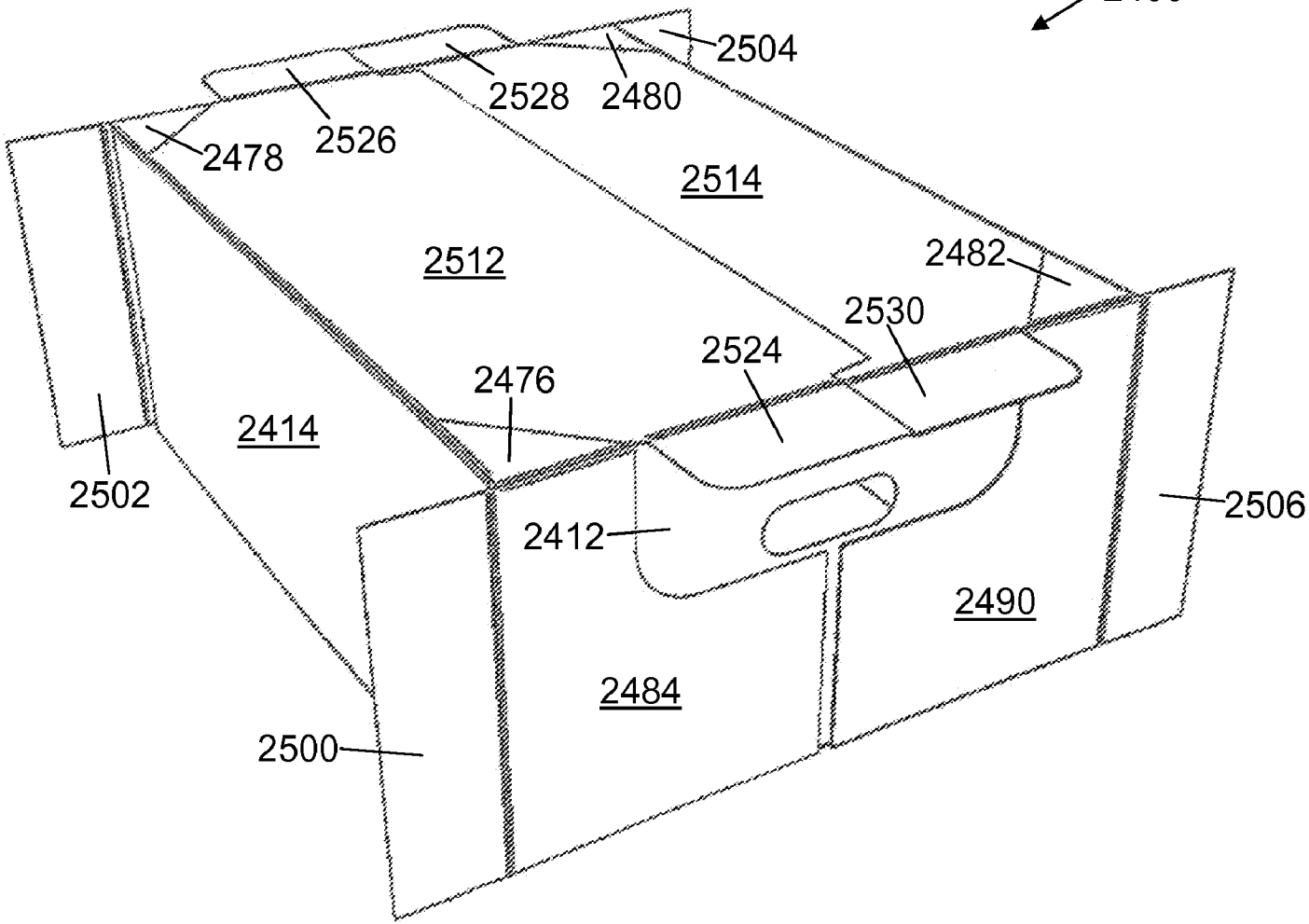
Figure 81F:
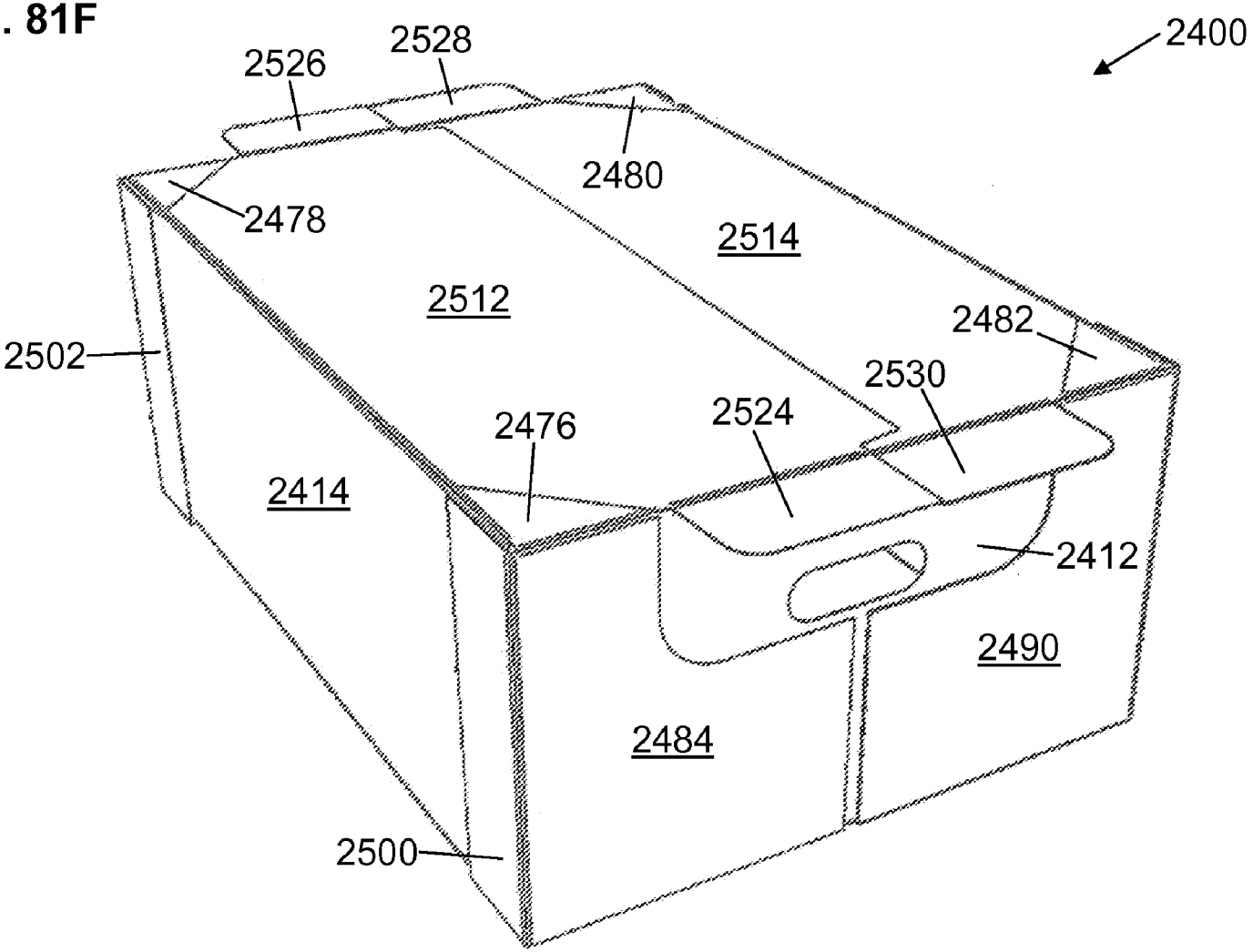
Figure 81G:
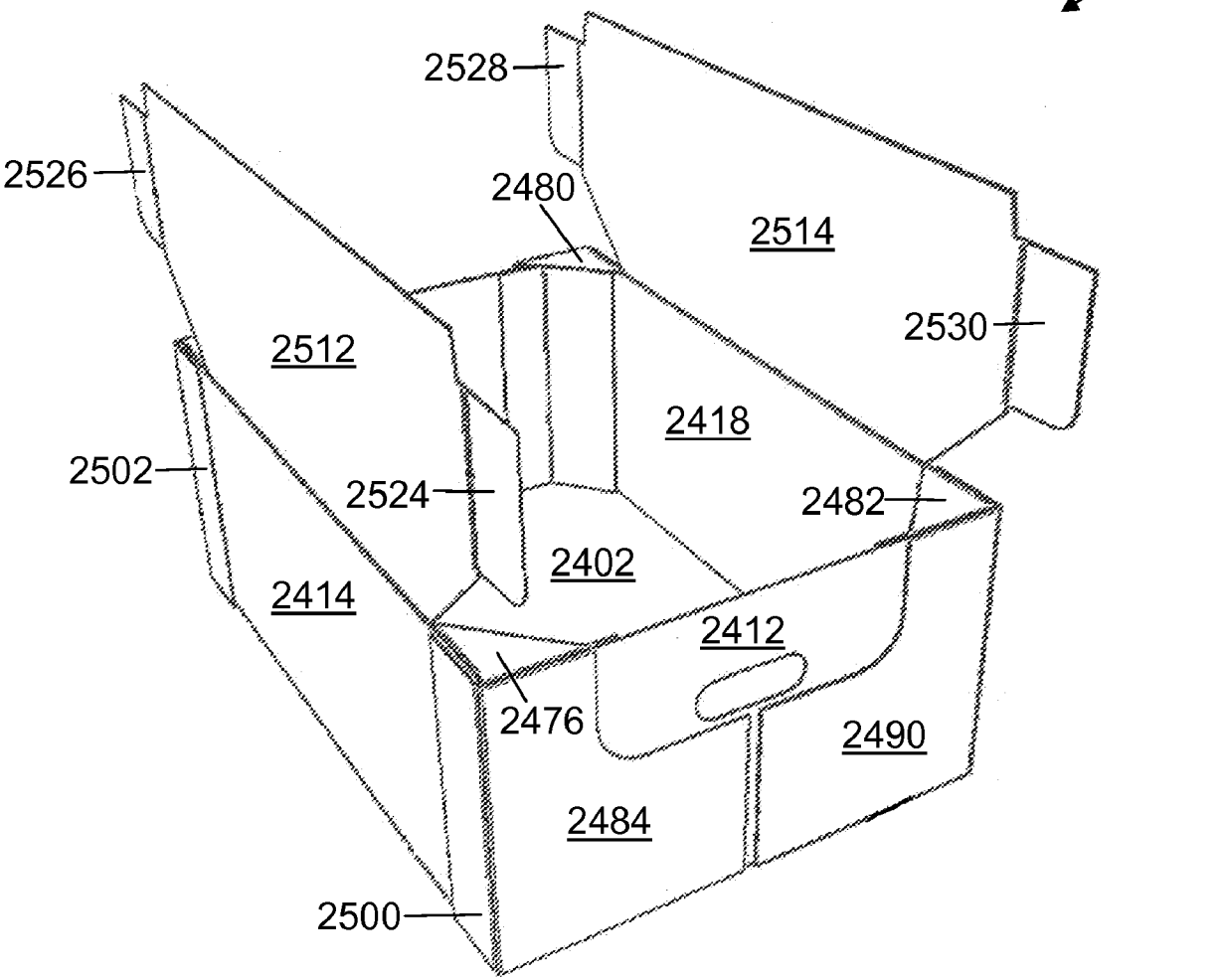
Figure 81H:
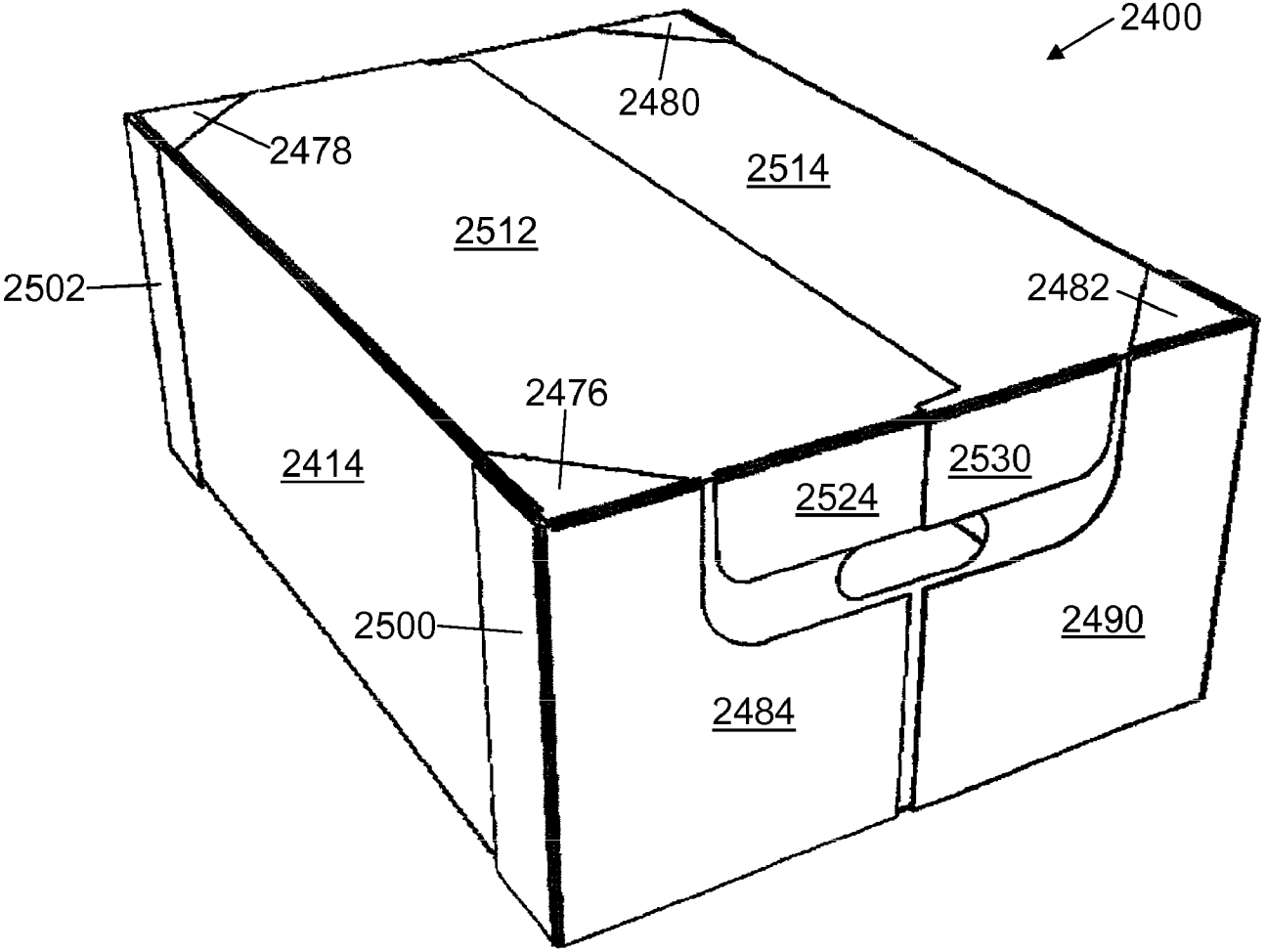

FIG. 81 is a plan view of a blank for a double-lidded carton, having stacking support structures, according to another preferred embodiment of the invention. Preferably blank 2400 is fabricated from corrugated paperboard material, and the corrugations run in the direction of the double-headed arrow. Blank 2400 includes bottom panel 2402; end panels 2412, 2416, connected by fold lines 2404, 2408, respectively; and front and rear panels 2418, 2414, connected by fold lines 2410, 2406, respectively.

Emanating from opposite front and rear edges of end panel 2412, along fold lines 2420 and 2422 are first inner support panels 2424, 2426. Emanating from fold lines 2428 and 2430, respectively are second inner support panels 2432, 2434. Emanating from fold lines 2436, 2438 are third inner support panels 2440, 2442.

Emanating from opposite front and rear edges of end panel 2416, along fold lines 2444 and 2446 are first inner support panels 2448, 2450. Emanating from fold lines 2452 and 2454, respectively are second inner support panels 2456, 2458. Emanating from fold lines 2460, 2462 are third inner support panels 2464, 2466.

Emanating from upper edges of front and rear panels 2418, 2414, respectively, along fold lines 2472, 2474, 2468, 2470 are triangular connection panels 2480, 2482, 2476, 2478, respectively. First outer support panels 2484, 2486, 2488 and 2490 (which are generally L-shaped) emanate from triangular connection panels 2476, 2478, 2480, 2482, respectively, along respective fold lines disposed therebetween. Second outer support panels 2500, 2502, 2504, 2506 emanate from the first outer support panels, along fold lines 2492, 2494, 2496, 2498. Hand openings 2532, 2534 are provided to facilitate lifting of carton 2400.

Lid panels 2514, 2512 emanate from front and rear panels 2418, 2414, respectively, along fold lines 2510, 2508, respectively. Lid panels 2512, 2514 are separated by diagonal through cuts from their adjacent triangular connection panels 2476, 2478; and 2480, 2482, respectively. Closure flaps 2524, 2526 emanate from opposite end edges of lid panel 2512, along fold lines 2516, 2518. Closure flaps 2528, 2530 emanate from opposite end edges of lid panel 2514, along fold lines 2520, 2522.

FIGS. 81A-81H illustrate various stages in the articulation of blank 2400, in which fold lines are not illustrated by broken lines. First, first inner support panels 2424, 2426, 2448, 2450 are folded perpendicular to end panels 2412, 2416. Second inner support panels 2432, 2434, 2456, 2458 are folded to an acute included angle relative to their respective adjacent first inner support panels, so that the first and second inner support panels, and the respective adjacent end panels describe a triangular area. This is possible, because the second inner support panels are substantially wider than the first inner support panels. At about the same time, third inner support panels 2440, 2442, 2464, 2466 are folded outwardly to positions face-to-face against inside surfaces of end panels 2412, 2416, and adhered thereto, using any suitable adhesive. At the end of the foregoing procedures, four triangle- (or "delta-") shaped support structures are positioned at the corners of bottom panel 2402. See FIG. 81B.

To assemble carton 2400, end panels 2412, 2416 are folded upwardly to positions perpendicular relative to bottom 2402. See FIG. 81A. Rear panel 2414 is folded up perpendicular to bottom panel 2402, and adhered to outwardly facing surfaces of first inner support panels 2424, 2448. Front panel 2418 is folded up perpendicular to bottom panel 2402, and adhered to outwardly facing surfaces of first inner support panels 2426, 2450. See FIG. 81 Triangular connection panels 2476, 2478, 2480, 2482 are folded inwardly to positions parallel to bottom panel 2402, atop the delta-shaped support structures. See, e.g., FIG. 81D. Adhesive may be applied therebetween. First outer support panels 2484, 2486, 2488, 2490 are folded down, to positions overlying outer surfaces of end panels 2412, 2416 and adhered thereto, if desired. See FIG. 81E. Second outer support panels 2500, 2502, 2504, 2506 are then folded perpendicular to the first outer support panels, to positions overlying outer surfaces of front and rear panels 2418, 2414 and adhered thereto. See FIG. 81F.

The resulting structure is an articulated container that is ready to be filled with product, as lid panels 2512 and 2514 have not been affixed in place. Lid panels 2512, 2514 may be raised (FIG. 81G) and product placed in carton 2400. Once product has been placed into carton 2400, lid panels 2512, 2514 are folded over to positions parallel to and over bottom panel 2402. Adhesive panels 2524, 2526, 2528, 2530 are folded down, and adhesively affixed to outside surfaces of end panels 2412, 2416, above the upper edges of L-shaped first outer support panels 2484, 2486, 2488, 2490. See FIG. 81H.

Figure 82:
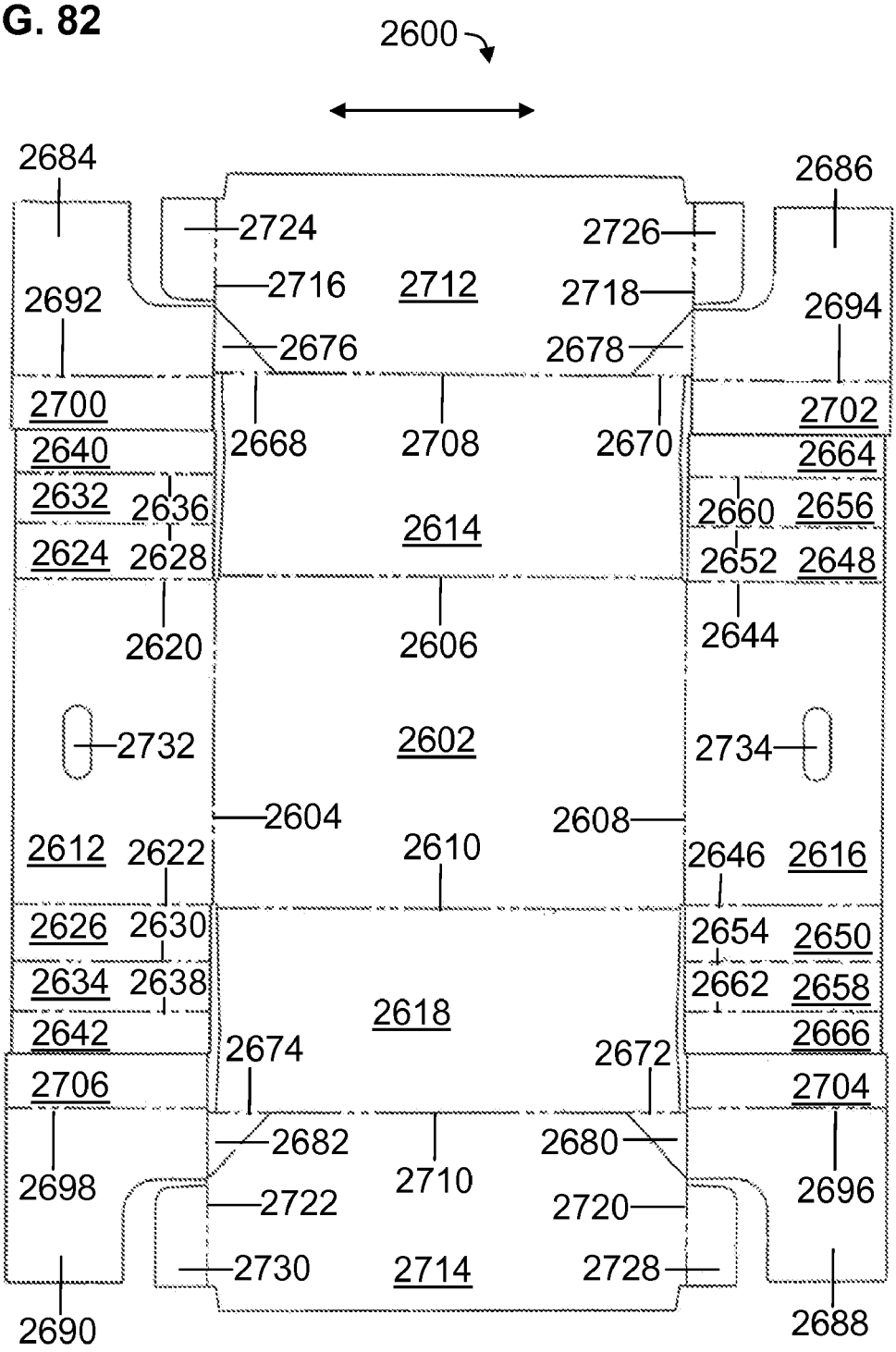
FIG. 82 is a plan view of a blank for a double-lidded carton, having stacking support structures, according to another preferred embodiment of the invention.
Figure 82A:
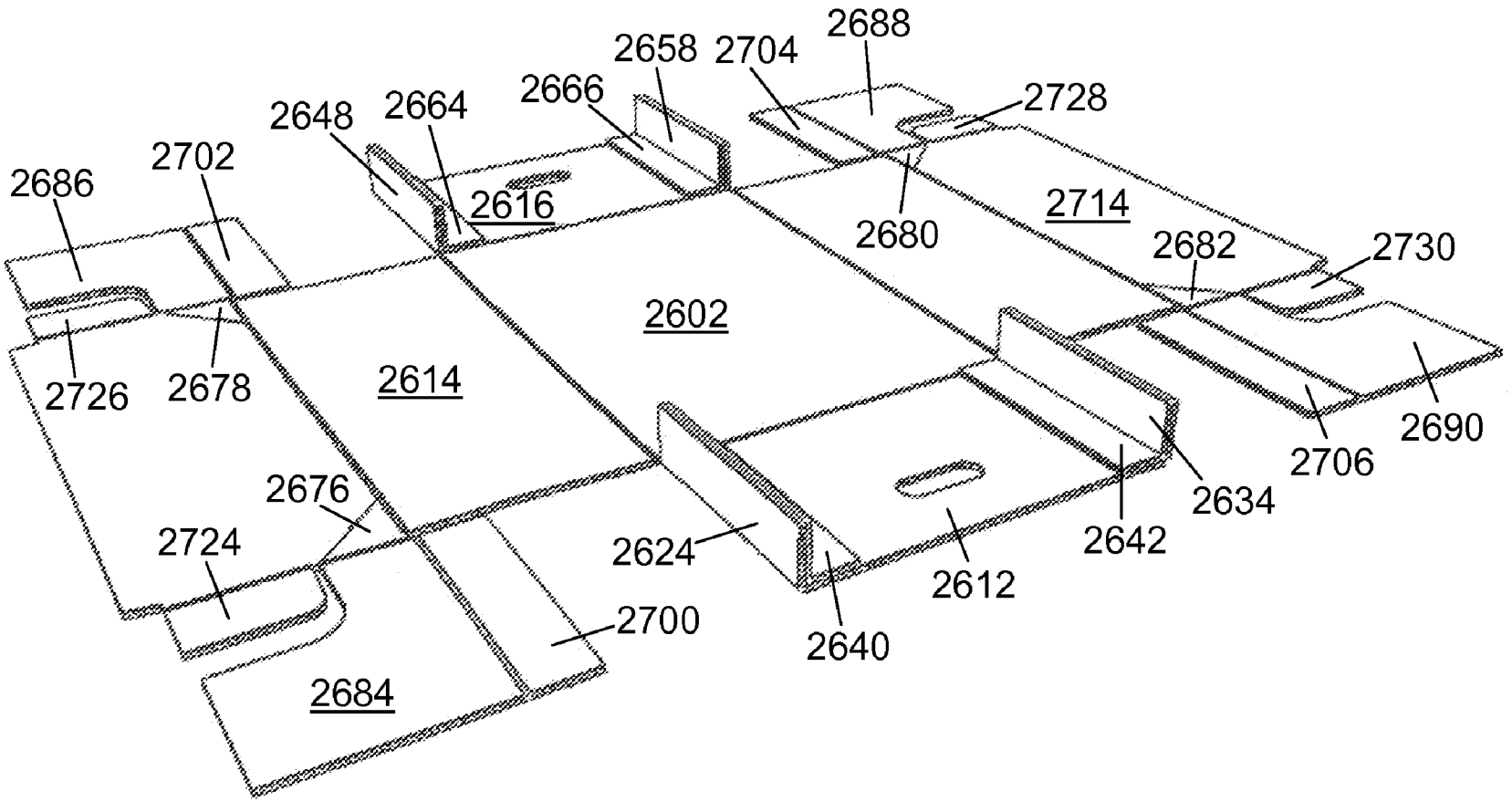
FIGS. 82A-82H illustrated various stages in the articulation of the blank of FIG. 82.
Figure 82B:
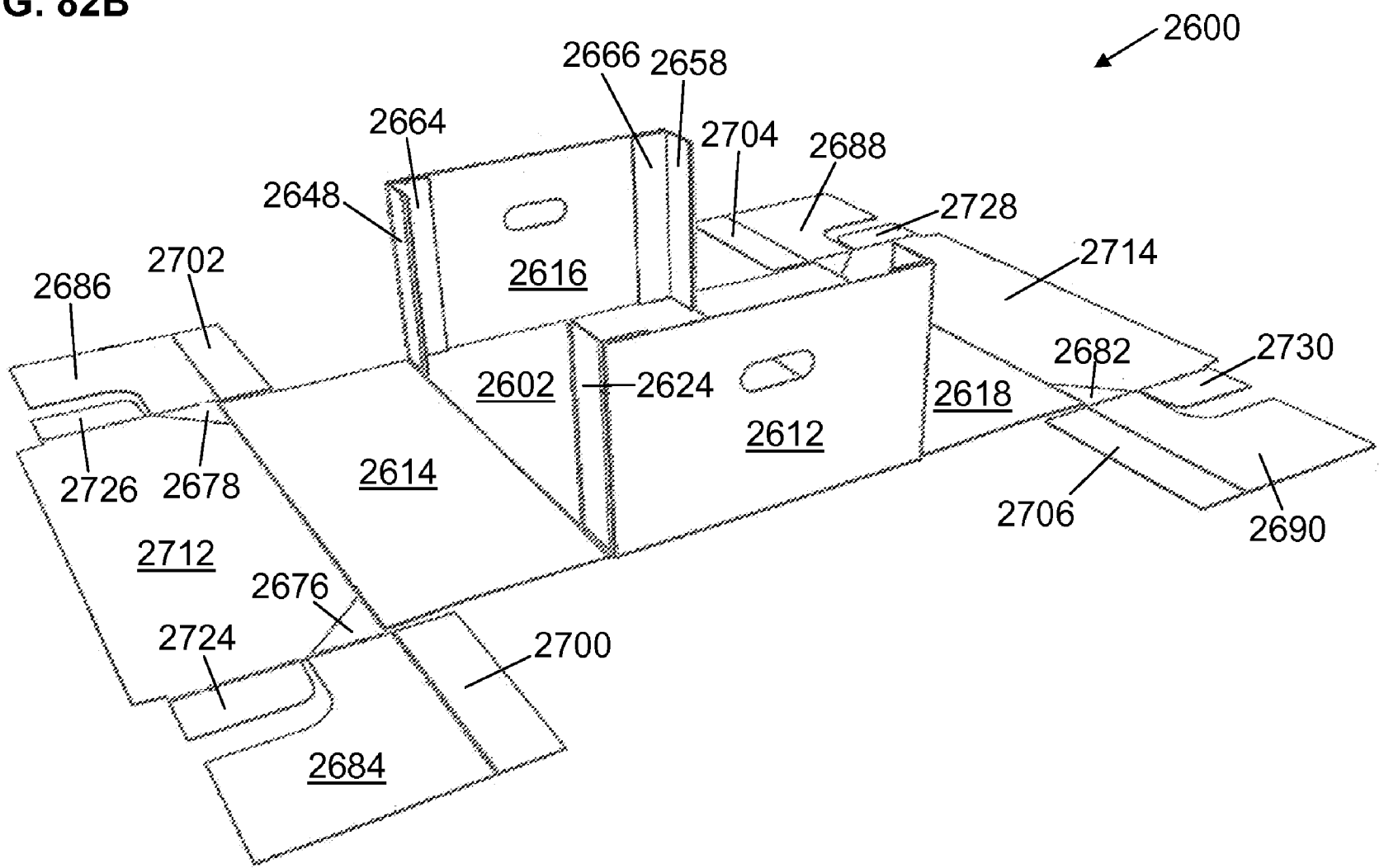
Figure 82C:
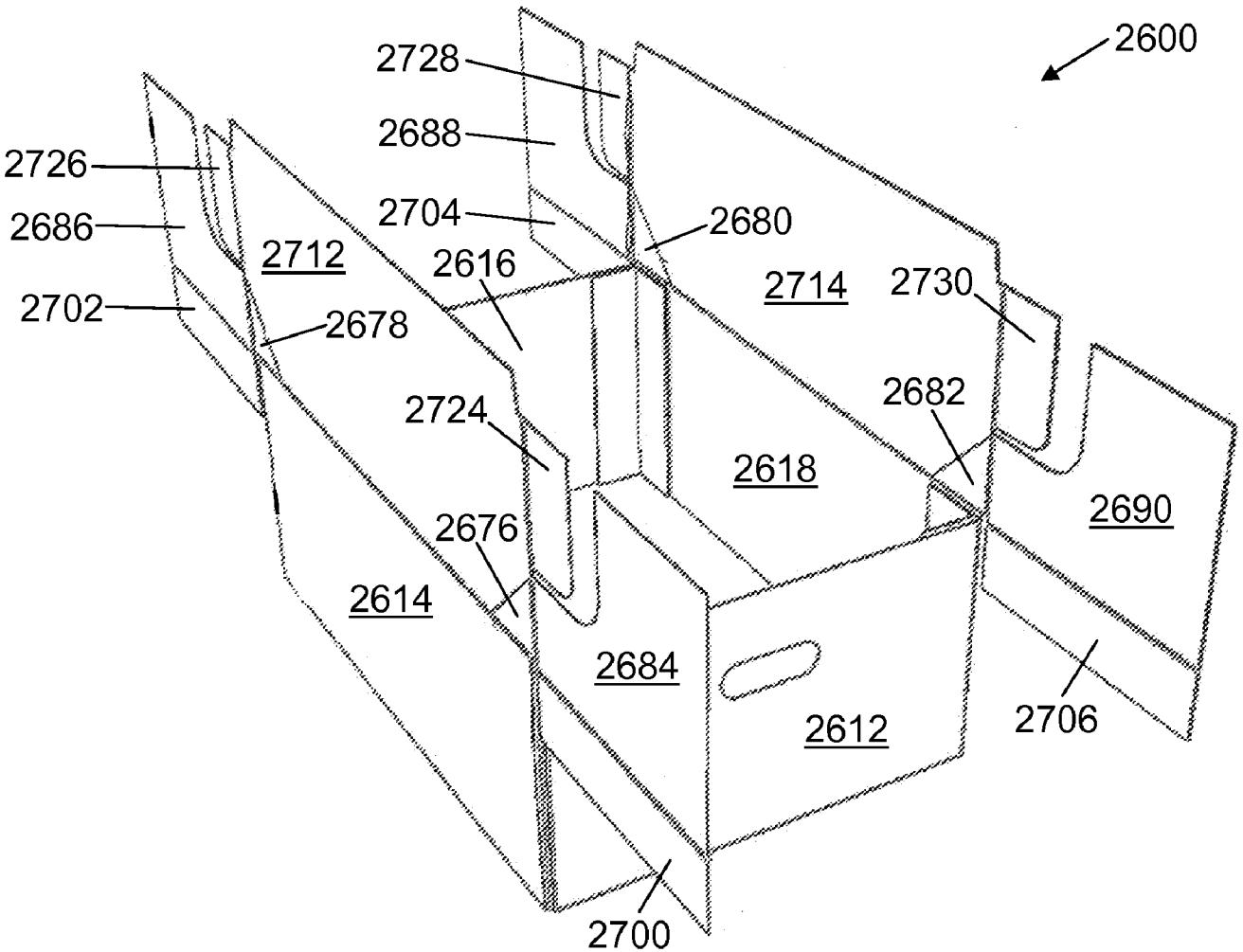

FIG. 82 is a plan view of a blank for a double-lidded carton, having stacking support structures, according to another preferred embodiment of the invention. Preferably, blank 2600 is fabricated from corrugated paperboard material, and the corrugations run in the direction of the double-headed arrow. Blank 2600 includes bottom panel 2602; end panels 2612, 2616, connected by fold lines 2604, 2608, respectively; and front and rear panels 2618, 2614, connected by fold lines 2610, 2606, respectively.

Emanating from opposite front and rear edges of end panel 2612, along fold lines 2620 and 2622 are first inner support panels 2624, 2626. Emanating from fold lines 2628 and 2630, respectively are second inner support panels 2632, 2634. Emanating from fold lines 2636, 2638 are third inner support panels 2640, 2642.

Emanating from opposite front and rear edges of end panel 2616, along fold lines 2644 and 2646 are first inner support panels 2648, 2650. Emanating from fold lines 2652 and 2654, respectively are second inner support panels 2656, 2658. Emanating from fold lines 2660, 2662 are third inner support panels 2664, 2666.

Emanating from upper edges of front and rear panels 2618, 2614, respectively, along fold lines 2672, 2674, 2668, 2670, are triangular connection panels 2680, 2682, 2676, 2678, respectively. First outer support panels 2684, 2686, 2688 and 2690 emanate from triangular connection panels 2676, 2678, 2680, 2682, respectively, along respective fold lines disposed therebetween. Second outer support panels 2700, 2702, 2704, 2706 emanate from the first outer support panels, along fold lines 2692, 2694, 2696, 2698. Hand openings 2732, 2734 are provided to facilitate lifting of carton 2600.

Lid panels 2714, 2712 emanate from front and rear panels 2618, 2614, respectively, along fold lines 2710, 2708, respectively. Lid panels 2712, 2714 are separated by diagonal through cuts from their adjacent triangular connection panels 2676, 2678; and 2680, 2682, respectively. Closure flaps 2724, 2726 emanate from opposite end edges of lid panel 2712, along fold lines 2716, 2718. Closure flaps 2728, 2730 emanate from opposite end edges of lid panel 2714, along fold lines 2720, 2722.

FIGS. 82A-82H illustrate various stages in the articulation of blank 2600, in which fold lines are not illustrated by broken lines. First, first inner support panels 2624, 2626, 2648, 2650 are folded perpendicular to end panels 2612, 2616. Second inner support panels 2632, 2634, 2656, 2658 are folded 180° relative to their adjacent first inner support panels, so that the first and second inner support panels are face-to-face (adhesive of any suitable kind may be applied therebetween to hold the first and second inner support panels against one another). This is possible, because the second inner support panels are slightly narrower than the first inner support panels. At about the same time, third inner support panels 2640, 2642, 2664, 2666 are folded outwardly 90° (or thereabouts) to positions face-to-face against inside surfaces of end panels 2612, 2616, and adhered thereto, using any suitable adhesive. At the end of the foregoing procedures, four L-shaped support structures are positioned at the corners of bottom panel 2602. See FIG. 82B.

Figure 82D:
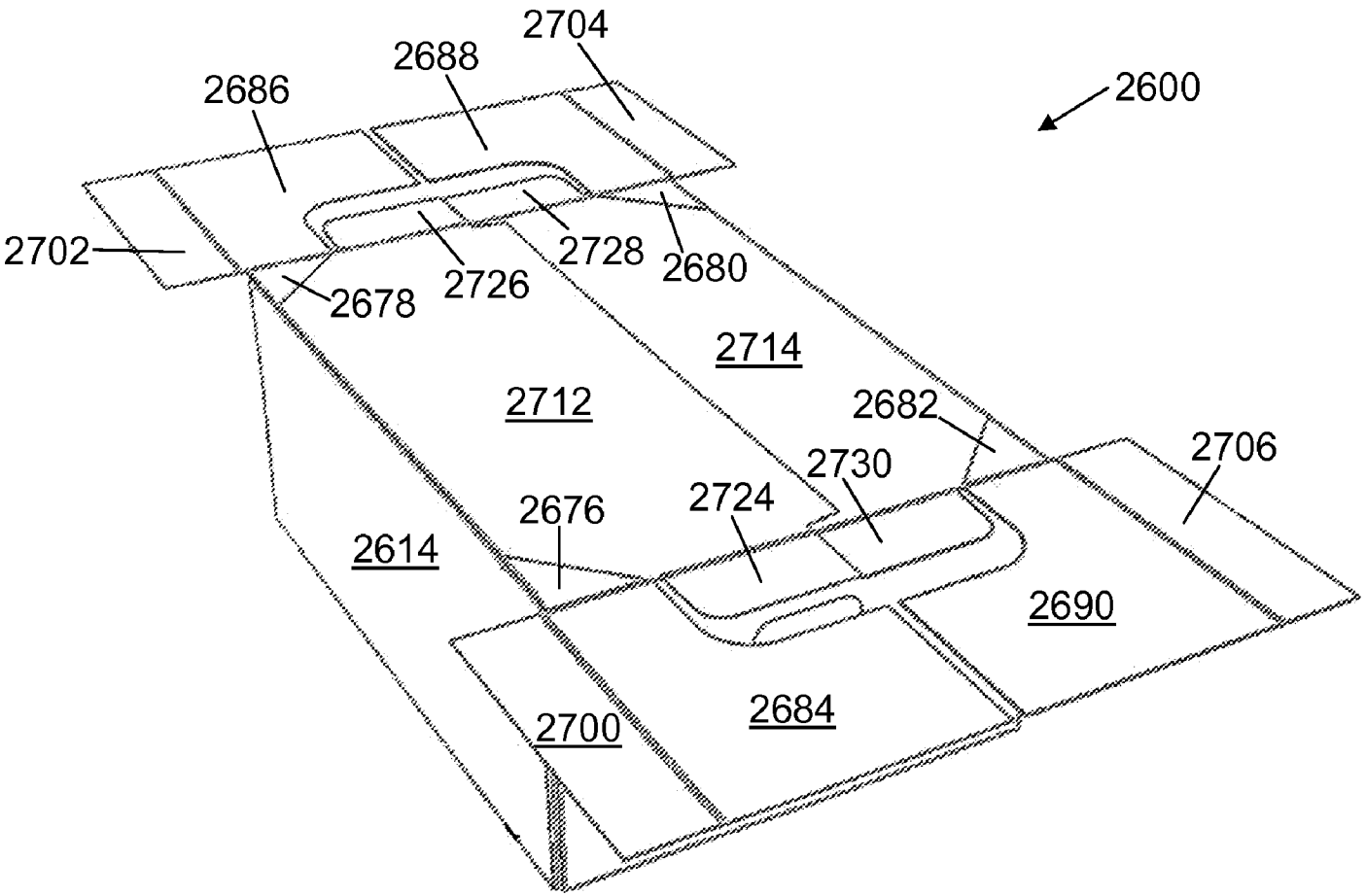
Figure 82E:
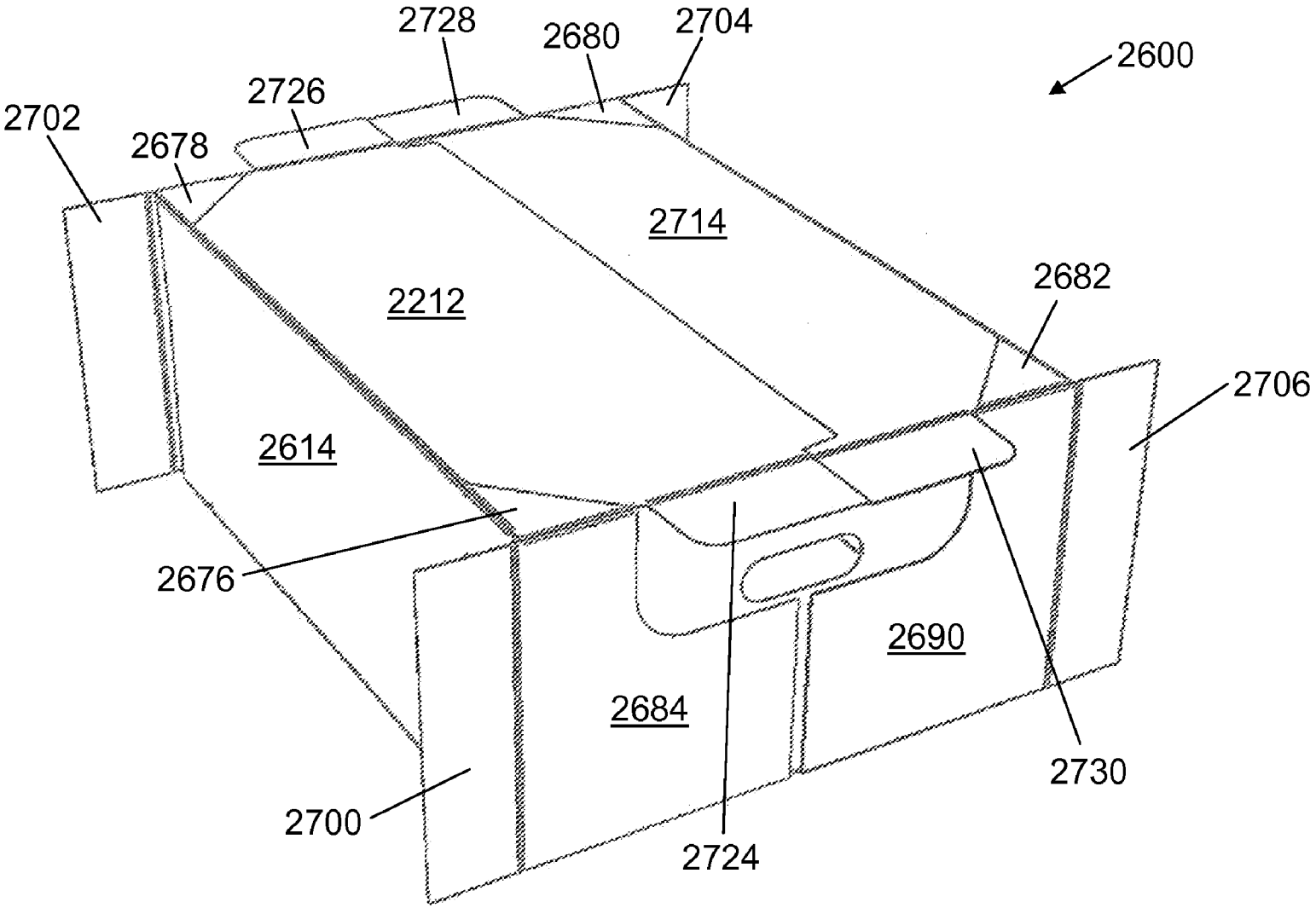
Figure 82F:
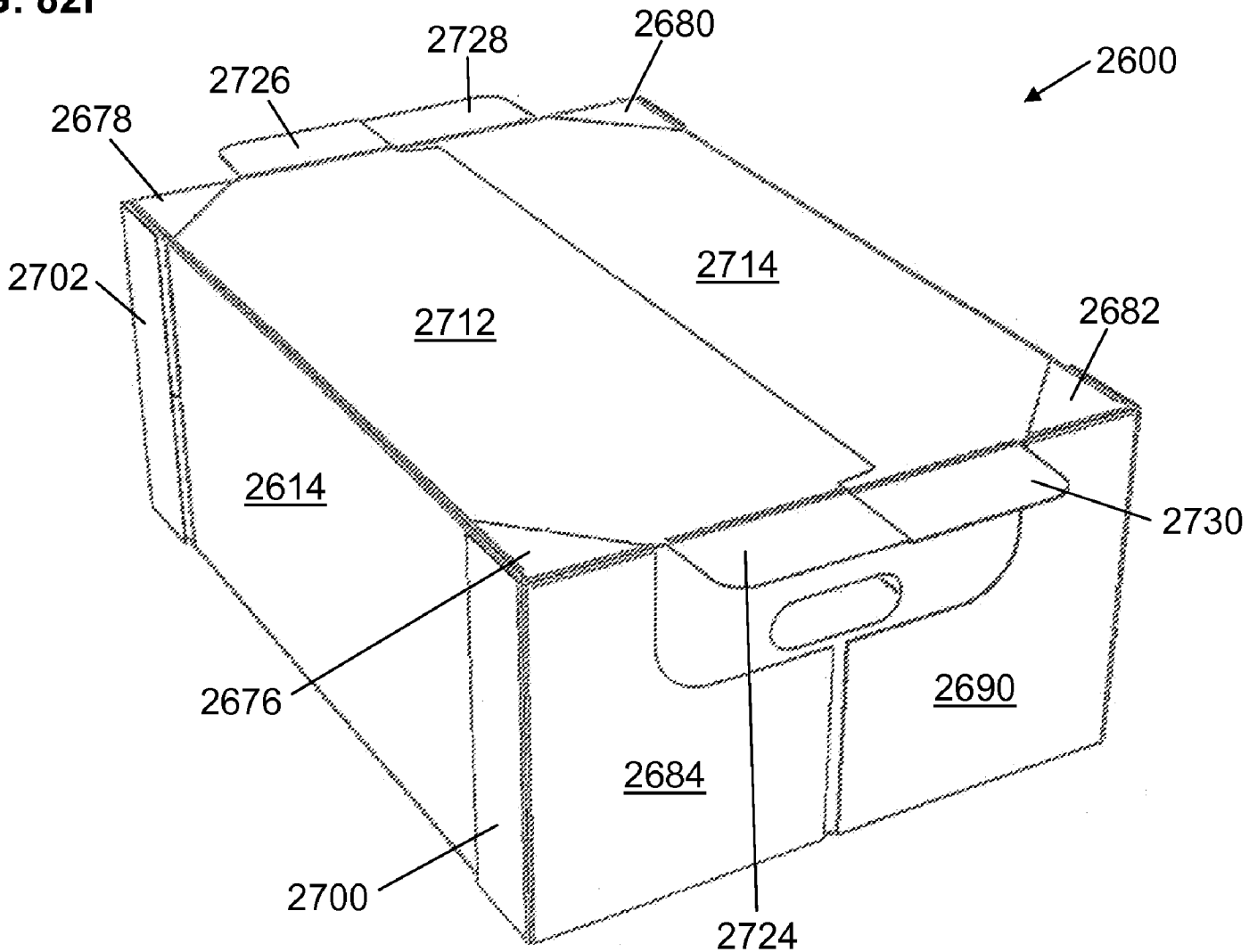
Figure 82G:
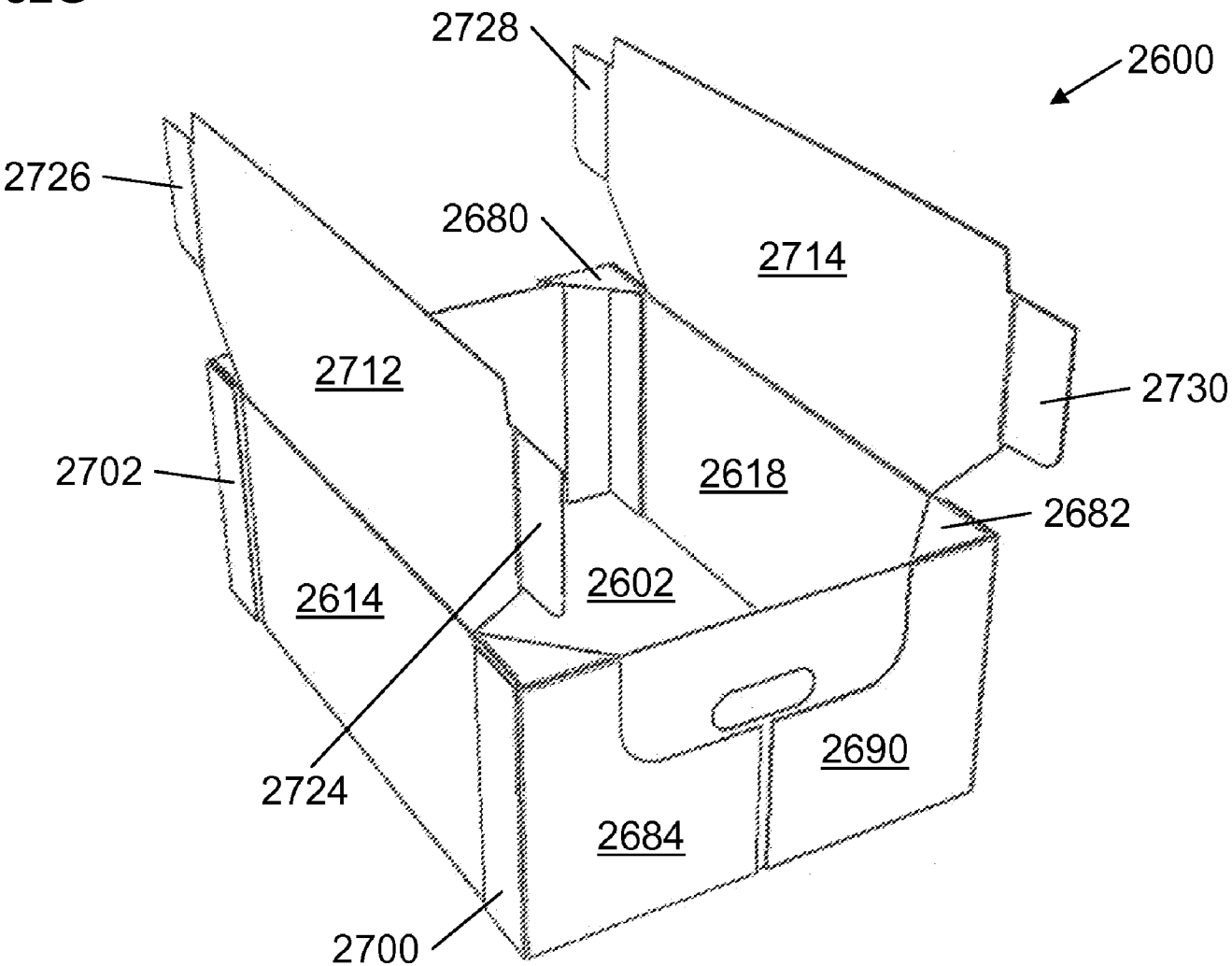
Figure 82H:
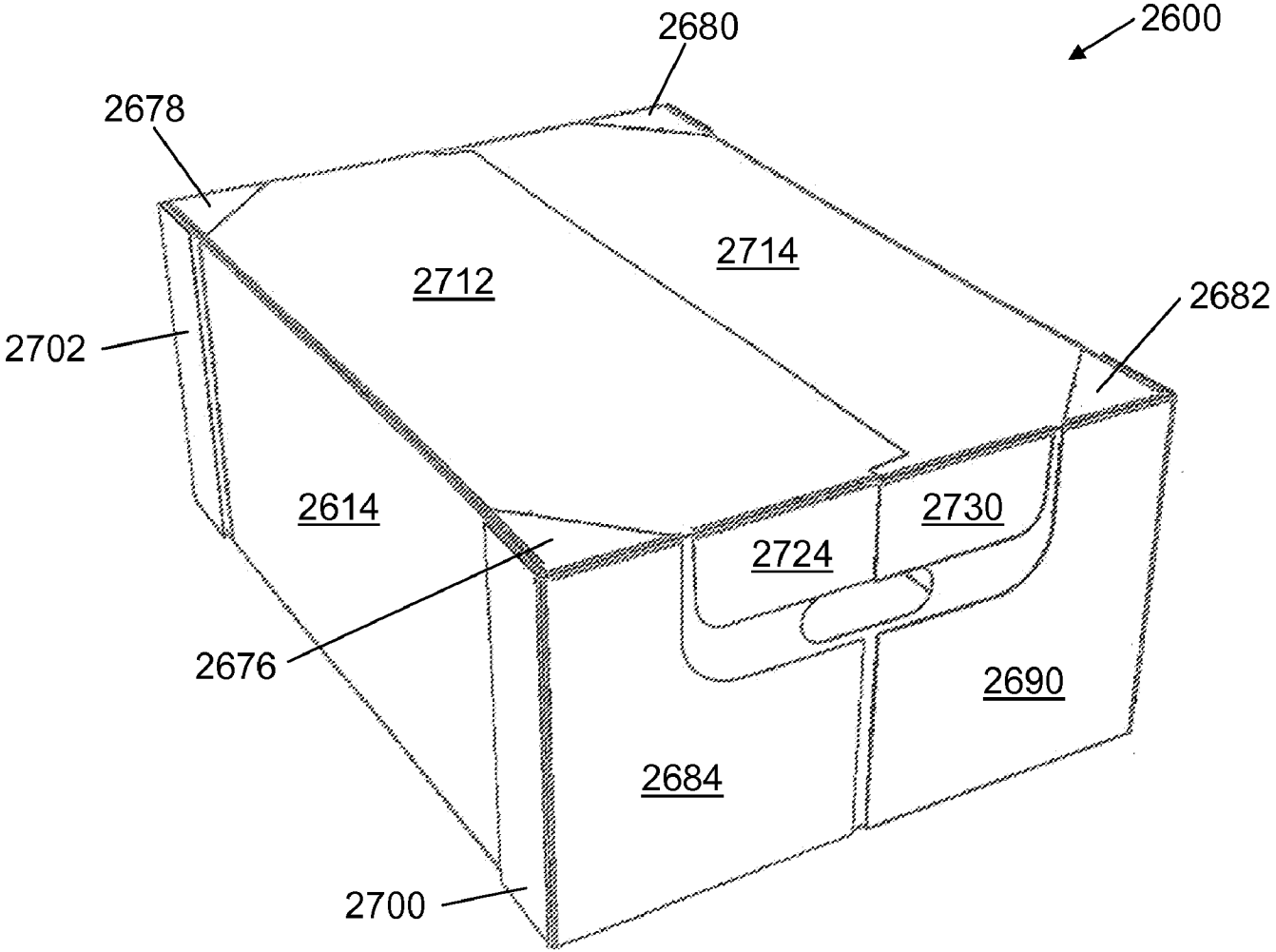

To assemble carton 2600, end panels 2612, 2616 are folded upwardly to positions perpendicular relative to bottom 2602. See FIG. 82A. Rear panel 2614 is folded up perpendicular to bottom panel 2602, and adhered to outwardly facing surfaces of first inner support panels 2624, 2648. Front panel 2618 is folded up perpendicular to bottom panel 2602, and adhered to outwardly facing surfaces of first inner support panels 2626, 2650. See FIG. 82C. Triangular connection panels 2676, 2678, 2680, 2682 are folded inwardly to positions parallel to bottom panel 2602, atop the L-shaped support structures. Adhesive may be applied therebetween. See. FIG. 82D. First outer support panels 2684, 2686, 2688, 2690 are folded down, to positions overlying outer surfaces of end panels 2612, 2616 and adhered thereto, if desired. See FIG. 82E. Second outer support panels 2700, 2702, 2704, 2706 are then folded perpendicular to the first outer support panels, to positions overlying outer surfaces of front and rear panels 2614, 2608 and adhered thereto. See FIG. 82F.

The resulting structure is an articulated container that is ready to be filled with product, as lid panels 2712 and 2714 have not been affixed in place. Panels 2712 and 2714 are raised up, and product placed into the interior of carton 2600. See FIG. 82G. Once product has been placed into carton 2600, lid panels 2712, 2714 are folded over to positions parallel to and over bottom panel 2602. Adhesive panels 2724, 2726, 2728, 2730 are folded down, and adhesively affixed to outside surfaces of end panels 2612, 2616, above the upper edges of L-shaped first outer support panels 2684, 2686, 2688, 2690. See FIG. 82H.

Figure 83:
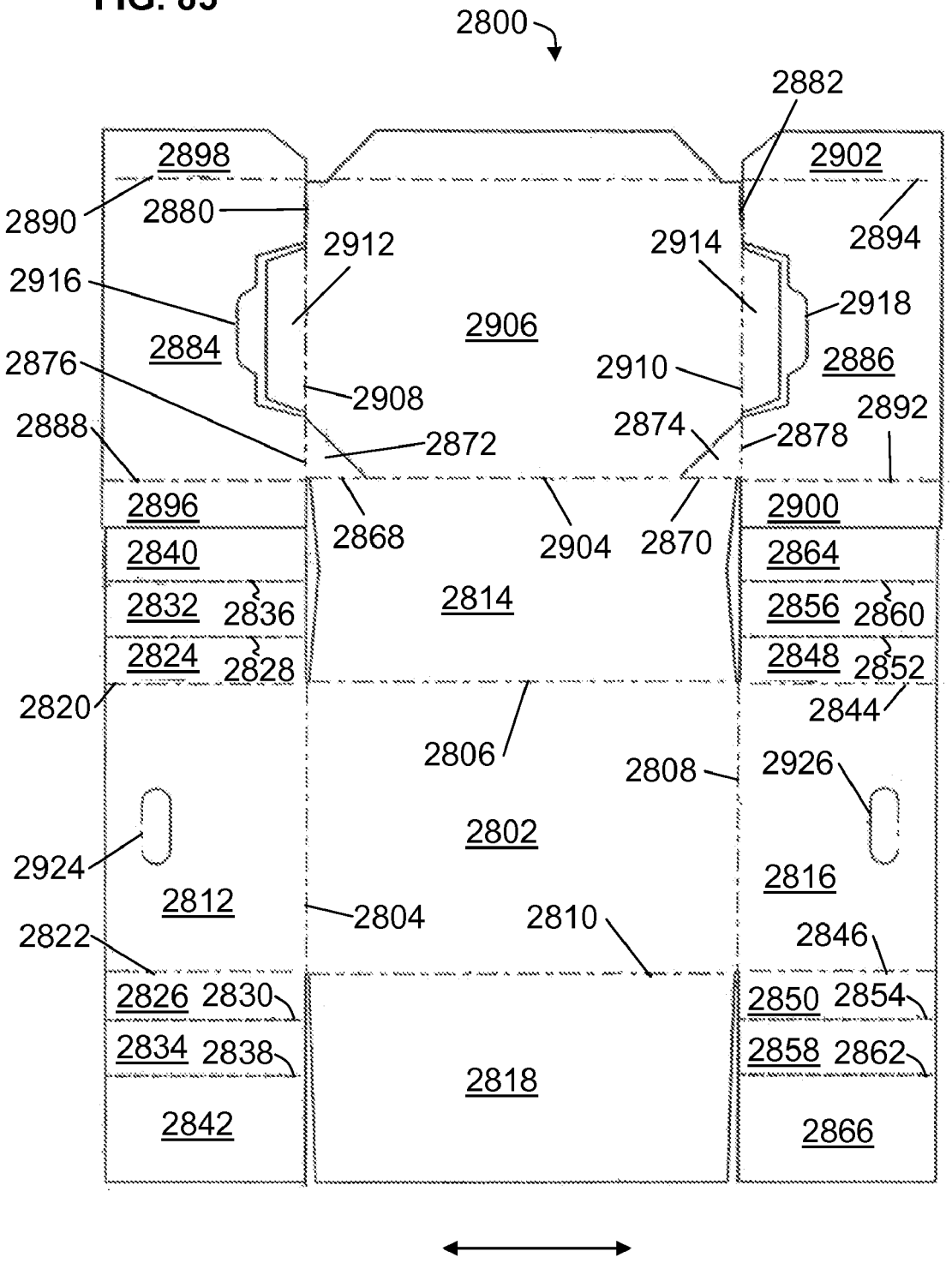
FIG. 83 is a plan view of a blank for a single-lidded carton, having stacking support structures, according to another preferred embodiment of the invention.
Figure 83A:
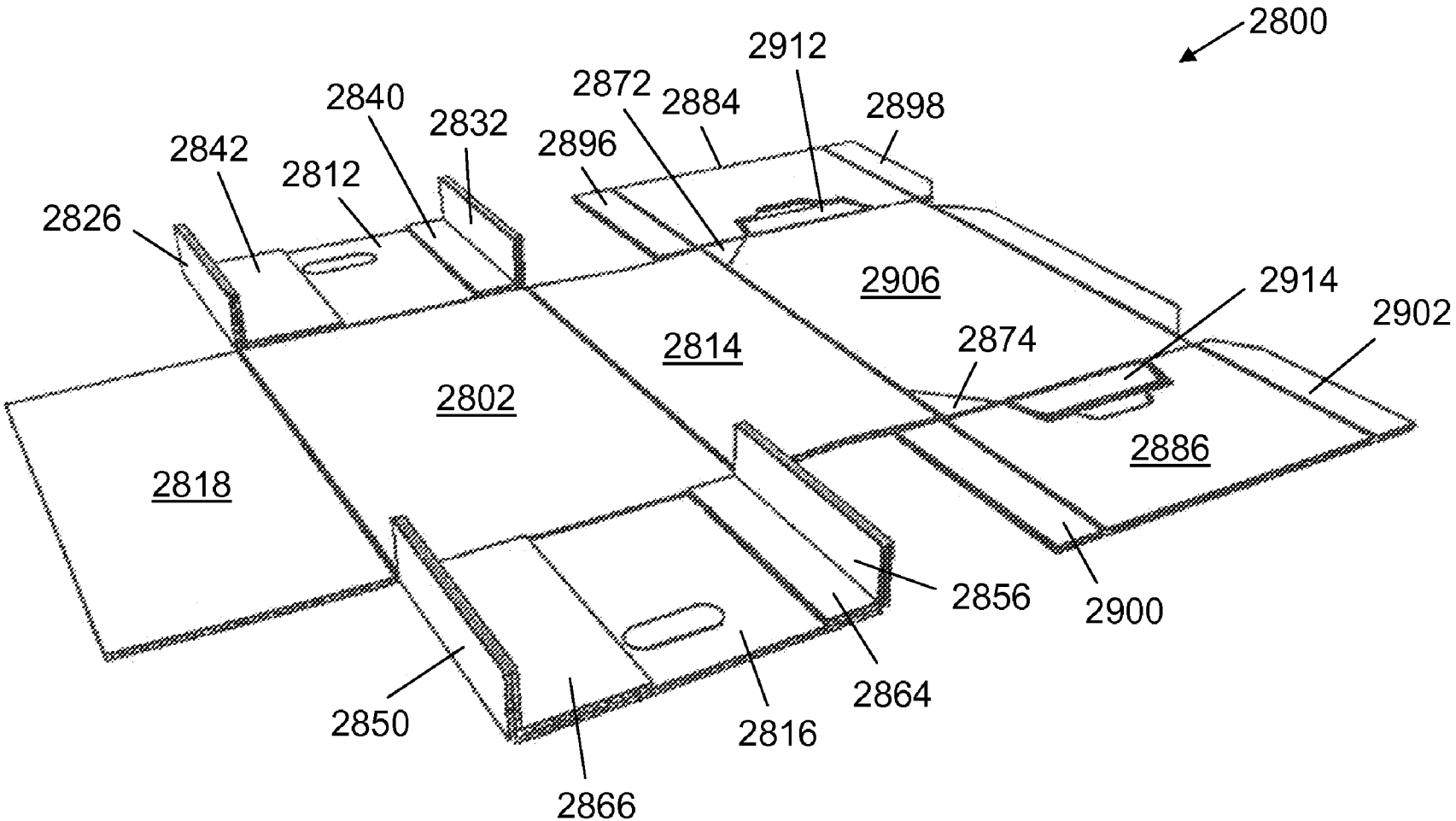
FIGS. 83A-83H illustrate various stages in the articulation of the blank of FIG. 83.
Figure 83B:
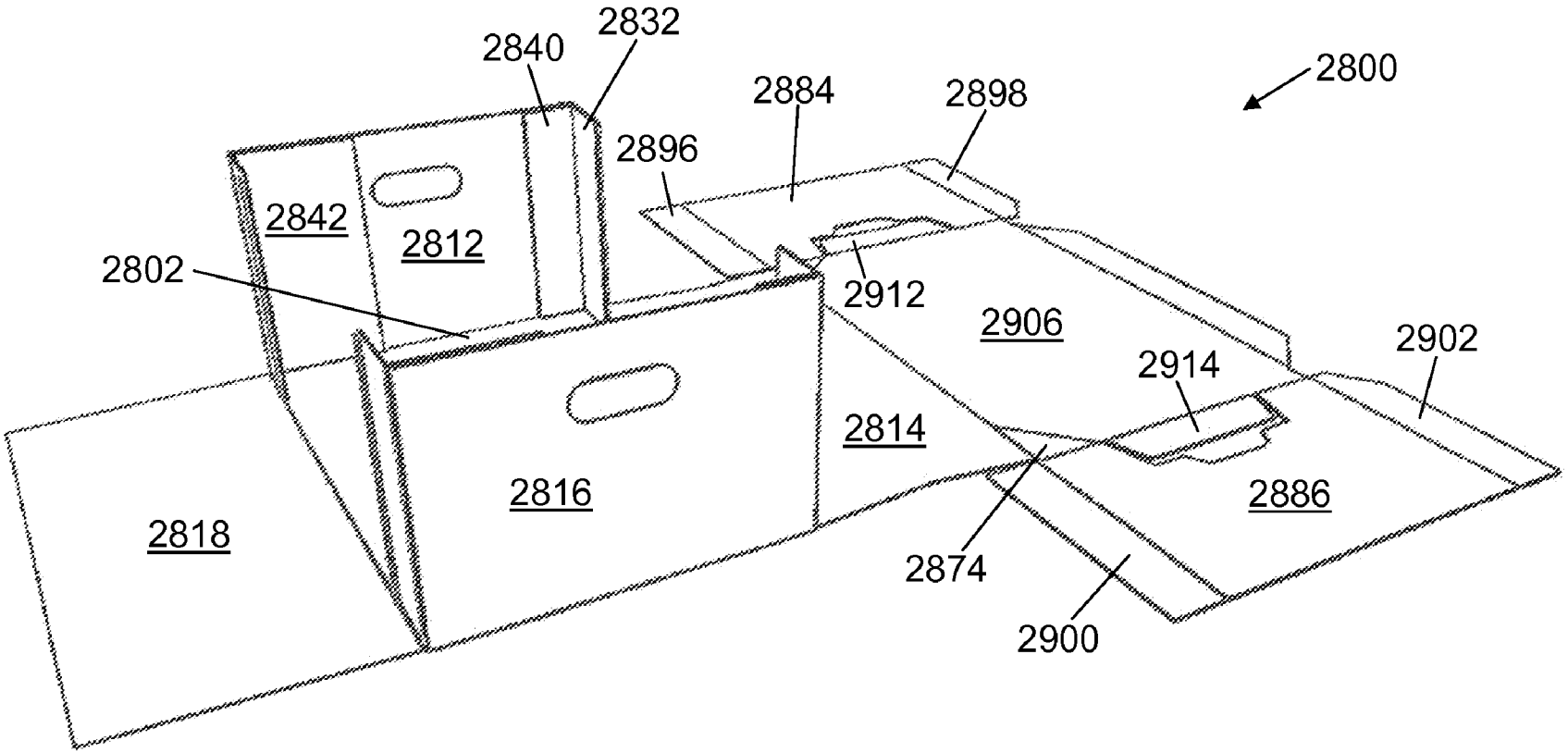
Figure 83C:
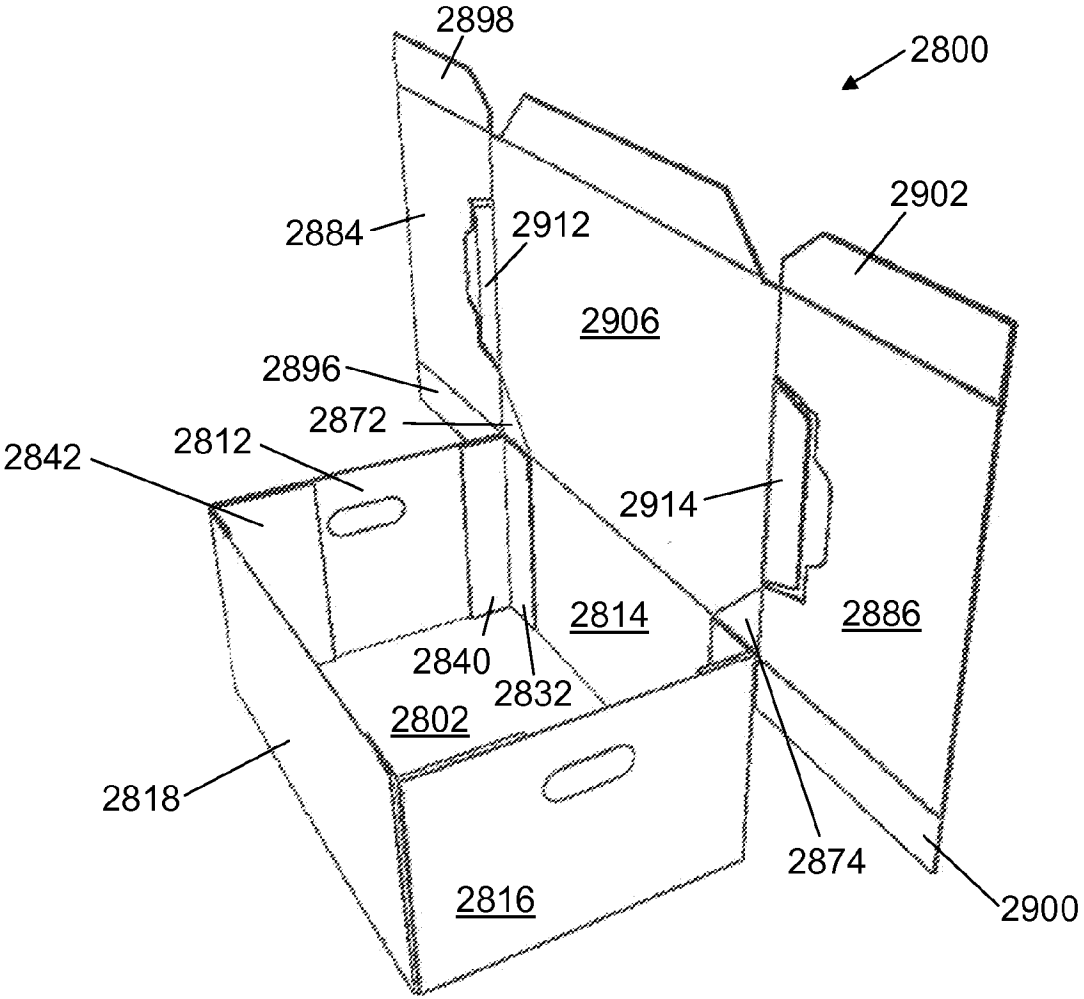
Figure 83D:
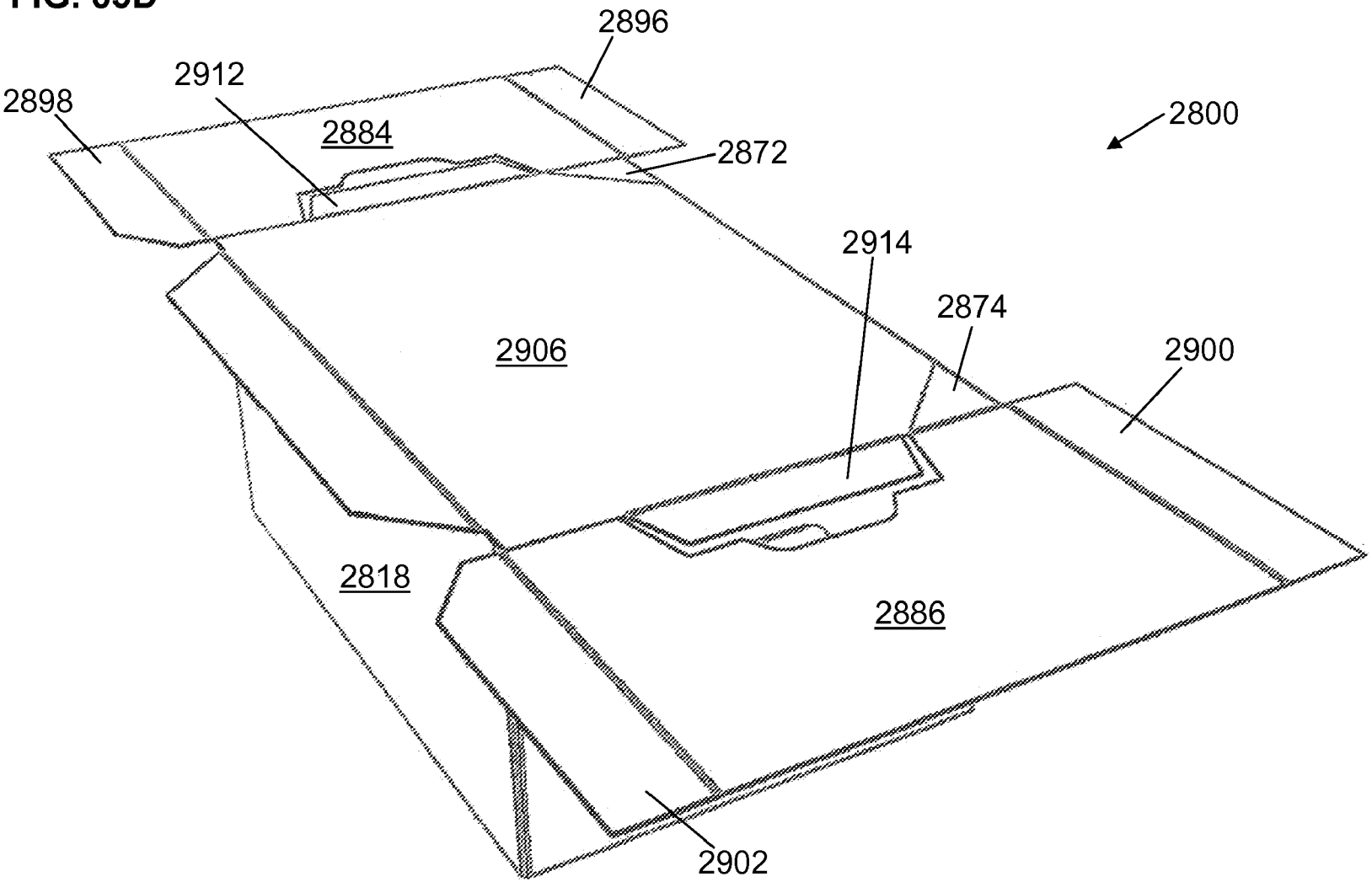
Figure 83E:
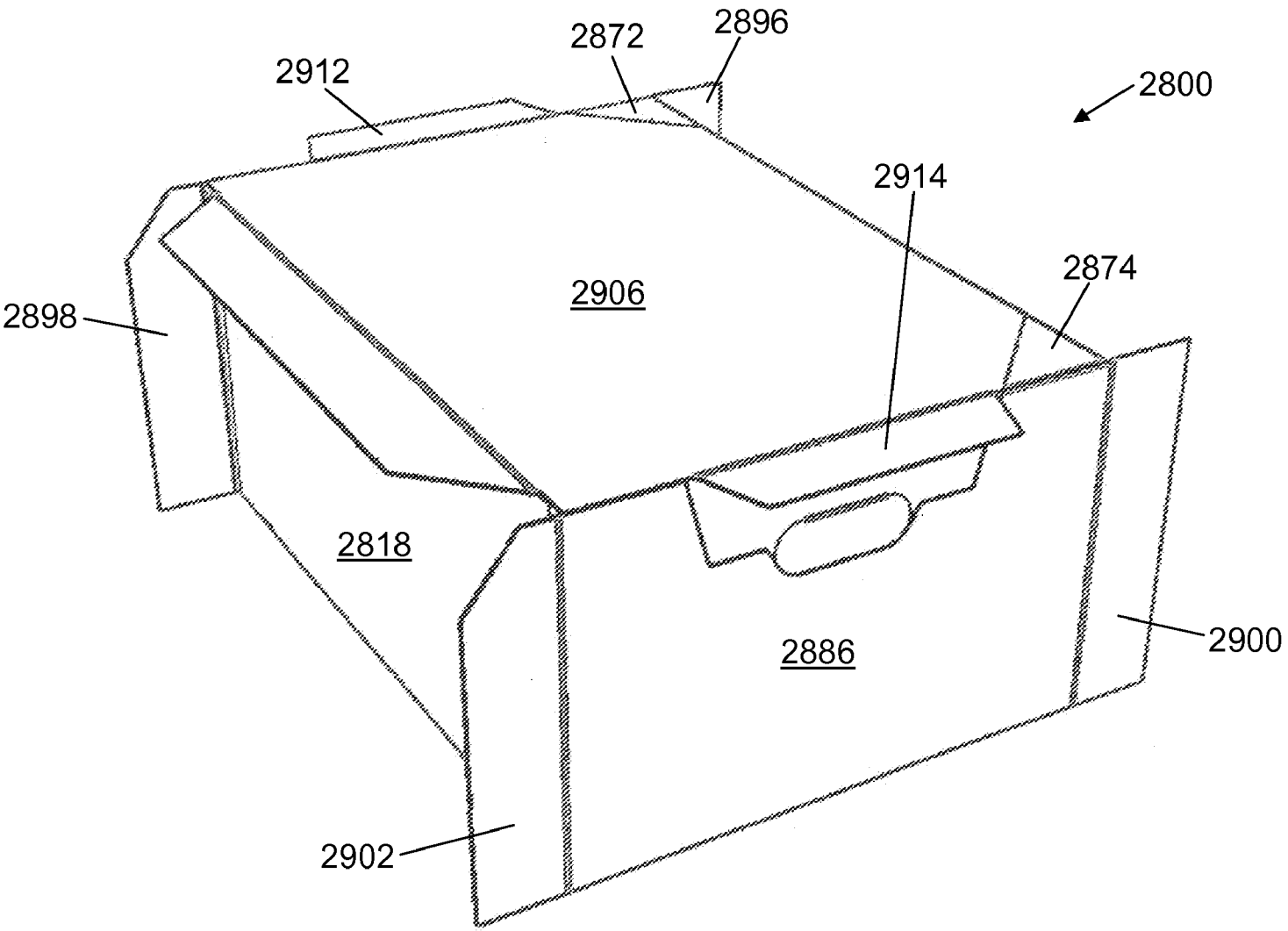
Figure 83F:
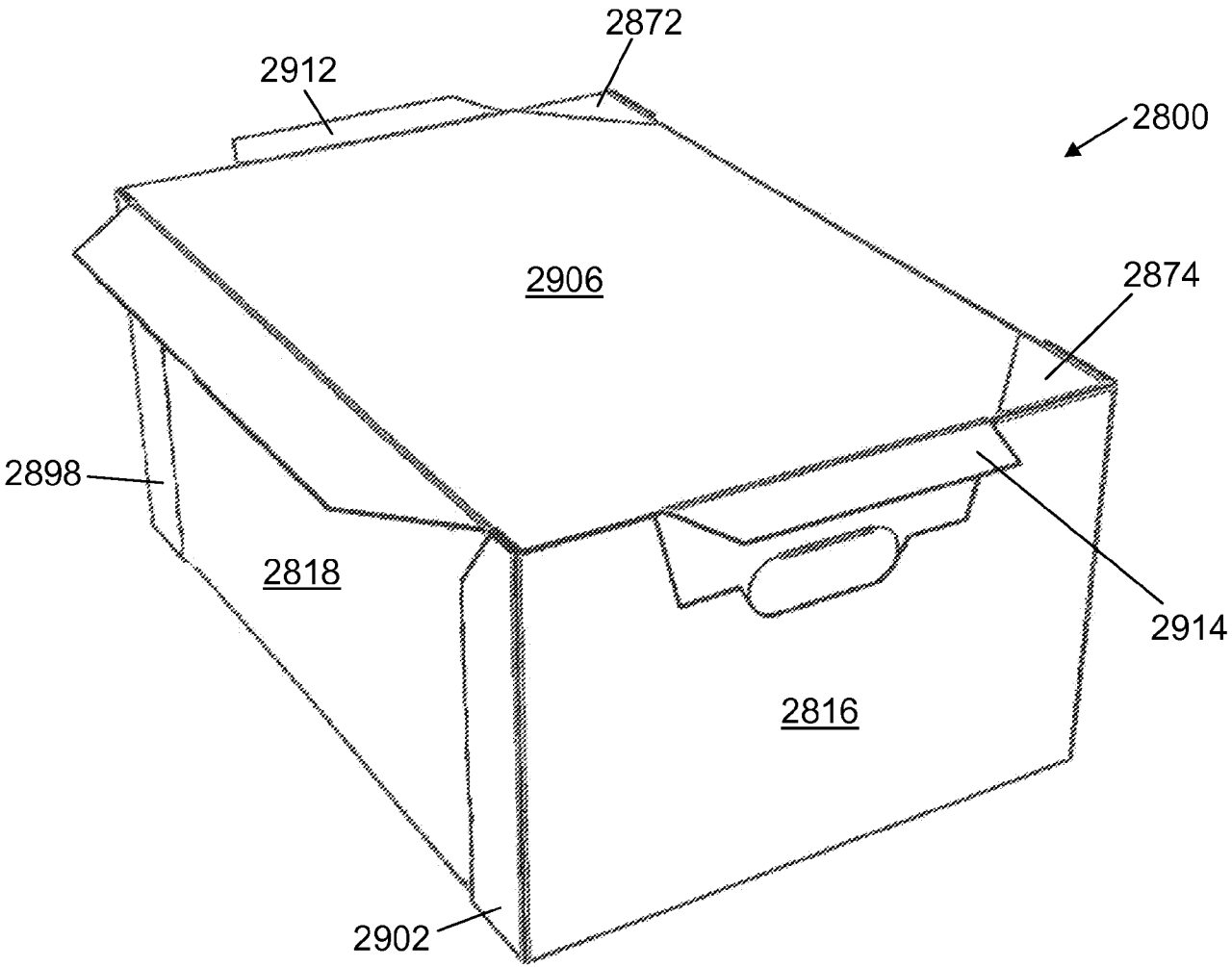
Figure 83G:
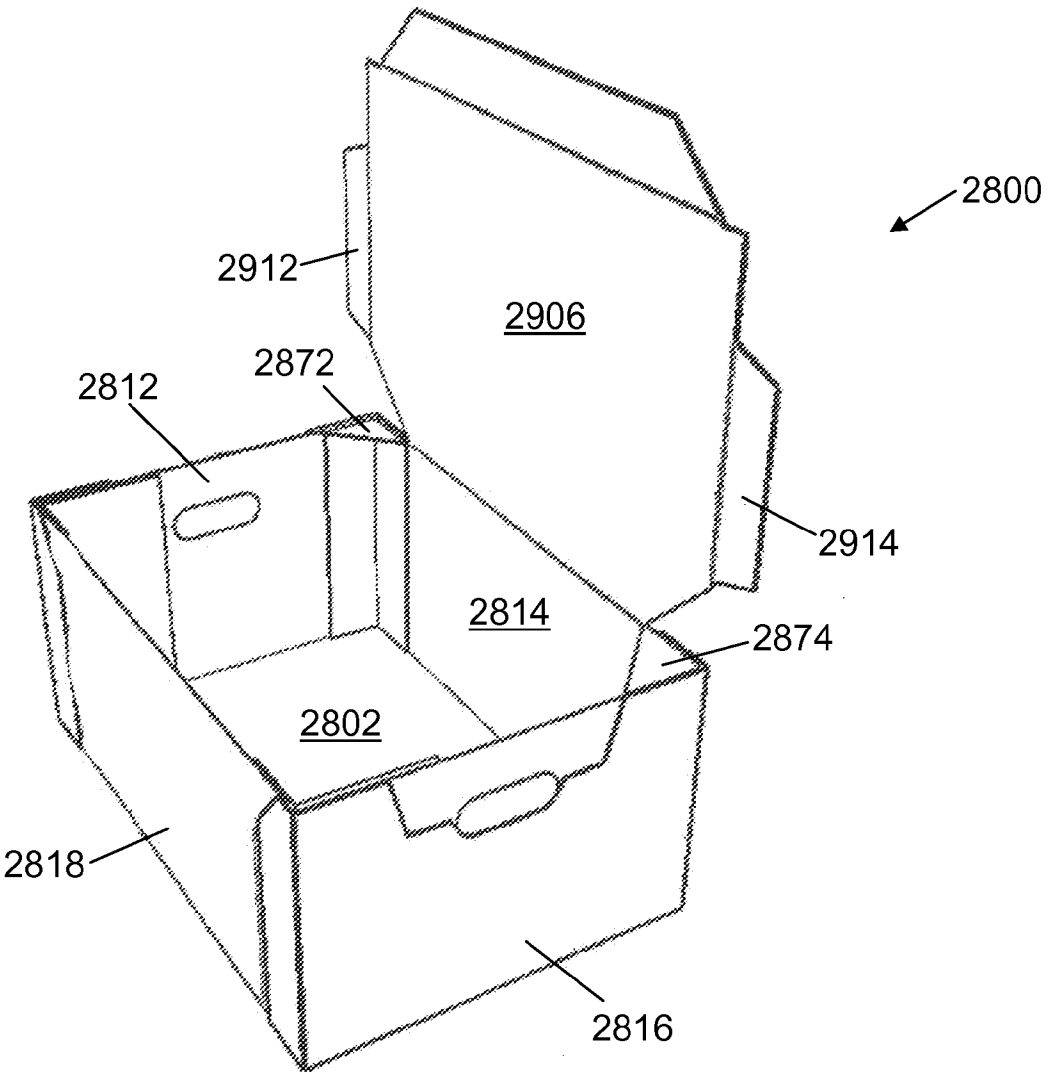
Figure 83H:
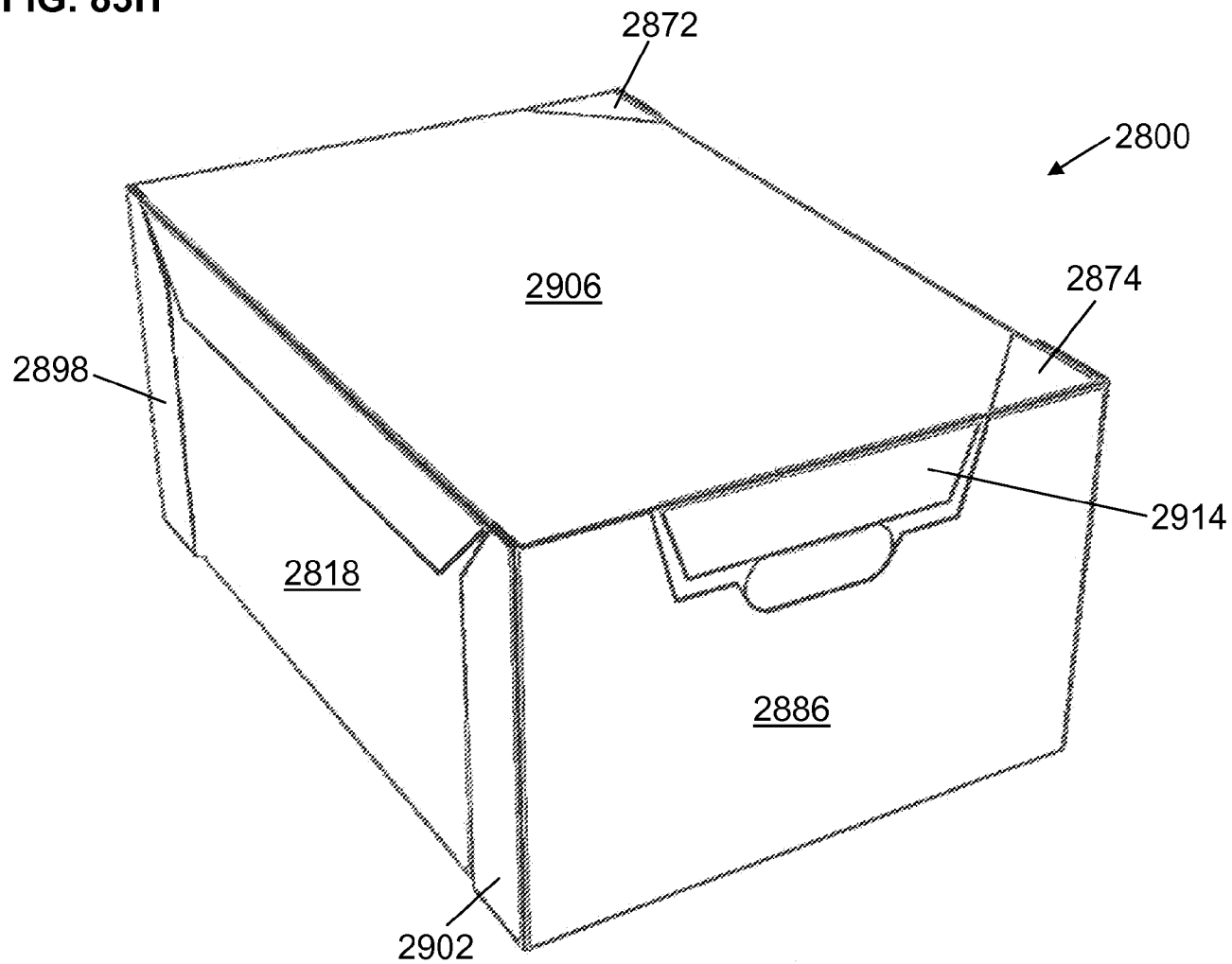

FIG. 83 is a plan view of a blank for a single-lidded carton, having stacking support structures, according to another preferred embodiment of the invention. Preferably, blank 2800 is fabricated from corrugated paperboard material, and the corrugations run in the direction of the double-headed arrow. Blank 2800 includes bottom panel 2802; end panels 2812, 2816, connected by fold lines 2804, 2808, respectively; and front and rear panels 2818, 2814, connected by fold lines 2810, 2806, respectively.

Emanating from opposite front and rear edges of end panel 2812, along fold lines 2820 and 2822 are first inner support panels 2824, 2826. Emanating from fold lines 2828 and 2830, respectively are second inner support panels 2832, 2834. Emanating from fold lines 2836, 2838 are third inner support panels 2840, 2842.

Emanating from opposite front and rear edges of end panel 2816, along fold lines 2844 and 2846 are first inner support panels 2848, 2850. Emanating from fold lines 2852 and 2854, respectively are second inner support panels 2856, 2858. Emanating from fold lines 2860, 2862 are third inner support panels 2864, 2866.

Emanating from the upper edge of rear panel 2814 along fold lines 2868, 2870, are triangular connection panels 2872, 2874, respectively. First outer support panels 2884, 2886 emanate from triangular connection panels 2872, 2874, respectively, along respective fold lines 2876, 2878 disposed therebetween. Second outer support panels 2896, 2898, 2900, 2902 emanate from the first outer support panels, along fold lines 2888, 2890, 2892, 2894. Hand opening knock-outs 2924, 2926 are provided to facilitate lifting of carton 2800.

Lid panel 2906 emanates from rear panel 2814 along fold line 2904. Lid panel 2906 is separated by diagonal through cuts from its adjacent triangular connection panels 2872, 2874, and by parallel cuts 2880, 2882, from first outer support panels 2884, 2886. Closure flaps 2912, 2914 emanate from opposite end edges of lid panel 2906, along fold lines 2908, 2910, and extend into the voids created by contoured recesses 2916, 2918.

FIGS. 83A-83H illustrate various stages in the articulation of blank 2800. First, first inner support panels 2824, 2826, 2848, 2850 are folded perpendicular to end panels 2812, 2816. Second inner support panels 2832, 2834, 2856, 2858 are folded 180° relative to their adjacent first inner support panels, so that the first and second inner support panels are face-to-face (adhesive of any suitable kind may be applied therebetween to hold the first and second inner support panels against one another). This is possible, because the second inner support panels are slightly narrower than the first inner support panels. At about the same time, third inner support panels 2840, 2842, 2864, 2866 are folded outwardly 90° (or thereabouts) to positions face-to-face against inside surfaces of end panels 2812, 2816, and adhered thereto, using any suitable adhesive. At the end of the foregoing procedures, four L-shaped support structures are positioned at the corners of bottom panel 2802. See FIG. 83B.

To assemble carton 2800, end panels 2812, 2816 are folded upwardly to positions perpendicular relative to bottom 2802. See FIG. 83A. At the same time, rear panel 2814 is folded up perpendicular to bottom panel 2802, and adhered to outwardly facing surfaces of first inner support panels 2824, 2848. Front panel 2818 is folded up perpendicular to bottom panel 2802, and adhered to outwardly facing surfaces of first inner support panels 2826, 2850. See FIG. 83C. Triangular connection panels 2872, 2874 are folded inwardly to positions parallel to bottom panel 2802, atop the L-shaped support structures. Adhesive may be applied therebetween. See FIG. 83D. First outer support panels 2884, 2886 are folded down, to positions overlying outer surfaces of end panels 2812, 2814 and adhered thereto, if desired. See FIG. 83E. Second outer support panels 2896, 2898, 2900, 2902 are then folded perpendicular to the first outer support panels, to positions overlying outer surfaces of front and rear panels 2814, 2818 and adhered thereto. See FIG. 83F.

The resulting structure is an articulated container that is ready to be filled with product, as lid panel 2906 has not been affixed in place. Lid panel 2906 is raised (FIG. 83G), and product placed into carton 2800. Once product has been placed into carton 2800, lid panel 2906 is folded over to a position parallel to and over bottom panel 2802. Adhesive panels 2912, 2914 are folded down, and adhesively affixed to outside surfaces of end panels 2812, 2816, above the upper edges of first outer support panels 2884, 2886. See FIG. 83H. Thereafter, knockouts 2924, 2926 are pushed in, to allow carton 2800 to be carried.

Figure 84:
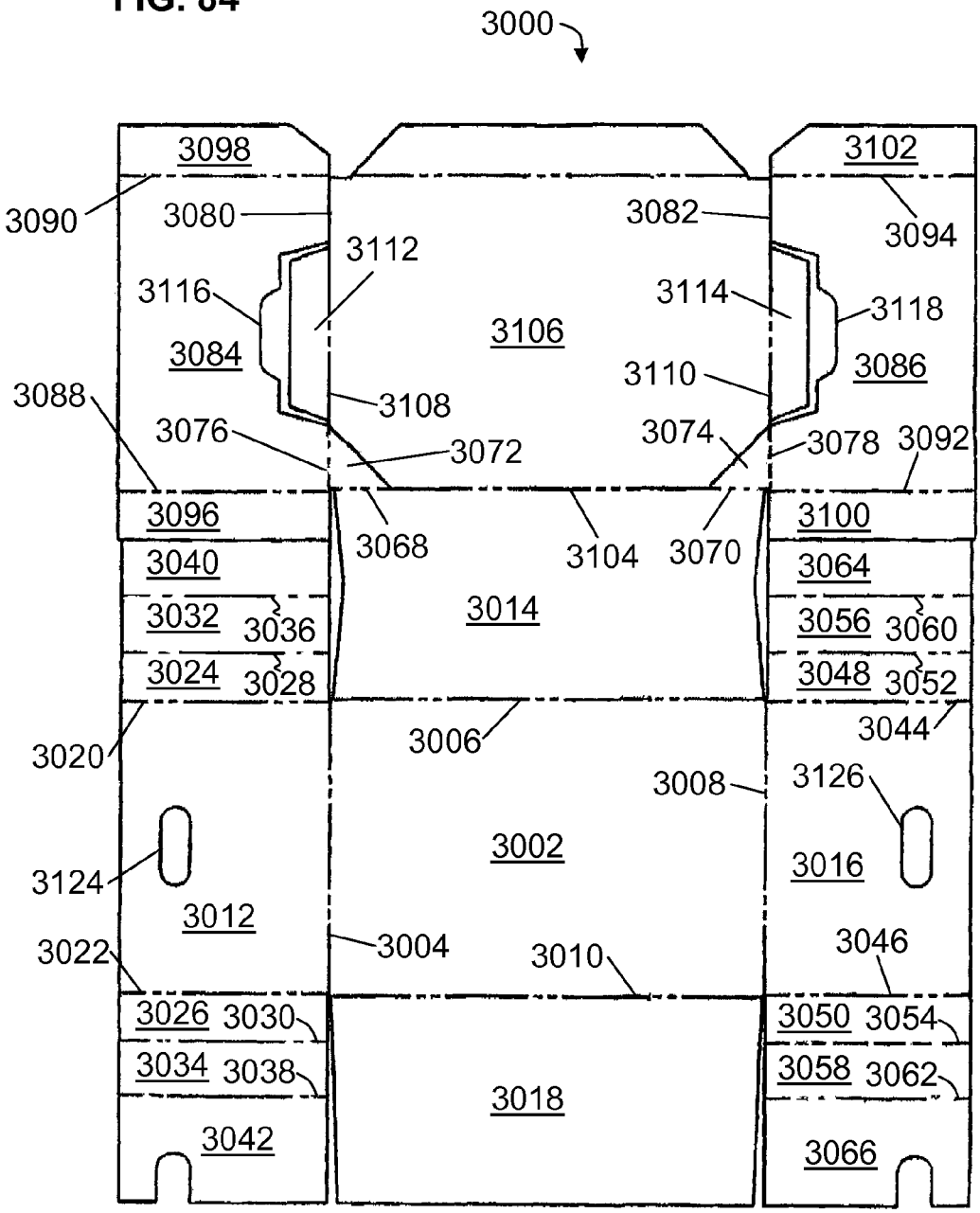
FIG. 84 is a plan view of a blank for a single-lidded carton, having stacking support structures, according to another preferred embodiment of the invention.
Figure 84A:
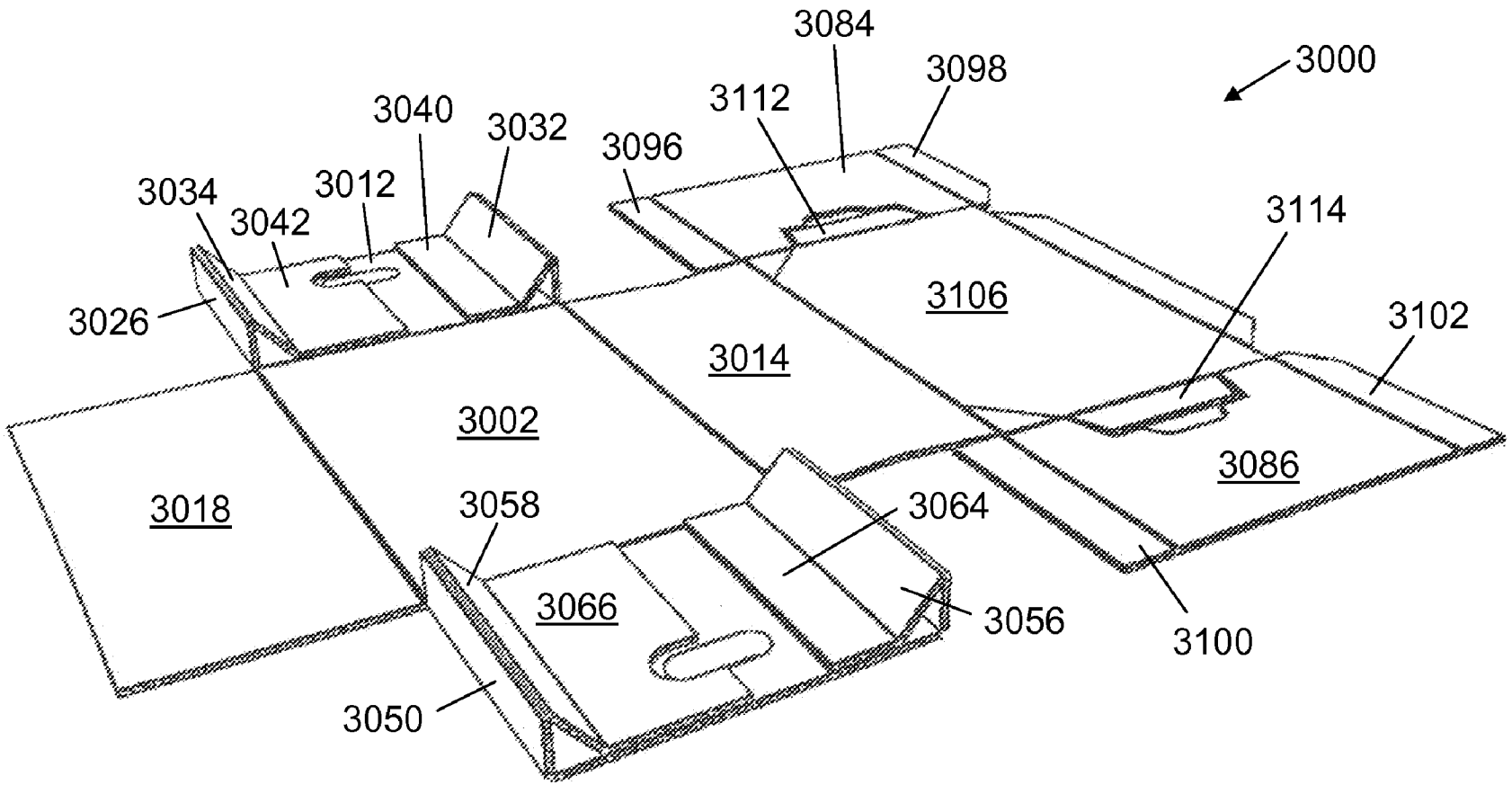
FIGS. 84A-84H illustrate various stages in the articulation of the blank of FIG. 84.
Figure 84B:
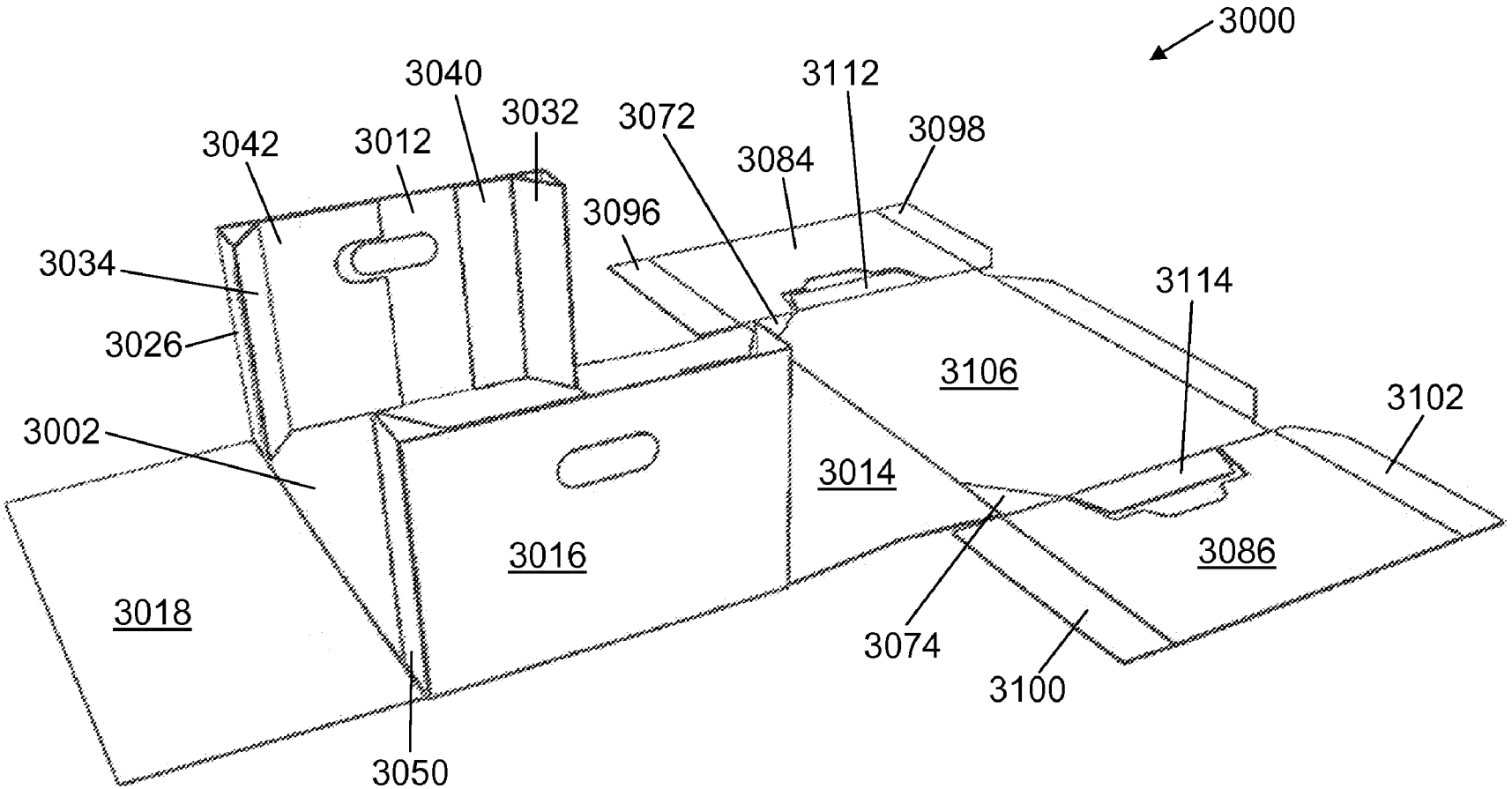
Figure 84C:
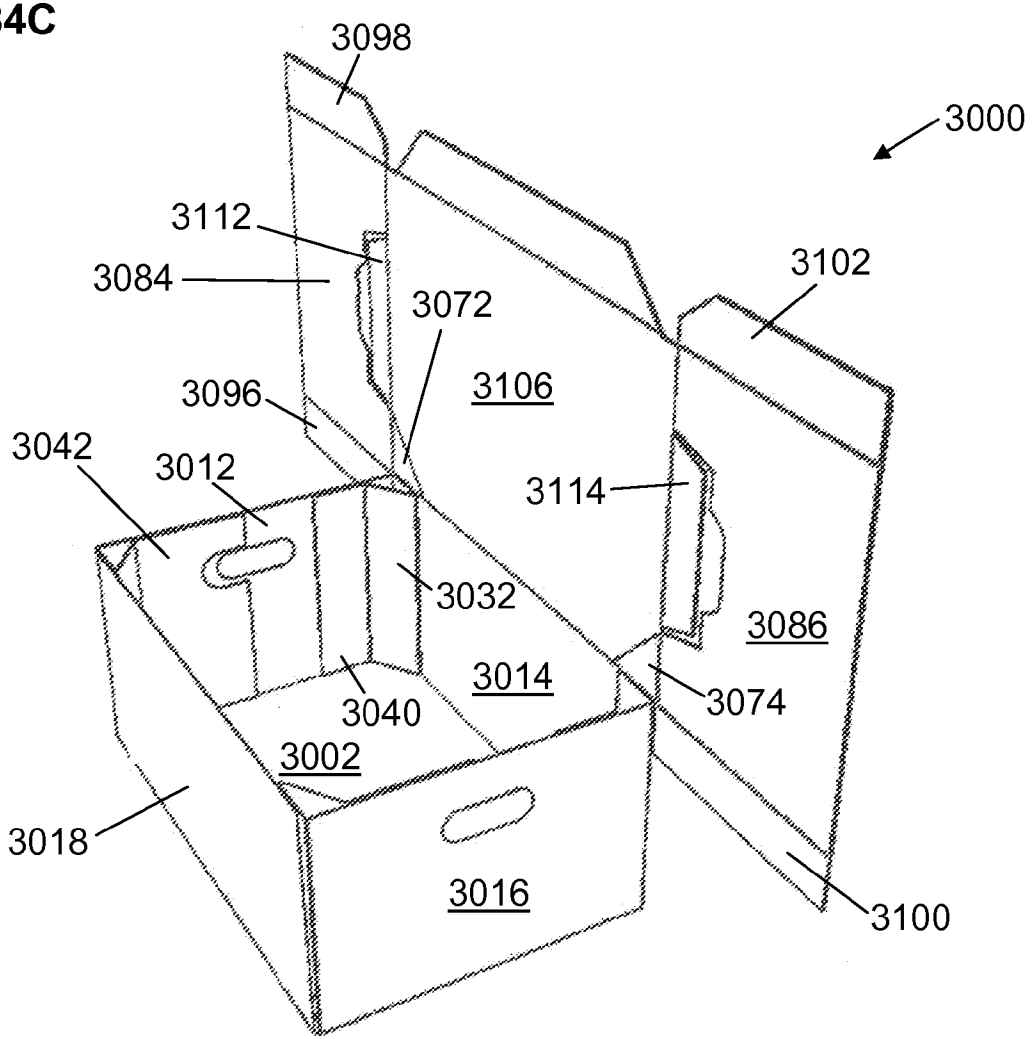
Figure 84D:
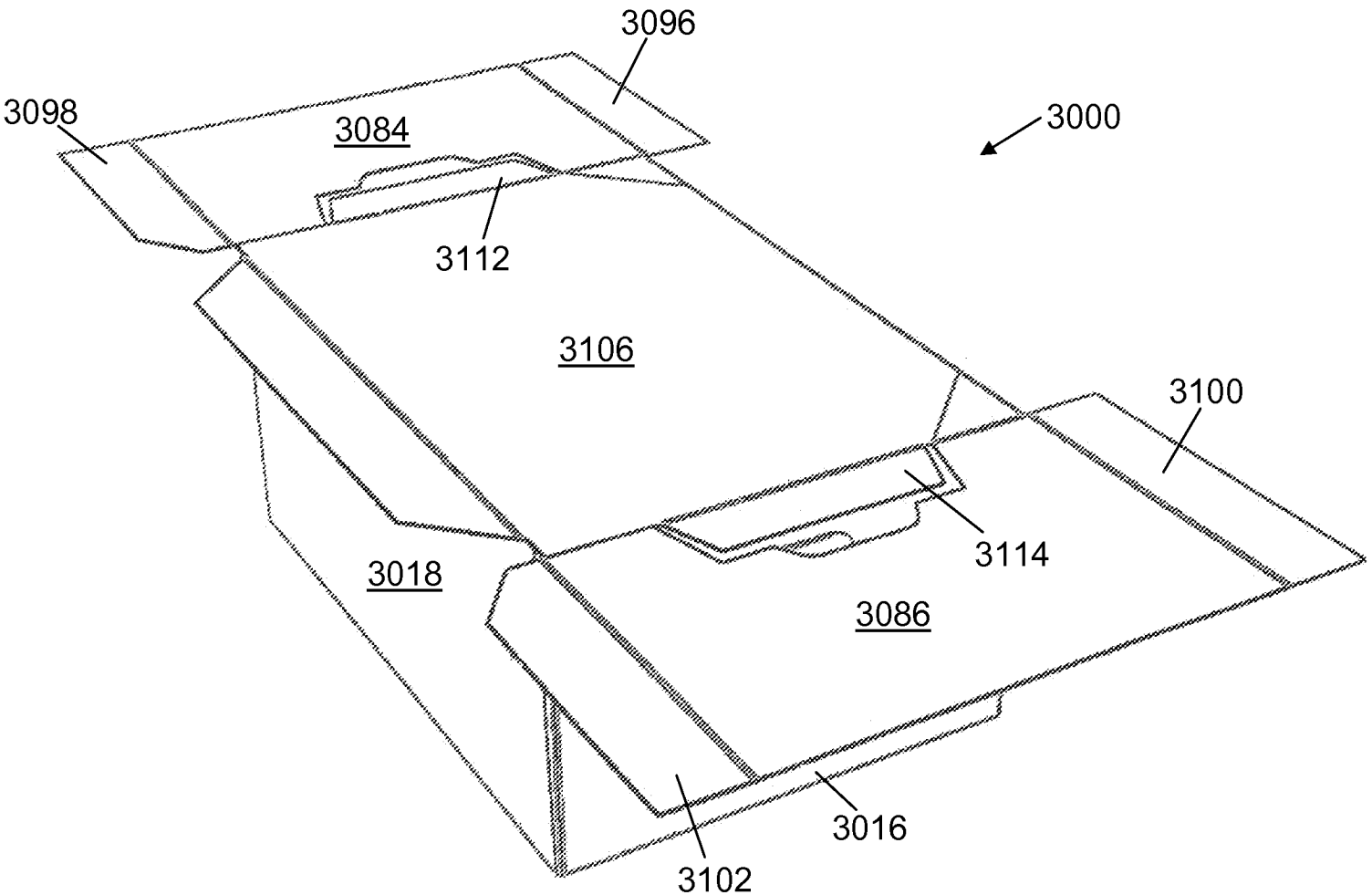
Figure 84E:
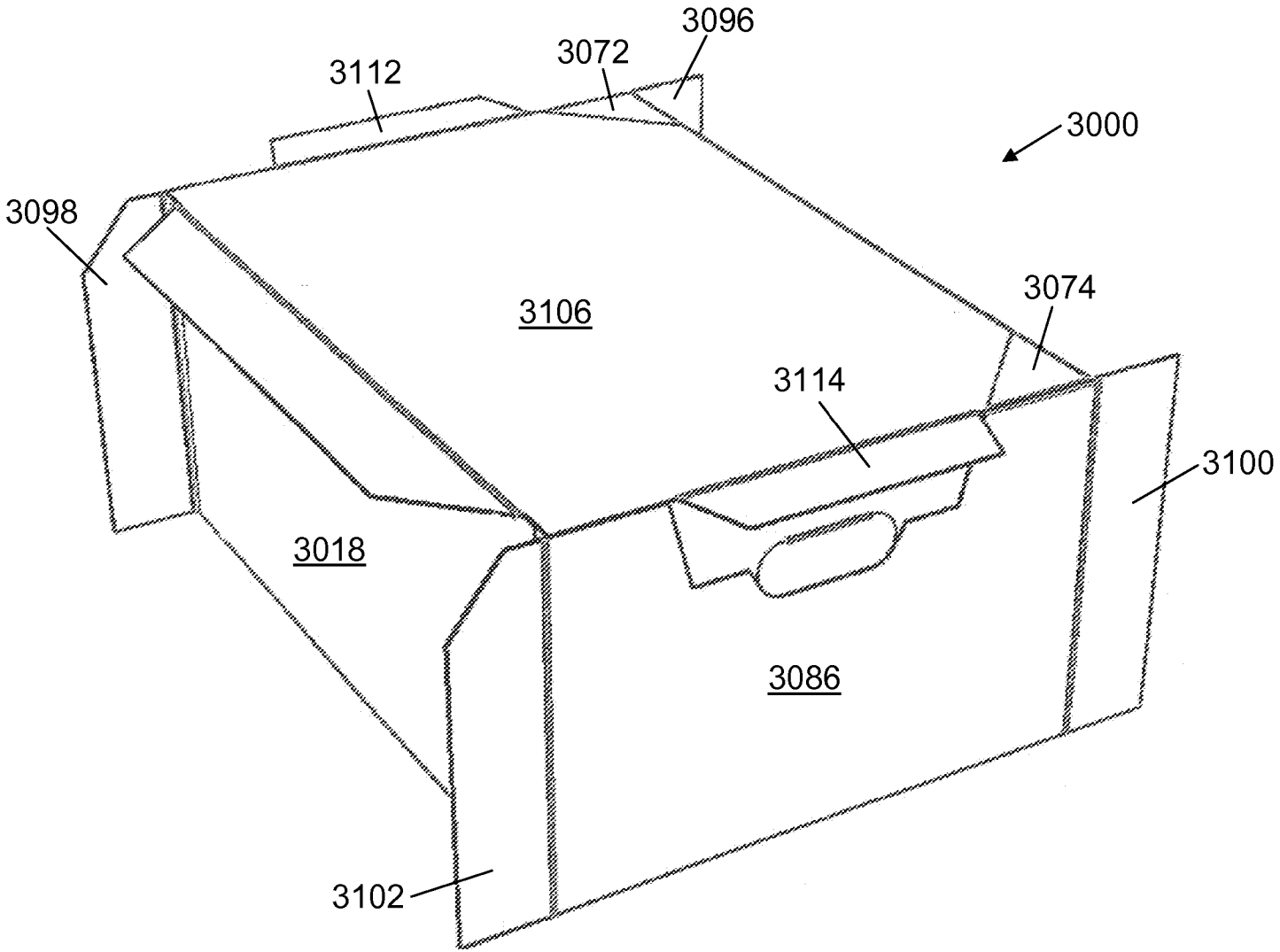
Figure 84F:
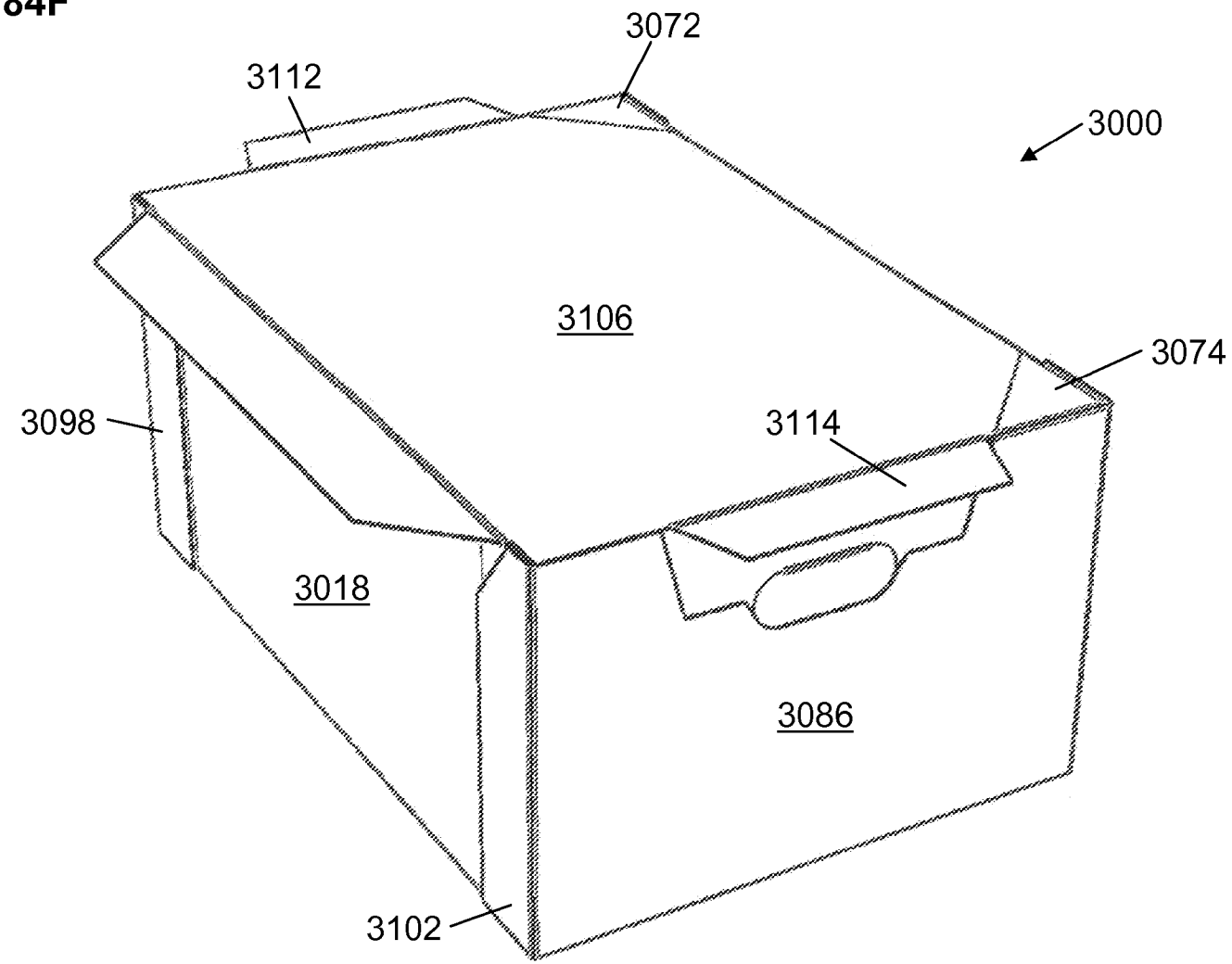
Figure 84G:
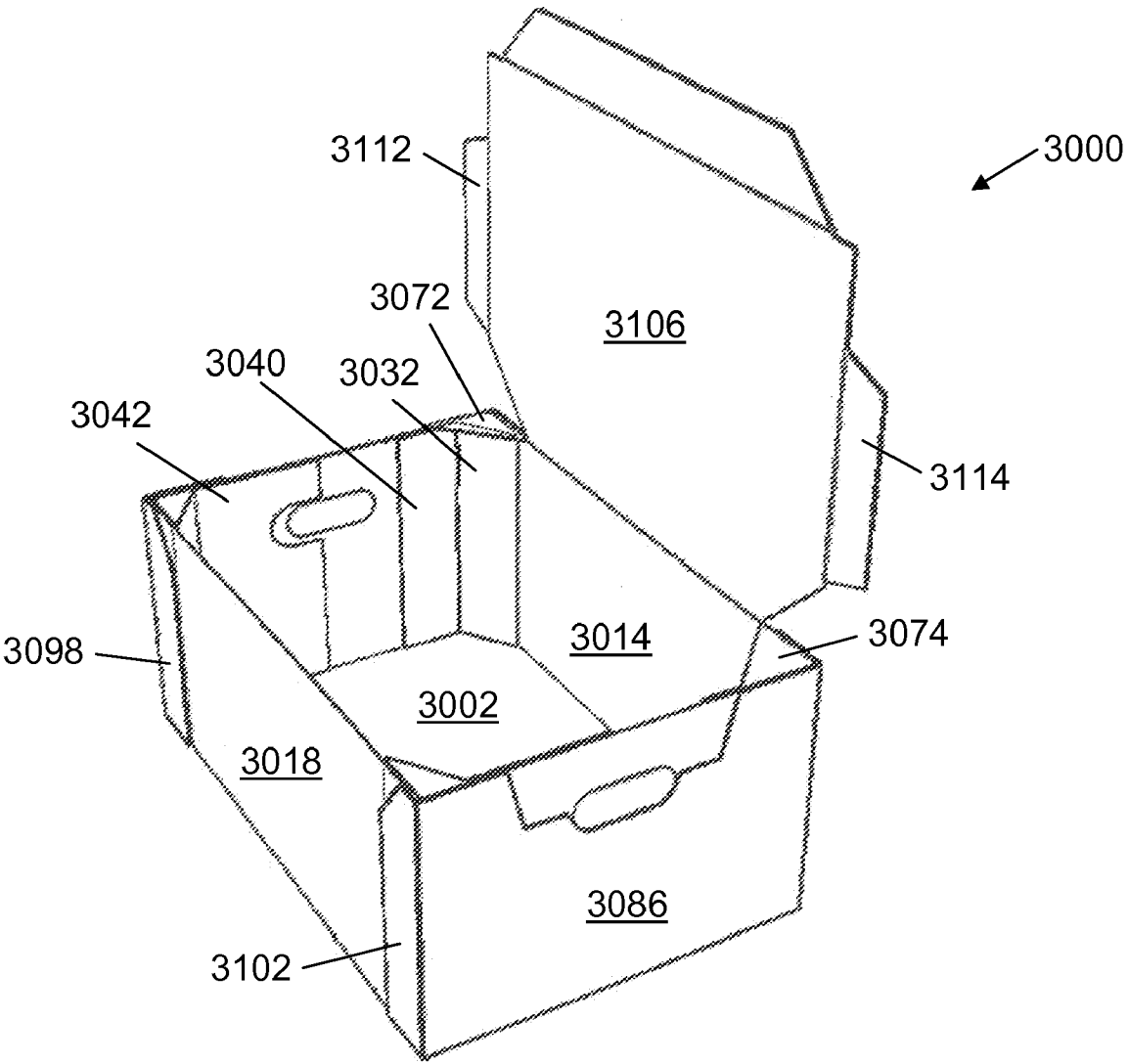
Figure 84H:
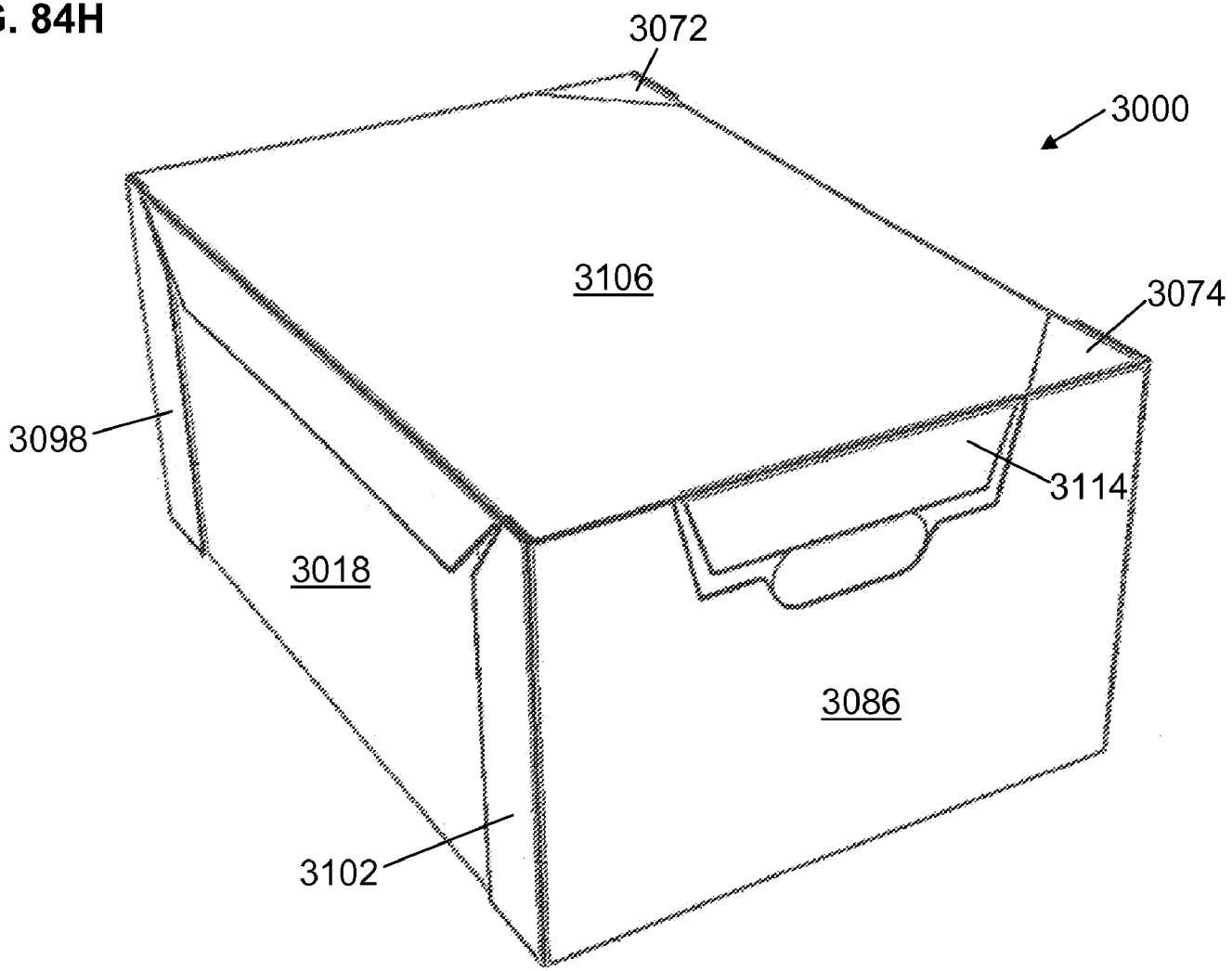

FIG. 84 is a plan view of a blank for a single-lidded carton, having stacking support structures, according to another preferred embodiment of the invention. Blank 3000 includes bottom panel 3002; end panels 3012, 3016, connected by fold lines 3004, 3008, respectively; and front and rear panels 3018, 3014, connected by fold lines 3010, 3006, respectively.

Emanating from opposite front and rear edges of end panel 3012, along fold lines 3020 and 3022 are first inner support panels 3024, 3026. Emanating from fold lines 3028 and 3030, respectively are second inner support panels 3032, 3034. Emanating from fold lines 3036, 3038 are third inner support panels 3040, 3042.

Emanating from opposite front and rear edges of end panel 3016, along fold lines 3044 and 3046 are first inner support panels 3048, 3050. Emanating from fold lines 3052 and 3054, respectively are second inner support panels 3056, 3058. Emanating from fold lines 3060, 3062 are third inner support panels 3064, 3066.

Emanating from the upper edge of rear panel 3014 along fold lines 3068, 3070, are triangular connection panels 3072, 3074, respectively. First outer support panels 3084, 3086 emanate from triangular connection panels 3072, 3074, respectively, along respective fold lines 3076, 3078 disposed therebetween. Second outer support panels 3096, 3098, 3100, 3102 emanate from the first outer support panels, along fold lines 3088, 3090, 3092, 3094. Hand opening knockouts 3124, 3126 are provided to facilitate lifting of carton 3000.

Lid panel 3106 emanates from rear panel 3014 along fold line 3104. Lid panel 3106 is separated by diagonal through cuts from its adjacent triangular connection panels 3072, 3074, and by parallel cuts 3080, 3082, from first outer support panels 3084, 3086. Closure flaps 3112, 3114 emanate from opposite end edges of lid panel 3106, along fold lines 3108, 3110, and extend into the voids created by contoured recesses 3116, 3118.

FIGS. 84A-84H illustrate various stages in the articulation of blank 3000, wherein fold lines are not illustrated with broken lines. To assemble carton 3000, first, first inner support panels 3024, 3026, 3048, 3050 are folded perpendicular to end panels 3012, 3016. Second inner support panels 3032, 3034, 3056, 3058 are folded to an included acute angle, relative to their adjacent first inner support panels, so that the first and second inner support panels, and adjacent end panels define triangular columns. This is possible, because the second inner support panels are wider than the first inner support panels. At about the same time, third inner support panels 3040, 3042, 3064, 3066 are folded outwardly to positions face-to-face against inside surfaces of end panels 3012, 3016, and adhered thereto, using any suitable adhesive. See FIG. 84B. At the end of the foregoing procedures, four triangle-(or delta-) shaped support structures are positioned at the corners of bottom panel 3002.

End panels 3012, 3016 are folded upwardly to positions perpendicular relative to bottom 3002. See FIG. 84A. To complete carton 3000, at the same time, rear panel 3014 is folded up perpendicular to bottom panel 3002, and adhered to outwardly facing surfaces of first inner support panels 3024, 3048. Front panel 3018 is folded up perpendicular to bottom panel 3002, and adhered to outwardly facing surfaces of first inner support panels 3026, 3050. See FIG. 84C. Triangular connection panels 3072, 3074 are folded inwardly to positions parallel to bottom panel 3002, atop the delta-shaped support structures. Adhesive may be applied therebetween. See FIG. 84D. First outer support panels 3084, 3086 are folded down, to positions overlying outer surfaces of end panels 3012, 3014 and adhered thereto, if desired. See FIG. 84E. Second outer support panels 3096, 3098, 3100, 3102 are then folded perpendicular to the first outer support panels, to positions overlying outer surfaces of front and rear panels 3014, 3018 and adhered thereto. See FIG. 84F.

The resulting structure is an articulated container that is ready to be filled with product, as lid panel 3106 has not been affixed in place. Lid 3106 is raised (FIG. 84G), and product placed therein. Once product has been placed into carton 3000, lid panel 3106 is folded over to a position parallel to and over bottom panel 3002. Adhesive panels 3112, 3114 are folded down, and adhesively affixed to outside surfaces of end panels 3012, 3016, above the upper edges of first outer support panels 3084, 3086. See FIG. 84H. Then, knockouts 3124, 3126 are pushed in, to enable carton 3000 to be carried.

The foregoing description and drawings merely explain and illustrate the invention and the invention is not limited thereto, as those skilled in the art who have the disclosure before them will be able to make modifications and variations therein without departing from the scope of the invention.

What is claimed is:

1. A carton, fabricated from a blank formed from at least one of paper, paperboard and corrugated paperboard, comprising:

a bottom panel;

two side panels emanating from opposing side edges of the bottom panel;

at least one lid panel emanating from a top edge of one of the side panels;

two end panels emanating from opposing end edges of the bottom panel, the opposing end edges of the bottom panel extending substantially perpendicular to the opposing side edges of the bottom panel;

at least one connection panel emanating from a top edge region of at least one of the two side panels, a foldable line of weakness disposed between the at least one of the two side panels and the at least one connection panel;

at least one outer support panel emanating from an end edge of the at least one connection panel, a foldable line of weakness disposed between the at least one connection panel and the at least one outer support panel, the at least one outer support panel being affixed to an outside surface of an adjacent one of the end panels;

at least one first inner support panel emanating from an end edge of at least one of the two end panels, a line of foldable weakness disposed between the at least one first inner support panel and the at least one of the two end panels;

at least one second inner support panel emanating from an edge of the at least one first inner support panel, a line of foldable weakness disposed between the at least one second inner support panel and the at least one first inner support panel; and at least one third inner support panel emanating from an edge of the at least one second inner support panel, a line of foldable weakness disposed between the at least one third inner support panel and the at least one second inner support panel;

the at least one third inner support panel being affixed to an inside surface of the at least one of the two end panels to form, with the at least one first inner support panel and the at least one second inner support panel, at least one vertically extending stacking support structure upon articulation of the blank into the carton.

2. The carton according to claim 1, wherein the at least one vertically extending stacking support structure is L-shaped in cross-section.

3. The carton according to claim 2, wherein the at least one second inner support panel has a width that is less than a width of the at least one first inner support panel.

4. The carton according to claim 1, wherein the at least one vertically extending stacking support structure is triangular in cross-section.

5. The carton according to claim 4, wherein the at least one second inner support panel has a width that is greater than a width of the at least one first inner support panel.

6. The carton according to claim 1, further comprising:

at least one second outer support panel emanating from the at least one first outer support panel along a foldable line of weakness disposed therebetween, the at least one second outer support panel being affixed to an outside surface of the at least one of the two side panels with which the at least one second outer support panel is associated.

7. The carton according to claim 1, wherein the at least one lid panel comprises:

two lid panels, each of the two lid panels emanating from a top edge of one of the two side panels.

8. The carton according to claim 1, further comprising:

at least one closure flap, emanating from an end edge of the at least one lid panel, and affixable to an outside surface of an adjacent end panel.

9. The carton according to claim 8, wherein the at least one closure flap comprises:

two closure flaps, emanating from opposing end edges of the at least one lid panel, and affixable to outside surfaces of adjacent end panels.

10. The carton according to claim 7, further comprising:

at least one closure flap, emanating from an end edge of each of the two lid panels, and affixable to an outside surface of an adjacent end panel.

11. The carton according to claim 10, wherein the at least one closure flap comprises:

two closure flaps, emanating from opposing end edges of each of the lid panels, and affixable to outside surfaces of adjacent end panels.

12. The carton according to claim 1, wherein the at least one outer support panel has a width which is substantially the same as the end panel adjacent to which it is positioned, the carton further comprising:

two second outer support panels, emanating from opposing end edges of the at least one outer support panel, and each of the two second outer support panels affixed to an outer surface of one of the two side panels.

13. A blank for a carton, formed from at least one of paper, paperboard and corrugated paperboard, comprising:

a bottom panel;

two side panels emanating from opposing side edges of the bottom panel;

at least one lid panel emanating from a top edge of one of the side panels;

two end panels emanating from opposing end edges of the bottom panel, the opposing end edges of the bottom panel extending substantially perpendicular to the opposing side edges of the bottom panel;

at least one connection panel emanating from a top edge region of at least one of the two side panels, a foldable line of weakness disposed between the at least one of the two side panels and the at least one connection panel;

at least one outer support panel emanating from an end edge of the at least one connection panel, a foldable line of weakness disposed between the at least one connection panel and the at least one outer support panel;

at least one first inner support panel emanating from an end edge of at least one of the two end panels, a line of foldable weakness disposed between the at least one first inner support panel and the at least one of the two end panels;

at least one second inner support panel emanating from an edge of the at least one first inner support panel, a line of foldable weakness disposed between the at least one second inner support panel and the at least one first inner support panel; and at least one third inner support panel emanating from an edge of the at least one second inner support panel, a line of foldable weakness disposed between the at least one third inner support panel and the at least one second inner support panel.

14. The blank according to claim 13, wherein the at least one second inner support panel has a width that is less than a width of the at least one first inner support panel.

15. The blank according to claim 13, wherein the at least one second inner support panel has a width that is greater than a width of the at least one first inner support panel.

16. The blank according to claim 13, further comprising:

at least one second outer support panel emanating from the at least one first outer support panel along a foldable line of weakness disposed therebetween.

17. The blank according to claim 13, wherein the at least one lid panel comprises:

two lid panels, each of the two lid panels emanating from a top edge of one of the two side panels.

18. The blank according to claim 13, further comprising:

at least one closure flap, emanating from an end edge of the at least one lid panel.

19. The blank according to claim 18, wherein the at least one closure flap comprises:

two closure flaps, emanating from opposing end edges of the at least one lid panel.

20. The blank according to claim 17, further comprising:

at least one closure flap, emanating from an end edge of each of the two lid panels.

21. The blank according to claim 20, wherein the at least one closure flap comprises:

two closure flaps, emanating from opposing end edges of each of the lid panels.

22. The blank according to claim 13, wherein the at least one outer support panel has a width which is substantially the same as the end panel adjacent to which it is positioned, the blank further comprising:

two second outer support panels, emanating from opposing end edges of the at least one outer support panel.

23. A method for forming a carton, fabricated from a blank formed from at least one of paper, paperboard and corrugated paperboard, the method comprising the steps of:

providing a bottom panel;

providing two side panels emanating from opposing side edges of the bottom panel;

providing at least one lid panel emanating from a top edge of a side panel;

providing two end panels emanating from opposing end edges of the bottom panel, the opposing end edges of the bottom panel extending substantially perpendicular to the opposing side edges of the bottom panel;

providing at least one connection panel emanating from a top edge region of at least one of the two side panels, a foldable line of weakness disposed between the at least one of the two side panels and the at least one connection panel;

providing at least one outer support panel emanating from an end edge of the at least one connection panel, a foldable line of weakness disposed between the at least one connection panel and the at least one outer support panel;

providing at least one first inner support panel emanating from an end edge of at least one of the two end panels, a line of foldable weakness disposed between the at least one first inner support panel and the at least one of the two end panels;

providing at least one second inner support panel emanating from an edge of the at least one first inner support panel, a line of foldable weakness disposed between the at least one second inner support panel and the at least one first inner support panel; and providing at least one third inner support panel emanating from an edge of the at least one second inner support panel, a line of foldable weakness disposed between the at least one third inner support panel and the at least one second inner support panel.

24. The method according claim 23, further comprising the steps of:

folding the at least one first inner support panel inwardly to a position substantially perpendicular to the at least one of the two end panels;

folding the at least one second inner support panel inwardly to a position substantially parallel to and overlying an inside surface of the at least one first inner support panel;

folding the at least one third inner support panel outwardly to a position substantially perpendicular to the at least one second inner support panel, and substantially parallel to an inside surface of the at least one of the two end panels such that the first, second and third inner support panels form a structure having an L-shaped cross-section;

affixing the structure to the inside surface of the at least one of the two end panels;

folding the two end panels to positions substantially perpendicular to the bottom panel;

folding the two side panels up to positions substantially perpendicular to the bottom panel;

affixing the at least one of the two side panels to an outside surface of the structure;

folding the at least one connection panel inwardly to a position substantially parallel to the bottom panel;

folding the at least one outer support panel downwardly to a position substantially parallel to and overlying at least a portion of an adjacent end panel.

25. The method according to claim 24, further comprising the step of:

affixing the at least one outer support panel to the adjacent end panel.

26. The method according to claim 23, further comprising the steps of:

folding the at least one first inner support panel inwardly to a position substantially perpendicular to the at least one of the two end panels;

folding the at least one second inner support panel inwardly to a position oblique to the at least one first inner support panel;

folding the at least one third inner support panel outwardly to a position oblique to the at least one second inner support panel, and substantially parallel to an inside surface of the at least one of the two end panels such that the first and second inner support panels and the at least one of the two end panels form a structure having a triangular cross-section;

affixing the structure to the inside surface of the at least one of the two end panels;

folding the two end panels to positions substantially perpendicular to the bottom panel;

folding the two side panels up to positions substantially perpendicular to the bottom panel;

affixing at least one of the side panels to an outside surface of the structure;

folding the at least one connection panel inwardly to a position substantially parallel to the bottom panel;

folding the at least one outer support panel downwardly to a position substantially parallel to and overlying at least a portion of an adjacent end panel.

27. The method according to claim 26, further comprising the step of:

affixing the at least one outer support panel to the adjacent end panel.

28. The method according to claim 26, further comprising the steps of:

providing at least one second outer support panel emanating from an edge of the at least one outer support panel; and folding the at least one second outer support panel to a position substantially perpendicular to the at least one outer support panel;

affixing the at least one second outer support panel to an outside surface of the at least one of the two side panels.

29. The method according to claim 24, further comprising the step of:

providing two lid panels, each of the two lid panels emanating from a top edge of one of the side panels.

30. The method according to claim 23, further comprising the step of:

providing at least one closure panel, emanating from an end edge of the at least one lid panel.

31. The method according to claim 30, further comprising the steps of:

filling the carton with articles;

folding the at least one lid panel to a position substantially parallel to the bottom panel;

folding the at least one closure panel to a position substantially perpendicular to the at least one lid panel; and affixing the at least one lid panel to an outside surface of the at least one of the two end panels.

32. The method according to claim 29, further comprising the steps of:

providing at least one closure panel, emanating from end edges of each of the lid panels.

33. The method according to claim 32, further comprising the steps of:

filling the carton with articles;

folding the lid panels to positions substantially parallel to the bottom panel;

folding the closure panels to positions substantially perpendicular to the at least one lid panel; and affixing the lid panels to outside surfaces of at least one end panel.

34. The method according to claim 24, further comprising the step of:

providing the at least one second inner support panel with a width less than a width of the at least one first inner support panel.

35. The method according to claim 26, further comprising the step of:

providing the at least one second inner support panel with a width greater than a width of the at least one first inner support panel.

36. The method according claim 23, further comprising the steps of:

folding the two end panels to positions substantially perpendicular to the bottom panel;

folding the at least one first inner support panel inwardly to a position substantially perpendicular to the at least one of the two end panels;

folding the at least one second inner support panel inwardly to a position substantially parallel to and overlying an inside surface of the at least one first inner support panel;

folding the at least one third inner support panel outwardly to a position substantially perpendicular to the at least one second inner support panel, and substantially parallel to an inside surface of the at least one of the two end panels such that the first, second and third inner support panels form a structure having an L-shaped cross-section;

affixing the structure to the inside surface of the at least one of the two end panels;

folding the two side panels up to positions substantially perpendicular to the bottom panel;

affixing the at least one of the two side panels to an outside surface of the structure;

folding the at least one connection panel inwardly to a position substantially parallel to the bottom panel;

folding the at least one outer support panel downwardly to a position substantially parallel to and overlying at least a portion of one of the two end panels adjacent the at least one outer support panel.

37. The method according to claim 23, further comprising the steps of:

folding the at least one connection panel inwardly to a position substantially parallel to the bottom panel;

folding the at least one first inner support panel inwardly to a position substantially perpendicular to the at least one of the two end panels;

folding the at least one second inner support panel inwardly to a position oblique to the at least one first inner support panel;

folding the at least one third inner support panel outwardly to a position oblique to the at least one second inner support panel, and substantially parallel to an inside surface of the at least one of the two end panels such that the first and second inner support panels and the at least one of the two end panels form a structure having a triangular cross-section;

affixing the structure to the inside surface of the at least one of the two end panels;

folding the two end panels to positions substantially perpendicular to the bottom panel;

folding the two side panels up to positions substantially perpendicular to the bottom panel;

affixing the at least one of the two side panels to an outside surface of the structure;

folding the at least one outer support panel downwardly to a position substantially parallel to and overlying at least a portion of one of the two end panels adjacent the at least one outer support panel.

* * * * *

UNITED STATES PATENT AND TRADEMARK OFFICE

CERTIFICATE OF CORRECTION

PATENT NO. : 7,665,654 B2
APPLICATION NO. : 11/148729
DATED : February 23, 2010
INVENTOR(S) : Michael B. McLeod It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1174 days.

Signed and Sealed this

Twenty-eighth Day of December, 2010

David J. Kappos

David J. Kappos
*Director of the United States Patent and Trademark Office*